US008227388B2

(12) United States Patent
Tagawa et al.

(10) Patent No.: US 8,227,388 B2
(45) **Date of Patent: *Jul. 24, 2012**

(54) HYDRAULIC OIL COMPOSITION

(75) Inventors: Kazuo Tagawa, Yokohama (JP); Yuji Shimomura, Yokohama (JP); Ken Sawada, Yokohama (JP); Katsuya Takigawa, Yokohama (JP); Toshio Yoshida, Yokohama (JP); Shinichi Mitsumoto, Yokohama (JP); Eiji Akiyama, Yokohama (JP); Junichi Shibata, Yokohama (JP); Satoshi Suda, Yokohama (JP); Hideo Yokota, Yokohama (JP); Masahiro Hata, Yokohama (JP); Hiroyuki Hoshino, Yokohama (JP); Hajime Nakao, Yokohama (JP); Shozaburo Konishi, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/317,941

(22) Filed: Nov. 1, 2011

(65) Prior Publication Data

US 2012/0053094 A1 Mar. 1, 2012

Related U.S. Application Data

(63) Continuation of application No. 12/307,375, filed as application No. PCT/JP2007/063301 on Jul. 3, 2007.

(30) Foreign Application Priority Data

Jul. 6, 2006 (JP) ..... P2006-187064
Jul. 6, 2006 (JP) ..... P2006-187070
Jul. 6, 2006 (JP) ..... P2006-187072
Jul. 6, 2006 (JP) ..... P2006-187076
Jul. 6, 2006 (JP) ..... P2006-187096
Jul. 6, 2006 (JP) ..... P2006-187099
Jul. 6, 2006 (JP) ..... P2006-187107

(51) Int. Cl.
*C10M 169/04* (2006.01)
*C10M 135/02* (2006.01)
*C07F 9/02* (2006.01)
*C10G 71/00* (2006.01)

(52) U.S. Cl. ..... 508/133; 508/459; 508/518; 508/419; 508/346; 508/331; 208/18; 208/19

(58) Field of Classification Search ..... 508/133, 508/110, 518, 583, 563, 459, 591, 166, 433, 508/461; 208/18, 19
See application file for complete search history.

(56) References Cited

U.S. PATENT DOCUMENTS 3,923,672 A 12/1975 Durr
(Continued)

FOREIGN PATENT DOCUMENTS

CN 1297472 5/2001
(Continued)

OTHER PUBLICATIONS

Supplemental European Search Report dated Aug. 18, 2010.
(Continued)

*Primary Examiner* — Walter D Griffin
*Assistant Examiner* — Vishal Vasisth
(74) *Attorney, Agent, or Firm* — Finnegan, Henderson, Farabow, Garrett & Dunner, LLP

(57) ABSTRACT

The present invention provides a refrigerating machine oil, a compressor oil composition, a hydraulic oil composition, a metalworking oil composition, a heat treating oil composition, a lubricating oil composition for machine tools and a lubricating oil composition which comprise a lubricating oil base oil having % $C_A$ of not more than 2, % $C_P$/% $C_N$ of not less than 6 and an iodine value of not more than 2.5.

1 Claim, 6 Drawing Sheets

U.S. PATENT DOCUMENTS

| | | | |
|---|---|---|---|
| 4,023,980 | A | 5/1977 | Prillieux et al. |
| 4,943,383 | A | 7/1990 | Avery et al. |
| 5,602,086 | A | 2/1997 | Le et al. |
| 5,958,849 | A | 9/1999 | Hewson et al. |
| 6,147,035 | A | 11/2000 | Sougawa et al. |
| 6,165,949 | A | 12/2000 | Berlowitz et al. |
| 6,667,285 | B1 | 12/2003 | Kawahara et al. |
| 6,783,661 | B1 | 8/2004 | Briot et al. |
| 2001/0044389 | A1 | 11/2001 | Komiya et al. |
| 2004/0009881 | A1 | 1/2004 | Hessell |
| 2004/0033908 | A1 | 2/2004 | Deckman et al. |
| 2004/0118744 | A1 | 6/2004 | Daniel et al. |
| 2005/0241990 | A1 | 11/2005 | Ziemer et al. |
| 2005/0261147 | A1 | 11/2005 | Rosenbaum et al. |
| 2006/0166843 | A1 | 7/2006 | Rajewski et al. |
| 2008/0146474 | A1 | 6/2008 | Takahashi et al. |

FOREIGN PATENT DOCUMENTS

| | | | |
|---|---|---|---|
| EP | 0 579 272 | A2 | 1/1994 |
| EP | 0 959 121 | | 11/1999 |
| EP | 1 092 760 | | 4/2001 |
| GB | 951 138 | A | 3/1964 |
| JP | 48-60107 | | 8/1973 |
| JP | 51-40384 | | 4/1976 |
| JP | 51-74005 | | 6/1976 |
| JP | 51-95408 | | 8/1976 |
| JP | 54-91502 | | 7/1979 |
| JP | 57-67693 | | 4/1982 |
| JP | 58-76497 | | 5/1983 |
| JP | 60-47100 | | 3/1985 |
| JP | 62-295995 | | 12/1987 |
| JP | 64-45869 | | 2/1989 |
| JP | 3-153795 | | 7/1991 |
| JP | 4-68082 | | 3/1992 |
| JP | 5-279730 | | 10/1993 |
| JP | 07-228882 | | 8/1995 |
| JP | 7-252489 | | 10/1995 |
| JP | 8-27478 | | 1/1996 |
| JP | 8-27479 | | 1/1996 |
| JP | 8-134488 | | 5/1996 |
| JP | 8-209175 | | 8/1996 |
| JP | 9-241669 | | 9/1997 |
| JP | 10-46168 | | 2/1998 |
| JP | 10-46169 | | 2/1998 |
| JP | 10-273685 | | 10/1998 |
| JP | 11-035962 | | 2/1999 |
| JP | 11-209775 | | 8/1999 |
| JP | 11-263993 | | 9/1999 |
| JP | 2000-104084 | | 4/2000 |
| JP | 2000-169868 | | 6/2000 |
| JP | 2000-169869 | | 6/2000 |
| JP | 2000-303086 | | 10/2000 |
| JP | 2001-294886 | | 10/2001 |
| JP | 2002-53885 | | 2/2002 |
| JP | 2002-129180 | | 5/2002 |
| JP | 2002-129181 | | 5/2002 |
| JP | 2002-524610 | | 8/2002 |
| JP | 2002-524611 | | 8/2002 |
| JP | 2003-165994 | | 6/2003 |
| JP | 2004-521976 | | 7/2004 |
| JP | 2004-521977 | | 7/2004 |
| JP | 2005-511814 | | 4/2005 |
| JP | 2005-154760 | | 6/2005 |
| JP | 2005-194416 | | 7/2005 |
| JP | 2005-537383 | | 12/2005 |
| WO | WO 00/60031 | | 10/2000 |
| WO | WO 02/064710 | | 8/2002 |
| WO | WO 02/070636 | | 9/2002 |
| WO | WO 2004/031331 | A1 | 4/2004 |
| WO | WO 2006/057292 | | 6/2006 |
| WO | WO 2006/073198 | A1 | 7/2006 |
| WO | WO 2007/026646 | A1 | 3/2007 |

OTHER PUBLICATIONS

Extended European Search Report for EP Application No. 11007765.8-2104 dated Jan. 31, 2012.
Extended European Search Report for EP Application No. 11007766.6-2104 dated Jan. 31, 2012.
Extended European Search Report for EP Application No. 11007767.4-2104 dated Feb. 13, 2012.
Extended European Search Report for EP Application No. 11007768.2-2104 dated Feb. 13, 2012.
Extended European Search Report for EP Application No. 11007769.0-2104 dated Feb. 13, 2012.
Extended European Search Report for EP Application No. 11007770.8-2104 dated Jan. 31, 2012.
International Preliminary Report on Patentability for PCT/JP2007/063301 dated Jan. 20, 2009.
Notice of Allowance for JP Application No. P2006-187107 dated Nov. 8, 2011.
Notice of Allowance for JP Application No. P2006-187076 dated Nov. 8, 2011.
Office Action for JP Application No. P2006-187099 dated Nov. 8, 2011.
Chinese Office Action dated Aug. 9, 2011.
Japanese Office Action dated Jul. 26, 2011.
Office Action for U.S. Appl. No. 12/307,375 dated Sep. 26, 2011.
Office Action for U.S. Appl. No. 13/317,942 dated Dec. 1, 2011.
Dr. Robert M. Gresham, "To chemically create quality lubricant from crude oil, manufacturers really have to use their noodles.", Tribology & Lubrication Technology, Apr. 2004, pp. 51-53.
Notification for JP Application No. P2006-187099 issued Mar. 13, 2012.
Office Action for JP Application No. P2006-187096 dated Mar. 27, 2012.
Petroleum Energy Center (PEC), "Summary of Proceedings for the 18th Report on Research Outcomes from Technical Development, R2. 1.4", Jun. 2006.
Peter Brown, "Synthetic basestocks (Groups IV and V) in Lubricant Applications", CMF Plus published by the Society of Tribologists and Lubrication Engineers, Sep. 2003, pp. 20-22.

HYDRAULIC OIL COMPOSITION

CROSS-REFERENCE TO RELATED APPLICATIONS

This is a continuation of application Ser. No. 12/307,375, filed Nov. 2, 2009, which is a National Phase of PCT International Application No. PCT/JP2007/063301, filed Jul. 3, 2007, and claims priority to Application No. P2006-187064, filed Jul. 6, 2006, in Japan; Application No. P2006-187070, filed Jul. 6, 2006 in Japan; Application No. P2006-187072, filed Jul. 6, 2006 in Japan; Application No. P2006-187076, filed Jul. 6, 2006 in Japan; Application No. P2006-187096, filed Jul. 6, 2006 in Japan; Application No. P2006-187107, filed Jul. 6, 2006 in Japan; and Application No. P2006-187099, filed Jul. 6, 2006 in Japan, all of which are incorporated herein by reference.

TECHNICAL FIELD

The present invention relates to a refrigerating machine oil, a compressor oil composition, a hydraulic oil composition, a metalworking oil composition, a heat treating oil composition, a lubricating oil composition for machine tools and a lubricating oil composition.

BACKGROUND ART

As described later, various characteristics are required of lubricating oils depending on the use thereof in the field of so-called industrial lubricating oils.

For example, in the field of refrigerating machine oils, CFC (chlorofluorocarbon) and HCFC (hydrochlorofluorocarbon), which have been conventionally used as a refrigerant for refrigeration/air conditioning equipments, have become an object of regulations due to the problem of the recent ozone depletion, and HFC (hydrofluorocarbon) has come to be used as a refrigerant in place of these.

Meanwhile, the above-mentioned HFC refrigerants still involve problems such as high global warming potential. Therefore, as alternative refrigerants for these freon refrigerants, use of natural refrigerants such as carbon dioxide ($CO_2$) refrigerant or hydrocarbon refrigerants has been studied.

As refrigerating machine oils for HFC refrigerants, oxygen containing synthetic oils such as PAG (polyalkylene glycol), POE (polyol ester) and PVE (polyvinyl ether) which are compatible to HFC refrigerants have been conventionally used, but these oxygen containing synthetic oils have both drawback and advantage in the characteristics as a refrigerating machine oil. On the other hand, alkylbenzenes such as branched-chain alkylbenzenes are incompatible with HFC refrigerants but they have characteristics that they are superior to the oxygen containing synthetic oils in abrasion resistance and friction characteristics in the presence of a refrigerant (for example, see the following Patent Documents 1 and 2).

In the meantime, various refrigerating machine oils have been suggested as refrigerating machine oils for natural refrigerants. For example, as refrigerating machine oils for carbon dioxide refrigerants, Patent Document 3 below discloses those using carbon hydride type base oils such as alkylbenzene and poly-α-olefin, Patent Document 4 below discloses those using ether type base oils such as polyalkylene glycol and polyvinyl ether, and Patent Documents 5 to 7 below disclose those using ester type base oils, respectively.

In addition, lubricating oils used for gas compressors such as rotary gas compressors (compressor oils) are required to have excellent heat/oxidation stability for reasons that they are circulated and used and that they inevitably contact with a high temperature compressed gas. Owing to this, compressor oils in which a highly refined mineral oil type base oil or a synthetic hydrocarbon oil represented by a hydrogenated product of a poly-α-olefin is combined with a phenolic antioxidant such as 2,6-di-tert-butyl-p-cresol or an amine antioxidant such as phenyl-α-naphthylamine are generally used conventionally.

However, in order to attain sufficient heat/oxidation stability in lubricating oils such as rotary gas compressor oils in which heat/oxidation stability at high temperatures is deemed important, a large amount of the antioxidant must be added and in this case, there is caused a problem that the antioxidant itself is easy to become sludge. The resulting sludge may adhere to the bearing of the rotation part of the rotary gas compressor and cause heating and damage of the bearing and further lead to clogging of mist collection mechanism for separating compressed gas and oil mist (demister), which may force shutdown of the facilities.

In order to cope with this, formulations of additives for attaining both heat/oxidation stability and sludge resistance of the lubricating oil have been studied, and use of specific antioxidants such as p-branched-chain-alkylphenyl-α-naphthylamine has been suggested (for example, see Patent Document 8).

In the meantime, there are sliding parts involving metal-metal contact or metal-rubber (resin) contact in pumps, control valves, oil pressure cylinders and the like which constitute a hydraulic circuit. It is required that abrasion resistance and friction characteristics should be good in the hydraulic oil which takes a role as a lubricant for such sliding parts.

In addition, when sludge is resulted by deterioration of the hydraulic oil and generation of abrasion powder, increase in sliding resistance at the above-mentioned sliding parts and further clogging of flow control valves in the hydraulic circuit are caused, and thus, heat/oxidation stability as well as abrasion resistance and friction characteristics are required of the hydraulic oils.

Therefore, in the conventional hydraulic oils, various attempts have been made to meet the above-mentioned requirements. For example, in order to secure heat/oxidation stability of the hydraulic oils, highly refined mineral oils such as hydrofined mineral oils and hydrocracked mineral oils have been used as lubricating oil base oils, and besides, synthetic hydrocarbon oils such as poly-α-olefins have been used and further improvement in heat/oxidation stability has been attempted by adding a phenolic or amine antioxidant to the lubricating oil base oils. In addition, from the viewpoint of improvement in abrasion resistance, zinc containing abrasion inhibitors such as zinc dithiophosphate (ZnDTP) and zinc-free abrasion inhibitors such as phosphoric acid esters and amine salts thereof, thiophosphates and β-dithiophosphorylated propionic acid compounds have been used as abrasion inhibitors. Besides, from the viewpoint of improvement in friction characteristics, reduction of friction coefficient of the sliding surface has been attempted by combining a friction reduction agent with a hydraulic oil (for example, see Patent Documents 9 to 12).

In the meantime, metalworking oils have been conventionally used to lubricate processing parts of processed metal products in the field of metalwork. Characteristics which enable reduction of processing force, improvement in productivity, improvement in surface appearance (for example, luster after the rolling) of the processed products by good lubrication (hereinbelow referred to as "workability") are required of such metalworking oils.

In order to cope with this, conventional metalworking oils added with additives such as oiliness agents and extreme pressure agents have been generally used in order to improve workability (for example, see Patent Documents 13 and 14).

In the meantime, heat treating oils have been conventionally used in heat-treatment (quenching, etc.) to modify metal by heating and cooling.

Cooling process when a product to be treated such as steel materials is quenched with a heat treating oil is usually as follows.

First, when a product to be treated is put into a heat treating oil, the product to be treated is covered with vapor of the oil or cracked gas thereof. At this stage, cooling rate is slow since heat is hard to transfer due to the shielding effect of the vapor film.

Next, surface temperature of the product to be treated gradually decreases and when it reaches below a certain temperature, nucleate boiling of the oil occurs. This stage is called a boiling stage and shows extremely large chilling effect. The temperature at which the vapor film of the oil collapses and nucleate boiling starts is referred to as "characteristic temperature" in JIS K 2242 (heat treating oil), and it is considered that a heat treating oil having a higher characteristic temperature, namely a heat treating oil in which the time required to reach the characteristic temperature is shorter, is desirable to attain sufficient hardness.

As the surface temperature of the product to be treated approaches the boiling point of the oil, the boiling abates, and when the temperature passes the boiling point, boiling terminates and gentle cooling only by convection is performed. The cooling rate at this stage depends on viscosity of the heat treating oil and shows the higher cooling characteristics as the heat treating oil has the lower viscosity. Owing to this, use of a heat treating oil having a kinematic viscosity not more than 30 $mm^2/s$ at 40° C. is recommended in JIS K 2242 (heat treating oils), and particularly when a steel material having a low hardenability is to be treated, use of a heat treating oil having a still lower viscosity not more than 26 $mm^2/s$ at 40° C. is recommended.

As above, it has been conventionally considered that heat treating oils having a high characteristic temperature and a low viscosity are desirable in order to attain sufficient hardness. In the conventional heat treating oils, however, when the viscosity of a mineral oil used as a base oil of the heat treating oil is simply lowered, characteristic temperature also falls, and therefore, an attempt to raise the characteristic temperature by adding a cooling characteristics improver such as a copolymer of ethylene and an α-olefin to a mineral oil having a low viscosity (for example, see Patent Document 15).

In the field of machine tools, improvement in processing precision of parts is required, and in accompaniment with this requirement, improvement in the positioning precision in the sliding guide surface is required. Performance of the sliding guide surface oil is deeply related with positioning precision in the sliding guide surface, and stick-slip reduction as well as low friction (that is, small friction coefficient) is demanded. Furthermore, in the lubricating oil for machine tools, demands for long life and maintenance-free properties are also increasing.

Therefore, in the conventional lubricating oil for machine tools, various attempts have been made to meet the above-mentioned requirements. For example, phosphorus compounds such as phosphoric acid esters and amine compounds thereof, sulfur compounds such as sulfurized oils and fats, sulfurized esters and so on have been used as an additive to attain excellent friction characteristics (for example, see Patent Documents 16 to 20 below).

Besides, in order to secure heat/oxidation stability of the lubrication oils for machine tools, highly refined mineral oils such as hydrofined mineral oils and hydrocracked mineral oils as well as solvent refined mineral oils, and besides, synthetic hydrocarbon oils such as poly-α-olefins have been used as lubricating oil base oils (for example, see Patent Documents 21 to 24).

In addition, it is important that lubricating oils used for steam turbines, gas turbines, rotary gas compressors, hydraulic machinery can endure long-term use since they are used at high temperatures and circulated and used. Deposition of insoluble matters (sludge) occurring in lubricating oils are strongly adverse particularly to the facilities or the apparatus mentioned above. For example, when the deposited sludge ingredients stick to the bearing of the rotation part, they cause heating and will invite the damage of the bearing in the worst case. In addition, when sludge deposits, there may be caused problems in the operation including clogging of filters disposed in the circulation. Still further, shutdown of the apparatus is forced when sludge accumulates in the control valves to cause failure in the operation of the control system. Therefore, characteristics which make sludge hard to deposit (hereinbelow referred to as "sludge suppressing properties") as well as heat/oxidation stability are required of lubricating oils used in such fields.

Therefore, in the conventional lubricating oils used for steam turbines, gas turbines, rotary gas compressors, hydraulic machinery, improvement in heat/oxidation stability and sludge suppressing properties has been attempted by using highly refined mineral oils and synthetic hydrocarbon oils represented by hydrogenated product of poly-α-olefins as a base oil, and combining an antioxidant with such a base oil (for example, see the following Patent Document 25).

Patent Document 1: Japanese Patent Laid-Open No. 08-27478

Patent Document 2: Japanese Patent Laid-Open No. 08-27479

Patent Document 3: Japanese Patent Laid-Open No. 10-46168

Patent Document 4: Japanese Patent Laid-Open No. 10-46169

Patent Document 5: Japanese Patent Laid-Open No. 2000-104084

Patent Document 6: Japanese Patent Laid-Open No. 2000-169868

Patent Document 7: Japanese Patent Laid-Open No. 2000-169869

Patent Document 8: Japanese Patent Laid-Open No. 07-252489

Patent Document 9: Japanese Patent Laid-Open No. 04-68082

Patent Document 10: Japanese Patent Laid-Open No. 2000-303086

Patent Document 11: Japanese Patent Laid-Open No. 2002-129180

Patent Document 12: Japanese Patent Laid-Open No. 2002-129181

Patent Document 13: Japanese Patent Laid-Open No. 10-273685

Patent Document 14: Japanese Patent Laid-Open No. 2003-165994

Patent Document 15: Japanese Patent Laid-Open No. 05-279730

Patent Document 16: Japanese Patent Laid-Open No. S57-67693

Patent Document 17: Japanese Patent Laid-Open No. S51-74005

Patent Document 18: Japanese Patent Laid-Open No. 08-134488

Patent Document 19: Japanese Patent Laid-Open No. 08-209175

Patent Document 20: Japanese Patent Laid-Open No. 11-209775

Patent Document 21: Japanese Patent Laid-Open No. 04-68082

Patent Document 22: Japanese Patent Laid-Open No. 2000-303086

Patent Document 23: Japanese Patent Laid-Open No. 2002-129180

Patent Document 24: Japanese Patent Laid-Open No. 2002-129181

Patent Document 25: Japanese Patent Laid-Open No. 07-252489

DISCLOSURE OF THE INVENTION

However, there is room for improvement in each of the above-mentioned conventional lubricating oils in the following points.

For example, as for branched-chain alkylbenzenes used for refrigerating machine oils for conventional HFC refrigerants, the present situation is that worldwide demands therefor have been declining for such reasons as poor biodegradability and in accompaniment with that, supply thereof is sharply dropping. Therefore, development of refrigerating machine oils which will substitute alkylbenzenes is longed for.

In addition, since the hydrocarbon refrigerant has a high solubility to refrigerating machine oils and the carbon dioxide refrigerant itself has a low viscosity, when these refrigerants are dissolved in the above-mentioned conventional refrigerating machine oils, the degree of the viscosity decrease of the refrigerating machine oil becomes too large to secure effective viscosity, and sliding members and the like in the refrigerant compressor are easy to become wear. In late years, particularly in the field of refrigeration/air conditioning equipment, refrigerating machine oils having a low viscosity, which are advantageous to reduction in stirring resistance and plumbing resistance, have been required from the viewpoint of energy saving, but when the viscosity of the refrigerating machine oil is made lower in this way, securing effective viscosity becomes still more difficult, and occurring of abrasion becomes more remarkable.

As for means to improve lubricity of the refrigerating machine oils, a method of adding an abrasion inhibitor such as an extreme pressure agent to the refrigerating machine oil can be considered, but it is necessary to add the abrasion inhibitor in a large amount to some extent to attain sufficient abrasion resistance, and stability of the refrigerating machine oils might be lost. In addition, the effect of improving abrasion resistance by the extreme pressure agent is resulted from a film formed, which is caused by the extreme pressure agent, on the surface of the sliding members but this cannot be said to be desirable from the viewpoint of energy saving since the coefficient of friction between the sliding members rises by the formation of such films.

In addition, as another means to improve lubricity of a refrigerating machine oil, a method of minimizing the degree of decrease in the effective viscosity of the refrigerating machine oil by using a synthetic base oil such as a poly-α-olefin whose viscosity index is high is considered. However, it is very difficult to attain sufficient abrasion resistance in the presence of a hydrocarbon refrigerant or a carbon dioxide refrigerant even in the case of using such a synthetic base oil. In addition, since the synthetic base oil such as a poly-α-olefin is expensive, use thereof leads to increase in cost as a whole refrigeration/air conditioning equipment.

In addition, in the case of a compressor oil, thermal load imposed on the compressor oil increases more and more in recent times as the facilities are made compact for the purpose of reduction of the amount of circulating oil, and there is a limit to improve characteristics of the compressor oil only by changing formulation of additives as described in the above Patent Document 8.

Besides, in the case of a hydraulic oil, the hydraulic operation system becomes highly efficient more and more in recent times, and, for example, cases in which flow rate and direction of the hydraulic system are controlled with valves such as spool valves and the like or further equipped with servo valves increase to perform high-speed and high precision control. When sludge occurs in the hydraulic oil, performance of such spool valves and servo valves largely falls. Therefore, further improvement in abrasion resistance and heat/oxidation stability is required of hydraulic oil.

In addition, due to revision of the energy-saving laws, reduction in energy becomes an essential item in a factory appointed as a designated energy management factory and it is necessary to carry out energy saving while determining a numerical target every year, and reduction of power consumption of driving motors in the hydraulic apparatuses, which are widely used in the factory, becomes an important issue. Since the reduction of the frictional resistance in the sliding parts is effective from the viewpoint of the energetic-saving, further improvement in friction characteristics is required of hydraulic oils.

However, there is room for improvement even in the conventional hydraulic oils mentioned above at the points such as heat/oxidation stability, friction characteristics, viscosity-temperature characteristics of the lubricating oil base oil used and there is a limit in the characteristics improving effect by the addition of various additives, and accordingly, it cannot be necessarily said that they satisfactorily meet all the requirements described above.

In addition, in the case of metalworking oils, further improvement in processing precision and processing efficiency are desired in recent time, and sufficient processability are becoming impossible to achieve with the conventional metalworking oils described in the above Patent Documents 13 and 14.

In the meantime, as means to improve processability with the metalworking oils, a method to increase the ratios of the fluid lubrication region, where the friction coefficient is small, by increasing the viscosity of the metalworking oils is considered. However, the most suitable thickness of oil film formed of a metalworking oil varies depending on the kind and processing conditions of the metalwork, and therefore, when the metalworking oil is made to have a high viscosity, the thickness of the oil film often falls out of the most suitable range and sufficient processability cannot be achieved. In addition, when the metalworking oil is made to have a high viscosity, there is caused a problem that the oil is hard to be removed from the product to be processed in the oil removing step which is performed after the processing step.

In addition, the processability can be improved to some extent by increasing the addition amount of additives such as oiliness agents and extreme pressure agents to the metalworking oil but naturally, there is a limit on the effect of improving the processability, and it is not necessarily easy to attain sufficient processability. The oil is also hard to be removed from the product to be processed in the oil removing step which is performed after the processing step when the amount of these additives is increased. Use of the additives in a large amount will also cause increase in the cost and aggravation (generation of bad smells and so on) of the working environment. Still further, processing conditions are becoming severer and in addition to that, efficient resource utilization, reduction of waste oil, reduction of user cost of the metalworking oil are required. From these viewpoints, heat/oxidation stability which enables to stably maintain the properties for a long term is required of the metalworking oil but the increase in the amount of the oiliness agent and the extreme pressure agent can be a cause of deterioration of the heat/oxidation stability of the metalworking oil.

In the case of heat treating oils, there is yet room for improvement for suppressing deformation (distortion) of the product to be treated during the quenching with a high temperature oil even in the heat treating oils described in the above-mentioned Patent Document 15. This distortion is easy to be resulted when the cooling rate in a martensite metamorphosis temperature region of the metal is excessively fast, and as for the mineral oils used as conventional heat treating oils, those having the lower viscosity generally show a tendency to increase the more the cooling rate in this temperature region.

In the case of lubricating oils for machine tools, there is yet room for improvement in friction characteristics and stick-slip reduction characteristics even in the conventional lubricating oils for machine tools described in the above-mentioned Patent Documents 21 to 24. In addition, it cannot be necessarily said that the conventional lubricating oils for machine tools mentioned above have sufficient heat/oxidation stability from the viewpoint of the long life, and further improvement is desired.

In addition, in recent power generation facilities, a number of gas turbines which use a high temperature fuel gas as an operation medium or combined cycle generation facilities in which a gas turbine and a steam turbine are used together come to be operated for the purpose of utilizing energy effectively and thus raising power generation efficiency. The temperature of combustion gas of a gas turbine used in commercial power generation facilities in 1980's was around 1,100° C., but in late years, use at high temperatures up to around 1,500° C. is pushed forward as the heat resistance in the constitution materials of the gas turbine is improved. In addition, the rotary gas compressor inherently has a mechanism in which a lubricating oil and a compressed gas at high temperatures come in contact, and in late years the heat load to lubricating oil largely increases with the compactification of the compressor.

Using conditions of the lubricating oil in the facilities or the apparatuses mentioned above become severer and severer in this way, and it becomes difficult to achieve sufficient heat/oxidation stability and sludge suppressing properties by the conventional lubricating oils described in the above-mentioned Patent Document 25.

Increase in the amount of the antioxidant is considered as a method to improve heat/oxidation stability of lubricating oil used for a steam turbine, a gas turbine, a rotary gas compressor, hydraulic machinery, but it cannot be a fundamental solution to attain both heat/oxidation stability and sludge suppressing properties since in this case the antioxidant in itself has a problem that it may become sludge. The increase in the amount of the antioxidant is undesirable in particular when a synthetic hydrocarbon oil such as hydrogenated poly-α-olefin is used as a base oil since such a base oil is inherently hard to dissolve additives and the oxidated and degraded products thereof.

Therefore, an object of the present invention is to provide a lubricating oil or a lubricating oil composition useful in the field of industrial lubricating oils.

Particularly, the present invention is intended to provide a refrigerating machine oil which shows excellent abrasion resistance and friction characteristics in the presence of a refrigerant such as an HFC refrigerant, a hydrocarbon refrigerant, a carbon dioxide refrigerant, and which can achieve both of improvement in the long-term reliability and the energy saving of refrigeration/air conditioning equipments.

Another object of the present invention is to provide a compressor oil composition which can achieve both of heat/oxidation stability and sludge resistance at a high level even if it is used at a high temperature.

Another object of the present invention is to provide a hydraulic oil composition which can achieve all of abrasion resistance, friction characteristics, heat/oxidation stability and viscosity-temperature characteristics in a good balance at a high level, and which is effective in attaining high performance and energy saving of the hydraulic operation system.

Another object of the present invention is to provide a metalworking oil which can attain an excellent processability without increasing the viscosity and/or the amount of additives and which is excellent in removal characteristics from a product to be processed after the processing.

Another object of the present invention is to provide a heat treating oil which can achieve sufficient hardness and sufficiently suppress distortion in quenching at a high oil temperature.

Another object of the present invention is to provide a lubricating oil composition for machine tools which can achieve friction characteristics, stick-slip reduction characteristics and heat/oxidation stability in a good balance at a high level and which is effective in attaining high performance of the machine tools.

Another object of the present invention is to provide a lubricating oil composition in which both heat/oxidation stability and sludge suppressing properties are attained in a good balance at a high level and which can realize sufficient extension of life when used as a lubricating oil for steam turbines, gas turbines, rotary gas compressors and hydraulic machinery.

In order to solve the problem mentioned above, the present invention provides a refrigerating machine oil characterized in that the refrigerating machine oil comprises a lubricating oil base oil having % CA of not more than 2, % CP/% CN of not less than 6 and an iodine value of not more than 2.5.

Since the lubricating oil base oil contained in the refrigerating machine oil of the present invention satisfies the above conditions for % $C_A$, % $C_P$/% $C_N$ and the iodine value respectively, the base oil in itself is excellent in abrasion resistance, friction characteristics and viscosity-temperature characteristics. And, the refrigerating machine oil of the present invention comprising such a lubricating oil base oil can sufficiently suppress abrasion of sliding members and the like of a refrigerant compressor in the presence of a refrigerant such as a HFC refrigerant, a hydrocarbon refrigerant and a carbon dioxide refrigerant and at the same time can sufficiently reduce a friction coefficient between sliding members and stirring resistance of the refrigerating machine oil. Furthermore, since the lubricating oil base oil mentioned above has sufficient heat/oxidation stability, the effect of improving abrasion resistance, the effect of reducing friction coefficient and the effect of reducing stirring resistance mentioned above can be stably attained for a long term. Therefore, both of improvement in the reliability and the energy saving of refrigeration/air conditioning equipments become feasible for a long term by using a refrigerating machine oil of the present invention for a refrigeration/air conditioning equipment in which an HFC refrigerant, a hydrocarbon refrigerant or a carbon dioxide refrigerant is used.

In addition, the present invention provides a compressor oil composition characterized in that the compressor oil composition comprises: a lubricating oil base oil having % CA of not more than 2, % CP/% CN of not less than 6 and an iodine value of not more than 2.5; an antioxidant; and a mist suppressant.

Since the lubricating oil base oil contained in the compressor oil composition of the present invention satisfies the above conditions for % $C_A$, % $C_P$/% $C_N$ and the iodine value respectively, the base oil in itself is excellent in heat/oxidation stability and viscosity-temperature characteristics. Furthermore, the lubricating oil base oil can dissolve and maintain additives such as antioxidants and mist inhibitors sufficiently stably and enables the functions of these additives to be developed at a higher level. Therefore, according to the present invention, both of heat/oxidation stability and sludge resistance can be achieved at a high level even if it is used at a high temperature, and besides, a compressor oil composition excellent in mist prevention characteristics and seal characteristics becomes feasible.

In the compressor oil composition of the present invention mentioned above, it is preferable that the content of the antioxidant is 0.02 to 5% by mass, based on the total amount of the composition. Heat/oxidation stability and sludge resistance can be achieved at a high temperature in a good balance at a high level by using the antioxidant in the above range.

In addition, the present invention provides a hydraulic oil composition characterized in that the hydraulic oil composition comprises: a lubricating oil base oil having % CA of not more than 2, % CP/% CN of not less than 6 and an iodine value of not more than 2.5; and a compound containing phosphorus and/or sulfur as a constituent element(s).

Since the lubricating oil base oil contained in the hydraulic oil composition of the present invention satisfies the above conditions for % $C_A$, % $C_P$/% $C_N$ and the iodine value respectively, the base oil in itself is excellent in heat/oxidation stability, viscosity-temperature characteristics and friction characteristics. Furthermore, when added with additives, the lubricating oil base oil can dissolve and maintain the additives stably and enables the functions of these additives to be developed at a higher level. Therefore, according to the hydraulic oil composition of the embodiment of the present invention, through synergism between the lubricating oil base oil having such excellent characteristics and a compound containing phosphorus and/or sulfur as a constituent element(s), all of abrasion resistance, friction characteristics, heat/oxidation stability and viscosity-temperature characteristics can be achieved in a good balance at a high level, and high performance of the hydraulic operation system and energy saving become feasible.

In addition, the present invention provides a metalworking oil composition characterized in that the metalworking oil composition comprises: a lubricating oil base oil having % CA of not more than 2, % CP/% CN of not less than 6 and an iodine value of not more than 2.5; and at least one lubricity improver selected from esters, alcohols, carboxylic acids and compounds containing phosphorus and/or sulfur as a constituent element(s).

Since the lubricating oil base oil contained in the metalworking oil composition of the present invention satisfies the above conditions for % $C_A$, % $C_P$/% $C_N$ and the iodine value respectively, the base oil in itself is excellent in friction characteristics and can reduce shear resistance in the fluid lubrication region thereby sufficiently preventing breakage of the oil film. In addition, when the lubricating oil base oil is added with a at least one lubricity improver selected from esters, alcohols, carboxylic acids and compounds containing phosphorus and/or sulfur as a constituent element(s), the lubricating oil base oil can dissolve and maintain the lubricity improver stably and enables the effect of improving lubricity caused by the lubricity improver to be developed at a higher level in a boundary lubrication region. Furthermore, the lubricating oil base oil can maintain the above-mentioned excellent lubricity by the use thereof for a long term since the lubricating oil base oil has a sufficient heat/oxidation stability.

Therefore, according to the metalworking oil composition of the embodiment of the present invention, excellent processability can be obtained stably for a long term. Furthermore, the metalworking oil composition of the embodiment of the present invention is excellent in removal characteristics from a product to be processed after the processing since increase in the viscosity and/or the amount of additives is not needed to attain the above-mentioned processability and properties to maintain the processability for a long term.

Also provided is a heat treating oil composition characterized in that the heat treating oil composition comprises: a lubricating oil base oil having % CA of not more than 2, % CP/% CN of not less than 6 and an iodine value of not more than 2.5; and a cooling property improver.

Since the lubricating oil base oil contained in the heat treating oil composition of the present invention satisfies the above conditions for % $C_A$, % $C_P$/% $C_N$ and the iodine value respectively, the base oil in itself has an excellent viscosity-temperature characteristics and further has a sufficient heat/oxidation stability. In addition, the lubricating oil base oil can dissolve and maintain the additives such as the cooling property improver sufficiently stably and enables the functions of these additives to be developed at a higher level. Therefore, according to the heat treating oil composition of the present invention comprising the lubricating oil base oil and cooling characteristics improver mentioned above, sufficient cooling characteristics in the boiling stage during quenching can be achieved, and besides the phenomenon that the cooling rate in the martensite temperature region becomes excessively fast can be sufficiently suppressed and as a result, processed metal products having a sufficient hardness and little distortion can be obtained stably.

It is preferable that the cooling property improver contained in the heat treating oil composition of the present invention is at least one selected from copolymers of ethylene and an α-olefin having 3 to 20 carbon atoms, asphalts and products having insoluble matters removed from the asphalts and alkaline earth metal salts of an alkylsalicylic acid. The above-mentioned effect by the present invention can be achieved at a higher level by using one or two or more of these cooling property improvers.

The present invention also provides a lubricating oil composition for machine tools characterized in that the lubricating oil composition comprises: a lubricating oil base oil having % CA of not more than 2, % CP/% CN of not less than 6 and an iodine value of not more than 2.5; and a compound containing phosphorus and/or sulfur as a constituent element(s).

Since the lubricating oil base oil contained in the lubricating oil composition for machine tools of the present invention satisfies the above conditions for % $C_A$, % $C_P$/% $C_N$ and the iodine value respectively, the base oil in itself is excellent in heat/oxidation stability and friction characteristics. Furthermore, when added with additives, the lubricating oil base oil can dissolve and maintain the additives stably and enables the functions of these additives to be developed at a higher level.

Therefore, according to the lubricating oil composition for machine tools of the present invention, through synergism between the lubricating oil base oil having such excellent characteristics and a compound containing phosphorus and/or sulfur as a constituent element(s), all of friction characteristics, stick-slip reduction characteristics and heat/oxidation stability can be achieved in a good balance at a high level, and high performance of the machine tools becomes feasible.

In addition, the present invention also provides a lubricating oil composition characterized in that the lubricating oil composition comprises: a lubricating oil base oil having % CA of not more than 2, % CP/% CN of not less than 6 and an iodine value of not more than 2.5; and an ashless antioxidant containing no sulfur as a constituent element, wherein the content of the ashless antioxidant is 0.3 to 5% by mass, based on the total amount of the composition.

Since the lubricating oil base oil contained in the lubricating oil composition of the present invention satisfies the above conditions for % $C_A$, % $C_P$/% $C_N$ and the iodine value respectively, the base oil in itself is excellent in heat/oxidation stability. Furthermore, when added with additives such as an ashless antioxidant, the lubricating oil base oil can dissolve and maintain the additives stably and enables the functions of these additives to be developed at a higher level. And both of heat/oxidation stability and sludge suppressing properties can be attained in a good balance at a high level by allowing the lubricating oil composition having excellent characteristics to contain an ashless antioxidant containing no sulfur as a constituent element. Therefore, according to the lubricating oil composition of the present invention, extension of life is sufficiently feasible when the composition is used as a lubricating oil in steam turbines, gas turbines, rotary gas compressors and hydraulic machinery, etc.

It is preferable that the lubricating oil composition of the present invention further comprises an alkyl group-substituted aromatic hydrocarbon compound. This enables to attain both of heat/oxidation stability and sludge suppressing properties at a still higher level.

The alkyl group-substituted aromatic hydrocarbon compound mentioned above is preferably at least one compound containing one or two alkyl groups having 8 to 30 carbon atoms selected from alkylbenzenes, alkylnaphthalenes, alkylbiphenyls and alkyldiphenylalkanes.

In addition, it is preferable that the lubricating oil composition of the present invention comprises both a phenyl-α-naphthylamine compound and an alkylated diphenylamine compound as an ashless antioxidant; and the ratio of the alkylated diphenylamine compound to the total amount of the phenyl-α-naphthylamine compound and the alkylated diphenylamine compound is preferably from 0.1 to 0.9, and more preferably from 0.1 to 0.4 by mass ratio. Both of heat/oxidation stability and sludge suppressing properties can be attained at a higher level by simultaneously using a phenyl-α-naphthylamine compound and an alkylated diphenylamine compound as an ashless antioxidant so that the content ratio of them may meet the above condition.

As described above, according to the present invention, a refrigerating machine oil which exhibits excellent abrasion resistance and friction characteristics in the presence of a refrigerant such as an HFC refrigerant, a hydrocarbon refrigerant, a carbon dioxide refrigerant and which achieves both the improvement in the long-term reliability and the saving energy of a refrigeration/air conditioning equipment is provided.

In addition, according to the present invention, a compressor oil composition which can achieve both of the heat/oxidation stability and sludge resistance at a high level even when used at a high temperature is provided.

In addition, according to the present invention, a hydraulic oil composition which can achieve all of abrasion resistance, friction characteristics, heat/oxidation stability and viscosity-temperature characteristics in a good balance at a high level and which is effective in the high performance of the hydraulic operation system and energy saving is provided.

In addition, according to the present invention, a metal-working oil composition which enables to attain excellent processability without increasing viscosity and/or the amount of additives and which is excellent in removal characteristics from a product to be processed after the processing is provided.

In addition, according to the present invention, a heat treating oil composition which can achieve sufficient hardness and sufficiently suppress distortion in quenching at a high oil temperature is provided.

In addition, according to the present invention, a lubricating oil composition for machine tools which can achieve friction characteristics, stick-slip reduction characteristics and heat/oxidation stability in a good balance at a high level and which is effective in attaining high performance of the machine tools is provided.

In addition, according to the present invention, a lubricating oil composition in which both heat/oxidation stability and sludge suppressing properties are attained in a good balance at a high level and which can realize sufficient extension of life when used as a lubricating oil for steam turbines, gas turbines, rotary gas compressors and hydraulic machinery is provided.

Figure 1:
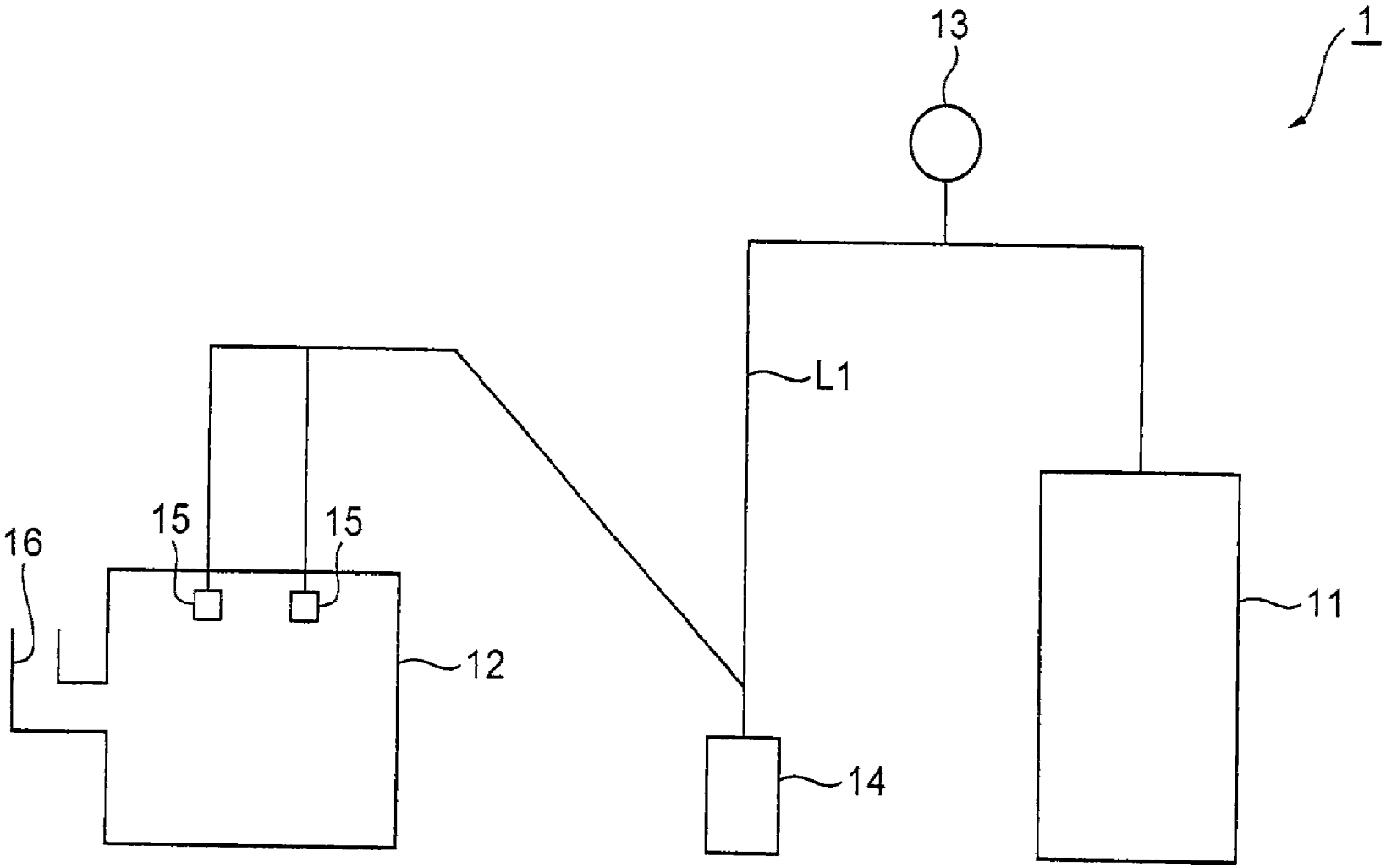
FIG. 1 is a schematic configuration diagram illustrating a mist test apparatus used in Examples.

| Description of Symbols | |
|---|---|
| 1: | Mist test apparatus |
| 11: | Mist generator |
| 12: | Mist box |
| 13: | Pressure gauge |
| 14: | Collecting bottle |
| 15: | Spray nozzle |
| 16: | Stray mist outlet |
| 201: | Disk |
| 202: | Ball |
| 301: | Table |
| 302: | A/C servo motor |
| 303: | Feed screw |
| 304: | Movable jig |
| 305: | Load cell |
| 306: | Bed |

-continued

| Description of Symbols | |
|---|---|
| 307: | Computer |
| 308: | Control panel |
| 309: | Weight |
| 400: | Elastic body |
| 401: | Upper test piece |
| 402: | Lower test piece |
| 403: | Load detector |
| 410: | Supporting stand |
| 601: | Oil tank |
| 602: | Pressure reducing valve |
| 604: | Line filter |
| 605: | Flow meter |
| 606: | Cooler |

BEST MODE FOR CARRYING OUT THE INVENTION

In the following, preferable embodiments of the present invention are described in detail.

First Embodiment

Refrigerating Machine Oil

The lubricating oil base oil according to the first embodiment of the present invention comprises a lubricating oil base oil having % CA of not more than 2, % CP/% CN of not less than 6 and an iodine value of not more than 2.5 (hereinbelow simply referred to as a "lubricating oil base oil according to the present invention".).

% $C_A$ of the lubricating oil base oil according to the present invention is not more than 2, and preferably not more than 1.5, more preferably not more than 1. When % $C_A$ of the lubricating oil base oil exceeds the upper limit value mentioned above, viscosity-temperature characteristics, heat/oxidation stability and friction characteristics deteriorate. In addition, % $C_A$ of the lubricating oil base oil according to the present invention may be 0, but solubility of the additives can be increased by increasing % $C_A$ to not less than 0.1.

In addition, the ratio of % $C_P$ to % $C_N$ (% $C_P$/% $C_N$) in the lubricating oil base oil according to the present invention is not less than 6, and more preferably not less than 7 as described above. When % $C_P$/% $C_N$ is less than the lower limit value mentioned above, viscosity-temperature characteristics, heat/oxidation stability and friction characteristics deteriorate, and the effect of the additive deteriorates when the lubricating oil base oil is added with an additive. In addition, it is preferable that % $C_P$/% $C_N$ is not more than 35, more preferably not more than 20, still more preferably not more than 14, and it is particularly preferably not more than 13. The solubility of the additives can be further increased by decreasing % $C_P$/% $C_N$ to not more than the upper limit mentioned above.

In addition, % $C_P$ of the lubricating oil base oil according to the present invention is preferably not less than 80, more preferably 82 to 99, still more preferably 85 to 95, and particularly preferably 87 to 93. When % $C_P$ of the lubricating oil base oil is less than the lower limit value mentioned above, viscosity-temperature characteristics, heat/oxidation stability and friction characteristics tend to deteriorate, and the effect of the additives tends to deteriorate when the lubricating oil base oil is added with an additive. In addition, the solubility of the additive tends to decrease when % C of the lubricating oil base oil exceeds the upper limit value mentioned above.

In addition, % $C_N$ of the lubricating oil base oil according to the present invention is preferably not more than 19, more preferably 5 to 15, still more preferably 7 to 13, particularly preferably 8 to 12. When % $C_N$ of the lubricating oil base oil exceeds the upper limit value mentioned above, viscosity-temperature characteristics, heat/oxidation stability and friction characteristics tend to deteriorate. In the meantime, the solubility of the additive tends to decrease when % $C_N$ is less than the lower limit value mentioned above.

Here, % $C_P$, % $C_N$ and % $C_A$ as used in the present invention can be determined by a method (n-d-M ring analysis) in accordance with ASTM D3238-85, and mean the percentage of the paraffin carbon number to all carbon number, the percentage of the naphthene carbon number of all carbon number and the percentage of the aromatic carbon number of all carbon number. In other words, the preferable range of % $C_P$, % $C_N$ and % $C_A$ mentioned above is based on the values determined by the above-mentioned method, and the lubricating oil base oil not containing naphthenes may exhibit % $C_N$ value determined by the above-mentioned method exceeding 0.

The iodine value of the lubricating oil base oil according to the present invention is not more than 2.5 as described above, preferably not more than 1.5, more preferably not more than 1, still more preferably not more than 0.8, and although the iodine value may be less than 0.01, it is preferably not less than 0.01, more preferably not less than 0.1, still more preferably not less than 0.5 from the little effect of lowering the value and relations with economy. Heat/oxidation stability can be improved drastically by decreasing the iodine value of the lubricating oil base oil to not more than 2.5. The "iodine value" as used in the present invention means the iodine value measured by the indicator titration method of JIS K 0070 "acid value, saponification value, iodine value, hydroxyl value and unsaponification value of a chemical".

The lubricating oil base oil according to the present invention is not limited in particular as long as % $C_A$, % $C_P$/% $C_N$ and an iodine value respectively satisfy the above conditions. Specifically included are paraffin base oil, normal paraffin base oil, isoparaffin base oil and the like which are obtained by subjecting lubricating oil fractions resulted from atmospheric distillation and/or distillation under reduced pressure of crude oil to a single one or a combination of two or more of refining processings such as solvent deasphalting, solvent extraction, hydrocracking, solvent dewaxing, catalytic dewaxing, hydrofining, sulfuric acid washing and clay treatment and which have % $C_A$, % $C_P$/% $C_N$ and an iodine value respectively satisfying the above conditions. A single one of these lubricating oil base oils may be used or a combination of two or more of them may be used.

Preferable examples of the lubricating oil base oil according to the present invention include base oils which are obtained by using as raw materials the base oils (1) to (8) shown below, refining these raw material oils and/or lubricating oil fractions collected from these raw material oils by a predetermined refinement method and collecting the lubricating oil fractions.

(1) Distillate oil by atmospheric distillation of paraffin group-based crude oil and/or mixed group-based crude oil (2) Distillate oil by distillation under reduced pressure of atmospheric distillation residual oil of paraffin group-based crude oil and/or mixed base crude oil (WVGO)

(3) Wax (a slack wax, etc.) obtained by dewaxing process of lubricating oils and/or synthetic wax (Fischer Tropsch wax, GTL wax, etc.) obtained by gas to liquid (GTL) process, etc.

(4) Mixed oil of one and/or two or more selected from base oils (1) to (3) and/or mild hydrocracking processing oil of the mixture oil (5) Mixed oil selected from two or more base oils (1) to (4)

(6) Deasphalted oil (DAO) of base oil (1), (2), (3), (4) or (5)

(7) Mild hydrocracking treated oil (MHC) of base oil (6)

(8) Mixed oil selected from two or more base oils (1) to (5).

Here, as the predetermined refinement method mentioned above, hydrofining such as hydrocracking and hydrogenation finishing; solvent refinings such as furfural solvent extraction; dewaxing such as solvent dewaxing and catalytic dewaxing; clay refining with acid clay or activated earth; chemical (acid or alkali) washing such as sulfuric acid washing and caustic soda washing are preferable. In the present invention, one of these refinement methods alone may be performed or two or more of them may be combined and performed. When two or more of refinement methods are combined, the order thereof is not limited in particular and can be selected appropriately.

Furthermore, as the lubricating oil base oil according to the present invention, particularly preferred are the following base oils (9) or (10) obtained by subjecting a base oil selected from the above-mentioned base oils (1) to (8) or a lubricating oil fraction collected from the base oils to a predetermined treatment.

(9) Hydrocracked mineral oil which is obtained by hydrocracking a base oil selected from the above-mentioned base oils (1) to (8) or a lubricating oil fraction collected from the base oils, subjecting the product or a lubricating oil fraction collected from the product by distillation and the like to dewaxing treatment such as solvent dewaxing and catalytic dewaxing or performing distillation after the dewaxing treatment

(10) Hydroisomerized mineral oil which is obtained by isomerizing a base oil selected from the above-mentioned base oils (1) to (8) or a lubricating oil fraction collected from the base oils, subjecting the product or a lubricating oil fraction collected from the product by distillation and the like to dewaxing treatment such as solvent dewaxing and catalytic dewaxing or performing distillation after the dewaxing treatment.

In addition, solvent refining treatment and/or hydrogenation finishing treatment may be further conducted at a convenient step as needed when the above-mentioned lubricating oil base oil (9) or (10) is obtained.

The catalysts used for the hydrocracking/hydroisomerization mentioned above are not limited particularly but a hydrocracking catalyst comprising a support in which a complex oxide (for example, silica-alumina, alumina-boria, silica-zirconia, etc.) having cracking activity or a combination of one or more of these complex oxides are bonded with a binder and a metal having hydrogenation capability (for example, one or more of metals of group VIa or metals of group VIII in the periodic table) carried on the support or a hydroisomerization catalyst comprising a support including zeolite (for example, ZSM-5, zeolite beta, SAPO-11, etc.) and a metal having hydrogenation capability selected from at least one of metals of group VIII carried on the support is preferably used. The hydrocracking catalyst and the hydroisomerization catalyst may be used in combination by lamination or mixing.

The reaction conditions in case of hydrocracking/hydroisomerization are not limited in particular, but it is preferable that hydrogen partial pressure is 0.1 to 20 MPa, average reaction temperature is 150 to 450° C., LHSV is 0.1 to 3.0 $hr^{-1}$, hydrogen/oil ratio is from 50 to 20000 scf/b.

As a preferable example of the manufacturing process of the lubricating oil base oil according to the present invention, manufacturing process A shown below is included.

That is, manufacturing process A according to the present invention comprises the first step for preparing a hydrocracking catalyst comprising a support in which the fraction of desorbed $NH_3$ at 300 to 800° C. to the total desorption of $NH_3$ is not more than 80% in $NH_3$ desorption temperature dependency evaluation, and at least one of metals of group VIa in the periodic table and at least one of metals of group VIII carried on the support;

the second step for hydrocracking a raw material oil containing 50% by volume or more of a slack wax in the presence of the hydrocracking catalyst at a hydrogen partial pressure of 0.1 to 14 MPa, average reaction temperature of 230 to 430° C., LHSV of 0.3 to 3.0 $hr^{-1}$, hydrogen/oil ratio of 50 to 14000 scf/b;

the third step for obtaining a lubricating oil fraction by distilling and separating the cracked oil obtained in the second step; and the fourth step for dewaxing the lubricating oil fraction obtained in the third step.

In the following, manufacturing process A mentioned above is described in detail.

(Raw Material Oil)

In manufacturing process A mentioned above, a raw material oil containing 50% by volume or more of a slack wax is used. Here, the "raw material oil containing 50% by volume or more of a slack wax" as used in the present invention encompasses a raw material oil consisting of only a slack wax and mixed oils of a slack wax and another raw material oil containing 50% by volume or more of a slack wax.

The slack wax is a wax containing component by-produced in the solvent dewaxing step when lubricating oil base oil is produced from paraffin lubricating oil fractions and the wax containing component further subjected to deoiling treatment is included in the slack wax in the present invention. Main ingredients of the slack wax are n-paraffin and branched paraffin with a little side-chain (isoparaffin) and the contents of naphthene or aromatic components are small. The kinematic viscosity of the slack wax to use for a preparation of the raw material oil can be appropriately selected depending on the kinematic viscosity of the lubricating oil base oil to be aimed at, but a slack wax having a comparatively low viscosity whose kinematic viscosity at 100° C. is preferably around 2 to 25 $mm^2/s$, preferably around 2.5 to 20 $mm^2/s$, more preferably around 3 to 15 $mm^2/s$ is desirable to produce a low viscosity base oil as a lubricating oil base oil according to the present invention. The other properties of the slack wax are arbitrary but the melting point is preferably 35 to 80° C., more preferably 45 to 70° C., and still more preferably 50 to 60° C. The oil content of the slack wax is preferably not more than 70% by mass, more preferably not more than 50% by mass, still more preferably not more than 25% by mass, particularly preferably not more than 10% by mass, and preferably not less than 0.5% by mass, more preferably not less than 1% by mass. In addition, the sulfur content of the slack wax is preferably not more than 1% by mass, more preferably not more than 0.5% by mass, and preferably not less than 0.001% by mass.

Here, the oil content of the sufficiently deoiled slack wax (hereinbelow referred to as "a slack wax A".) is preferably 0.5 to 10% by mass and more preferably 1 to 8% by mass. The sulfur content of the slack wax A is preferably 0.001 to 0.2% by mass, more preferably 0.01 to 0.15% by mass, and still more preferably 0.05 to 0.12% by mass. On the other hand, the oil content of the slack wax not deoiled or insufficiently deoiled (hereinbelow referred to as "a slack wax B".) is preferably 10 to 60% by mass, more preferably 12 to 50% by mass, and still more preferably 15 to 25% by mass. The sulfur content of the slack wax B is preferably 0.05 to 1% by mass, more preferably 0.1 to 0.5% by mass, and still more preferably 0.15 to 0.25% by mass. In addition, these a slack waxes A and B may be subjected to desulfurization treatment depending on the kind and characteristics of hydrocracking/isomerization catalysts and the sulfur content of that case is preferably not more than 0.01% by mass, and more preferably not more than 0.001% by mass.

In the in above manufacturing process A, lubricating oil base oil according to the present invention in which % $C_A$, % $C_P$/% $C_N$ and an iodine value respectively satisfy the above requirements can be suitably obtained by using a slack wax A mentioned above as a raw material. In addition, according to manufacturing process A mentioned above, lubricating oil base oils high in added value which has a high viscosity index and excellent low-temperature characteristics and heat/oxidation stability can be obtained even when a slack wax B which has relatively high oil and sulfur contents and which is relatively crude and inexpensive.

When the raw material oil is a mixed oil of a slack wax and another raw material oil, the other raw material oil is not particularly limited as long as the content of the slack wax is not less than 50% by volume in the total volume of the mixed oil but a mixed oil with a heavy atmospheric distillate oil and/or a distillate oil by distillation under reduced pressure of the crude oil is preferably used.

In addition, when the raw material oil is a mixed oil of a slack wax and another raw material oil, the content of the slack wax in the mixed oil is preferably not less than 70% by volume and more preferably not less than 75% by volume from the viewpoint of producing a base oil with a high viscosity index. When the content is less than 50% by volume, oil content such as aromatic and naphthene components increases in the obtained lubricating oil base oil, and the viscosity index of the lubricating oil base oil tends to decrease.

On the other hand, it is preferable that the heavy atmospheric distillate oil and/or distillate oil by distillation under reduced pressure of the crude oil used in combination with the slack wax are fractions having 60% by volume or more distillate components in the distillation temperature range of 300 to 570° C. in order to maintain a high viscosity index of the produced lubricating oil base oil.

(Hydrocracking Catalyst)

In manufacturing process A mentioned above, a hydrocracking catalyst comprising a support in which the fraction of desorbed $NH_3$ at 300 to 800° C. to the total desorption of $NH_3$ is not more than 80% in $NH_3$ desorption temperature dependency evaluation, and at least one of metals of group Via in the periodic table and at least one of metals of group VIII carried on the support is used.

Here, the "$NH_3$ desorption temperature dependency evaluation" is a method introduced by some documents (Sawa M., Niwa M., Murakami Y., Zeolites 1990, 10, 532, Karge H. G., Dondur V., J. Phys. Chem, 1990, 94, 765) and so on, and can be performed as follows. First, the catalyst support is pretreated at a temperature not less than 400° C. for more than 30 minutes in a nitrogen gas stream to remove adsorbed molecules and then $NH_3$ are allowed to adsorb at 100° C. until saturated. Subsequently, the catalyst support is heated at a temperature increasing rate not more than 10° C./min from to 100 to 800° C. to desorb $NH_3$ while monitoring $NH_3$ separated by desorption at every predetermined temperature. And a fraction of desorbed $NH_3$ at 300 to 800° C. to the total desorption of $NH_3$ (desorption at 100 to 800° C.) is determined.

The catalyst support used in manufacturing process A mentioned above is a support in which the fraction of desorbed $NH_3$ at 300 to 800° C. to the total desorption of $NH_3$ is not more than 80%, preferably not more than 70%, and more preferably not more than 60% in the above $NH_3$ desorption temperature dependency evaluation. Since acidity which rules cracking activity is sufficiently suppressed by constituting a hydrocracking catalyst using such a support, generation of isoparaffin by cracking isomerization of high molecular weight n-paraffin derived from a slack wax and so on in the raw material oil is efficiently and securely performed by hydrocracking and besides, excessive cracking of the generated isoparaffin compound is sufficiently, suppressed. As a result, sufficient amount of molecules having appropriately branched chemical structures and high viscosity index can be given in an appropriate molecular weight range.

As such a support, binary oxides which are amorphous and have acidity are preferable, and examples thereof include binary oxides as exemplified by document ("Kinzoku Sakabutsu to sono Shokubai Sayou" ("Metal Oxides and Catalytic Effects Thereof", Tetsuro Shimizu, Kodansha, 1978).

Among these, amorphous complex oxides which are acidic binary oxides formed by composition of oxides of two elements selected from Al, B, Ba, Bi, Cd, Ga, La, Mg, Si, Ti, W, Y, Zn and Zr are preferably contained. Acidic supports suitable for the purpose of the present invention can be obtained in the above $NH_3$ desorption evaluation by adjusting the ratios of each oxides of these acidic binary oxides. Here, the acidic binary oxide which constitutes the support may be one or a mixture of two or more of the above. In addition, the support may consist of the above-mentioned acidic binary oxide or a support to which the acidic binary oxide is bonded with a binder.

Furthermore, it is preferable that the support contains at least one acidic binary oxide selected from amorphous silica alumina, amorphous silica zirconia, amorphous silica magnesia, amorphous silica titania, amorphous silica boria, amorphous alumina zirconia, amorphous alumina magnesia, amorphous alumina titania, amorphous alumina boria, amorphous zirconia magnesia, amorphous zirconia titania, amorphous zirconia boria, amorphous magnesia titania, amorphous magnesia boria and amorphous titania boria. The acidic binary oxide which constitutes the support may be one or a mixture of two or more of the above. In addition, the support may consist of the above-mentioned acidic binary oxide or a support to which the acidic binary oxide is bonded with a binder. Such a binder is not particularly limited as long as it is generally used for a preparation of catalyst but those selected from silica, alumina, magnesia, titania, zirconia, clay or mixtures are preferable.

In manufacturing process A mentioned above, a hydrocracking catalyst is constructed by carrying at least one of metals of group VIa of the periodic table (molybdenum, chrome, tungsten, etc.) and at least one of metals of group VIII (nickel, cobalt, palladium, platinum, etc.) on the support mentioned above. These metals bear hydrogenation capability, while the acidic supports terminates the cracking or branching reaction of paraffin compounds, and thus they carry an important role on generation of isoparaffin having an appropriate molecular weight and branching structures.

As for a metal amount supported in the hydrocracking catalyst, it is preferable that supported amount of group VIa metal is 5 to 30% by mass per one of metal, and supported amount of group VIII metal is 0.2 to 10% by mass per one of metal.

Furthermore, in the hydrocracking catalyst used in manufacturing process A mentioned above, it is more preferable that molybdenum is contained as one or more of metals of group VIa in a range of 5 to 30% by mass and nickel is contained as one or more of metals of group VIII in a range of 0.2 to 10% by mass.

The hydrocracking catalyst consisting of the support mentioned above and one or more of metals of group VIa and one or more of metals of group VIII is used preferably in a sulfurated state. Sulfuration treatment can be performed by well-known methods.

(Hydrocracking Step)

In the manufacturing process A mentioned above, the raw material oil containing a slack wax in an amount of 50% by volume or more is hydrocracked in the presence of the hydrocracking catalyst mentioned above at a hydrogen partial pressure of 0.1 to 14 MPa, preferably 1 to 14 MPa, more preferably 2 to 7 MPa; at an average reaction temperature of 230 to 430° C., preferably 330 to 400° C., more preferably 350 to 390° C.; at LHSV of 0.3 to 3.0 $hr^{-1}$, preferably 0.5 to 2.0 $hr^{-1}$; at a hydrogen/oil ratio of from 50 to 14000 scf/b, preferably from 100 to 5000 scf/b.

In such a hydrocracking step, isoparaffin ingredients having a low pour point and a high viscosity index is generated by proceeding isomerization to isoparaffin in the process of cracking of n-paraffin coming from a slack wax of the raw material oil, and at the same time, aromatic compounds contained in the raw material oil which are an inhibiting factor against achieving high viscosity index can be cracked to monocyclic aromatic compounds, naphthene compounds and paraffin compounds and polycyclic naphthene compounds which are also an inhibiting factor against achieving high viscosity index can be cracked to monocyclic naphthene compounds and paraffin compounds. From a viewpoint of achieving high viscosity index, the less contained are compounds having high boiling point and low viscosity index in the raw material oil, the more preferable.

In addition, when the cracking percentage which evaluates the progress degree of the reaction is defined as in the following expression:

(Cracking percentage (% by volume))=100−(Content of fractions having boiling point not less than 360° C. in the product (% by volume))

it is preferable that the cracking percentage is from 3 to 90% by volume. When the cracking percentage is less than 3% by volume, generation of isoparaffin by cracking isomerization of high molecular weight n-paraffin having a high pour point which is contained in the raw material oil and hydrocracking of aromatic ingredients and polycyclic naphthene ingredients inferior in the viscosity index become insufficient, and when the cracking percentage exceeds 90% by volume, yield of the lubricating oil fraction decreases, both of which are respectively inpreferable.

(Distillation Separation Step)

Subsequently, lubricating oil fraction is distilled and separated from the resulted cracked oil obtained by the hydrocracking step mentioned above. On this occasion, there is a case that fuel oil fractions can be obtained for light component.

The fuel oil fractions are fractions obtained as a result of sufficiently performed desulfurization and denitration as well as sufficiently performed hydrogenation of aromatic ingredients. Of these, the naphtha fraction has a large isoparaffin content, heating oil fraction has a high smoke point and light oil fraction has a high cetane value, and each of them has high quality as a fuel oil.

On the other hand, when hydrocracking of the lubricating oil fraction is insufficient, part of them may be subjected again to the hydrocracking step. In addition, the lubricating oil fraction may be further distilled under reduced pressure in order to obtain a lubricating oil fraction having a desired kinematic viscosity. This distillation under reduced pressure and separation may be performed after the dewaxing shown below.

Lubricating oil base oils called 70 Pale, SAE10 and SAE20 can be suitably obtained in the evaporation separation step by performing distillation under reduced pressure of the cracked oil obtained in the hydrocracking step.

The system using a slack wax having a lower viscosity as the raw material oil is suitable for generating much of 70 Pale and SAE10 fractions, and the system using a slack wax having a high viscosity within the above range as the raw material oil is suitable for generating much of SAE20. However, even when a slack wax having a high viscosity is used, conditions which generate a considerable amount of 70 Pale, SAE10 can be selected depending on the progress degree of the cracking reaction.

(Dewaxing Step)

Since the lubricating oil fractions fractionated from the cracked oil has a high pour point in the distillation separation step mentioned above, dewaxing is performed in order to obtain a lubricating oil base oil having a desired pour point. The dewaxing treatment can be performed by ordinary methods such as solvent dewaxing method or catalytic dewaxing method. Of these, mixed solvents of MEK and toluene are generally used for the solvent dewaxing method, but solvents such as benzene, acetone, MIBK may be used. It is performed under the conditions of solvent/oil of 1 to 6 times, filtration temperature at −5 to −45° C., preferably −10 to −40° C. in order to lower the pour point of the dewaxed oil below −10° C. The wax removed here can be served as a slack wax again in the hydrocracking step.

In the above manufacturing process, the dewaxing treatment may be appended with solvent refining treatment and/or hydrorefining treatment. These appended treatments are performed in order to improve ultraviolet ray stability and oxidation stability of the lubricating oil base oil and can be performed by a method as performed in ordinary lubricating oil refinement process.

In the case of the solvent refining, furfural, phenol, N-methylpyrrolidone, etc. are generally used as a solvent and a little amount of aromatic compounds remaining in the lubricating oil fractions, in particular, polynuclear aromatic compounds are removed.

Hydrofining is performed in order to hydrogenate olefin compounds and aromatic compounds and the catalyst is not particularly limited and the hydrofining can be performed using an alumina catalyst which carries at least one of metals of group VIa such as molybdenum and at least one of metals of group VIII such as cobalt and nickel under conditions of a reaction pressure (hydrogen partial pressure) of 7 to 16 MPa, an average reaction temperature of 300 to 390° C. and LHSV of 0.5 to 4.0 $hr^{-1}$.

Preferable examples of the manufacturing process of the lubricating oil base oil according to the present invention also include manufacturing process B shown below.

That is, manufacturing process B according to the present invention comprises the fifth step for hydrocracking and/or hydroisomerizing a raw material oil containing paraffinic hydrocarbons in the presence of a catalyst; and the sixth step for subjecting the product obtained by the fifth step or lubricating oil fractions collected from the product by distillation or the like to dewaxing treatment.

In the following, manufacturing process B mentioned above is described in detail.

(Raw Material Oil)

In manufacturing process B mentioned above, a raw material oil containing paraffinic hydrocarbons is used. The "paraffinic hydrocarbon" as used in the present invention refers to a hydrocarbon whose paraffin molecule content is 70% by mass or more. The number of carbon atoms in the paraffinic hydrocarbon is not limited in particular, but those containing around 10 to 100 carbon atoms are usually used. In addition, the manufacturing process of the paraffinic hydrocarbon is not limited in particular and various paraffinic hydrocarbon derived from petroleum or synthesized can be used but particularly preferable paraffinic hydrocarbons include synthetic wax (Fischer Tropsch wax (FT wax), GTL wax, etc.) obtained by gas to liquid (GTL) process, etc. and, of these, FT wax is preferable. As a synthetic wax, waxes containing normal paraffin having preferably 15 to 80, more preferably 20 to 50 carbon atoms as a main component are preferable.

The kinematic viscosity of the paraffinic hydrocarbon used for a preparation of the raw material oil can be appropriately selected depending on the kinematic viscosity of the lubricating oil base oil to be aimed at, but paraffinic hydrocarbon having a relatively low viscosity of around 2 to 25 $mm^2/s$, preferably around 2.5 to 20 $mm^2/s$, more preferably around 3 to 15 $mm^2/s$ at 100° C. is desirable to produce a low viscosity base oil as a lubricating oil base oil according to the present invention. The other properties of the paraffinic hydrocarbon are also arbitrary but when paraffinic hydrocarbon is synthetic wax such as the FT wax, the melting point is preferably 35 to 80° C., more preferably 50 to 80° C. and still more preferably 60 to 80° C. In addition, the oil content of the synthetic wax is preferably not more than 10% by mass, more preferably not more than 5% by mass and still more preferably not more than 2% by mass. Sulfur content of the synthetic wax is preferably not more than 0.01% by mass, more preferably not more than 0.001% by mass and still more preferably not more than 0.0001% by mass.

When the raw material oil is a mixed oil of a synthetic wax mentioned above and another raw material oil, the other raw material oil is not particularly limited as long as the content of the synthetic wax is not less than 50% by volume in the total volume of the mixed oil but a mixed oil with a heavy atmospheric distillate oil and/or a distillate oil by distillation under reduced pressure of the crude oil is preferably used.

In addition, when the raw material oil is a mixed oil of a synthetic wax mentioned above and another raw material oil, the content of the synthetic wax in the raw material oil is preferably not less than 70% by volume and more preferably not less than 75% by volume from the viewpoint of producing a base oil with a high viscosity index. When the content is less than 70% by volume, oil content such as aromatic and naphthene components increases in the obtained lubricating oil base oil, and the viscosity index of the lubricating oil base oil tends to decrease.

On the other hand, it is preferable that the heavy atmospheric distillate oil and/or distillate oil by distillation under reduced pressure of the crude oil used in combination with the synthetic wax are fractions having 60% by volume or more distillate components in the distillation temperature range of 300 to 570° C. in order to maintain a high viscosity index of the produced lubricating oil base oil.

(Catalyst)

The catalyst used in manufacturing process B is not limited in particular, but a catalyst comprising a support which contains an aluminosilicate and carries as active metal ingredients at least one selected from metals of group VIb and metals of group VIII is preferably used.

The aluminosilicate refers to a metal oxide consisting of 3 elements of aluminum, silicon and oxygen. The other metallic elements may coexist as long as it does not hinder the effect of the present invention. In this case, the amount of other metallic element is preferably not more than 5% by mass, more preferably not more than 3% by mass as an oxide of the total amount of alumina and silica. Examples the metallic element which can coexist include titanium, lanthanum and manganese.

The crystallinity of an aluminosilicate can be estimated by the ratio of tetracoordinate aluminium atoms to the total aluminium atoms and this ratio can be measured by $^{27}Al$ solid NMR. Aluminosilicates used in the present invention have an amount of tetracoordinate aluminium atoms in the total aluminium atoms of preferably not less than 50% by mass, more preferably not less than 70% by mass, and still more preferably not less than 80% by mass. Hereinbelow, aluminosilicates having an amount of tetracoordinate aluminium atoms in the total aluminium atoms of not less than 50% by mass are referred to as "crystalline aluminosilicates".

As crystalline aluminosilicates, so-called zeolite can be used. Preferable examples include Y type zeolite, super stability Y type zeolite (USY type zeolite), β type zeolite, mordenite, ZSM-5, and of these, USY zeolite is particularly preferable. A single one crystalline aluminosilicate may be used or a combination of two or more of them may be used.

As a method for preparing a support containing a crystalline aluminosilicate, included is a method of molding a mixture of a crystalline aluminosilicate and a binder and burning the molded body. There is no limitation in particular about the binder to use but alumina, silica, silica alumina, titania, magnesia are preferable, and of these, alumina is particularly preferable. The content of the binder is not limited in particular, but usually 5 to 99% by mass is preferable, 20 to 99% by mass is more preferable based on the total amount the molded body. As for the burning temperature of a molded body containing a crystalline aluminosilicate and a binder, 430 to 470° C. is preferable, 440 to 460° C. is more preferable, and 445 to 455° C. is still more preferable. In addition, the burning time is not limited in particular but it is usually from one minute to 24 hours, preferably from 10 minutes to 20 hours, and more preferably from 30 minutes to 10 hours. The burning may be performed under an air atmosphere, but it is preferably performed in an oxygen free atmosphere such as a nitrogen atmosphere.

The group VIb metal carried by the above-mentioned support includes chrome, molybdenum, tungsten and group VIII metal specifically includes cobalt, nickel, rhodium, palladium, iridium and platinum. A single one of these metals may be used or a combination of two or more of these metals may be used. When two or more of metals are combined, noble metals such as platinum and palladium may be combined or base metals such as nickel, cobalt, tungsten and molybdenum may be combined, or a noble metal and a base metal may be combined.

Carrying a metal on the support can be performed by method by impregnation of the support in a solution containing the metal, ion exchange, etc. The carried amount of metal can be appropriately selected but usually it is 05 to 2% by mass, preferably 0.1 to 1% by mass, based on the total amount of the catalyst.

(Hydrocracking/Hydroisomerization Step)

In manufacturing process B mentioned above, the raw material oil containing paraffinic hydrocarbons are subjected to hydrocracking/hydroisomerization in the presence of a catalytic mentioned above. Such a hydrocracking/hydroisomerization step can be performed using an immobilized bed reaction apparatus. As for the conditions of the hydrocracking/hydroisomerization, for example, the temperature is at 250 to 400° C., the hydrogen pressure is at 0.5 to 10 MPa, liquid space velocity (LHSV) of the raw material oil is at 0.5 to 10 $h^{-1}$ is preferable, respectively.

(Distillation Separation Step)

Subsequently, lubricating oil fraction is distilled and separated from the cracked oil obtained by the hydrocracking/hydroisomerization step mentioned above. Since the distilled separation process in manufacturing process B is similar to a distilled separation process in manufacturing process A, redundant description is omitted here.

(Dewaxing Step)

Subsequently, the lubricating oil fraction which has been fractionated from the cracked oil in the distillation separation step mentioned above is dewaxed. The dewaxing treatment can be performed by ordinary methods such as solvent dewaxing method or catalytic dewaxing method. When the substances having a boiling point of not less than 370° C. present in the cracking/isomerization product oil are not separated from the high boiling point substances prior to dewaxing, total amount of the hydrocracked product may be dewaxed or the fractions having a boiling point of not less than 370° C. may be dewaxed depending on the use of the cracking/isomerization product oil.

In the solvent dewaxing, the isomerization product is contacted with cooled ketone and acetone, and the other solvents such as MEK and MIBK, and further cooled to precipitate high pour point substances as wax solid and the precipitation is separated from the solvent containing lubricating oil fraction which is raffinate. Furthermore, wax solid content can be removed by cooling the raffinate in a scraped surface chiller. Low molecular weight hydrocarbons such as propane can also be used in dewaxing, but in this case, the low molecular weight hydrocarbon is mixed with the cracking/isomerization product oil, and at least part thereof is vaporized to further cool the cracking/isomerization product oil to precipitate wax. The wax is separated from the raffinate by filtration, membrane or centrifugal separation. After that, the solvent is removed from the raffinate and the object lubricating oil base oil can be obtained by fractionating the raffinate.

In the case of catalytic dewaxing (catalyst dewaxing), the cracking/isomerization product oil is reacted with hydrogen in the presence of a suitable dewaxing catalyst in an effective condition to lower the pour point. In the catalytic dewaxing, part of the high boiling point substances are converted to low boiling point substances, the low boiling point substances are separated from heavier base oil fraction, and the base oil fractions is fractionated to obtain two or more of lubricating oil base oils. The separation of the low boiling point substances can be performed before the object lubricating oil base oils are obtained or during the fractionation.

The dewaxing catalyst is not limited in particular as long as it can lowers the pour point of the cracking/isomerization product oil but a catalyst which enables to obtain the object lubricating oil base oil at a high yield from the cracking/isomerization product oil is preferable. As such a dewaxing catalyst, shape selective molecular sieve (molecular sieve) is preferable, and specific examples thereof include ferrierite, mordenite, ZSM-5, ZSM-11, ZSM-23, ZSM-35, ZSM-22 (also referred to as theta one or TON) and silicoaminophosphate (SAPO). It is preferable that these molecular sieves are used in combination with a catalytic metal component, and more preferably they are used in combination with a noble metal. Preferable examples of such a combination include a complex of platinum and H-mordenite.

The dewaxing conditions are not limited in particular but a temperature of 200 to 500° C. is preferable and a hydrogen pressure of 10 to 200 bar (1 MPa to 20 MPa) is preferable, respectively. In the case of a flow through reactor, the $H_2$ treatment rate of 0.1 to 10 kg/l/hr is preferable, and as for LHSV, 0.1 to 10 $h^{-1}$ is preferable, and 0.2 to 2.0 $h^{-1}$ is more preferable. The dewaxing is preferably performed so that the substances contained in the cracking/isomerization product oil in an amount usually not more than 40% by mass and preferably not more than 30% by mass and having an initial boiling point of 350 to 400° C. are converted to the substances having a boiling point less than this initial boiling point.

Manufacturing process A and manufacturing process B which are preferable manufacturing processes of the lubricating oil base oil according to the present invention have been hitherto described but the manufacturing processes of the lubricating oil base oil according to the present invention are not limited to these. For example, in manufacturing process A mentioned above, FT wax and GTL wax in substitution for a slack wax may be used. In addition, in manufacturing process B mentioned above, raw material oil containing a slack wax (preferably slack wax A, B) may be used. Furthermore, in each of manufacturing processes A and B, a slack wax (preferably slack wax A, B) and a synthetic wax (preferably, FT wax, GTL wax) may be used in combination.

In addition, when the raw material oil which is used for producing a lubricating oil base oil according to the present invention is a mixed oil of a slack wax and/or a synthetic wax mentioned above and a raw material oil other than these waxes, the content of the slack wax and/or the synthetic wax is preferably not less than 50% by mass, based on the total amount of the raw material oil.

For the raw material oil to produce lubricating oil base oil according to the present invention, a raw material oil containing a slack wax and/or a synthetic wax wherein the oil content is preferably not more than 60% by mass, more preferably not more than 50% by mass, still more preferably not more than 25% by mass is preferable.

In addition, the content of the saturated components in the lubricating oil base oil according to the present invention is preferably not less than 90% by mass, more preferably not less than 93% by mass, still more preferably not less than 95% by mass, based on the total amount of the lubricating oil base oil and the content of the cyclic saturated components in the saturated components is preferably not more than 40% by mass, more preferably 0.1 to 40% by mass, still more preferably 2 to 30% by mass, further still more preferably 5 to 25% by mass and particularly preferably 10 to 21% by mass. When the content of the saturated components and the content of the cyclic saturated components in the saturated components satisfy the above conditions respectively, viscosity-temperature characteristics and heat/oxidation stability can be achieved at a higher level, and when an additive is added to the lubricating oil base oil, it is enabled to dissolve and maintain the additive in the lubricating oil base oil sufficiently stably while enabling to develop the function of the additive at a higher level. Furthermore, the friction characteristics of lubricating oil base oil in itself can be improved, and, as a result, improvement in the friction reduction effect and thus improvement in the energetic-saving can be achieved.

In addition, when the content of the saturated components is less than 90% by mass, viscosity-temperature characteristics, heat/oxidation stability and friction characteristics tend to become insufficient. In addition, when the content of the cyclic saturated components in the saturated components exceed 40% by mass, the effect of the additive tends to deteriorate. Furthermore, when the content of the cyclic saturated components in the saturated components is less than 0.1% by mass, solubility of the additive added to the lubricating oil base oil lowers, and therefore effective amount of the additive dissolve and maintained in the lubricating oil base oil decreases and the effect of the additive cannot be obtained effectively. In addition, the content of the saturated components may be 100% by mass, but preferably the content is not more than 99.9% by mass, more preferably not more than 99.5% by mass, still preferably not more than 99% by mass, particularly preferably not more than 98.5% by mass from the viewpoint of reduction of the production cost and the improvement in the solubility of the additive.

In lubricating oil base oil according to the present invention, the content of the cyclic saturated components in the saturated components being not more than 40% by mass equals to the content of the acyclic saturated components in the saturated components being not less than 60% by mass. Here, acyclic saturated components encompass both of normal paraffin and branched paraffin. The content of each paraffin in the lubricating oil base oil according to the present invention is not particularly limited but the content of the branched paraffin is preferably 55 to 99% by mass, more preferably 57.5 to 96% by mass, still more preferably 60 to 95% by mass, further still more preferably 70 to 92% by mass, and particularly preferably 80 to 90% by mass, based on the total amount of the lubricating oil base oil. When the content of the branched paraffin in the lubricating oil base oil satisfies the above condition, viscosity-temperature characteristics and heat/oxidation stability can be further improved, and when an additive is added to the lubricating oil base oil, it is enabled to dissolve and maintain the additive in the lubricating oil base oil sufficiently stably while enabling to develop the function of the additive at a higher level. In addition, the content of the normal paraffin in the lubricating oil base oil is preferably not more than 1% by mass, more preferably not more than 0.5% by mass, still more preferably not more than 0.2% by mass, based on the total amount of the lubricating oil base oil. When the content of the normal paraffin satisfies the above conditions, a lubricating oil base oil which is excellent in low temperature viscosity characteristics can be obtained.

In addition, in the lubricating oil base oil according to the present invention, the content of monocyclic saturated components and bi- or more cyclic saturated components in the saturated components is not limited, but the content of bi- or more cyclic saturated components in the saturated components is preferably not less than 0.1% by mass, more preferably not less than 1% by mass, still more preferably not less than 3% by mass, particularly preferably not less than 5% by mass, and preferably not more than 40% by mass, more preferably not more than 20% by mass, still more preferably not more than 15% by mass, particularly preferably not more than 11% by mass. In addition, the content of monocyclic saturated components in the saturated components may be 0% by mass, but the content is preferably not less than 1% by mass, more preferably not less than 2% by mass, still more preferably not less than 3% by mass, particularly preferably not less than 4% by mass, and preferably not more than 40% by mass, more preferably not more than 20% by mass, still more preferably not more than 15% by mass, particularly preferably not more than 11% by mass.

In addition, in the lubricating oil base oil according to the present invention, the ratio ($M_A/M_B$) of the mass of monocyclic saturated components ($M_A$) to the mass of bi- or more cyclic saturated components ($M_B$) in the saturated cyclic components is preferably not more than 20, more preferably not more than 3, still more preferably not more than 2, and particularly preferably not more than 1. The ratio $M_A/M_B$ may be 0, but preferably not less than 0.1, more preferably not less than 0.3, and still more preferably not less than 0.5. When $M_A/M_B$ satisfies the above conditions, both of viscosity-temperature characteristics and heat/oxidation stability can be achieved at a higher level.

In addition, in the lubricating oil base oil according to the present invention, the ratio ($M_A/M_C$) of the mass of monocyclic saturated components ($M_A$) to the mass of bicyclic saturated components ($M_C$) in the saturated cyclic components is preferably not more than 3, more preferably not more than 1.5, still more preferably not more than 1.3, and particularly preferably not more than 1.2. The ratio $M_A/M_C$ may be 0, but preferably not less than 0.1, more preferably not less than 0.3, and still more preferably not less than 0.5. When $M_A/M_C$ satisfies the above conditions, both of heat/oxidation stability and viscosity-temperature characteristics can be achieved at a higher level.

The content of the saturated components as used in the present invention means a value (unit=% by mass) measured in accordance with ASTM D 2007-93.

In addition, the ratios of cyclic saturated components, monocyclic saturated components and bi- or more cyclic saturated components, and acyclic saturated components to the saturated components as used in the present invention mean naphthene components (measurement subject: 1- to 6-ring-naphthenes; unit=% by mass) and alkane components (unit=% by mass) measured in accordance with ASTM D 2786-91 respectively.

The normal paraffin component in the lubricating oil base oil as used in the present invention means a value which converted the measured value to a value based on the total amount of the lubricating oil base oil, wherein the measured value is determined by subjecting the saturated components collected and separated by a method described in the above ASTM D 2007-93 to gas chromatography analysis under the conditions below and identifying and quantifying the normal paraffin components in the saturated components. In the identification and quantification, a mixed sample of the normal paraffin having 5 to 50 carbon atoms is used as a standard sample, and the normal paraffin components are determined as the ratio of the total of the peak areas corresponding to each normal paraffin to the total of the peak areas in the chromatogram (except for the peak area coming from a diluent).

(Gas Chromatography Condition)

Column; fluid phase non-polar column (25 mm in length, inside diameter 0.3 mm ϕ, fluid phase film thickness 0.1 μm)

Temperature elevating condition; 50° C. to 400° C. (temperature elevating rate: 10° C./min)

Carrier gas=helium (linear velocity: 40 cm/min)

Split ratio; 90/1

Amount of sample injection: 0.5 μL (Amount of injection of the sample diluted to 20 times with carbon disulfide)

In addition, the ratio of the branched paraffin to lubricating oil base oil means the value obtained by converting the difference between the acyclic saturated components in the above saturated components and the normal paraffin components in the above saturated components based on the total amount of the lubricating oil base oil.

As for the separation method of saturated components and composition analysis of cyclic saturated components and acyclic saturated components, similar methods which give the same results can be used. For example, in addition to the above, a method described in ASTM D 2425-93, a method described in ASTM D 2549-91, a method by high-performance liquid chromatography (HPLC) or improved methods of these methods are included.

In addition, the aromatic components in the lubricating oil base oil according to the present invention are not limited as long as % $C_A$, % $C_P$/% $C_N$ and an iodine value satisfy the above conditions but preferably not more than 7% by mass, more preferably not more than 5% by mass, still more preferably not more than 4% by mass, particularly preferably not more than 3% by mass, and preferably not less than 0.1% by mass, more preferably not less than 0.5% by mass, still more preferably not less than 1% by mass, particularly preferably not less than 1.5% by mass, based on the total amount of the lubricating oil base oil. When the content of the aromatic components exceeds the upper limit value mentioned above, viscosity-temperature characteristics, heat/oxidation stability, friction characteristics and besides volatilization prevention characteristics and low temperature viscosity characteristics tend to decrease, and further when an additive is added to the lubricating oil base oil, the effect of the additive tends to deteriorate. In addition, the lubricating oil base oil according to the present invention does not need to contain an aromatic component but solubility of the additive can be further increased by making the content of the aromatic components not less than the above lower limit value.

The aromatic components as used in the present invention means a value measured in accordance with ASTM D 2007-93. In addition to alkylbenzenes and alkylnaphthalenes, anthracene, phenanthrene and these alkylates, and besides compounds in which four or more benzene rings are condensed, aromatic compounds having heteroatoms such as pyridines, quinolines, phenols, naphthols are usually included in aromatic components.

The viscosity index of the lubricating oil base oil according to the present invention is preferably not less than 110. When the viscosity index is less than above lower limit value, viscosity-temperature characteristics and heat/oxidation stability, and besides volatilization prevention characteristics tend to deteriorate. Preferable range of the viscosity index of the lubricating oil base oil according to the present invention depends on the viscosity grade of the lubricating oil base oil and the details hereof are described later.

The other properties of the lubricating oil base oil according to the present invention are not particularly limited as long as % $C_A$, % $C_P$/% $C_N$ and an iodine value satisfy the above conditions respectively but it is preferable that the lubricating oil base oil according to the present invention has various properties shown below.

The sulfur content of the lubricating oil base oil according to the present invention is dependent on the sulfur content of the raw materials. For example, when raw materials which do not substantially contain sulfur like a synthetic wax ingredient obtained by Fischer Tropsch reaction are used, the lubricating oil base oil which does not substantially contain sulfur can be obtained. When raw materials containing sulfur such as slack wax obtained in a refinement process of the lubricating oil base oil or microwax obtained in a refinement process of wax are used, the sulfur content of the obtained lubricating oil base oil is usually not less than 100 mass ppm. In the lubricating oil base oil according to the present invention, it is preferable that the sulfur content is preferably not more than 100 mass ppm, more preferably not more than 50 mass ppm, still more preferably not more than 10 mass ppm, and particularly preferably not more than 5 mass ppm from the viewpoint of further improvement in heat/oxidation stability and lowering of sulfur content.

In addition, it is preferable to use a slack wax and so on as raw materials from a viewpoint of cost reduction, and in that case, the sulfur content is preferably not more than 50 mass ppm, more preferably not more than 10 mass ppm. The sulfur content as used in the present invention means a sulfur content measured in accordance with JIS K 2541-1996.

The nitrogen content in the lubricating oil base oil according to the present invention is not limited in particular, but preferably not more than 5 mass ppm, more preferably not more than 3 mass ppm, still more preferably not more than 1 mass ppm. When the nitrogen content exceeds 5 mass ppm, heat/oxidation stability tends to deteriorate. The nitrogen content as used in the present invention means a nitrogen content measured in accordance with JIS K 2609-1990.

The kinematic viscosity of the lubricating oil base oil according to the present invention is not particularly limited, as long as % $C_A$, % $C_P$/% $C_N$ and an iodine value satisfy the above conditions respectively but the kinematic viscosity thereof at 100° C. is preferably 1.5 to 20 $mm^2/s$, more preferably 2.0 to 11 $mm^2/s$. The kinematic viscosity of the lubricating oil base oil at 100° C. less than 1.5 $mm^2/s$ is inpreferable from a viewpoint of vaporization loss. On the other hand, when a lubricating oil base oil having a kinematic viscosity at 100° C. more than 20 $mm^2/s$ is intended to obtain, the yield lowers and the cracking percentage is difficult to raise even when a heavy component wax is used as a raw material, and therefore such a condition is inpreferable.

In the present embodiment, it is preferable that lubricating oil base oils having a kinematic viscosity at 100° C. in the following range is fractionated by the distillation and the like and used.

(I) A lubricating oil base oil having a kinematic viscosity at 100° C. of not less than 1.5 $mm^2/s$ and not more than 3.5 $mm^2/s$, preferably not less than 2.0 and not more than 3.0 $mm^2/s$ (II) A lubricating oil base oil having a kinematic viscosity at 100° C. of not less than 3.0 $mm^2/s$ and not more than 4.5 $mm^2/s$, preferably not less than 3.5 and not more than 4.1 $mm^2/s$ (III) A lubricating oil base oil having a kinematic viscosity at 100° C. of not less than 4.5 and not more than 20 $mm^2/s$, preferably not less than 4.8 and not more than 11 $mm^2/s$, particularly preferably not less than 5.5 and not more than 8.0 $mm^2/s$ In addition, the kinematic viscosity at 40° C. of the lubricating oil base oil according to the present invention is preferably 6.0 to 80 $mm^2/s$, more preferably 8.0 to 50 $mm^2/s$. In the present embodiment, it is preferable that lubricating oil base oils having a kinematic viscosity at 40° C. in the following range is fractionated by the distillation and the like and used.

(IV) A lubricating oil base oil having a kinematic viscosity at 40° C. of not less than 6.0 $mm^2/s$ and not more than 12 $mm^2/s$, preferably not less than 8.0 and not more than 12 $mm^2/s$ (V) A lubricating oil base oil having a kinematic viscosity at 40° C. of not less than 12 $mm^2/s$ and not more than 28 $mm^2/s$, preferably 13 to 19 $mm^2/s$ (VI) A lubricating oil base oil having a kinematic viscosity at 40° C. of 28 to 50 $mm^2/s$, more preferably 29 to 45 $mm^2/s$, particularly preferably 30 to 40 $mm^2/s$ The above-mentioned lubricating oil base oils (I) and (IV) are excellent particularly in low temperature viscosity characteristics and capable of reducing viscous resistance and stirring resistance remarkably as compared with conventional lubricating oil base oils having the same viscosity grade when % $C_A$, % $C_P$/% $C_N$ and an iodine value satisfy the above-mentioned conditions, respectively. In addition, BF viscosity at −40° C. can be lowered to less than 2000 mPa·s by adding a pour point depressant. The BF viscosity at −40° C. means a viscosity measured in accordance with JPI-5S-26-99.

In addition, the above-mentioned lubricating oil base oils (II) and (V) are excellent particularly in low temperature viscosity characteristics, volatilization prevention characteristics and lubricity as compared with conventional lubricating oil base oils having the same viscosity grade when % $C_A$, % $C_P$/% $C_N$ and an iodine value satisfy the above-mentioned conditions, respectively. For example, in lubricating oil base oils (II) and (V), CCS viscosity at −35° C. can be lowered to less than 3000 mPa·s.

In addition, the above-mentioned lubricating oil base oils (III) and (VI) are excellent in low temperature viscosity characteristics, volatilization prevention characteristics, heat/oxidation stability and lubricity as compared with conventional lubricating oil base oils having the same viscosity grade when % $C_A$, % $C_P$1% $C_N$ and an iodine value satisfy the above-mentioned conditions, respectively.

Furthermore, it is preferable that the kinematic viscosity of the lubricating oil base oil according to the present invention is appropriately selected according to the kind of the refrigeration/air conditioning equipment to which the refrigerating machine oil is applied and the kind of the refrigerant. For example, when a refrigerating machine oil of an embodiment of the present invention is applied to a refrigeration/air conditioning equipment in which an HFC refrigerant is used, the kinematic viscosity at 40° C. of lubricating oil base oil according to the present invention is preferably not less than 12 $mm^2/s$, more preferably not less than 15 $mm^2/s$, still more preferably not less than 22 $mm^2/s$ from a viewpoint of abrasion resistant, and preferably not more than 500 $mm^2/s$, more preferably not more than 320 $mm^2/s$, still more preferably not more than 220 $mm^2/s$ and particularly preferably not more than 150 $mm^2/s$ from a viewpoint of capability of reducing stirring resistance.

When a refrigerating machine oil of an embodiment of the present invention is applied to a refrigerator in which isobutane is used as a hydrocarbon refrigerant, the kinematic viscosity at 40° C. of lubricating oil base oil according to the present invention is preferably not more than 32 $mm^2/s$, more preferably not more than 22 $mm^2/s$, still more preferably not more than 12 $mm^2/s$ from a viewpoint of energy efficiency, and preferably not less than 4 $mm^2/s$, more preferably not less than 6 $mm^2/s$, still more preferably not less than 8 $mm^2/s$ from a viewpoint of abrasion resistance.

When a refrigerating machine oil of an embodiment of the present invention is applied to an air conditioner in which propane is used as a hydrocarbon refrigerant, the kinematic viscosity at 40° C. of lubricating oil base oil according to the present invention is preferably not less than 12 $mm^2/s$, more preferably not less than 22 $mm^2/s$, still more preferably not less than 32 $mm^2/s$ from a viewpoint of abrasion resistance. In addition, the kinematic viscosity at 40° C. of lubricating oil base oil according to the present invention is preferably not more than 450 $mm^2/s$, more preferably not more than 320 $mm^2/s$, still more preferably not more than 220 $mm^2/s$, particularly preferably not more than 150 $mm^2/s$ from a viewpoint of capability of reducing stirring resistance.

In addition, when a refrigerating machine oil of an embodiment of the present invention is applied to a water heater in which a carbon dioxide refrigerant is used, the kinematic viscosity at 40° C. of lubricating oil base oil according to the present invention is preferably not less than 22 $mm^2/s$, more preferably not less than 32 $mm^2/s$, still more preferably not less than 40 $mm^2/s$ from a viewpoint of sealing properties. In addition, the kinematic viscosity at 40° C. of lubricating oil base oil according to the present invention is preferably not more than 450 $mm^2/s$, more preferably not more than 320 $mm^2/s$, still more preferably not more than 220 $mm^2/s$, particularly preferably not more than 150 $mm^2/s$ from a viewpoint of capability of reducing stirring resistance.

The viscosity index of the lubricating oil base oil according to the present invention depends on viscosity grade of the lubricating oil base oil, but, for example, the viscosity index of lubricating oils (I) and (IV) mentioned above is preferably 105 to 130, more preferably 110 to 125 and still more preferably 120 to 125. The viscosity index of the lubricating oil base oils (II) and (V) mentioned above is preferably 125 to 160, more preferably 130 to 150 and still more preferably 135 to 150. The viscosity index of the lubricating oil base oils (III) and (VI) mentioned above is preferably 135 to 180, more preferably 140 to 160. When the viscosity index is less than the above lower limit, viscosity-temperature characteristics and heat/oxidation stability, and besides, volatilization prevention characteristics tend to deteriorate. In the meantime, when the viscosity index exceeds the above upper limit, low temperature viscosity characteristics tend to deteriorate.

The viscosity index as used in the present invention means a viscosity index measured in accordance with JIS K 2283-1993.

In addition, refractive index at 20° C. of the lubricating oil base oil according to the present invention depends on viscosity grade of the lubricating oil base oil, but, for example, the refractive index at 20° C. of lubricating oils (I) and (IV) mentioned above is preferably not more than 1.455, more preferably not more than 1.453, still more preferably not more than 1.451. The refractive index at 20° C. of lubricating oils (II) and (V) mentioned above is preferably not more than 1.460, more preferably not more than 1.457, still more preferably not more than 1.455. The refractive index at 20° C. of lubricating oils (III) and (VI) mentioned above is preferably not more than 1.465, more preferably not more than 1.463, still more preferably not more than 1.460. When the refractive indexes exceed the above upper limit value, viscosity-temperature characteristics and heat/oxidation stability, and besides volatilization prevention characteristics and low temperature viscosity characteristics of the lubricating oil base oil tend to deteriorate, and when an additive is added to the lubricating oil base oil, the effect of the additive tends to deteriorate.

In addition, the pour point of the lubricating oil base oil according to the present invention depends on viscosity grade of the lubricating oil base oil, but, for example, the pour point of lubricating oils (I) and (IV) mentioned above is preferably not more than −10° C., more preferably not more than −12.5° C., still more preferably not more than −15° C. The pour point of lubricating oils (II) and (V) mentioned above is preferably not more than −10° C., more preferably not more than −15° C., still more preferably not more than −17.5° C. The pour point of lubricating oils (III) and (VI) mentioned above is preferably not more than −10° C., more preferably not more than −12.5° C., still more preferably not more than −15° C. When the pour point is beyond the above upper limit value, low temperature fluidity of a lubricating oil using the lubricating oil base oil tends to deteriorate. The pour point as used in the present invention means a pour point measured in accordance with JIS K 2269-1987.

In addition, the CCS viscosity at −35° C. of the lubricating oil base oil according to the present invention depends on viscosity grade of the lubricating oil base oil, but, for example, the CCS viscosity at −35° C. of lubricating oils (I) and (IV) mentioned above is preferably not more than 1000 mPa·s. The CCS viscosity at −35° C. of lubricating oils (II) and (V) mentioned above is preferably not more than 3000 mPa·s, more preferably not more than 2400 mPa·s, still more preferably not more than 2000 mPa·s. The CCS viscosity at −35° C. of lubricating oils (III) and (VI) mentioned above is preferably not more than 15000 mPa·s, more preferably not more than 10000 mPa·s. When the CCS viscosity at −35° C. exceeds the above upper limit value, low temperature fluidity of a lubricating oil using the lubricating oil base oil tends to deteriorate. The CCS viscosity at −35° C. as used in the present invention means a viscosity measured in accordance with JIS K 2010-1993.

In addition, density ($\rho_{15}$, unit: g/cm$^3$) at 15° C. of the lubricating oil base oil according to the present invention depends on viscosity grade of the lubricating oil base oil, but it is preferably less than the value ρ of the following expression (1) that is, $\rho_{15} \leqq \rho$.

$$\rho = 0.0025 \times kv100 + 0.820 \quad (1)$$

[In the expression, kv100 shows kinematic viscosity (mm$^2$/s) at 100° C. of the lubricating oil base oil.]

When $\rho_{15} > \rho$, viscosity-temperature characteristics and heat/oxidation stability, and besides volatilization prevention characteristics and low temperature viscosity characteristics tend to deteriorate, and when an additive is added to the lubricating oil base oil, the effect of the additive tends to deteriorate.

For example, $\rho_{15}$ of lubricating oil base oils (I) and (IV) mentioned above is preferably not more than 0.825 g/cm$^3$, more preferably not more than 0.820 g/cm$^3$. In addition, $\rho_{15}$ of lubricating oil base oils (II) and (V) mentioned above is preferably not more than 0.835 g/cm$^3$, more preferably not more than 0.830 g/cm$^3$. In addition, $\rho_{15}$ of lubricating oil base oils (III) and (VI) mentioned above is preferably not more than 0.840 g/cm$^3$, more preferably not more than 0.835 g/cm$^3$.

The density at 15° C. as used in the present invention means a density measured at 15° C. in accordance with JIS K 2249-1995.

The aniline point (AP (° C.)) of the lubricating oil base oil according to the present invention depends on viscosity-grade of the lubricating oil base oil, but it is preferable that a value is not less than the value A of the following expression (2), that is, AP≧A.

$$A = 4.1 \times kv100 + 97 \quad (2)$$

[In the expression, kv100 shows a kinematic viscosity (mm$^2$/s) at 100° C. of the lubricating oil base oil.]

When AP<A, viscosity-temperature characteristics and heat/oxidation stability, and besides, volatilization prevention characteristics and low temperature viscosity characteristics tend to deteriorate, and when an additive is added to the lubricating oil base oil, the effect of the additive tends to deteriorate.

For example, AP of lubricating oil base oils (I) and (IV) mentioned above is preferably not less than 108° C., more preferably not less than 110° C., and still more preferably not less than 112° C. AP of lubricating oil base oils (II) and (V) mentioned above is preferably not less than 113° C., more preferably not less than 116° C., and still more preferably not less than 120° C. AP of lubricating oil base oils (III) and (VI) mentioned above is preferably not less than 125° C., more preferably not less than 127° C., and still more preferably not less than 128° C. The aniline point as used in the present invention means an aniline point measured in accordance with JIS K 2256-1985.

In addition, the NOACK evaporation amount of the lubricating oil base oil according to the present invention is not limited particularly but, for example, the NOACK evaporation amount of lubricating oil base oils (I) and (IV) mentioned above is preferably not less than 20% by mass, more preferably not less than 25% by mass, still more preferably not less than 30% by mass, and preferably not more than 50% by mass, more preferably not more than 45% by mass, still more preferably not more than 42% by mass. The NOACK evaporation amount of lubricating oil base oils (II) and (V) mentioned above is preferably not less than 6% by mass, more preferably not less than 8% by mass, still more preferably not less than 10% by mass, and preferably not more than 20% by mass, more preferably not more than 16% by mass, still more preferably not more than 15% by mass, and particularly preferably not more than 14% by mass. The NOACK evaporation amount of lubricating oil base oils (III) and (VI) mentioned above is preferably not less than 1% by mass, more preferably not less than 2% by mass, and preferably not more than 8% by mass, more preferably not more than 6% by mass, still more preferably not more than 4% by mass. When the NOACK evaporation amount equals the above lower limit value, improvement in low temperature viscosity characteristics tends to be difficult. When the NOACK evaporation amount exceeds the above upper limit values respectively, in the case that the lubricating oil base oil is used for internal combustion engines and the like, amount of vaporization loss of the lubricating oil increases and in accompany with this, catalyst poisoning is promoted and thus such a condition is not preferable. The NOACK evaporation amount as used in the present invention means the amount of vaporization loss measured in accordance with ASTM D 5800-95.

As for the distillation properties of the lubricating oil base oil according to the present invention, it is preferable that the initial boiling point (IBP) is 290 to 440° C. and final boiling point (FBP) is 430 to 580° C. by gas chromatography distillation, and the lubricating oil base oils (I) to (III) and (IV) to (VI) having the preferable viscosity range mentioned above can be obtained by rectifying one or two or more of fractions selected from fractions in such a distillation range.

For example, as for the distillation properties of the lubricating oil base oils (I) and (IV) mentioned above, the initial boiling point (IBP) is preferably 260 to 360° C., more preferably 300 to 350° C., and still more preferably 310 to 350° C. 10% distilling temperature (T10) is preferably 320 to 400° C., more preferably 340 to 390° C., and still more preferably 350 to 380° C. 50% distilling temperature (T50) is preferably 350 to 430° C., more preferably 360 to 410° C., and still more preferably 370 to 400° C. 90% distilling temperature (T90) is preferably 380 to 460° C., more preferably 390 to 450° C., and still more preferably 400 to 440° C. The final boiling point (FBP) is preferably 420 to 520° C., more preferably 430 to 500° C., and still more preferably 440 to 480° C. T90-T10 is preferably 50 to 100° C., more preferably 55 to 85° C., and still more preferably 60 to 70° C. FBP-IBP is preferably 100 to 250° C., more preferably 110 to 220° C., and still more preferably 120 to 200° C. T10-IBP is preferably 10 to 80° C., more preferably 15 to 60° C., and still more preferably 20 to 50° C. FBP-T90 is preferably 10 to 80° C., more preferably 15 to 70° C., and still more preferably 20 to 60° C.

As for the distillation properties of the lubricating oil base oils (II) and (V) mentioned above, the initial boiling point (IBP) is preferably 300 to 380° C., more preferably 320 to 370° C., and still more preferably 330 to 360° C. 10% distilling temperature (T10) is preferably 340 to 420° C., more preferably 350 to 410° C., and still more preferably 360 to 400° C. 50% distilling temperature (T50) is preferably 380 to 460° C., more preferably 390 to 450° C., and still more preferably 400 to 460° C. 90% distilling temperature (T90) is preferably 440 to 500° C., more preferably 450 to 490° C., and still more preferably 460 to 480° C. The final boiling point (FBP) is preferably 460 to 540° C., more preferably 470 to 530° C., and still more preferably 480 to 520° C. T90-T10 is preferably 50 to 100° C., more preferably 60 to 95° C., and still more preferably 80 to 90° C. FBP-IBP is preferably 100 to 250° C., more preferably 120 to 180° C., and still more preferably 130 to 160° C. T10-IBP is preferably 10 to 70° C., more preferably 15 to 60° C., and still more preferably 20 to 50° C. FBP-T90 is preferably 10 to 50° C., more preferably 20 to 40° C., and still more preferably 25 to 35° C.

As for the distillation properties of the lubricating oil base oils (III) and (VI) mentioned above, the initial boiling point (IBP) is preferably 320 to 480° C., more preferably 350 to 460° C., and still more preferably 380 to 440° C. 10% distilling temperature (T10) is preferably 420 to 500° C., more preferably 430 to 480° C., and still more preferably 440 to 460° C. 50% distilling temperature (T50) is preferably 440 to 520° C., more preferably 450 to 510° C., and still more preferably 460 to 490° C. 90% distilling temperature (T90) is preferably 470 to 550° C., more preferably 480 to 540° C., and still more preferably 490 to 520° C. The final boiling point (FBP) is preferably 500 to 580° C., more preferably 510 to 570° C., and still more preferably 520 to 560° C. T90-T10 is preferably 50 to 120° C., more preferably 55 to 100° C., and still more preferably 55 to 90° C. FBP-IBP is preferably 100 to 250° C., more preferably 110 to 220° C., and still more preferably 115 to 200° C. T10-IBP is preferably 10 to 100° C., more preferably 15 to 90° C., and still more preferably 20 to 50° C. FBP-T90 is preferably 10 to 50° C., more preferably 20 to 40° C., and still more preferably 25 to 35° C.

In each of lubricating oil base oils (I) to (VI), further improvement of the low temperature viscosity and further reduction of the vaporization loss are enabled by setting IBP, T10, T50, T90, FBP, T90-T10, FBP-IBP, T10-IBP, FBP-T90 in the preferable ranges mentioned above. As for each of T90-T10, FBP-IBP, T10-IBP and FBP-T90, when the distillation ranges are set too narrow, yield of the lubricating oil base oils deteriorates, which is inpreferable from a viewpoint of economy.

IBP, T10, T50, T90 and FBP as used in the present invention respectively means distilling points measured in accordance with ASTM D 2887-97.

The remaining metal components in the lubricating oil base oils according to the present invention come from metal components inevitably included in catalysts and raw materials in the manufacturing process, but it is preferable that these remaining metal components are removed sufficiently. For example, it is preferable that the content of AI, Mo and Ni are not more than 1 mass ppm respectively. When the content of these metals exceeds the upper limit value mentioned above, functions of additives added to the lubricating oil base oils tend to be inhibited.

The remaining metal components as used in the present invention means metal components measured in accordance with JPI-5S-38-2003.

In addition, according to the lubricating oil base oil according to the present invention, since % $C_A$, % $C_P$/% $C_N$ and an iodine value satisfy the conditions mentioned above, excellent heat/oxidation stability can be achieved, but it is preferable to show the following RBOT life to show depending on the kinematic viscosity. For example, RBOT life of lubricating oil base oils (I) and (IV) mentioned above is preferably not less than 300 min, more preferably not less than 320 min, and still more preferably not less than 330 min. RBOT life of lubricating oil base oils (II) and (V) mentioned above is preferably not less than 350 min, more preferably not less than 370 min, and still more preferably not less than 380 min. RBOT life of lubricating oil base oils (III) and (VI) mentioned above is preferably not less than 400 min, more preferably not less than 410 min, and still more preferably not less than 420 min. When RBOT life is less than the above lower limit values respectively, viscosity-temperature characteristics and heat/oxidation stability of the lubricating oil base oil tend to deteriorate, and when an additive is added to the lubricating oil base oil, the effect of the additive tends to deteriorate.

RBOT life as used in the present invention in lubricating oil base oil means RBOT value measured in accordance with JIS K 2514-1996 on a composition prepared by adding 0.2% by mass phenolic antioxidant (2,6-di-tert-butyl-p-cresol; PBPC) to a lubricating oil base oil.

In the refrigerating machine oil of an embodiment of the present invention, a lubricating oil base oil according to the present invention mentioned above may be used independently or a lubricating oil base oil according to the present invention may be used along with one or two or more of the other base oils. When the lubricating oil base oil according to the present invention and the other base oil(s) are used together, the content of lubricating oil base oil according to the present invention in the mixed base oil is preferably not less than 30% by mass, more preferably not less than 50% by mass, still more preferably not less than 70% by mass.

The other base oil used together with the lubricating oil base oil according to the present invention is not particularly limited but, for example, as a mineral oil type base oil, solvent refining mineral oils, hydrocracked mineral oils, hydrofined mineral oils, solvent dewaxed base oils having kinematic viscosity at 100° C. of 1 to 100 $mm^2/s$ are included.

The synthetic base oil includes poly-α-olefin or hydrogenated products thereof, isobutene oligomer or hydrogenated products thereof, isoparaffins, alkylbenzenes, alkylnaphthalenes, diesters (ditridecyl glutarate, di-2-ethylhexyl adipate, di-isodecyl adipate, ditridecyl adipate, di-2-ethylhexyl cebacate, etc.), polyol esters (monoesters, diesters, triesters, tetraesters, etc. of at least one compound selected from polyols such as neopentyl glycol, trimethylolethane, trimethylolpropane, trimethylolbutane, pentaerythritol and dipentaerythritol and at least one compound selected from fatty acids such as valeric acid, caproic acid, enanthic acid, caprylic acid, pelargonic acid, capric acid, oleic acid, isopentanoic acid, 2-methylhexanoic acid, 2-ethylpentanoic acid, 2-ethylhexanoic acid, 3,5,5-trimethylhexanoic acid; and mixtures of two or more thereof), polyoxyalkylene glycol, polyvinyl ether, dialkyldiphenyl ether, polyphenyl ether, and of these, poly-α-olefins are preferable. As poly-α-olefin, typically, oligomers or co-oligomers of α-olefin having 2 to 32, preferably 6 to 16 carbon atoms (1-octene oligomer, decene oligomer, ethylene-propylene co-oligomer) and hydrogenated products thereof are included.

The manufacturing process of the poly-α-olefin is not limited in particular, but, for example, a method of polymerizing α-olefin in the presence of a polymerization catalyst such as aluminium trichloride or boron trifluoride and Friedel-Crafts catalysts including complexes with water, alcohol (ethanol, propanol, butane, etc.), carboxylic acid or ester is included.

The refrigerating machine oil of the embodiment of the present invention may consist only of the lubricating oil base oil mentioned above but can contain various additives shown below to further improve various performances.

The refrigerating machine oil of the embodiment of the present invention preferably contains a phosphorus extreme pressure agent from a viewpoint of capability of further improving abrasion resistance. Phosphorus extreme pressure agent includes phosphoric acid ester, acidic phosphoric acid ester, amine salt of acidic phosphoric acid ester, chlorinated phosphoric acid ester, phosphorous acid ester, phosphorothionate.

Among the phosphorus extreme pressure agents mentioned above, phosphoric acid ester, acidic phosphoric acid ester, amine salt of acidic phosphoric acid ester, chlorinated phosphoric acid ester, phosphorous acid ester are ester of phosphoric acid or phosphorous acid and alkanol or polyether type alcohol or derivatives thereof.

The phosphoric acid ester includes tripropyl phosphate, tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, xylyldiphenyl phosphate.

Acidic phosphoric acid ester includes phosphoric acid monoalkyl esters such as monopropyl acid phosphate, monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate and monooleyl acid phosphate, and phosphoric acid dialkyl esters and phosphoric acid di(alkyl)aryl esters such as dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate.

The amine salt of acidic phosphoric acid ester includes salts of the above-mentioned acidic phosphoric acid ester with amine such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, trioctylamine.

The chlorinated acidic phosphoric acid ester includes tris dichloro propyl phosphate, tris chloroethyl phosphate, tris chlorophenyl phosphate, polyoxyalkylene bis[di(chloroalkyl)]phosphate.

The phosphorous acid ester includes dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleoyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, tricresyl phosphite.

Phosphorothionate is preferably compounds represented by the following general formula (4):

[Chem. 1]

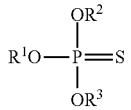

(4)

wherein $R^1$, $R^2$ and $R^3$ may be the same or different and respectively represent a hydrocarbon group having 1 to 24 carbon atoms.

The hydrocarbon group having 1 to 24 carbon atoms represented by $R^1$ to $R^3$ specifically includes an alkyl group, a cycloalkyl group, an alkenyl group, an alkylcycloalkyl group, an aryl group, an alkylaryl group, an arylalkyl group.

Examples of the alkyl group include alkyl groups (these alkyl groups may be straight-chain or branched) such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group.

Examples of the cycloalkyl groups include cycloalkyl groups having 5 to 7 carbon atoms such as a cyclopentyl group, a cyclohexyl group and a cycloheptyl group. Examples of the alkylcycloalkyl group mentioned above include alkyl cyclo alkyl groups (wherein substituted position to a cycloalkyl group of an alkyl group is arbitrary) having 6 to 11 carbon atoms such as a methylcyclopentyl group, a dimethylcyclopentyl group, a methylethylcyclopentyl group, a diethylcyclopentyl group, a methylcyclohexyl group, a dimethylcyclohexyl group, a methylethylcyclohexyl group, a diethylcyclohexyl group, a methylcycloheptyl group, a dimethylcycloheptyl group, a methylethylcycloheptyl group, a diethylcycloheptyl group.

Examples of the alkenyl group include alkenyl groups (these alkenyl groups may be straight-chain or branched and the position of double bond is arbitrary) such as a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group.

Examples of the aryl group include aryl groups such as a phenyl group, a naphthyl group. Examples of the alkylaryl group mentioned above include alkylaryl groups (wherein the alkyl group may be straight-chain or branched and substituted position to a cycloalkyl group of an alkyl group is also arbitrary) having 7 to 18 carbon atoms such as a tolyl group, a xylyl group, an ethyl phenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group.

Examples of the arylalkyl group (wherein the alkyl group may be straight-chain or branched) having 7 to 12 carbon atoms such as a benzyl group, a phenylethyl group, a phenylpropyl group, a phenylbutyl group, a phenylpentyl group, a phenylhexyl group.

The hydrocarbon group having 1 to 24 carbon atoms represented by above $R^3$ to $R^5$ is preferably an alkyl group, an aryl group and an alkylaryl group, more preferably an alkyl group having 4 to 18 carbon atoms, an alkylaryl group having 7 to 24 carbon atoms, and a phenyl group.

The phosphorothionate represented by general formula (4) specifically includes tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, triolecyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propylphenyl) phosphorothionate, tris(isopropylphenyl) phosphorothionate, tris(n-butylphenyl)phosphorothionate, tris(isobutylphenyl)phosphorothionate, tris(s-butylphenyl) phosphorothionate, tris(t-butylphenyl)phosphorothionate. Mixtures of these can be also used.

A single one or a combination of two or more of the phosphorus extreme pressure agent mentioned above may be used and when a phosphorothionate is used in combination with a phosphorus extreme pressure agent other than the phosphorothionate, lubricity of the refrigerating machine oil of the embodiment of the present invention can be further improved.

The content of the phosphorus extreme pressure agent in the refrigerating machine oil of the embodiment of the present invention is not limited in particular, but it is preferably not less than 0.01% by mass and more preferably not less than 0.1% by mass, based on the total amount of the refrigerating machine oil. When the content of the phosphorus extreme pressure agent is less than 0.01% by mass, lubricity improvement effect by the use of the phosphorus extreme pressure agent tends to become insufficient. In addition, the content of the phosphorus extreme pressure agent is preferably not more than 5% by mass, more preferably not more than 3% by mass and still more preferably not more than 1% by mass, based on the total amount of the refrigerating machine oil. Even when the content of the phosphorus extreme pressure agent exceeds 5% by mass, the lubricity improvement effect corresponding to the content is not liable to be obtained but the stability of the refrigerating machine oil might be lost.

In addition, the refrigerating machine oil of the embodiment of the present invention may further contain an oiliness agent. The oiliness agent includes alcohol oiliness agents, carboxylic acid oiliness agents and ester oiliness agents. The oiliness agent is described in detail in the description of the third enforcement.

In the refrigerating machine oil of the embodiment of the present invention, a single one or a combination of two or more of the alcohol oiliness agent, carboxylic acid oiliness agent and ester oiliness agent may be used as an oiliness agent.

The content of the oiliness agent is arbitrary but it is preferably not less than 0.01% by mass, more preferably not less than 0.05% by mass and still more preferably not less than 0.1% by mass, based on the total amount of the composition since it is excellent in the improvement effect of abrasion resistance and friction characteristics. In addition, the content is preferably not more than 10% by mass, more preferably not more than 7.5% by mass and still more preferably not more than 5% by mass, based on the total amount of the composition since it is excellent in separation prevention characteristics under a refrigerant atmosphere and at low temperatures and in heat/oxidation stability of the refrigerating machine oil.

The refrigerating machine oil of the embodiment of the present invention may further contain an epoxy compound. When an epoxy compound is contained in the refrigerating machine oil, stability of the refrigerating machine oil can be improved.

As the epoxy compounds it is preferable to use at least one of epoxy compound selected from a phenylglycidyl ether type epoxy compound, an alkyl glycidyl ether type epoxy compound, a glycidyl ester type epoxy compound, an allyl oxirane compound, an alkyl oxirane compound, a cycloaliphatic epoxy compound, an epoxidized fatty acid monoester and epoxidized vegetable oil.

As phenyl glycidyl ether type epoxy compounds, phenyl glycidyl ether or alkylphenyl glycidyl ether can be specifically exemplified. The alkylphenyl glycidyl ether as used herein includes those having 1 to 3 alkyl groups having 1 to 13 carbon atoms, and among these, those having one alkyl group having 4 to 10 carbon atoms, for example, n-butylphenyl glycidyl ether, i-butylphenyl glycidyl ether, sec-butylphenyl glycidyl ether, tert-butylphenyl glycidyl ether, pentylphenyl glycidyl ether, hexylphenyl glycidyl ether, heptylphenyl glycidyl ether, octylphenyl glycidyl ether, nonylphenyl glycidyl ether, decylphenyl glycidyl ether, etc. can be exemplified as preferable examples.

As the alkyl glycidyl ether type epoxy compounds, decyl glycidyl ether, undecyl glycidyl ether, dodecyl glycidyl ether, tridecyl glycidyl ether, tetradecyl glycidyl ether, 2-ethylhexyl glycidyl ether, neopentyl glycol diglycidyl ether, trimethylolpropane triglycidyl ether, pentaerythritol tetraglycidyl ether, 1,6-hexane diol diglycidyl ether, sorbitol polyglycidyl ether, polyalkylene glycol monoglycidyl ether, polyalkylene glycol diglycidyl ether, etc. can be specifically exemplified.

The glycidyl ester type epoxy compounds specifically include compounds represented by the following general formula (5):

[Chem. 2]

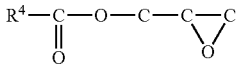

(5)

wherein $R^4$ represents a hydrocarbon group having 1 to 18 carbon atoms.

The hydrocarbon group having 1 to 18 carbon atoms represented by $R^4$ in the above formula (5) includes an alkyl group having 1 to 18 carbon atoms, an alkenyl group having 2 to 18 carbon atoms, a cycloalkyl group having 5 to 17 carbon atoms, an alkylcycloalkyl group having 6 to 18 carbon atoms, an aryl group having 6 to 10 carbon atoms, an alkylaryl group having 7 to 18 carbon atoms, and an arylalkyl group having 7 to 18 carbon atoms. Among these, an alkyl group having 5 to 15 carbon atoms, an alkenyl group having 2 to 15 carbon atoms, a phenyl group and an alkylphenyl group having an alkyl group having 1 to 4 carbon atoms are preferable.

As preferable examples among the glycidyl ester type epoxy compounds, glycidyl-2,2-dimethyl octanoate, glycidyl benzoate, glycidyl-tert-butyl benzoate, glycidyl acrylate, glycidyl methacrylate, etc. can be specifically exemplified.

As the allyl oxirane compounds, 1,2-epoxy styrene, alkyl-1,2-epoxy styrene, etc. can be specifically exemplified.

As the alkyl oxirane compounds, 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane, 1,2-epoxyeicosane, etc. can be specifically exemplified.

The cycloaliphatic epoxy compound includes compounds in which the carbon atoms constituting an epoxy group directly constitutes an alicycle ring represented by the following general formula (6).

[Chem. 3]

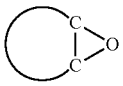

(6)

As the cycloaliphatic epoxy compounds, 1,2-epoxycyclohexane, 1,2-epoxycyclopentane, 3,4-epoxycyclohexylmethyl-3,4-epoxycyclohexane carboxylate, bis(3,4-epoxy cyclohexylmethyl)adipate, exo-2,3-epoxynorbornane, bis(3,4-epoxy-6-methylcyclohexylmethyl)adipate, 2-(7-oxabicyclo[4.1.0]-hept-3-yl)-spiro(1,3-dioxane-5,3'-[7]oxabicyclo[4.1.0]heptane, 4-(1'-methylepoxyethyl)-1,2-epoxy-2-methylcyclohexane, 4-epoxyethyl-1,2-epoxycyclohexane, etc. can be specifically exemplified.

As the epoxidized fatty acid monoester, esters of an epoxidized fatty acid having 12 to 20 carbon atoms and an alcohol, a phenol and an alkylphenol having 1 to 8 carbon atoms, etc. can be specifically exemplified. Particularly, butyl, hexyl, benzyl, cyclohexyl, methoxyethyl, octyl, phenyl and butylphenyl esters of epoxystearic acid are preferably used.

As the epoxidized vegetable oil, epoxy compounds of vegetable oil such as bean oil, linseed oil, the cotton seed oil can be specifically exemplified.

Of these, phenylglycidyl ether type epoxy compounds, glycidyl ester type epoxy compounds, cycloaliphatic epoxy compounds, epoxidized fatty acid monoester are preferable since these can improve heat/oxidation stability more, and glycidyl ester type epoxy compounds and cycloaliphatic epoxy are more preferable.

In the present embodiment, a single one or a combination of two or more of the epoxy compounds mentioned above may be used.

When an epoxy compound mentioned above is contained in a refrigerating machine oil of the embodiment of the present invention, the content thereof is not particularly limited but it is preferably not less than 0.01% by mass, more preferably not less than 0.1% by mass, based on the total amount of the refrigerating machine oil. When the content of the epoxy compound is less than 0.01% by mass, heat/oxidation stability improvement effect of the refrigerating machine oil tends to become insufficient. In addition, the content of the epoxy compound is preferably not more than 5% by mass, more preferably not more than 3% by mass and still more preferably not more than 1% by mass, based on the total amount of the refrigerating machine oil. When the content of the epoxy compound exceeds 5% by mass, moisture absorbency of the refrigerating machine oil is raised, and water becomes easy to get mixed in a frozen system and the stability improvement effect by the use of epoxy compounds does not tend to be exhibited effectively.

In addition, a single one or a combination of several of additives such phenolic antioxidants such as di-tert-butyl-p-cresol and bispenol A, amine antioxidants such as phenyl-α-naphthylamine, N,N-di(2-naphthyl)-p-phenylenediamine, abrasion inhibitors such as zinc dithiophosphate, chlorinated paraffins, extreme pressure agents such as sulfur compounds, oiliness agents such as fatty acids, antifoaming agents such as silicone compounds, viscosity index improvers, pour point depressants, detergent-dispersants as needed can be contained in refrigerating machine oil of the embodiment of the present invention. The content of these additives is not limited in particular, but the total amount thereof is preferably not more than 10% by mass and more preferably not more than 5% by mass, based on the total amount of the refrigerating machine oil.

The volume resistivity of refrigerating machine oil of the embodiment of the present invention is not limited in particular, but it is preferably not less than $1.0\times10^{9}\Omega\cdot$cm. High electrical insulation tends to be necessary particularly when used in a hermetic refrigerator. The volume resistivity as used here means a value [Ω·cm] at 25° C. measured in accordance with JIS C 2101 "Electric insulating oil testing method".

Furthermore, the moisture content of the refrigerating machine oil of the embodiment of the present invention is not particularly limited, but it is preferably not more than 200 ppm, more preferably not more than 100 ppm and most preferably not more than 50 ppm based on the total amount of the refrigerating machine oil. When used in a hermetic refrigerator in particular, little moisture content is demanded from the viewpoint of influence on heat oxidation stability and electrical insulation characteristics of the refrigerating machine oil.

Furthermore, the acid value of refrigerating machine oil of the embodiment of the present invention is not limited in particular, but it is preferably not more than 0.5 mgKOH/g, more preferably not more than 0.3 mgKOH/g, still more preferably not more than 0.1 mgKOH/g and particularly preferably not more than 0.05 mgKOH/g in order to prevent erosion into the metal used for refrigeration/air conditioning equipment or pipings. The acid value as used here means a value [mgKOH/g] measured in accordance with JIS K 2501 "Petroleum products and lubricants—Determination of neutralization number".

The ash content of the refrigerating machine oil of the present embodiment is not particularly limited but it can be preferably not more than 100 ppm, more preferably not more than 50 ppm in order to enhance heat/hydrolytic stability of refrigerating machine oil of the embodiment of the present invention and to suppress generation of the sludge and the like. The ash content in the present invention means a value [ppm] measured in accordance with JIS K 2272 "Crude oil and petroleum products-Determination of ash and sulfated ash".

The refrigerating machine oil of the embodiment of the present invention having the constitution mentioned above exhibits excellent abrasion resistance and friction characteristics in the presence of a refrigerant, and enables to achieve both of improvement in the reliability for a long term and energy saving of refrigeration/air conditioning equipments. Here, the refrigerant used with refrigerating machine oil of the embodiment of the present invention is preferably used with fluorine containing ether refrigerants such as HFC refrigerants and perfluoroesters, non-fluorine containing ether refrigerants such as dimethyl ether and natural refrigerants such as carbon dioxide and hydrocarbons. These refrigerants may be used in a single one or mixtures of two or more of them.

The HFC refrigerant includes hydrofluorocarbons having 1 to 3, preferably 1 to 2 carbon atoms. Specific examples thereof include HFCs such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a) or mixtures of two or more of these. These refrigerants are appropriately selected depending on the use and required performance but for example HFC-32 alone; HFC-23 alone; HFC-134a alone; HFC-125 alone; a mixture of HFC-134a/HFC-32=60 to 80% by mass/40 to 20% by mass; a mixture of HFC-32/HFC-125=40 to 70% by mass/60 to 30% by mass; a mixture of HFC-125/HFC-143a=40 to 60% by mass/60 to 40% by mass; a mixture of HFC-134a/HFC-32/HFC-125=60% by mass/30% by mass/10% by mass; a mixture of HFC-134a/HFC-32/HFC-125=40 to 70% by mass/15 to 35% by mass/5 to 40% by mass; and a mixture of HFC-125/HFC-134a/HFC-143a=35 to 55% by mass/1 to 15% by mass/40 to 60% by mass are included as preferable example. In addition, specific examples include a mixture of HFC-134a/HFC-32=70/30% by mass; a mixture of HFC-32/HFC-125=60/40% by mass; a mixture of HFC-32/HFC-125=50/50% by mass (R410A); a mixture of HFC-32/HFC-125=45/55% by mass (R410B); a mixture of HFC-125/HFC-143a=50/50% by mass (R507c); a mixture of HFC-32/HFC-125/HFC-134a=30/10/60% by mass; a mixture of HFC-32/HFC-125/HFC-134a=23/25/52% by mass (R407c); a mixture of HFC-32/HFC-125/HFC-134a=25/15/60% by mass (R407E); a mixture of HFC-125/HFC-134a/HFC-143a=44/4/52% by mass (R404A).

As natural refrigerants, hydrocarbon refrigerants, carbon dioxide refrigerants and ammonia, etc. are included. As a hydrocarbon refrigerant, it is preferable to use those which are a gas at 25° C. under 1 atm. Specifically included are preferably alkanes, cycloalkanes, alkenes having 1 to 5 carbon atoms, preferably 1 to 4 and carbon atoms or mixtures of these. Specifically included are methane, ethylene, ethane, propylene, propane, cyclopropane, butane, isobutane, cyclobutane, methylcyclopropane or mixtures of two or more of these. Of these, propane, butane, isobutane or mixtures of these are preferable.

The refrigerating machine oil of the embodiment of the present invention usually exists in the form of a fluid composition mixed with a refrigerant mentioned above in refrigerators (for example, refrigeration/air conditioning equipments). The composition of the refrigerating machine oil and refrigerant in this fluid composition is not limited in particular, but the refrigerating machine oil is preferably 1 to 500 mass parts, more preferably 2 to 400 mass parts per 100 mass parts of a refrigerant.

The refrigerating machine oil of the embodiment of the present invention sufficiently satisfies all the required performances such as lubricity, refrigerant compatibility, low temperature fluidity and stability in a good balance and it is suitable for refrigerators or heat pumps with a reciprocal or rotary open type, semi-hermetic type or hermetic type compressor. Particular when used in a refrigerator with a lead containing bearing, it is enabled to achieve both of suppression of elution of the lead from the lead containing bearing and heat/chemical stability at a high level. As such freezing apparatuses, an automotive air-conditioner, a dehumidifier, a refrigerator, a freezing cold storage warehouse, a vending machine, a showcase, cooling means in chemical plants and so on, an air-conditioner for houses, a package air-conditioner, a heat pump for hot water supply are specifically included. Furthermore, the refrigerating machine oil of the embodiment of the present invention is usable for any forms of compressors such reciprocal type, rotary type, centrifuging type, etc.

As the constitution of the refrigerant circulation system which can preferably use the refrigerating machine oil of the embodiment of the present invention, a typical example comprises a refrigerant compressor, a condenser, expansion mechanism, a vaporizer, each connected through a flow path in this order and further a dryer in the flow path as needed.

As the refrigerant compressor, exemplified are a high pressure container type compressor comprising a motor consisting of a rotor and stators, a rorating axis put through the rotor, a rorating bearing (lead containing bearing) and a compressor part connected to the motor with the rorating axis contained in a hermetic container which stores a refrigerating machine oil wherein a high pressure refrigerant gas discharged from the compressor part stays within the hermetic container; a low pressure container type compressor comprising a motor consisting of a rotor and stators, a rorating axis put through the rotor, a rorating bearing (lead containing bearing) and a compressor part connected to the motor with the rorating axis contained in a hermetic container which stores a refrigerating machine oil wherein a high pressure refrigerant gas discharged from the compressor part is directly discharged out of the hermetic container; etc.

For the electrically insulative film which is served as an electric insulation system material in the motor part, a crystalline plastic film having a glass transition point not less than 50° C., specifically at least one electrically insulative film selected from polyethylene terephthalate, polybutylene terephthalate, polyphenylene sulfide, polyetheretherketone, polyethylenenaphthalate, polyamide-imide and polyimides or a composite film in which a film having a low glass transition point is covered with a resin layer having a high glass transition point are hard to cause deterioration phenomenon of strength characteristic and electric insulative characteristics, and thus preferably used. In addition, for magnet wires used for the motor part, those having an enamel coating having a glass transition point not less than 120° C., for example, a single layer of polyester, polyesterimide, polyamide and polyamide-imide, etc. or an enamel coating in which a lower layer having a low glass transition point and a upper layer having a high glass transition point are composited are preferably used. For the enamel wires having a composite coating, included are those coated with polyesterimide as a lower layer and polyamide-imide as a upper layer (AI/EI), those coated with polyester as a lower layer and polyamide-imide as a upper layer (AI/PE), etc.

For a desiccating agent to fill the dryer, synthetic zeolite consisting of silicic acid, aluminic acid alkali metal composite salt having a pore diameter not more than 3.3 angstrom and whose carbon dioxide absorption volume at a carbon dioxide partial pressure of 250 mmHg at 25° C. is not more than 1.0% is preferably used. Specifically included are product name XH-9, XH-10, XH-11, XH-600 manufactured by Union Showa Co., Ltd. etc.

Second Embodiment

Compressor Oil Composition

A compressor oil composition according to a second embodiment of the present invention comprises the above-mentioned lubricating oil base oil according to the present invention, an antioxidant, and a mist suppressant.

In the compressor oil composition according to the embodiment, the aspect of the lubricating oil base oil according to the present invention is the same as in the first embodiment, so duplicate description is omitted here.

In the compressor oil composition according to the embodiment, the above-mentioned lubricating oil base oil according to the present invention may be used singly or in combination with one or two or more types of other base oils. Specific examples of the other base oils, and the proportion of the lubricating oil base oil according to the present invention accounted for in a mixed base oil are the same as in the first embodiment, so duplicate description is omitted here.

The compressor oil composition according to the embodiment contains an antioxidant. Such an antioxidant includes amine antioxidants, phenolic antioxidants and organometallic antioxidants such as zinc dithiophosphate. Among these, amine antioxidants and phenolic antioxidants are preferable because when they are formulated in the above-mentioned lubricating oil base oil according to the present invention, the oxidation inhibiting performance at high temperatures can be held over a long period.

The amine antioxidants include phenyl-α-naphthylamine compounds, dialkyldiphenylamine compounds, benzylamine compounds and polyamine compounds. Above all these, phenyl-α-naphthylamine compounds and alkyldiphenylamine compounds are preferable.

The phenyl-α-naphthylamine compound preferably used is a phenyl-α-naphthylamine represented by the following general formula (7):

[Chem. 4]

(7)

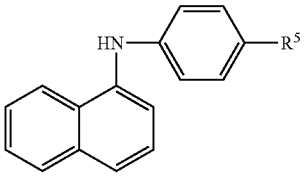

wherein $R^5$ denotes a hydrogen atom or a straight-chain or branched-chain alkyl group having 1 to 16 carbon atoms.

In the case where $R^5$ in the general formula (7) is an alkyl group, the alkyl group is a straight-chain or branched-chain alkyl group having 1 to 16 carbon atoms as described above. Such an alkyl group specifically includes, for example, a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group and a hexadecyl group (these alkyl groups may be of straight-chain or branched-chain.). In the case where $R^5$ has carbon atoms exceeding 16, that the proportion of a functional group accounted for in a molecule is small has a risk of adversely affecting the oxidation inhibiting performance.

In the case where $R^5$ in the general formula (7) is an alkyl group, $R^5$ is preferably a branched-chain alkyl group having 8 to 16 carbon atoms, and more preferably a branched-chain alkyl group having 8 to 16 carbon atoms derived from an olefin oligomer having 3 or 4 carbon atoms, in view of excellent solubility. The olefin having 3 or 4 carbon atoms specifically includes propylene, 1-butene, 2-butene and isobutylene, but is preferably propylene or isobutylene in view of excellent solubility. For providing more excellent solubility, $R^5$ is still more preferably a branched-chain octyl group derived from a dimer of isobutylene, a branched-chain nonyl group derived from a trimer of propylene, a branched-chain dodecyl group derived from a trimer of isobutylene, a branched-chain dodecyl group derived from a tetramer of propylene or a branched-chain pentadecyl group derived from a pentamer of propylene, and particularly preferably a branched-chain octyl group derived from a dimer of isobutylene, a branched-chain dodecyl group derived from a trimer of isobutylene or a branched-chain dodecyl group derived from a tetramer of propylene.

The phenyl-α-naphthyamine represented by the general formula (7) usable may be a commercially available one or a synthetic one. The synthetic one can easily be synthesized by the reaction of a phenyl-α-naphthyamine with a halogenated alkyl compound having 1 to 16 carbon atoms, or the reaction of a phenyl-α-naphthyamine with an olefin having 2 to 16 carbon atoms or an olefin oligomer having 2 to 16 carbon atoms, using a Friedel Craft catalyst. The Friedel Craft catalysts usable are specifically, for example, metal halides such as aluminum chloride, zinc chloride and ferric chloride, and acidic catalysts such as sulfuric acid, phosphoric acid, phosphorus pentaoxide, boron fluoride, acid clay and activated clay, and the like.

The alkyldiphenylamine compound preferably used is a p,p'-dialkyldiphenylamine represented by the following general formula (8):

[Chem. 5]

(8)

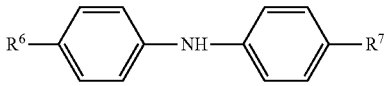

wherein $R^6$ and $R^7$ may be the same or different, and each denote an alkyl group having 1 to 16 carbon atoms.

The alkyl group denoted as $R^6$ and $R^7$ specifically includes a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group and a hexadecyl group (these alkyl groups may be of straight-chain or branched-chain.). Above all these, $R^6$ and $R^7$ are preferably a branched-chain alkyl group having 3 to 16 carbon atoms, and more preferably a branched-chain alkyl group having 3 to 16 carbon atoms derived from an olefin having 3 or 4 carbon atoms or its oligomer, in view that the oxidation inhibiting performance at high temperatures can be held over a long period. The olefin having 3 or 4 carbon atoms specifically includes propylene, 1-butene, 2-butene and isobutylene, but preferably propylene or isobutylene in view that the oxidation inhibiting performance at high temperatures can be held over a long period. For providing further more excellent oxidation inhibiting performance, $R^6$ and $R^7$ are each more preferably a branched-chain isopropyl group derived from propylene, a tert-butyl group derived from isobutylene, a branched-chain hexyl group derived from a dimer of propylene, a branched-chain octyl group derived from a dimer of isobutylene, a branched-chain nonyl group derived from a trimer of propylene, a branched-chain dodecyl group derived from a trimer of isobutylene, a branched-chain dodecyl group derived from a tetramer of propylene or a branched-chain pentadecyl group derived from a pentamer of propylene, and most preferably a tert-butyl group derived from isobutylene, a branched-chain hexyl group derived from a dimer of propylene, a branched-chain octyl group derived from the dimer of isobutylene, a branched-chain nonyl group derived from a trimer of propylene, a branched-chain dodecyl group derived from a trimer of isobutylene or a branched-chain dodecyl group derived from a tetramer of propylene.

In the case of a compound in which one or both of $R^6$ and $R^7$ are hydrogen atoms, the oxidation of the compound itself has a risk of generating sludge. In the case of the number of carbon atoms of the alkyl group exceeding 16, the proportion of a functional group accounted for in a molecule is small, and there is a risk of a decrease in the oxidation inhibiting performance at high temperatures.

The p,p'-dialkyldiphenylamine represented by the general formula (8) usable may be a commercially available one or a synthetic one. The synthetic one can easily be synthesized by the reaction of a diphenyl amine with a halogenated alkyl compound having 1 to 16 carbon atoms, or the reaction of a diphenylamine with an olefin having 2 to 16 carbon atoms or its oligomer, using a Friedel Craft catalyst. The Friedel Craft catalysts to be used are metal halides, acidic catalysts and the like exemplified in the description of the phenyl-α-naphthylamine.

Any of the compounds represented by the general formulas (7), (8) is an aromatic amine. These aromatic amines may be used singly or as a mixture of two or more having different structures, but preferable is a combined use of a phenyl-α-naphthylamine represented by the general formula (7) and a p,p'-dialkyldiphenylamine represented by the general formula (8). In this case, the mixing ratio is optional, but the mass ratio is preferably in the range of 1/10 to 10/1.

The phenolic compounds usable are any alkylphenol compounds used as antioxidants for lubricating oils, and are not especially limited, but the alkylphenol compound preferably includes, for example, at least one alkylphenol compound selected from compounds represented by the following general formula (9), general formula (10) and general formula (11):

[Chem. 6]

(9)

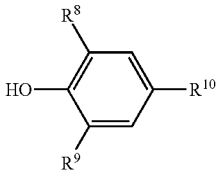

wherein $R^8$ denotes an alkyl group having 1 to 4 carbon atoms; $R^9$ denotes a hydrogen atom or an alkyl group having 1 to 4 carbon atoms; and $R^{10}$ denotes a hydrogen atom, an alkyl group having 1 to 4 carbon atoms or a group represented by the following general formula (i) or (ii):

[Chem. 7]

(i)

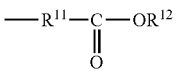

wherein $R^{11}$ denotes an alkylene group having 1 to 6 carbon atoms; and $R^{12}$ denotes an alkyl group or an alkenyl group having 1 to 24 carbon atoms,

[Chem. 8]

(ii)

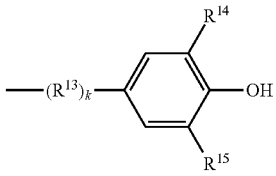

wherein $R^{13}$ denotes an alkylene group having 1 to 6 carbon atoms; $R^{14}$ denotes an alkyl group having 1 to 4 carbon atoms; $R^{15}$ denotes a hydrogen atom or an alkyl group having 1 to 4 carbon atoms; and k denotes 0 or 1,

[Chem. 9]

(10)

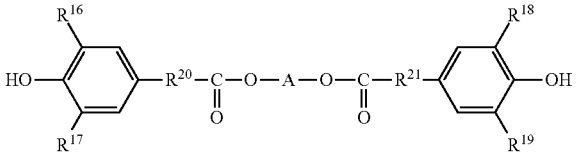

wherein $R^{16}$ and $R^{18}$ may be the same or different, and each denote an alkyl group having 1 to 4 carbon atoms; $R^{17}$ and $R^{19}$ may be the same or different, and each denote a hydrogen atom or an alkyl group having 1 to 4 carbon atoms; $R^{20}$ and $R^{21}$ may be the same or different, and each denote an alkylene group having 1 to 6 carbon atoms; and A denotes an alkylene group having 1 to 18 carbon atoms or a group represented by the general formula (iii):

$$—R^{22}—S—R^{23}— \quad \text{(iii)}$$

wherein $R^{22}$ and $R^{23}$ may be the same or different, and each denote an alkylene group having 1 to 6 carbon atoms,

[Chem. 10]

(11)

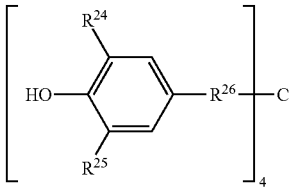

wherein $R^{24}$ denotes an alkyl group having 1 to 4 carbon atoms; $R^{25}$ denotes a hydrogen atom or an alkyl group having 1 to 4 carbon atoms; and $R^{26}$ denotes an alkylene group having 1 to 6 carbon atoms or a group represented by the following general formula (iv):

[Chem. 11]

(iv)

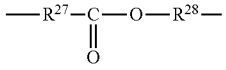

wherein $R^{27}$ and $R^{28}$ may be the same or different, and each denote an alkylene group having 1 to 6 carbon atoms.

In the case where $R^{10}$ in a compound represented by the general formula (9) is a group represented by the general formula (i), more preferably, $R^{11}$ in the general formula (i) is an alkylene group having 1 or 2 carbon atoms, and $R^{12}$ therein is a straight-chain or branched-chain alkyl group having 6 to 12 carbon atoms; and particularly preferably, $R^{11}$ in the general formula (i) is an alkylene group having 1 or 2 carbon atoms, and $R^{12}$ therein is a branched-chain alkyl group having 6 to 12 carbon atoms.

Preferable compounds among compounds represented by the general formula (9) are shown below.

Examples of compounds in the case where $R^{10}$ is an alkyl group having 1 to 4 carbon atoms include 2,6-di-tert-butyl-p-cresol and 2,6-di-tert-butyl-4-ethylphenol.

Examples of the compounds in the case where $R^{10}$ is a group represented by the general formula (i) include (3-methyl-5-tert-butyl-4-hydroxyphenyl)acetic acid n-hexyl ester, (3-methyl-5-tert-butyl-4-hydroxyphenyl)acetic acid isohexyl ester, (3-methyl-5-tert-butyl-4-hydroxyphenyl)acetic acid n-heptyl ester, (3-methyl-5-tert-butyl-4-hydroxyphenyl)acetic acid isoheptyl ester, (3-methyl-5-tert-butyl-4-hydroxyphenyl)acetic acid n-octyl ester, (3-methyl-5-tert-butyl-4-hydroxyphenyl)acetic acid isooctyl ester, (3-methyl-5-tert-butyl-4-hydroxyphenyl)acetic acid 2-ethylhexyl ester, (3-methyl-5-tert-butyl-4-hydroxyphenyl)acetic acid n-nonyl ester, (3-methyl-5-tert-butyl-4-hydroxyphenyl)acetic acid isononyl ester, (3-methyl-5-tert-butyl-4-hydroxyphenyl)acetic acid n-decyl ester, (3-methyl-5-tert-butyl-4-hydroxyphenyl)acetic acid isodecyl ester, (3-methyl-5-tert-butyl-4-hydroxyphenyl)acetic acid n-undecyl ester, (3-methyl-5-tert-butyl-4-hydroxyphenyl)acetic acid isoundecyl ester, (3-methyl-5-tert-butyl-4-hydroxyphenyl)acetic acid n-dodecyl ester, (3-methyl-5-tert-butyl-4-hydroxyphenyl)acetic acid isododecyl ester, (3-methyl-5-tert-butyl-4-hydroxyphenyl)propionic acid n-hexyl ester, (3-methyl-5-tert-butyl-4-hydroxyphenyl)propionic acid isohexyl ester, (3-methyl-5-tert-butyl-4-hydroxyphenyl)propionic acid n-heptyl ester, (3-methyl-5-tert-butyl-4-hydroxyphenyl)propionic acid isoheptyl ester, (3-methyl-5-tert-butyl-4-hydroxyphenyl)propionic acid n-octyl ester, (3-methyl-5-tert-butyl-4-hydroxyphenyl)propionic acid isooctyl ester, (3-methyl-5-tert-butyl-4-hydroxyphenyl)propionic acid 2-ethylhexyl ester, (3-methyl-5-tert-butyl-4-hydroxyphenyl)propionic acid n-nonyl ester, (3-methyl-5-tert-butyl-4-hydroxyphenyl)propionic acid isononyl ester, (3-methyl-5-tert-butyl-4-hydroxyphenyl)propionic acid n-decyl ester, (3-methyl-5-tert-butyl-4-hydroxyphenyl)propionic acid isodecyl ester, (3-methyl-5-tert-butyl-4-hydroxyphenyl)propionic acid n-undecyl ester, (3-methyl-5-tert-butyl-4-hydroxyphenyl)propionic acid isoundecyl ester, (3-methyl-5-tert-butyl-4-hydroxyphenyl)propionic acid n-dodecyl ester, (3-methyl-5-tert-butyl-4-hydroxyphenyl)propionic acid isododecyl ester, (3,5-di-tert-butyl-4-hydroxyphenyl)acetic acid n-hexyl ester, (3,5-di-tert-butyl-4-hydroxyphenyl)acetic acid isohexyl ester, (3,5-di-tert-butyl-4-hydroxyphenyl)acetic acid n-heptyl ester, (3,5-di-tert-butyl-4-hydroxyphenyl)acetic acid isoheptyl ester, (3,5-di-tert-butyl-4-hydroxyphenyl)acetic acid n-octyl ester, (3,5-di-tert-butyl-4-hydroxyphenyl)acetic acid isooctyl ester, (3,5-di-tert-butyl-4-hydroxyphenyl)acetic acid 2-ethylhexyl ester, (3,5-di-tert-butyl-4-hydroxyphenyl)acetic acid n-nonyl ester, (3,5-di-tert-butyl-4-hydroxyphenyl)acetic acid isononyl ester, (3,5-di-tert-butyl-4-hydroxyphenyl)acetic acid n-decyl ester, (3,5-di-tert-butyl-4-hydroxyphenyl)acetic acid isodecyl ester, (3,5-di-tert-butyl-4-hydroxyphenyl)acetic acid n-undecyl ester, (3,5-di-tert-butyl-4-hydroxyphenyl)acetic acid isoundecyl ester, (3,5-di-tert-butyl-4-hydroxyphenyl)acetic acid n-dodecyl ester, (3,5-di-tert-butyl-4-hydroxyphenyl)acetic acid isododecyl ester, (3,5-di-tert-butyl-4-hydroxyphenyl)propionic acid n-hexyl ester, (3,5-di-tert-butyl-4-hydroxyphenyl)propionic acid isohexyl ester, (3,5-di-tert-butyl-4-hydroxyphenyl)propionic acid n-heptyl ester, (3,5-di-tert-butyl-4-hydroxyphenyl)propionic acid isoheptyl ester, (3,5-di-tert-butyl-4-hydroxyphenyl)propionic acid n-octyl ester, (3,5-di-tert-butyl-4-hydroxyphenyl)propionic acid isooctyl ester, (3,5-di-tert-butyl-4-hydroxyphenyl)propionic acid 2-ethylhexyl ester, (3,5-di-tert-butyl-4-hydroxyphenyl)propionic acid n-nonyl ester, (3,5-di-tert-butyl-4-hydroxyphenyl)propionic acid isononyl ester, (3,5-di-tert-butyl-4-hydroxyphenyl)propionic acid n-decyl ester, (3,5-di-tert-butyl-4-hydroxyphenyl)propionic acid isodecyl ester, (3,5-di-tert-butyl-4-hydroxyphenyl)propionic acid n-undecyl ester, (3,5-di-tert-butyl-4-hydroxyphenyl)propionic acid isoundecyl ester, (3,5-di-tert-butyl-4-hydroxyphenyl)propionic acid n-dodecyl ester and (3,5-di-tert-butyl-4-hydroxyphenyl)propionic acid isododecyl ester.

Examples of the compounds in the case where $R^{10}$ is a group represented by the general formula (ii) include bis(3,5-di-tert-butyl-4-hydroxyphenyl), bis(3,5-di-tert-butyl-4-hydroxyphenyl)methane, 1,1-bis(3,5-di-tert-butyl-4-hydroxyphenyl)ethane, 1,2-bis(3,5-di-tert-butyl-4-hydroxyphenyl)ethane, 1,1-bis(3,5-di-tert-butyl-4-hydroxyphenyl)propane, 1,2-bis(3,5-di-tert-butyl-4-hydroxyphenyl)propane, 1,3-bis(3,5-di-tert-butyl-4-hydroxyphenyl)propane, 2,2-bis(3,5-di-tert-butyl-4-hydroxyphenyl)propane, and mixtures of two or more thereof.

Then, the alkylphenols represented by the general formula (10) will be described.

The most preferable compound in the case where A in the general formula (10) is an alkylene group having 1 to 18 carbon atoms is a compound represented by the following formula (10-1):

[Chem. 12]

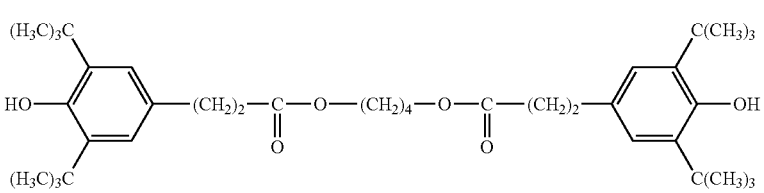

The most preferable compound in the case where A in the general formula (10) is a group represented by the formula (iii) is a compound represented by the following formula (10-2):

[Chem. 13]

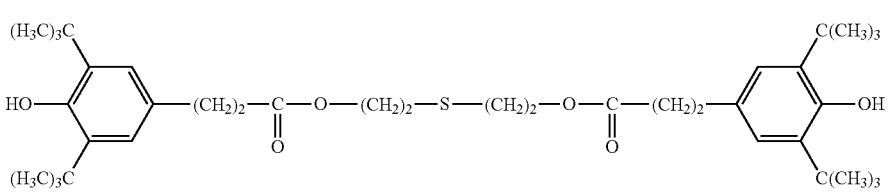

(10-2)

Then, alkylphenols represented by the general formula (11) will be described.

The most preferable alkylphenols represented by the general formula (11) are specifically compounds represented by the formula (11-1) or the formula (11-2) shown below:

[Chem. 14]

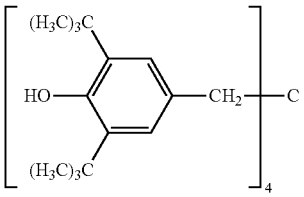

(11-1)

[Chem. 15]

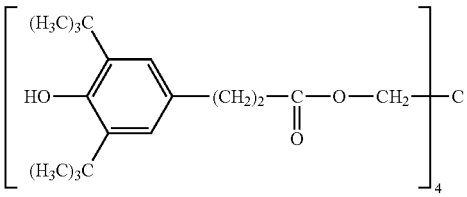

(11-2)

The content of an antioxidant is preferably 0.02 to 5% by mass, and more preferably 0.1 to 3% by mass, based on the total amount of a composition. With the content of less than 0.02% by mass of an antioxidant, the thermal and oxidative stability is likely to be insufficient. By contrast, with that exceeding 5% by mass, an effect of improving the thermal and oxidative stability corresponding to the content cannot be provided and the content is economically disadvantageous, which is not preferable.

The compressor oil composition according to the embodiment contains a mist suppressant. Such mist suppressants preferably used are polymer compounds containing, as constituting monomers, an alkyl acrylate having 1 to 18 carbon atoms, an alkyl methacrylate having 1 to 18 carbon atoms, an olefin having 2 to 20 carbon atoms, styrene, methylstyrene, maleic anhydride and a mixture of two or more thereof. The weight-average molecular weight of such polymer compounds is optional, but preferably 1,000 to 300,000, and more preferably 5,000 to 100,000.

The mist suppressants usable are any compounds used as mist suppressants of lubricating oils, but are preferably, for example, copolymers containing, as a copolymerization component, a nitrogen-containing monomer having an ethylenic unsaturated bond. More specifically, the mist suppressants are preferably copolymers of one or two or more monomers (hereinafter, referred to as "monomer (M-1)") selected from compounds represented by the general formulas (12-1), (12-2) or (12-3) shown below, and one or two or more monomers (hereinafter, referred to as "monomer (M-2)") selected from compounds represented by the general formulas (12-4) or (12-5) shown below:

[Chem. 16]

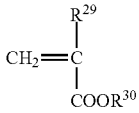

(12-1)

wherein $R^{29}$ denotes a hydrogen atom or a methyl group; and $R^{30}$ denotes an alkyl group having 1 to 18 carbon atoms,

[Chem. 17]

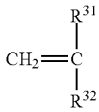

(12-2)

wherein $R^{31}$ denotes a hydrogen atom or a methyl group; and $R^{32}$ denotes a hydrocarbon group having 1 to 12 carbon atoms,

[Chem. 18]

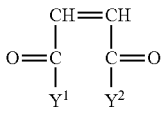

(12-3)

wherein $Y^1$ and $Y^2$ may be the same or different, and each denote a hydrogen atom, an alkoxy group having 1 to 18 carbon atoms or a monoalkylamino group having 1 to 18 carbon atoms,

[Chem. 19]

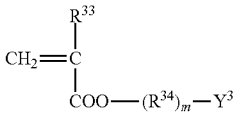

(12-4)

wherein $R^{33}$ denotes a hydrogen atom or a methyl group; $R^{34}$ denotes an alkylene group having 2 to 18 carbon atoms; m denotes 0 or 1; and $Y^3$ denotes an organic group containing a nitrogen atom and having 1 to 30 carbon atoms,

[Chem. 20]

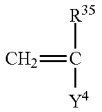

(12-5)

wherein $R^{35}$ denotes a hydrogen atom or a methyl group; and $Y^4$ denotes an organic group containing a nitrogen atom and having 1 to 30 carbon atoms.

The alkyl group having 1 to 18 carbon atoms denoted as $R^{30}$ in the general formula (12-1) specifically includes alkyl groups (these alkyl groups may be of straight-chain or branched-chain), such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group and an octadecyl group.

The hydrocarbon group having 1 to 12 carbon atoms denoted as $R^{32}$ in the general formula (12-2) specifically includes alkyl groups (these alkyl groups may be of straight-chain or branched-chain), such as a methyl group, an ethyl group, a propyl group, a butyl group, a pentyl group, a hexyl group, a heptyl group, an octyl group, a nonyl group, a decyl group, an undecyl group and a dodecyl group; alkenyl groups (these alkenyl groups may be of straight-chain or branched-chain), such as a butenyl group, a pentenyl group, a hexenyl group, a heptenyl group, an octenyl group, a nonenyl group, a decenyl group, an undecenyl group and a dodecenyl group; cycloalkyl groups having 5 to 7 carbon atoms such as a cyclopentyl group, a cyclohexyl group and a cycloheptyl group; alkylcycloalkyl groups having 6 to 11 carbon atoms (the alkyl group may be of straight-chain or branched-chain, and is bonded to an optional position of the cycloalkyl group), such as a methylcyclopentyl group, a dimethylcyclopentyl group, a methylethylcyclopentyl group, a diethylcyclopentyl group, a methylcyclohexyl group, a dimethylcyclohexyl group, a methylethylcyclohexyl group, a diethylcyclohexyl group, a methylcycloheptyl group, a dimethylcycloheptyl group, a methylethylcycloheptyl group and a diethylcycloheptyl group; aryl groups such as a phenyl group and a naphthyl group; alkylaryl groups having 7 to 12 carbon atoms (the alkyl group may be of straight-chain or branched-chain, and is bonded to an optional position of the aryl group), such as a tolyl group, a xylyl group, an ethylphenyl group, a propylphenyl group, a butylphenyl group, a pentylphenyl group and a hexylphenyl group; and arylalkyl groups having 7 to 12 carbon atoms (the alkyl group may be of straight-chain or branched-chain, and the aryl group is bonded to an optional position of the alkyl group), such as a benzyl group, a phenylethyl group, a phenylpropyl group, a phenylbutyl group, a phenylpentyl group and a phenylhexyl group.

The alkoxy group having 1 to 18 carbon atoms denoted as $Y^1$ and $Y^2$ in the general formula (12-3) is a residue (—$OR^{36}$; $R^{36}$ is an alkyl group having 1 to 18 carbon atoms) obtained by removing a hydrogen atom from a hydroxyl group of an alkylalcohol having 1 to 18 carbon atoms. The alkyl group having 1 to 18 carbon atoms denoted as $R^{36}$ includes alkyl groups exemplified in the description about the alkyl groups having 1 to 18 carbon atoms denoted as $R^{30}$ in the general formula (12-1).

The monoalkylamino group having 1 to 18 carbon atoms denoted as $Y^1$ and $Y^2$ in the general formula (12-3) is a residue (—$NHR^{37}$; $R^{37}$ is an alkyl group having 1 to 18 carbon atoms) obtained by removing a hydrogen atom from an amino group of a monoalkylamine having 1 to 18 carbon atoms. An alkyl group having 1 to 18 carbon atoms denoted as $R^{33}$ includes alkyl groups exemplified in the description about the alkyl groups having 1 to 18 carbon atoms denoted as $R^{30}$ in the general formula (12-1).

The alkylene group having 2 to 18 carbon atoms denoted as $R^{34}$ in the general formula (12-4) specifically includes alkylene groups (these alkylene groups may be of straight-chain or branched-chain) such as an ethylene group, a propylene group, a butylene group, a pentylene group, a hexylene group, a heptylene group, an octylene group, a nonylene group, a decylene group, an undecylene group, a dodecylene group, a tridecylene group, a tetradecylene group, a pentadecylene group, a hexadecylene group, a heptadecylene group and an octadecylene group.

$Y^3$ in the general formula (12-4) and $Y^4$ in the general formula (12-5) are each an organic group having 1 to 30 carbon atoms containing a nitrogen atom. The number of nitrogen atoms the organic groups denoted as $Y^3$ and $Y^4$ have is not especially limited, but is preferably 1. The number of carbon atoms the organic groups denoted as $Y^3$ and $Y^4$ have is 1 to 30 as described above, preferably 1 to 20, and more preferably 1 to 16.

The organic groups denoted as $Y^3$ and $Y^4$ are each preferably a group containing further an oxygen atom, and preferably a group having a ring. Particularly, the organic groups denoted as $Y^3$ and $Y^4$ preferably have a ring containing an oxygen atom in view of sludge resistance. In the case where the organic groups denoted as $Y^3$ and $Y^4$ is a group having a ring, the ring may be either of an aliphatic ring and an aromatic ring, but is preferably an aliphatic ring. Further, the ring the organic groups denoted as $Y^3$ and $Y^4$ has is preferably a six-membered ring in view of sludge resistance.

Organic groups denoted as $Y^3$ and $Y^4$ specifically include a dimethylamino group, a diethylamino group, a dipropylamino group, a dibutylamino group, an anilino group, a toluidino group, a xylidino group, an acetylamino group, a benzoylamino group, a morpholino group, a pyrrolyl group, a pyrrolino group, a pyridyl group, a methylpyridyl group, a pyrrolidinyl group, a piperidinyl group, a quinonyl group, a pyrrolidonyl group, a pyrrolidono group, an imidazolino group and a pyrazino group. Above all these, a morpholino group is most preferable.

Preferable examples of compounds represented by the general formulas (12-1) to (12-3) include alkyl acrylates having 1 to 18 carbon atoms, alkyl methacrylates having 1 to 18 carbon atoms, olefins having 2 to 20 carbon atoms, styrene, methylstyrene, maleic anhydride esters, maleic anhydride amides, and mixtures thereof.

Preferable examples of compounds represented by the general formulas (12-4) and (12-5) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

Among the compounds represented by the general formulas (12-1) to (12-3) shown above, a compound represented by the general formula (12-1) is preferable as the monomer (M-1) in view of the viscosity-temperature property. On the other hand, as the monomer (M-2), a compound represented by the general formula (12-4) is preferable among the compounds represented by the general formulas (12-4) and (12-5) in view of sludge resistance.

On copolymerization of the monomer (M-1) and the monomer (M-2), the polymerization ratio (molar ratio) of the monomer (M-1) and the monomer (M-2) is optional, but is preferably in the range of 80:20 to 95:5. The method of the copolymerization reaction is also optional, but a copolymer desired can easily and surely be obtained usually by subjecting a monomer (M-1) and a monomer (M-2) to a radical solution polymerization in the presence of a polymerization initiator such as benzoyl peroxide. The weight-average molecular weight of the obtained copolymer is also optional, but is preferably 1,000 to 300,000, and more preferably 5,000 to 100,000.

The content of a mist suppressant in the compressor oil composition according to the embodiment is preferably 5% by mass or less, more preferably 1% by mass or less, and still more preferably 0.5% by mass or less, based on the total amount of a composition. Even with the content of the mist suppressant exceeding the upper limit described above, a further improvement in mist suppressability corresponding to the content is not found, and a decrease in viscosity by shearing is also caused, which is not preferable. The content of the mist suppressant is preferably 0.01% by mass or more, more preferably 0.03% by mass or more, and still more preferably 0.05% by mass or more, based on the total amount of the composition. With the content of the mist suppressant of less than the lower limit described above, an effect of improving mist suppressability by the addition is likely to be insufficient.

The compressor oil composition according to the embodiment may contain the above-mentioned lubricating oil base oil, antioxidant and mist suppressant, but may contain further various types of additives shown below for further improving its characteristics.

The compressor oil composition according to the embodiment may further contain a phosphorus-based extreme pressure agent and/or a phosphorothionate for further improving abrasion resistance and load carrying capability. Specific examples of phosphorus-based extreme pressure agents and phosphorothionates are the same as in the first embodiment described before, so duplicate description is omitted here. In the compressor oil composition according to the present embodiment, the phosphorus-based extreme pressure agent is preferably an orthophosphate or a phosphite, and most preferably an orthophosphate, in view that they excel in various properties such as extreme pressure performance, and has little adverse effect on stability.

In the case of using a phosphorus-based extreme pressure agent and/or a phosphorothionate, the total of the contents in terms of phosphorus element is preferably 0.005 to 0.5% by mass, and more preferably 0.02 to 0.2% by mass, based on the total amount of the composition. With the total content in the range described above, both of oxidative stability and extreme pressure performance can be achieved in high levels and well-balancedly.

The compressor oil composition according to the embodiment may contain one or two or more of well-known lubricating oil additives other than the above, for example, a rust preventive, an anticorrosive, a pour point depressant and a defoaming agent, for further improving various performances of the compressor oil composition.

The rust preventives include, for example, aliphatic amines, organosulfonic acid metal salts, organophosphoric acid metal salts, alkenyl succinates and polyhydric alcohol esters.

The anticorrosives include, for example, benzotriazol compounds, thiadiazole compounds and imidazole compounds.

The defoaming agents include, for example, silicones such as dimethyl silicone.

The contents of these additives can optionally be selected, but with respect to the content of each additive based on the total amount of a composition, preferably, the pour point depressant is 0.01 to 5.0% by mass; the rust preventive and the anticorrosive are each 0.01 to 3.0% by mass; and the defoaming agent is 0.00001 to 0.5% by mass.

The compressor oil composition having the above-mentioned constitution according to the embodiment can achieve both of an improvement in thermal and oxidative stability and a decrease in sludge in high levels and well-balancedly, and is very useful particularly as a compressor oil composition for high-temperature applications. With respect to high-temperature applications mentioned herein, the using temperature is not especially limited, but in the case where the oil temperature in a tank during circulating use is continuously 60° C. or higher, the compressor oil composition according to the embodiment effectively exhibits the effect described above. In the case of the temperature of 80° C. or higher, and further 100° C. or higher, that exhibits a more excellent effect. Such high-temperature applications include rotary gas compressors and gas turbines for electricity generation, but applications of the compressor oil composition according to the embodiment are not limited thereto.

Third Embodiment

Hydraulic Oil Composition

A hydraulic oil composition according to a third embodiment of the present invention comprises the above-mentioned lubricating oil base oil according to the present invention, and a compound containing phosphorus and/or sulfur as a constituent element(s).

In the hydraulic oil composition according to the embodiment, the aspect of the lubricating oil base oil according to the present invention is the same as in the first embodiment, so duplicate description is omitted here.

In the hydraulic oil composition according to the present embodiment, the above-mentioned lubricating oil base oil according to the present invention may be used singly or in combination with one or two or more types of other base oils. Specific examples of the other base oils, and the proportion of the lubricating oil base oil according to the present invention accounted for in a mixed base oil are the same as in the first embodiment, so duplicate description is omitted here.

The hydraulic oil composition according to the present embodiment contains a compound containing phosphorus and/or sulfur as a constituent element(s).

In the hydraulic oil composition according to the embodiment, specific examples and preferable aspect of phosphorus compounds according to the present invention are the same in the first embodiment, so duplicate description is omitted here.

In the case of using phosphates and phosphites in the present embodiment, the content is preferably 10% by mass or less, more preferably 5% by mass or less, and still more preferably 3% by mass, based on the total amount of a composition. Even with the content exceeding 5% by mass, a further improvement in abrasion resistance and friction characteristics corresponding to the content is not found, and oxidative stability decreases, which is not preferable. By contrast, the content of phosphates and phosphites are preferably 0.01% by mass or more, more preferably 0.05% by mass or more, and still more preferably 0.1% by mass, based on the total amount of the composition. With the content of phosphates and phosphites of less than 0.01% by mass, an effect of improving abrasion resistance and friction characteristics by the addition is likely to be insufficient.

The structure of the phosphorus-containing carboxylic acid compound is not especially limited as long as the compound contains both of a carboxyl group and a phosphorus atom in the same one molecule. However, a phosphorylated carboxylic acid is preferable in view of abrasion resistance and thermal and oxidative stability.

The phosphorylated carboxylic acid includes, for example, a compound represented by the following general formula (13):

[Chem. 21]

(13)

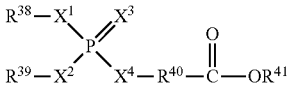

wherein $R^{38}$ and $R^{39}$ may be the same or different, and each denote a hydrogen atom or a hydrocarbon group having 1 to 30 carbon atoms; $R^{40}$ denotes an alkylene group having 1 to 20 carbon atoms; $R^{41}$ denotes a hydrogen atom or a hydrocarbon group having 1 to 30 carbon atoms; $X^1$, $X^2$, $X^3$ and $X^4$ may be the same or different, and each denote an oxygen atom or a sulfur atom.

In the general formula (13), $R^{38}$ and $R^{39}$ each denote a hydrogen atom or a hydrocarbon group having 1 to 30 carbon atoms. The hydrocarbon groups having 1 to 30 carbon atoms include an alkyl group, an alkenyl group, a cycloalkyl group, a bicycloalkyl group, a tricycloalkyl group, an alkylcycloalkyl group, an alkylbicycloalkyl group, an alkyltricycloalkyl group, a cycloalkylalkyl group, a bicycloalkylalkyl group, a tricycloalkylalkyl group, an aryl group, an alkylaryl group and an arylalkyl group. $R^{38}$ and $R^{39}$ may be bonded to form a divalent group represented by the general formula (14) shown below. The two bonds of the divalent group bond with $X^1$ and $X^2$, respectively.

[Chem. 22]

(14)

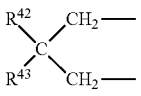

In the formula, $R^{42}$ and $R^{43}$ may be the same or different, and each denote a hydrogen atom or an alkyl group having 1 to 4 carbon atoms; and both of $R^{42}$ and $R^{43}$ are preferably methyl groups.

Among the above-mentioned groups, $R^{38}$ and $R^{39}$ are each preferably an alkyl group, a cycloalkyl group, a cycloalkylalkyl group, a tricycloalkylalkyl group, an aryl group, an alkylaryl group, or a divalent group represented by the general formula (14) shown above in which $R^{38}$ and $R^{39}$ are bonded; and $R^{38}$ and $R^{39}$ are each more preferably an alkyl group.

The alkyl group as $R^{38}$ and $R^{39}$ may be of straight-chain or branched-chain. The alkyl group preferably has 1 to 18 carbon atoms. Such alkyl groups specifically include a methyl group, an ethyl group, a propyl group, an isopropyl group, an n-butyl group, an isobutyl group, a tert-butyl group, a pentyl group, an isopentyl group, a hexyl group, a heptyl group, a 3-heptyl group, an octyl group, a 2-ethylhexyl group, a nonyl group, a decyl group, an undecyl group, a dodecyl group, a tridecyl group, a tetradecyl group, a pentadecyl group, a hexadecyl group, a heptadecyl group, an octadecyl group, a 2-ethylbutyl group, a 1-methylphenyl group, a 1,3-dimethylbutyl group, a 1,1,3,3-tetramethylbutyl group, a 1-methylhexyl group, an isoheptyl group, a 1-methylheptyl group, a 1,1,3-trimethylhexyl group and a 1-methylundecyl group. Above all these, an alkyl group having 3 to 18 carbon atoms is preferable, and an alkyl group having 3 to 8 carbon atoms is more preferable.

The cycloalkyl group as $R^{38}$ and $R^{39}$ includes, for example, a cyclopentyl group, a cyclohexyl group, a cycloheptyl group, a cyclooctyl group and a cyclododecyl group. Above all these, a cycloalkyl group having 5 or 6 carbon atoms (a cyclopentyl group and a cyclohexyl group) is preferable, and particularly, a cyclohexyl group is preferable.

The cycloalkylalkyl group as $R^{38}$ and $R^{39}$ is preferably a cycloalkylmethyl group, more preferably a cycloalkylmethyl group having 6 or 7 carbon atoms, and most preferably a cyclopentylmethyl group and a cyclohexylmethyl group.

The bicycloalkylalkyl group as $R^{38}$ and $R^{39}$ is preferably a bicycloalkylmethyl group, more preferably a bicycloalkylmethyl group having 9 to 11 carbon atoms, and most preferably a decalinylmethyl group.

The tricycloalkylalkyl group as $R^{38}$ and $R^{39}$ is preferably a tricycloalkylmethyl group, more preferably a tricycloalkylmethyl group having 9 to 15 carbon atoms, and most preferably a group represented by the following formula (15) or (16):

[Chem. 23]

(15)

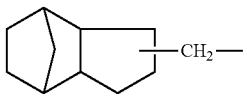

[Chem. 24]

(16)

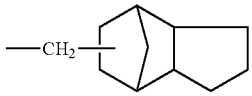

The aryl group and the alkylaryl group as $R^{38}$ and $R^{39}$ include a phenyl group, a tolyl group, a xylyl group, an ethylphenyl group, a vinylphenyl group, a methylphenyl group, a dimethylphenyl group, a trimethylphenyl group, an ethylphenyl group, an isopropylphenyl group, a tert-butylphenyl group, a di-tert-butylphenyl group, 2,6-di-tert-butyl-4-methylphenyl group. Above all these, an aryl group and an alkylaryl group having 6 to 15 carbon atoms are preferable.

$R^{40}$ denotes an alkylene group having 1 to 20 carbon atoms. The number of carbon atoms of such an alkylene group is preferably 1 to 10, more preferably 2 to 6, and still more preferably 3 or 4. Further, such an alkylene group represented by the general formula (17) shown below is preferable.

[Chem. 25]

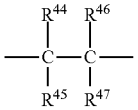

(17)

In the general formula (17), $R^{44}$, $R^{45}$, $R^{46}$ and $R^{47}$ may be the same or different, and each denote a hydrogen atom or a hydrocarbon group having 1 to 4 carbon atoms, and the total number of carbon atoms of $R^{44}$, $R^{45}$, $R^{46}$ and $R^{47}$ is 6 or less; preferably, $R^{44}$, $R^{45}$, $R^{46}$ and $R^{47}$ may be the same or different, and each denote a hydrogen atom or a hydrocarbon group having 1 to 3 carbon atoms, and the total number of carbon atoms of $R^{44}$, $R^{45}$, $R^{46}$ and $R^{47}$ is 5 or less; and more preferably, $R^{44}$, $R^{45}$, $R^{46}$ and $R^{47}$ may be the same or different, and each denote a hydrogen atom or a hydrocarbon group having 1 or 2 carbon atoms, and the total number of carbon atoms of $R^{44}$, $R^{45}$, $R^{46}$ and $R^{47}$ is 4 or less; especially preferably, $R^{44}$, $R^{45}$, $R^{46}$ and $R^{47}$ may be the same or different, and each denote a hydrogen atom or a hydrocarbon group having 1 or 2 carbon atoms, and the total number of carbon atoms of $R^{44}$, $R^{45}$, $R^{46}$ and $R^{47}$ is 3 or less; and most preferably, one of $R^{46}$ and $R^{47}$ is a methyl group, and the other three groups are hydrogen atoms.

$R^{41}$ in the general formula (13) denotes a hydrogen atom or a hydrocarbon group having 1 to 30 carbon atoms. Such a hydrocarbon group includes the hydrocarbon groups exemplified in the description about $R^{38}$ and $R^{39}$.

$X^1$, $X^2$, $X^3$ and $X^4$ in the general formula (13) may be the same or different, and each denote an oxygen atom or a sulfur atom. In view of extreme pressure performance, one or more of $X^1$, $X^2$, $X^3$ and $X^4$ are preferably sulfur atoms; two or more thereof are more preferably sulfur atoms; and still more preferably, two thereof are sulfur atoms and the other two thereof are oxygen atoms. In this case, which one(s) of $X^1$, $X^2$, $X^3$ and $X^4$ is an oxygen atom is optional, but preferably, $X^1$ and $X^2$ are oxygen atoms and $X^3$ and $X^4$ are sulfur atoms.

Heretofore, each group in the general formula (13) has been described, but β-dithiophosphorylated propionic acids represented by the general formula (18) shown below are preferably used because of its excellent extreme pressure performance.

[Chem. 26]

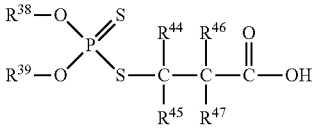

(18)

In the formula, $R^{38}$ and $R^{39}$ are as defined as $R^{38}$ and $R^{39}$ in the formula (13); and $R^{44}$, $R^{45}$, $R^{46}$ and $R^{47}$ are as defined as $R^{44}$, $R^{45}$, $R^{46}$ and $R^{47}$ in the formula (17).

In the case of using a phosphorus-containing carboxylic acid compound described above, the content is not especially limited, but is preferably 0.001 to 5% by mass, more preferably 0.002 to 3% by mass, and still more preferably 0.003 to 1% by mass, based on the total amount of a composition. With the content of the phosphorus-containing carboxylic acid compound of less than the lower limit described above, an effect of improving abrasion resistance and friction characteristics by the addition is likely to be insufficient. By contrast, with that exceeding the upper limit described above, an effect of improving lubricating performance corresponding to the content is not likely to be provided, and there is further a risk of decreases in thermal and oxidative stability and hydrolytic stability, which is not preferable. The content of a compound (including a β-dithiophosphorylated propionic acid represented by the general formula (18)) in which $R^{41}$ is a hydrogen atom out of the phosphorylated carboxylic acids represented by the general formula (13) is preferably 0.001 to 0.1% by mass, more preferably 0.002 to 0.08% by mass, further preferably 0.003 to 0.07, still further preferably 0.004 to 0.06% by mass, and most preferably 0.005 to 0.05% by mass. With the content of less than 0.001, there is a risk of an insufficient effect of improving extreme pressure performance, and by contrast, with that exceeding 0.1% by mass, there is a risk of a decrease in thermal and oxidative stability.

The phosphorothionates are compounds represented by the general formula (4) described in the first embodiment described before, and their specific examples and preferable examples are the same as in the first embodiment, so duplicate description is omitted here.

In the case of using a phosphorothionate, the content is not especially limited, but is preferably 0.001 to 10% by mass, more preferably 0.005 to 5% by mass, and still more preferably 0.01 to 3% by mass, based on the total amount of a composition. Even with the content of a phosphorothionate exceeding the upper limit described above, a further improvement in abrasion resistance and friction characteristics corresponding to the content is not found, and the oxidative stability decreases, which is not preferable. Meanwhile, the content of the phosphorothionate is preferably 0.01% by mass or more, more preferably 0.05% by mass or more, and still more preferably 0.1% by mass or more, based on the total amount of the composition. With the content of the phosphorothionate of less than 0.01% by mass, an effect of improving abrasion resistance and friction characteristics by the addition is likely to be insufficient.

The compounds containing sulfur as a constituent element (hereinafter, referred to as "sulfur compound") specifically include sulfurized oils and fats, sulfurized fatty acids, sulfurized esters, sulfurized olefins, dihydrocarbyl (poly)sulfides, thiadiazole compounds, alkylthiocarbamoyl compounds, thiocarbamate compounds, thioterpene compounds, dialkylthiodipropionate compounds, sulfurized mineral oils, zinc dithiocarbamate compounds and molybdenum dithiocarbamate. These sulfur compounds may be used singly or as a mixture of two or more. Here, although the zinc dithiocarbamate compounds and molybdenum dithiocarbamate compounds are compounds containing both of phosphorus and sulfur as constituent elements, the zinc dithiocarbamate compounds and molybdenum dithiocarbamate compounds are defined as "sulfur compounds" in the embodiment.

The sulfurized oils and fats are ones obtained by reacting sulfur or a sulfur-containing compound with an oil and fat (lard oil, whale oil, vegetable oil, fish oil or the like), and the sulfur content is not especially limited, but is generally suitably 5 to 30% by mass. Specific examples thereof include sulfurized lard, sulfurized rapeseed oil, sulfurized castor oil, sulfurized soybean oil, sulfurized rice bran oil and mixtures thereof.

Examples of the sulfurized aliphatic acids include sulfurized oleic acid; examples of the sulfurized esters include ones obtained by sulfurizing, by an optional method, unsaturated aliphatic acid esters or mixtures thereof obtained by reacting unsaturated aliphatic acids (including oleic acid, linoleic acid and aliphatic acids extracted from the above-mentioned animal and vegetable oils and fats) with various types of alcohols, and specifically include, for example, methyl sulfurized oleate, sulfurized rice bran aliphatic acid octyl ester and a mixture thereof.

The sulfurized olefins include, for example, compounds represented by the general formula (19) shown below.

The compounds are obtained by reacting an olefin having 2 to 15 carbon atoms or its dimer to tetramer with a sulfurizing agent such as sulfur or sulfur chloride. The olefin is preferably propylene, isobutene, diisobutene and the like.

$$R^{48}—S_a—R^{49} \quad (19)$$

In the formula, $R^{48}$ denotes an alkenyl group having 2 to 15 carbon atoms; $R^{49}$ denotes an alkyl group or an alkenyl group having 2 to 15 carbon atoms; and a denotes an integer of 1 to 8.

The dihydrocarbyl (poly)sulfides are compounds represented by the general formula (20) shown below. Here, in the case where $R^{50}$ and $R^{51}$ are alkyl groups, the sulfides are referred to as sulfurized alkyls in some cases.

$$R^{50}—S_b—R^{51} \quad (20)$$

In the formula, $R^{50}$ and $R^{51}$ may be the same or different, and each denote a straight-chain alkyl group having 1 to 20 carbon atoms, a branched-chain or cyclic alkyl group, an aryl group having 6 to 20 carbon atoms, an alkylaryl group having 7 to 20 carbon atoms, or an arylalkyl group having 7 to 20 carbon atoms; and b denotes an integer of 1 to 8.

$R^{50}$ and $R^{51}$ in the general formula (20) shown above specifically include straight-chain or branched-chain alkyl groups such as an n-propyl group, an isopropyl group, an n-butyl group, an isobutyl group, a sec-butyl group, a tert-butyl group, a straight-chain or branched-chain pentyl group, a straight-chain or branched-chain hexyl group, a straight-chain or branched-chain heptyl group, a straight-chain or branched-chain octyl group, a straight-chain or branched-chain nonyl group, a straight-chain or branched-chain decyl group, a straight-chain or branched-chain undecyl group, a straight-chain or branched-chain dodecyl group, a straight-chain or branched-chain tridecyl group, a straight-chain or branched-chain tetradecyl group, a straight-chain or branched-chain pentadecyl group, a straight-chain or branched-chain hexadecyl group, a straight-chain or branched-chain heptadecyl group, a straight-chain or branched-chain octadecyl group, a straight-chain or branched-chain nonadecyl group and a straight-chain or branched-chain icosyl group; aryl groups such as a phenyl group and a naphthyl group; alkylaryl groups such as a tolyl group, an ethylphenyl group, a straight-chain or branched-chain propylphenyl group, a straight-chain or branched-chain buthylphenyl group, a straight-chain or branched-chain pentylphenyl group, a straight-chain or branched-chain hexylphenyl group, a straight-chain or branched-chain heptylphenyl group, a straight-chain or branched-chain octylphenyl group, a straight-chain or branched-chain nonylphenyl group, a straight-chain or branched-chain decylphenyl group, a straight-chain or branched-chain undecylphenyl group, a straight-chain or branched-chain dodecylphenyl group, a xylyl group, an ethylmethylphenyl group, a diethylphenyl group, a di-(straight-chain or branched-chain)-propylphenyl group, a di-(straight-chain or branched-chain)-buthylphenyl group, a methylnaphthyl group, an ethylnaphthyl group, a straight-chain or branched-chain propylnaphthyl group, a straight-chain or branched-chain butylnaphthyl group, a dimethylnaphthyl group, an ethylmethylnaphthyl group, a diethylnaphthyl group, a di-(straight-chain or branched-chain)-propylnaphthyl group and a di-(straight-chain or branched-chain)-butylnaphthyl group; and arylalkyl groups such as a benzyl group, a phenylethyl group and a phenylpropyl group. Above all these, $R^{50}$ and $R^{51}$ in the general formula (20) are preferably alkyl groups having 3 to 18 carbon atoms derived from propylene, 1-butene or isobutylene, or aryl groups, alkylaryl groups or arylalkyl groups having 6 to 8 carbon atoms, and these groups include, for example, alkyl groups such as an isopropyl group, a branched-chain hexyl group derived from a propylene dimer, a branched-chain nonyl group derived from a propylene trimer, a branched-chain dodecyl group derived from a propylene tetramer, a branched-chain pentadecyl group derived from a propylene pentamer, a branched-chain octadecyl group derived from a propylene hexamer, a sec-butyl group, a tert-butyl group, a branched-chain octyl group derived from 1-butene dimer, a branched-chain octyl group derived from an isobutylene dimer, a branched-chain dodecyl group derived from 1-butene trimer, a branched-chain dodecyl group derived from an isobutylene trimer, a branched-chain hexadecyl group derived from a 1-butene tetramer and a branched-chain hexadecyl group derived from an isobutylene tetramer; alkylaryl groups such as a phenyl group, a tolyl group, an ethylphenyl group and a xylyl group; and arylalkyl groups such as a benzyl group and a phenylethyl group. Here, each of these groups includes all types of structural isomers.

Further, $R^{50}$ and $R^{51}$ in the general formula (20) shown above are each more preferably branched-chain alkyl groups having 3 to 18 carbon atoms derived from ethylene or propylene, and most preferably branched-chain alkyl groups having 6 to 15 carbon atoms derived from ethylene or propylene, in view of improvement in abrasion resistance and friction characteristics.

The dihydrocarbyl (poly)sulfides represented by the general formula (20) preferably include, for example, dibenzyl polysulfides, various dinonyl polysulfides, various didodecyl polysulfides, various dibutyl polysulfides, various dioctyl polysulfides, diphenyl polysulfides, dicyclohexyl polysulfides and mixtures thereof.

The thiadiazole compounds include, for example, 1,3,4-thiadiazole compounds represented by the general formula (21) shown below, 1,2,4-thiadiazole compounds represented by the general formula (22) shown below and 1,4,5-thiadiazole compounds represented by the general formula (23) shown below:

[Chem. 27]

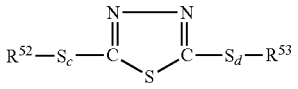

(21)

[Chem. 28]

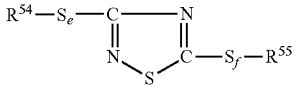

(22)

[Chem. 29]

-continued (23)

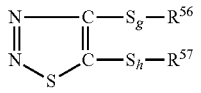

wherein $R^{52}$, $R^{53}$, $R^{54}$, $R^{55}$, $R^{56}$ and $R^{57}$ may be the same or different, and each denote a hydrogen atom or a hydrocarbon group having 1 to 20 carbon atoms; and c, d, e, f, g and h may be the same or different, and each denote an integer of 0 to 8.

Such thiadiazole compounds preferably specifically include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,5-bis(n-octyldithio)-1,2,4-thiadiazole, 3,5-bis(n-nonyldithio)1,2,4-thiadiazole, 3,5-bis(1,1,3,3-tetramethylbutyldithio)-1,2,4-thiadiazole, 4,5-bis(n-hexyldithio)-1,2,3-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazole and mixtures thereof.

The alkylthiocarbamoyl compounds include, for example, compounds represented by the following general formula (24):

[Chem. 30]

(24)

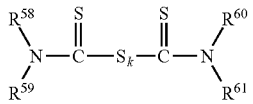

wherein $R^{58}$ and $R^{61}$ may be the same or different, and each denote an alkyl group having 1 to 20 carbon atoms; and k denotes an integer of 1 to 8.

Such alkylthiocarbamoyl compounds preferably specifically include bis(dimethylthiocarbamoyl)monosulfide, bis(dibutylthiocarbamoyl)monosulfide, bis(dimethylthiocarbamoyl) disulfide, bis(dibutylthiocarbamoyl)disulfide, bis(diamylthiocarbamoyl)disulfide, bis(dioctylthiocarbamoyl) disulfide and mixtures thereof.

The alkylthiocarbamate compounds include, for example, compounds represented by the following general formula (25):

[Chem. 31]

(25)

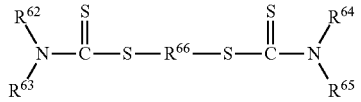

wherein $R^{62}$ to $R^{65}$ may be the same or different, and each denote an alkyl group having 1 to 20 carbon atoms; and $R^{66}$ denotes an alkyl group having 1 to 10 carbon atoms.

Such alkylthiocarbamate compounds preferably specifically include methylene bis(dibutyldithiocarbamate) and methylene bis[di(2-ethylhexyl)dithiocarbamate].

The thioterpene compounds include, for example, a reaction product of phosphorus pentasulfide and pinene; and the dialkyl thiodipropionate compounds include, for example, dilauryl thiodipropionate, distearyl thiodipropionate and a mixture thereof.

The sulfurized mineral oils are ones in which an elemental sulfur is dissolved in a mineral oil. Here, mineral oils used for sulfurized mineral oils according to the present invention are not especially limited, but specifically include paraffinic mineral oils and naphthenic mineral oils obtained by refining lubricating oil fractions, obtained by subjecting crude oils to atmospheric distillation and vacuum distillation, by a suitable combination of refining processes such as solvent deasphalting, solvent extraction, hydrogenation decomposition, solvent dewaxing, catalytic dewaxing, hydrogenation refining, sulfuric acid scrubbing and clay treatment. The elemental sulfur usable may be one having any form such as a lump form, a powdery form or a molten liquid form, but use of an elemental sulfur having a powdery form or a molten liquid form is preferable because it is effectively dissolved in a base oil. Since use of an elemental sulfur having a molten liquid form needs mixing of liquids, the use has an advantage that dissolving work can be carried out in a very short time; however, the elemental sulfur needs to be handled at a melting point or higher of the elemental sulfur, which necessitates a special apparatus such as a heating facility, and necessitates handling not necessarily easy involving a danger and the like because of obliged handling under a high-temperature atmosphere. By contrast, an elemental sulfur having a powdery form is inexpensive and is easily handled, and only necessitates a sufficiently short time needed for dissolving, which is particularly preferable. The sulfur content of the sulfurized mineral oils according to the present invention is not especially limited, but is preferably usually 0.05 to 1.0% by mass, and more preferably 0.1 to 0.5% by mass, based on the total amount of a sulfurized mineral oil.

The zinc dithiophosphate compounds, zinc dithiocarbamate compounds, molybdenum dithiophosphate compounds and molybdenum dithiocarbamate compounds respectively means compounds represented by the following general formulas (26) to (29):

[Chem. 32]

(26)

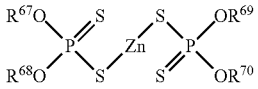

[Chem. 33]

(27)

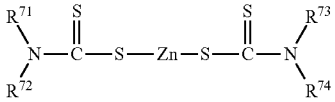

[Chem. 34]

(28)

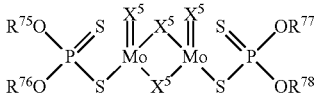

[Chem. 35]

(29)

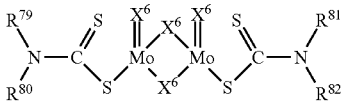

wherein $R^{67}$ to $R^{82}$ may be the same or different, and each denote a hydrocarbon group having one or more carbon atoms; and $X^5$ and $X^6$ each denote an oxygen atom or a sulfur atom.

Specific examples of hydrocarbon groups denoted as $R^{67}$ to $R^{82}$ include alkyl groups such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a henicosyl group, a docosyl group, a tricosyl group and a tetracosyl group; cycloalkyl groups such as a cyclopentyl group, a cyclohexyl group and a cycloheptyl group; alkylcycloalkyl groups such as a methylcyclopentyl group, an ethylcyclopentyl group, a dimethylcyclopentyl group, a propylcyclopentyl group, a methylethylcyclopentyl group, a trimethylcyclopentyl group, a butylcyclopentyl group, a methylpropylcyclopentyl group, a diethylcyclopentyl group, a dimethylethylcyclopentyl group, a methylcyclohexyl group, an ethylcyclohexyl group, a dimethylcyclohexyl group, a propylcyclohexyl group, a methylethylcyclohexyl group, a trimethylcyclohexyl group, a butylcyclohexyl group, a methylpropylcyclohexyl group, a diethylcyclohexyl group, a dimethylethylcyclohexyl group, a methylcycloheptyl group, an ethylcycloheptyl group, a dimethylcycloheptyl group, a propylcycloheptyl group, a methylethylcycloheptyl group, a trimethylcycloheptyl group, a butylcycloheptyl group, a methylpropylcycloheptyl group, a diethylcycloheptyl group and a dimethylethylcycloheptyl group; aryl groups such as a phenyl group and a naphthyl group; alkylaryl groups such as a tolyl group, a xylyl group, an ethylphenyl group, a propylphenyl group, a methylethylphenyl group, a trimethylphenyl group, a butylphenyl group, a methylpropylphenyl group, a diethylphenyl group, a dimethylethylphenyl group, a pentylphenyl group, a hexylphenyl group, a heptylphenyl group, an octylphenyl group, a nonylphenyl group, a decylphenyl group, an undecylphenyl group, a dodecylphenyl group, a tridecylphenyl group, a tetradecylphenyl group, a pentadecylphenyl group, a hexadecylphenyl group, a heptadecylphenyl group and an octadecylphenyl group; and arylalkyl groups such as a benzyl group, a phenethyl group, a phenylpropyl group and a phenylbutyl group. These groups each include all of branched-chain isomers and substituted isomers.

In the case of using an above-mentioned sulfur compound, the content is preferably 0.01% by mass or more, more preferably 0.05% by mass or more, and still more preferably 0.1% by mass or more, based on the total amount of a composition. With the content of a sulfur compound of less than the lower limit described above, an effect of improving abrasion resistance and friction characteristics by the addition is likely to be insufficient. By contrast, the content of the sulfur compound is preferably 10% by mass or less, more preferably 5% by mass or less, and still more preferably 3% by mass or less, based on the total amount of the composition, because the formulation of more than those contents provides no effect corresponding to the addition amounts.

The hydraulic oil composition according to the embodiment may contain the lubricating oil base oil according to the present invention and a compound containing phosphorus and/or sulfur as a constituting element(s), but may further contain additives shown hereinafter for further improving the characteristics.

The hydraulic oil composition according to the embodiment preferably contains further a dispersion-type viscosity index improver in view of sludge suppressability.

The dispersion-type viscosity index improvers usable are any compounds used as dispersion-type viscosity index improvers of lubricating oils, but preferable are, for example, copolymers containing a nitrogen-containing monomer containing an ethylenic unsaturated bond as a copolymerization component. More specifically, preferable are copolymers of one or two or more monomers (monomer (M-1)) selected from the compounds represented by the general formulas (12-1), (12-2) and (12-3) and one or two or more monomers (monomer (M-2)) selected from the compounds represented by the general formulas (12-4) and (12-5).

In the embodiment, on copolymerization of the monomer (M-1) and the monomer (M-2), the polymerization ratio (molar ratio) of the monomer (M-1) and the monomer (M-2) is optional, but is preferably in the range of 80:20 to 95:5. The method of the copolymerization reaction is also optional, but a copolymer desired can easily and surely be obtained usually by subjecting a monomer (M-1) and a monomer (M-2) to a radical solution polymerization in the presence of a polymerization initiator such as benzoyl peroxide. The number-average molecular weight of the obtained copolymer is also optional, but is preferably 1,000 to 1,500,000, and more preferably 10,000 to 200,000.

The content of a dispersion-type viscosity index improver in the hydraulic oil composition according to the embodiment is preferably 10% by mass or less, more preferably 5% by mass or less, and still more preferably 2% by mass or less, based on the total amount of a composition. Even with the content of a dispersion-type viscosity index improver exceeding 10% by mass, a further improvement in sludge suppressability corresponding to the content is not found, and a decrease in viscosity by shearing is caused, which is not preferable. By contrast, the content of the dispersion-type viscosity index improver is preferably 0.01% by mass or more, more preferably 0.05% by mass or more, and still more preferably 0.1% by mass or more, based on the total amount of the composition. With the content of the dispersion-type viscosity index improver of less than 0.01% by mass, an effect of improving sludge suppressability by the addition is likely to be insufficient.

The hydraulic oil composition according to the embodiment preferably contains at least one selected from compounds represented by the general formulas (30) to (32) shown below because friction characteristics can be improved further, $$R^{83}—CO—NR^{84}—(CH_2)_p—COOX^7 \quad (30)$$

wherein $R^{83}$ denotes an alkyl group having 6 to 30 carbon atoms or an alkenyl group having 6 to 30 carbon atoms; $R^{84}$ denotes an alkyl group having 1 to 4 carbon atoms; $X^7$ denotes a hydrogen atom, an alkyl group having 1 to 30 carbon atoms or an alkenyl group having 1 to 30 carbon atoms; and p denotes an integer of 1 to 4, $$[R^{85}—CO—NR^{86}—(CH_2)_q—COO]_rY^5 \quad (31)$$

wherein $R^{85}$ denotes an alkyl group having 6 to 30 carbon atoms or an alkenyl group having 6 to 30 carbon atoms; $R^{86}$ denotes an alkyl group having 1 to 4 carbon atoms; $Y^5$ denotes an alkali metal atom or an alkaline earth metal atom; n denotes an integer of 1 to 4; r denotes 1 when $Y^5$ is an alkali metal atom, and 2 when $Y^5$ is an alkaline earth metal, $$[R^{87}—CO—NR^{88}—(CH_2)_s—COO]_t—Z—(OH)_u \quad (32)$$

wherein $R^{87}$ denotes an alkyl group having 6 to 30 carbon atoms or an alkenyl group having 6 to 30 carbon atoms; $R^{88}$ denotes an alkyl group having 1 to 4 carbon atoms; Z denotes a residue obtained by removing a hydroxyl group from a di- or more polyhydric alcohol; and s denotes an integer of 1 to 4, t denotes an integer of 1 or more, and u denotes an integer of 0 or more.

In the general formulas (30) to (32), $R^{83}$, $R^{85}$ and $R^{87}$ each denotes an alkyl group having 6 to 30 carbon atoms or an alkenyl group having 6 to 30 carbon atoms. The number of carbon atoms of the alkyl groups and the alkenyl groups denoted as $R^{83}$, $R^{85}$ and $R^{87}$ is 6 or more, preferably 7 or more, and more preferably 8 or more, in view of solubility to lubricating oil base oils, and the like. The number of carbon atoms of the alkyl groups and the alkenyl groups denoted as $R^{83}$, $R^{85}$ and $R^{87}$ is 30 or less, preferably 24 or less, and more preferably 20 or less, in view of storing stability and the like. Such alkyl groups and alkenyl groups specifically include, for example, alkyl groups (these alkyl groups may be of straight-chain or branched-chain) such as a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group and an icosyl group; and alkenyl groups (these alkenyl groups may be of straight-chain or branched-chain, and the position of a double bond is optional) such as a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group and an icosenyl group.

In the general formulas (30) to (32), $R^{84}$, $R^{86}$ and $R^{88}$ each denotes an alkyl group having 1 to 4 carbon atoms. The number of $R^{88}$ carbon atoms of the alkyl groups denoted as $R^{84}$, $R^{86}$ and $R^{88}$ is 4 or less, preferably 3 or less, and more preferably 2 or less, in view of storing stability and the like.

In the general formulas (30) to (32), p, q and s each denote an integer of 1 to 4. p, q and s must be an integer of 4 or less, preferably 3 or less, and more preferably 2 or less, in view of storing stability and the like.

In the general formula (30), $X^7$ denotes a hydrogen atom, an alkyl group having 1 to 30 carbon atoms or an alkenyl group having 1 to 30 carbon atoms. The number of carbon atoms of the alkyl groups and alkenyl groups denoted as $X^7$ is 30 or less, preferably 20 or less, and more preferably 10 or less, in view of storing stability and the like. Such alkyl groups and alkenyl groups specifically include, for example, alkyl groups (these alkyl groups may be of straight-chain or branched-chain) such as a methyl group, an ethyl group, a propyl group, a butyl group, a pentyl group, a hexyl group, a heptyl group, an octyl group, a nonyl group and a decyl group; and alkenyl groups (these alkenyl groups may be of straight-chain or branched-chain, and the position of a double bond is optional) such as an ethenyl group, a propenyl group, a butenyl group, a pentenyl group, a hexenyl group, a heptenyl group, a octenyl group, a nonenyl group and a decenyl group. $X^7$ is preferably an alkyl group in view of excellent sludge suppressability. Further, in view of improvement in friction characteristics and improvement in sustainability of the friction characteristics effect, $X^7$ is preferably a hydrogen atom, an alkyl group having 1 to 20 carbon atoms or an alkenyl group having 1 to 20 carbon atoms, more preferably a hydrogen atom or an alkyl group having 1 to 20 carbon atoms, and still more preferably a hydrogen atom or an alkyl group having 1 to 10 carbon atoms.

In the general formula (31), $Y^5$ denotes an alkali metal atom or an alkaline earth metal atom, and specifically includes, for example, sodium, potassium, magnesium and calcium. Above all these, alkaline earth metals are preferable in view of improvement in sustainability of friction characteristics effect. In the general formula (32), r denotes 1 when $Y^5$ is an alkali metal, and 2 when $Y^5$ is an alkaline earth metal.

In the general formula (32), Z denotes a residue obtained by removing a hydroxyl group from a di- or more polyhydric alcohol. Such polyhydric alcohols specifically include, for example, dihydric alcohols such as ethylene glycol, propylene glycol, 1,4-butanediol, 1,2-butanediol, neopentyl glycol, 1,6-hexandiol, 1,2-octanediol, 1,8-octanediol, isoprene glycol, 3-methyl-1,5-pentanediol, sorbite, catechol, resorcinol, hydroquinone, bisphenol A, bisphenol F, hydrogenated bisphenol A, hydrogenated bisphenol F and dimer diols; trihydric alcohols such as glycerol, 2-(hydroxymethyl)-1,3-propanediol, 1,2,3-butanetriol, 1,2,3-pentanetriol, 2-methyl-1,2,3-propanetriol, 2-methyl-2,3,4-butanetriol, 2-ethyl-1,2,3-butanetriol, 2,3,4-pentanetriol, 2,3,4-hexanetriol, 4-propyl-3,4,5-heptanetriol, 2,4-dimethyl-2,3,4-pentanetriol, 1,2,4-butanetriol, 1,2,4-pentanetriol, trimethylolethane and trimethylolpropane; tetrahydric alcohols such as pentaerythritol, erythritol, 1,2,3,4-pentanetetrol, 2,3,4,5-hexanetetrol, 1,2,4,5-pentanetetrol, 1,3,4,5-hexanetetrol, diglycerol and sorbitan; pentahydric alcohols such as adonitol, arabitol, xylitol and triglycerol; hexahydric alcohols such as dipentaerythritol, sorbitol, mannitol, iditol, inositol, dulcitol, talose and allose; and polyglycerins and dehydrated condensates thereof.

In the general formula (32), t is an integer of 1 or more; u is an integer of 0 or more; and t+u is equal to the valence number of Z. That is, all or only a part of hydroxyl groups of a polyhydric alcohol giving a residue Z may be substituted.

Among the compounds selected from the general formulas (30) to (32), preferable is at least one compound selected from the compounds represented by the general formulas (30) and (31) in view of improvement in sustainability of friction characteristics effect, and the like. A suitable example of the compounds represented by the general formula (30) is N-oleoyl sarcosine in which $R^{83}$ is an alkenyl group having 17 carbon atoms; $R^{84}$ is a methyl group; $X^7$ is a hydrogen atom; and p is 1.

The compounds represented by the general formulas (30) to (32) may be used singly or in combination of two or more.

The content of a compound represented by the general formulas (30) to (32) is preferably 5% by mass or less, more preferably 2% by mass or less, and still more preferably 1% by mass or less, based on the total amount of a composition. Even with the content exceeding 5% by mass of the compound represented by the general formulas (30) to (32), a further improvement in friction characteristics corresponding to the content is not found, and the storing stability is likely to decrease. The content of the compound represented by the general formulas (30) to (32) is preferably 0.001% by mass or more, more preferably 0.003% by mass or more, and still more preferably 0.005% by mass or more, on the total amount of the composition. With the content of less than 0.001% by mass of the compound represented by the general formulas (30) to (32), an effect of improving friction characteristics by the addition is likely to be insufficient.

The hydraulic oil composition according to the embodiment preferably contains further a compound represented by the general formula (33) shown below in view of improvement in friction characteristics, $$R^{89}—CH_2COOH \quad (33)$$

wherein $R^{89}$ denotes an alkyl group having 7 to 29 carbon atoms, an alkenyl group having 7 to 29 carbon atoms or a group represented by the following general formula (34):

$$R^{90}—C_6H_4O— \quad (34)$$

wherein $R^{90}$ denotes an alkyl group having 1 to 20 carbon atoms or a hydrogen atom.

In the case where $R^{89}$ in the general formula (33) is an alkyl group, the number of carbon atoms of the alkyl group is 7 or more, and preferably 9 or more, in view of solubility to lubricating oil base oils, and the like. In view of storing stability and the like, the number of carbon atoms of the alkyl group is 29 or less, preferably 22 or less, and more preferably 19 or less. Such alkyl groups specifically include, for example, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group and a nonadecyl group (these alkyl groups may be of straight-chain or branched-chain).

In the case where $R^{90}$ in the general formula (34) is an alkenyl group, the number of carbon atoms of the alkenyl group is 7 or more, and preferably 9 or more, in view of solubility to lubricating oil base oils, and the like. In view of storing stability and the like, the number of carbon atoms of the alkenyl group is 29 or less, preferably 22 or less, and more preferably 19 or less. Such alkenyl groups specifically include, for example, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group and a nonadecenyl group (these alkenyl groups may be of straight-chain or branched-chain).

In the case where $R^{89}$ in the general formula (33) is a group represented by the general formula (34), $R^{90}$ in the general formula (34) is an alkyl group having 1 to 20 carbon atoms or a hydrogen atom. The number of carbon atoms of the alkyl groups denoted as $R^{90}$ is 20 or less, preferably 19 or less, and still more preferably 15 or less, in view of storing stability and the like. The number of carbon atoms of the alkyl groups is 3 or more, and preferably 5 or more, in view of solubility to lubricating oil base oils, and the like. In the case where $R^{90}$ is an alkyl group, the substitution position of the alkyl group on a benzene ring is optional, but is preferably a para-position or a meta-position relative to —$CH_2COOH$ in the general formula (33), and more preferably a para-position, in view of more excellent effect of improving friction characteristics.

In the general formula (33), $R^{89}$ may be any of an alkyl group having 7 to 29 carbon atoms, an alkenyl group having 7 to 29 carbon atoms and a group represented by the general formula (34), but is preferably a group represented by the general formula (34) in view of more excellent friction characteristics.

The content of a compound represented by the general formula (33) is optional, but is preferably 5% by mass or less, more preferably 1% by mass or less, and still more preferably 0.5% by mass or less, based on the total amount of a compound because a much amount of formulation has a risk of decreasing sludge suppressability. By contrast, in view that an effect of improving friction characteristics is fully exhibited, the content of the compound represented by the general formula (33) is preferably 0.001% by mass or more, more preferably 0.003% by mass or more, and still more preferably 0.005% by mass or more, based on the total amount of the compound.

The hydraulic oil composition according to the embodiment preferably contains an epoxy compound in view of sludge suppressability. Specific examples and preferable examples of the epoxy compounds are the same as in the first embodiment, so duplicate description is omitted here.

In the case where the hydraulic oil composition according to the embodiment contains an epoxy compound, the content is not especially limited, but is preferably 0.1 to 5.0% by mass, and more preferably 0.2 to 2.0% by mass, based on the total amount of a compound.

The hydraulic oil composition according to the present embodiment can contain further a phenolic antioxidant, an amine antioxidant or the both in view of a further improvement in oxidative stability. Specific examples and preferable examples of phenolic antioxidants and amine antioxidants are the same as the phenolic antioxidants and the amine antioxidants in the second embodiment, so duplicate description is omitted here.

The content of a phenolic antioxidant in the hydraulic oil composition according to the embodiment is preferably 3% by mass or less, more preferably 2% by mass or less, and still more preferably 1% by mass, based on the total amount of a compound. Even with the content exceeding 3% by mass of the phenolic antioxidant, a further effect of improving thermal and oxidative stability and sludge suppressability corresponding to the content is not found, and the solubility to lubricating oil base oils is likely to be insufficient. The content of the phenolic antioxidant is preferably 0.01% by mass or more, more preferably 0.1% by mass or more, and still more preferably 0.2% by mass or more, based on the total amount of the compound. With the content of less than 0.01% by mass of the phenolic antioxidant, an effect of improving thermal and oxidative stability and sludge suppressability by the addition is likely to be insufficient.

The content of an amine antioxidant in the hydraulic oil composition according to the embodiment is preferably 3% by mass or less, more preferably 2% by mass or less, and still more preferably 1% by mass or less, based on the total amount of a compound. Even with the content exceeding 3% by mass of the amine antioxidant, a further effect of improving thermal and oxidative stability and sludge suppressability corresponding to the content is not found, and the solubility to lubricating oil base oils is likely to be insufficient. By contrast, the lower limit of the content of the amine antioxidant is preferably 0.01% by mass or more, more preferably 0.1% by mass or more, and still more preferably 0.2% by mass or more, based on the total amount of the compound. With the content of less than 0.01% by mass of the amine antioxidant, an effect of improving thermal and oxidative stability and sludge suppressability by the addition is likely to be insufficient.

The hydraulic oil composition according to the embodiment preferably contains an oiliness agent in view of improvement in friction characteristics.

The oiliness agents include ester oiliness agents, alcohol oiliness agents, carboxylic acid oiliness agents, ether oiliness agents, amine oiliness agents and amide oiliness agents.

The ester oiliness agents can be obtained by the reaction of an alcohol and a carboxylic acid. The alcohol may be a monohydric alcohol or a polyhydric alcohol. The carboxylic acid may be a monobasic acid or a polybasic acid.

The monohydric alcohols constituting ester oiliness agents to be used are usually ones having 1 to 24 carbon atoms, preferably ones having 1 to 12 carbon atoms, and more preferably ones having 1 to 8 carbon atoms. Such alcohols may be of straight-chain or branched-chain, and may be saturated ones or unsaturated ones. The alcohols having 1 to 24 carbon atoms specifically include, for example, methanol, ethanol, a straight-chain or branched-chain propanol, a straight-chain or branched-chain butanol, a straight-chain or branched-chain pentanol, a straight-chain or branched-chain hexanol, a straight-chain or branched-chain heptanol, a straight-chain or branched-chain octanol, straight-chain or branched-chain nonanol, a straight-chain or branched-chain decanol, a straight-chain or branched-chain undecanol, a straight-chain or branched-chain dodecanol, a straight-chain or branched-chain tridecanol, a straight-chain or branched-chain tetradecanol, a straight-chain or branched-chain pentadecanol, a straight-chain or branched-chain hexadecanol, a straight-chain or branched-chain heptadecanol, a straight-chain or branched-chain octadecanol, a straight-chain or branched-chain nonadecanol, a straight-chain or branched-chain icosanol, a straight-chain or branched-chain henicosanol, a straight-chain or branched-chain tricosanol, a straight-chain or branched-chain tetracosanol and a mixture thereof.

The polyhydric alcohols constituting ester oiliness agents to be used are usually dihydric to decahydric ones, and preferably dihydric to hexahydric ones. The di- to deca-polyhydric alcohols specifically include, for example, dihydric alcohols such as ethylene glycol, diethylene glycol, polyethylene glycols (a trimer to a pentadecamer of ethylene glycol), propylene glycol, dipropylene glycol, polypropylene glycols (a trimer to a pentadecamer of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol and neopentyl glycol; polyhydric alcohols such as glycerol, polyglycerols (a dimmer to an octamer of glycerol, for example, diglycerol, triglycerol and tetraglycerol), trimethylolalkanes (trimethylolethane, trimethylolpropane, trimethylolbutane, etc.) and dimers to octamers thereof, pentaerythritol and dimers to tetramers thereof, 1,2,4-butanetriol, 1,3,5-pentanetriol, 1,2,6-hexanetriol, 1,2,3,4-butanetetrol, sorbitol, sorbitan, sorbitol glycerol condensates, adonitol, arabitol, xylitol and mannitol; saccharides such as xylose, arabinose, ribose, rhamnose, glucose, fructose, galactose, mannose, sorbose, cellobiose, maltose, isomaltose, trehalose and sucrose; and mixtures thereof.

Among these polyhydric alcohols, preferable are dihydric to hexahydric polyalcohols such as ethylene glycol, diethylene glycol, polyethylene glycols (a trimer to decamer of ethylene glycol), propylene glycol, dipropylene glycol, polypropylene glycols (a trimer to a decamer of propylene glycol), 1,3-propanediol, 2-methyl-1,2-propanediol, 2-methyl-1,3-propanediol, neopentyl glycol, glycerol, diglycerol, triglycerol, trimethylolalkanes (trimethylolethane, trimethylolpropane, trimethylolbutane, etc.) and dimmers to tetramers thereof, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol glycerol condensates, adonitol, arabitol, xylitol, mannitol, and mixtures thereof. Still more preferable are ethylene glycol, propylene glycol, neopentyl glycol, glycerol, trimethylolethane, trimethylolpropane, pentaerythritol, sorbitan and mixtures thereof.

The alcohols constituting the ester oiliness agents may be monohydric ones or polyhydric ones as described above, but are preferably polyhydric alcohols in view of more excellent friction characteristics.

Among acids constituting ester oiliness agents, monobasic acids to be used are usually fatty acids having 2 to 24 carbon atoms; the fatty acids may be straight-chain ones or branched-chain ones, and saturated ones or unsaturated ones. Monobasic acids may be used singly or in combination of two or more.

The polybasic acids include dibasic acids and trimellitic acid, but are preferably dibasic acids. Dibasic acids may be either of chain dibasic acids and cyclic dibasic acids. The chain dibasic acids may be either of straight-chain ones and branched-chain ones, and either of saturated ones and unsaturated ones. The chain dibasic acids are preferably ones having 2 to 16 carbon atoms, and specifically include, for example, ethanedioic acid, propanedioic acid, straight-chain or branched-chain butanedioic acid, straight-chain or branched-chain pentanedioic acid, straight-chain or branched-chain hexanedioic acid, straight-chain or branched-chain heptanedioic acid, straight-chain or branched-chain octanedioic acid, straight-chain or branched-chain nonanedioic acid, straight-chain or branched-chain decanedioic acid, straight-chain or branched-chain undecanedioic acid, straight-chain or branched-chain dodecanedioic acid, straight-chain or branched-chain tridecanedioic acid, straight-chain or branched-chain tetradecanedioic acid, straight-chain or branched-chain heptadecanedioic acid, straight-chain or branched-chain hexadecanedioic acid, straight-chain or branched-chain hexenedioic acid, straight-chain or branched-chain heptenedioic acid, straight-chain or branched-chain octenedioic acid, straight-chain or branched-chain nonenedioic acid, straight-chain or branched-chain decenedioic acid, straight-chain or branched-chain undecenedioic acid, straight-chain or branched-chain dodecenedioic acid, straight-chain or branched-chain tridecenedioic acid, straight-chain or branched-chain tetradecenedioic acid, straight-chain or branched-chain heptadecenedioic acid, straight-chain or branched-chain heptadecenedioic acid and mixtures thereof. The cyclic dibasic acids include 1,2-cyclohexanedicarboxylic acid, 4-cyclohexene-1,2-dicarboxylic acid and aromatic dicarboxylic acids. Above all these, chain dibasic acids are preferable in view of stability.

The acids constituting esteric oiliness agents may be monobasic acids or polybasic acids as described above, but are preferably monobasic acids in view of a more excellent effect of improving friction characteristics.

The combination of an alcohol and an acid in esteric oiliness agents is optional, and is not especially limited, but esters include the following combinations, for example, (i) to (vii):

(i) an ester of a monohydric alcohol and a monobasic acid, (ii) an ester of a polyhydric alcohol and a monobasic acid, (iii) an ester of a monohydric alcohol and a polybasic acid, (iv) an ester of a polyhydric alcohol and a polybasic acid, (v) a mixed ester of a mixture of a monohydric alcohol and a polyhydric alcohol, and a polybasic acid, (vi) a mixed ester of a polyhydric alcohol and a mixture of a monobasic acid and a polybasic acid, and (vii) a mixed ester of a mixture of a monohydric alcohol and a polyhydric alcohol, and a monobasic acid and a polybasic acid.

Each of the esters of (ii) to (vii) shown above may be a complete ester in which all of hydroxyl groups of a polyhydric alcohol or carboxyl groups of a polybasic acid are esterified, or may be a partial ester in which some of the hydroxyl groups or the carboxyl groups remains as hydroxyl groups or carboxyl groups, but is preferably the partial ester in view of an effect of improving friction characteristics.

Among the esters of (i) to (vii) shown above, (ii) an ester of a polyhydric alcohol and a monobasic acid is preferable. This ester exhibits a very high effect of improving friction characteristics.

The number of carbon atoms of a monobasic acid in the ester (ii) shown above is preferably 10 or more, more preferably 12 or more, and still more preferably 14 or more, in view of a further improvement in friction characteristics.

The number of carbon atoms of the monobasic acids is preferably 28 or less, more preferably 26 or less, and still more preferably 24 or less, in view of deposition preventiveness. Such esters include glycerol monooleate and sorbitan monooleate.

The alcohol oiliness agents include the alcohols exemplified in the description of the ester oiliness agents described above. The number of carbon atoms of the alcohol oiliness agents is preferably 6 or more, more preferably 8 or more, and most preferably 10 or more, in view of improvement in friction characteristics. Since too large a number of carbon atoms has a risk of being liable to deposit, the number of carbon atoms is preferably 24 or less, more preferably 20 or less, and most preferably 18 or less.

The carboxylic acid oiliness agents may be monobasic acids or polybasic acids. Such carboxylic acids include, for example, the monobasic acids and the polybasic acids exemplified in the description of the ester oiliness agents. Among these, monobasic acids are preferable in view of improvement in friction characteristics. The number of carbon atoms of the carboxylic acid oiliness agents is 6 or more, more preferably 8 or more, and most preferably 10 or more, in view of improvement in friction characteristics. Since too large a number of carbon atoms of the carboxylic acid oiliness agent has a risk of being liable to deposit, the number of carbon atoms is preferably 24 or less, more preferably 20 or less, and most preferably 18 or less.

The ether oiliness agents include etherified substances of aliphatic tri- to hexa-polyhydric alcohols, and etherified substances of bimolecular or trimolecular condensates of aliphatic tri- to hexa-polyhydric alcohols.

The etherified substances of aliphatic tri- to hexa-polyhydric alcohols are represented, for example, by the following general formulas (35) to (40):

[Chem. 36]

(35)

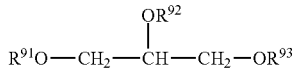

[Chem. 37]

(36)

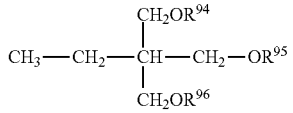

[Chem. 38]

(37)

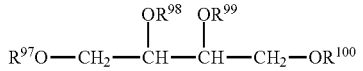

[Chem. 39]

-continued (38)

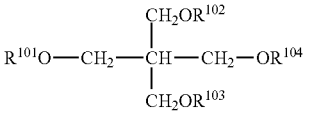

[Chem. 40]

(39)

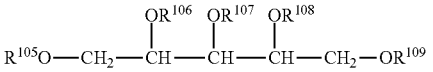

[Chem. 41]

(40)

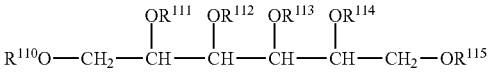

wherein $R^{91}$ to $R^{115}$ may be the same or different, and each denote a hydrogen atom, a straight-chain or branched-chain alkyl group having 1 to 18 carbon atoms, an allyl group, an aralkyl group or a glycol ether residue represented by $—(R^aO)_n—R^b$ ($R^a$ denotes an alkylene group having 2 to 6 carbon atoms; $R^b$ denotes an alkyl group having 1 to 20 carbon atoms, an aryl group or an aralkyl group; and n denotes an integer of 1 to 10).

Specific examples of the aliphatic tri- to hexa-polyhydric alcohols include glycerol, trimethylolpropane, erythritol, pentaerythritol, arabitol, sorbitol and mannitol. $R^{91}$ to $R^{115}$ in the general formulas (35) to (40) shown above include a methyl group, an ethyl group, an n-propyl group, an isopropyl group, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, a phenyl group and a benzyl group. The above-mentioned etherified substances include partially etherified substances in which some of $R^{91}$ to $R^{115}$ is a hydrogen atom.

The etherified substances of the bimolecular or trimolecular condensates of the aliphatic tri- to hexa-polyhydric alcohols include condensates of the same compounds or different compounds out of the compounds represented by the general formulas (35) to (40) shown above. For example, etherified substances of bimolecular condensates and trimolecular condensates of the alcohol represented by the general formula (35) are represented by the general formulas (41) and (42), respectively. Etherified substances of bimolecular condensates and trimolecular condensates of the alcohol represented by the general formula (38) are represented by the general formulas (43) and (44), respectively,

[Chem. 42]

(41)

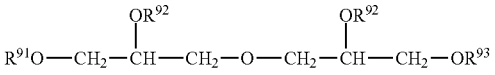

[Chem. 43]

(42)

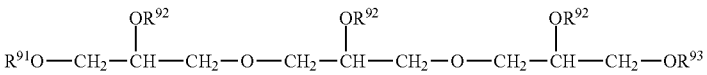

[Chem. 44]

-continued (43)

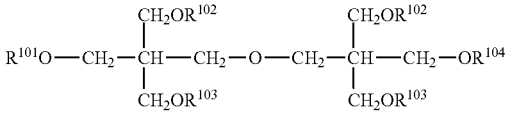

[Chem. 45]

(44)

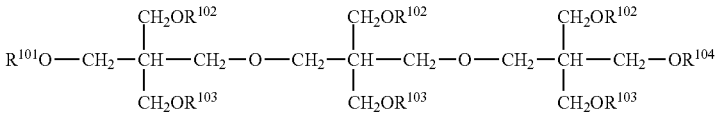

wherein $R^{91}$ to $R^{93}$, and $R^{101}$ to $R^{104}$ are defined as $R^{91}$ to $R^{93}$ in the formula (35), and $R^{101}$ and $R^{103}$ in the formula (38), respectively.

Specific examples of bimolecular condensates and trimolecular condensates of the aliphatic tri- to hexa-polyhydric alcohols include diglycerol, ditrimethylolpropane, dipentaerythritol, disorbitol, triglycerol, trimethylolpropane, tripentaerythritol and trisorbitol.

Among the ether oiliness agents represented by the general formulas (35) to (40), preferable are diphenyl octyl triether of glycerol, di(methyloxyisopropylene)dodecyl triether of trimethylolpropane, tetrahexyl ether of pentaerythritol, hexapropyl ether of sorbitol, dimethyl dioctyl tetraether of diglycerol, tetra(methyloxyisopropylene) decyl pentaether of triglycerol, hexapropyl ether of dipentaerythritol and pentamethyl octyl hexaether of tripentaerythritol.

The oiliness agents usable in the present invention include amine oiliness agents and amide oiliness agents in addition to the above.

The amine oiliness agents include monoamines, polyamines and alkanolamines, but above all these, monoamines are preferable in view of improvement in friction characteristics.

The monoamines specifically include, for example, alkylamines such as monomethylamine, dimethylamine, trimethylamine, monoethylamine, diethylamine, triethylamine, monopropylamine, dipropylamine, tripropylamine, monobutylamine, dibutyl amine, tributylamine, monopentylamine, dipentylamine, tripentylamine, monohexylamine, dihexylamine, monoheptylamine, diheptylamine, monooctylamine, dioctylamine, monononylamine, monodecylamine, monoundecylamine, monododecylamine, monotridecylamine, monotetradecylamine, monopentadecylamine, monohexadecylamine, monoheptadecylamine, monooctadecylamine, monononadecylamine, monoicosylamine, monohenicosylamine, monodocosylamine, monotricosylamine, dimethyl (ethyl)amine, dimethyl(propyl)amine, dimethyl(butyl) amine, dimethyl(pentyl)amine, dimethyl(hexyl)amine, dimethyl(heptyl)amine, dimethyl(octyl)amine, dimethyl (nonyl)amine, dimethyl(decyl)amine, dimethyl(undecyl) amine, dimethyl(dodecyl)amine, dimethyl(tridecyl)amine, dimethyl(tetradecyl)amine, dimethyl(pentadecyl)amine, dimethyl(hexadecyl)amine, dimethyl(heptadecyl)amine, dimethyl(octadecyl)amine, dimethyl(nonadecyl)amine, dimethyl(icosyl)amine, dimethyl(henicosyl)amine and dimethyl (tricosyl)amine;

alkenylamines such as monovinylamine, divinylamine, trivinylamine, monopropenylamine, dipropenylamine, tripropenylamine, monobutenylamine, dibutenylamine, tributenylamine, monopentenylamine, dipentenylamine, tripentenylamine, monohexenylamine, dihexenylamine, monoheptenylamine, diheptenylamine, monooctenylamine, dioctenylamine, monononenylamine, monodecenylamine, monoundecenylamine, monododecenylamine, monotridecenylamine, monotetradecenylamine, monopentadecenylamine, monohexadecenylamine, monoheptadecenylamine, monooctadecenylamine, monononadecenylamine, monoicosenylamine, monohenicosenylamine, monodocosenylamine and monotricosenylamine;

monoamines having an alkyl group and an alkenyl group such as dimethyl(vinyl)amine, dimethyl(propenyl)amine, dimethyl(butenyl)amine, dimethyl(pentenyl)amine, dimethyl(hexenyl)amine, dimethyl(heptenyl)amine, dimethyl(octenyl)amine, dimethyl(nonenyl)amine, dimethyl(decenyl) amine, dimethyl(undecenyl)amine, dimethyl(dodecenyl) amine, dimethyl(tridecenyl)amine, dimethyl(tetradecenyl) amine, dimethyl(pentadecenyl)amine, dimethyl (hexadecenyl)amine, dimethyl(heptadecenyl)amine, dimethyl(octadecenyl)amine, dimethyl(nonadecenyl)amine, dimethyl(icosenyl)amine, dimethyl(henicosenyl)amine and dimethyl(tricosenyl)amine;

aromatic-substituted alkylamines such as monobenzylamine, (1-phenylethyl)amine, (2-phenylethyl)amine (alias: monophenethylamine), dibenzylamine, bis(1-phenylethyl) amine and bis(2-phenylethylene)amine (alias: diphenethylamine);

cycloalkylamines having 5 to 16 carbon atoms such as monocyclopentylamine, dicyclopentylamine, tricyclopentylamine, monocyclohexylamine, dicyclohexylamine, monocycloheptylamine and dicycloheptylamine;

monoamines having an alkyl group and a cycloalkyl group such as dimethyl(cyclopentyl)amine, dimethyl(cyclohexyl) amine and dimethyl(cycloheptyl)amine;

alkylcycloalkylamines such as (methylcyclopentyl)amine, bis(methylcyclopentyl)amine, (dimethylcyclopentyl)amine, bis(dimethylcyclopentyl)amine, (ethylcyclopentyl)amine, bis(ethylcyclopentyl)amine, (methylethylcyclopentyl) amine, bis(methylethylcyclopentyl)amine, (diethylcyclopentyl)amine, (methylcyclohexyl)amine, bis(methylcyclohexyl) amine, (dimethylcyclohexyl)amine, bis(dimethylcyclohexyl) amine, (ethylcyclohexyl)amine, bis(ethylcyclohexyl)amine, (methylethylcyclohexyl)amine, (diethylcyclohexyl)amine, (methylcycloheptyl)amine, bis(methylcycloheptyl)amine, (dimethylcycloheptyl)amine, (ethylcycloheptyl)amine, (methylethylcycloheptyl)amine and (diethylcycloheptyl)amine. The above-mentioned monoamines include monoamines derived from oils and fats such as beef tallow amines. Each of these compounds includes all of their isomers.

Among the above-mentioned amines, in view of improvement in friction characteristics, especially preferable are alkylamines, monoamines having an alkyl group and an alkenyl group, monoamines having an alkyl group and a cycloalkyl group, cycloalkylamines and alkylcycloalkylamines, and more preferable are alkylamines and monoamines having an alkyl group and an alkenyl group.

The number of carbon atoms of the monoamines is not especially limited, but is preferably 8 or more, and more preferably 12 or more, in view of rust preventiveness. Further, in view of improvement in friction characteristics, the number is preferably 24 or less, and more preferably 18 or less.

Further, the number of hydrocarbon groups bonded to a nitrogen atom in a monoamine is not especially limited, but is preferably 1 or 2, and more preferably 1, in view of improvement in friction characteristics.

The amide oiliness agents include amides obtained by reacting a fatty acid having 6 to 30 carbon atoms or its acid chloride with ammonia or a nitrogen-containing compound such as an amine compound containing only a hydrocarbon group or a hydroxyl group-containing hydrocarbon group having 1 to 8 carbon atoms in the molecule.

The fatty acid mentioned here may be a straight-chain fatty acid or a branched-chain fatty acid, and a saturated fatty acid or an unsaturated fatty acid. The number of carbon atoms thereof is 6 to 30, and preferably 9 to 24.

The fatty acids specifically include, for example, saturated fatty acids (these saturated fatty acids may be of straight-chain or branched-chain) such as heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid and a triacontyl group; and unsaturated fatty acids (these unsaturated fatty acids may be of straight-chain or branched-chain, and the positions of double bonds are optional) such as heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid (including oleic acid), nonadecenoic acid, icosenoic acid, henicosenoic acid, docosenoic acid, tricosenoic acid, tetracosenoic acid, pentacosenoic acid, hexacosenoic acid, heptacosenoic acid, octacosenoic acid, nonacosenoic acid and triacontenoic acid, but preferably used are straight-chain fatty acids such as lauric acid, myristic acid, palmitic acid, stearic acid, oleic acid and straight-chain fatty acids (coconut oil fatty acid, etc.) derived from various oils and fats, and mixtures of straight-chain fatty acids and branched-chain fatty acids synthesized by the oxo method or the like.

The nitrogen-containing compounds reacted with the above-mentioned fatty acids are specifically exemplified by ammonia; alkylamines (the alkyl group may be of straight-chain or branched-chain) such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; alkanolamines (the alkanol group may be of straight-chain or branched-chain) such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

The fatty acid amides especially preferably used are lauric acid amide, lauric acid diethanolamide, lauric acid monopropanolamide, myristic acid amide, myristic acid diethanolamide, myristic acid monopropanolamide, palmitic acid amide, palmitic acid diethanolamide, palmitic acid monopropanolamide, stearic acid amide, stearic acid diethanolamide, stearic acid monopropanolamide, oleic acid amide, oleic acid diethanolamide, oleic acid monopropanolamide, coconut oil fatty acid amide, coconut oil fatty acid diethanolamide, coconut oil fatty acid monopropanolamide, synthetic mixed fatty acid amides having 12 or 13 carbon atoms, synthetic mixed fatty acid diethanolamides having 12 or 13 carbon atoms, synthetic mixed fatty acid monopropanolamides having 12 or 13 carbon atoms, and mixtures thereof.

Among the oiliness agents, preferable are partial esters of polyhydric alcohols and aliphatic amides in view of an effect of improving friction characteristics.

The content of an oiliness agent in the hydraulic oil composition according to the embodiment is optional, but is preferably 0.01% by mass or more, more preferably 0.05% by mass or more, and still more preferably 0.1% by mass or more, based on the total amount of a composition in view of an excellent effect of improving friction characteristics. By contrast, in view of deposition preventiveness, the content is preferably 10% by mass or less, more preferably 7.5% by mass or less, and still more preferably 5% by mass or less, based on the total amount of the composition.

The hydraulic oil composition according to the embodiment preferably contains triazole and/or its derivatives having a structure represented by the formula (45) shown below in view of improvement in thermal and oxidative stability.

[Chem. 46]

(45)

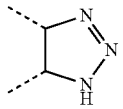

In the formula (45), two dashed lines each denote the same or different substituents in the triazole ring, preferably a hydrocarbon group; and they may be taken together with each other to form, for example, a condensed benzene ring.

Compounds preferable as triazole and/or its derivatives are benzotriazole and/or its derivatives.

The benzotriazole is exemplified by a compound represented by the following formula (46):

[Chem. 47]

(46)

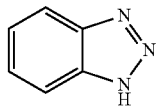

The benzotriazole derivatives include, for example, alkylbenzotriazoles represented by the general formula (47) shown below and (alkyl)aminoalkylbenzotriazoles represented by the general formula (48) shown below.

[Chem. 48]

(48)

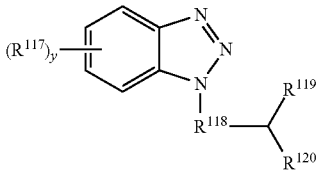

[Chem. 49]

(48)

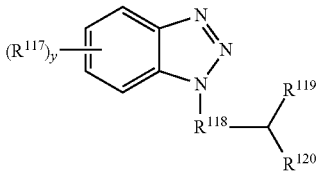

In the formula (47) above, $R^{116}$ denotes a straight-chain or branched-chain alkyl group having 1 to 4 carbon atoms, and preferably a methyl group or an ethyl group. x denotes an integer of 1 to 3, and preferably 1 or 2. $R^{116}$ includes, for example, a methyl group, an ethyl group, an n-propyl group, an isopropyl group, an n-butyl group, an isobutyl group, a sec-butyl group and a tert-butyl group. The alkylbenzotriazoles represented by the general formula (47) are preferably compounds in which $R^{116}$ is a methyl group or an ethyl group and x is 1 or 2 especially in view of excellent thermal oxidation inhibiting performance, which compounds include, for example, methylbenzotriazol (tolyltriazole), dimethylbenzotriazole, ethylbenzotriazole, ethylmethylbenzotriazol, diethylbenzotriazol and a mixture thereof.

In the formula (48) above, $R^{117}$ denotes a straight-chain or branched-chain alkyl group having 1 to 4 carbon atoms, and preferably a methyl group or an ethyl group. $R^{118}$ denotes a methylene group or an ethylene group. $R^{119}$ and $R^{120}$ may be the same or different, and each denote a hydrogen atom or a straight-chain or branched-chain alkyl group having 1 to 18 carbon atoms, and preferably a straight-chain or branched-chain alkyl group having 1 to 12 carbon atoms. y denotes an integer of 0 to 3, and preferably 0 or 1. $R^{117}$ includes, for example, a methyl group, an ethyl group, an n-propyl group, an isopropyl group, an n-butyl group, an isobutyl group, a sec-butyl group and a tert-butyl group. $R^{119}$ and $R^{120}$ each include a hydrogen atom, alkyl groups such as a methyl group, an ethyl group, a propyl group, an isopropyl group, an n-butyl group, an isobutyl group, a sec-butyl group, a tert-butyl group, a straight-chain or branched-chain pentyl group, a straight-chain or branched-chain hexyl group, a straight-chain or branched-chain heptyl group, a straight-chain or branched-chain octyl group, a straight-chain or branched-chain nonyl group, a straight-chain or branched-chain decyl group, a straight-chain or branched-chain undecyl group, a straight-chain or branched-chain dodecyl group, a straight-chain or branched-chain tridecyl group, a straight-chain or branched-chain tetradecyl group, a straight-chain or branched-chain pentadecyl group, a straight-chain or branched-chain hexadecyl group, a straight-chain or branched-chain heptadecyl group and a straight-chain or branched-chain octadecyl group.

As the (alkyl)aminobenzotriazoles represented by the formula (48) above, especially in view of excellent oxidative preventiveness, preferably used are dialkylaminoalkylbenzotriazols, dialkylaminoalkyltolyltriazoles or mixtures thereof in which $R^{117}$ is a methyl group; y is 0 or 1; $R^{118}$ is a methylene group or an ethylene group; and $R^{119}$ and $R^{120}$ are straight-chain or branched-chain alkyl groups having 1 to 12 carbon atoms. These dialkylaminoalkylbenzotriazols include, for example, dimethylaminomethylbenzotriazol, diethylaminomethylbenzotriazol, di-(straight-chain or branched-chain)-propylaminomethylbenzotriazol, di-(straight-chain or branched-chain)-butylaminomethylbenzotriazol, di-(straight-chain or branched-chain)-pentylaminomethylbenzotriazol, di-(straight-chain or branched-chain)-hexylaminomethylbenzotriazol, di-(straight-chain or branched-chain)-heptylaminomethylbenzotriazol, di-(straight-chain or branched-chain)-octylaminomethylbenzotriazol, di-(straight-chain or branched-chain)-nonylaminomethylbenzotriazol, di-(straight-chain or branched-chain)-decylaminomethylbenzotriazol, di-(straight-chain or branched-chain)-undecylaminomethylbenzotriazol and di-(straight-chain or branched-chain)-dodecylaminomethylbenzotriazol; dimethylaminoethyl benzotriazol, diethylaminoethylbenzotriazol, di-(straight-chain or branched-chain)-propylaminoethylbenzotriazole, di-(straight-chain or branched-chain)-butylaminoethylbenzotriazole, di-(straight-chain or branched-chain)-pentylaminoethylbenzotriazole, di-(straight-chain or branched-chain)-hexylaminoethylbenzotriazole, di-(straight-chain or branched-chain)-heptylaminoethylbenzotriazol, di-(straight-chain or branched-chain)-octylaminoethylbenzotriazol, di-(straight-chain or branched-chain)-nonylaminoethylbenzotriazol, di-(straight-chain or branched-chain)-decylaminoethylbenzotriazol, di-(straight-chain or branched-chain)-undecylaminoethylbenzotriazol and di-(straight-chain or branched-chain)-dodecylaminoethylbenzotriazole; dimethylaminomethyltolyltriazole, diethylaminomethyltolyltriazole, di-(straight-chain or branched-chain)-propylaminomethyltolyltriazole, di-(straight-chain or branched-chain)-butylaminomethyltolyltriazole, di-(straight-chain or branched-chain)-pentylaminomethyltolyltriazole, di-(straight-chain or branched-chain)-hexylaminomethyltolyltriazole, di-(straight-chain or branched-chain)-heptylaminomethyltolyltriazole, di-(straight-chain or branched-chain)-octylaminomethyltolyltriazole, di-(straight-chain or branched-chain)-nonylaminomethyltolyltriazole, di-(straight-chain or branched-chain)-decylaminomethyltolyltriazole, di-(straight-chain or branched-chain)-undecylaminomethyltolyltriazole and di-(straight-chain or branched-chain)-dodecylaminomethyltolyltriazole; dimethylaminoethyltolyltriazole, diethylaminoethyltolyltriazole, di-(straight-chain or branched-chain)-propylaminoethyltolyltriazole, di-(straight-chain or branched-chain)-butylaminoethyltolyltriazole, di-(straight-chain or branched-chain)-pentylaminoethyltolyltriazole, di-(straight-chain or branched-chain)-hexylaminoethyltolyltriazole, di-(straight-chain or branched-chain)-heptylaminoethyltolyltriazole, di-(straight-chain or branched-chain)-octylaminoethyltolyltriazole, di-(straight-chain or branched-chain)-nonylaminoethyltolyltriazole, di-(straight-chain or branched-chain)-decylaminoethyltolyltriazole, di-(straight-chain or branched-chain)-undecylaminoethyltolyltriazole and di-(straight-chain or branched-chain)-dodecylaminoethyltolyltriazole; and mixtures thereof.

The content of triazole and/or its derivatives in the hydraulic oil composition according to the embodiment is optional, but is preferably 0.001% by mass or more, and more preferably 0.005% by mass or more, based on the total amount of a composition. With the content of less than 0.001% by mass of triazole and/or its derivatives, an effect of improving thermal and oxidative stability by the addition is likely to be insufficient. The content of triazole and/or its derivatives is preferably 1.0% by mass or less, and more preferably 0.5% by mass or less, based on the total amount of the composition. With the content exceeding 1.0% by mass, a further effect of improving thermal and oxidative stability corresponding to the content cannot be provided, and there is a risk of an economical disadvantage.

The hydraulic oil composition according to the embodiment may contain, as required for further improving its performance, singly one of various types of additives represented by rust preventives, metal deactivators, viscosity index improvers and cleaning dispersants other than the above-mentioned dispersion type viscosity index improvers, pour point depressants, defoaming agents and the like, or a combination of several types thereof.

The rust preventives are specifically exemplified by metal soaps such as fatty acid metal salts, lanolin fatty acid metal salts and oxidized wax metal salts; partial esters of polyhydric alcohols such as sorbitan fatty acid esters; esters such as lanolin fatty acid esters; sulfonates such as calcium sulfonate and barium sulfonate; oxidized waxes; amines; and phosphoric acid and phosphates. In the embodiment, one compound or two or more compounds optionally selected from these rust preventives can be contained in optional amounts, but the content is usually desirably 0.01 to 1% by mass, based on the total amount of a composition.

The metal deactivators are specifically exemplified by imidazole compounds in addition to the above-mentioned benzotriazole compounds. In the embodiment, one compound or two or more compounds optionally selected from these metal deactivators can be contained in optional amounts, but the content is usually desirably 0.001 to 1% by mass, based on the total amount of a composition.

The viscosity index improvers other than the dispersion type viscosity index improvers are specifically exemplified by copolymers of two or more monomers of various methacrylates, or their hydrogenated substances, ethylene-α-olefin copolymers (α-olefins are exemplified by propylene, 1-butene and 1-pentene) or their hydrogenated substances, polyisobutylenes and their hydrogenated substances, and so-called non-dispersion type viscosity index improvers such as styrene-diene hydrogenated copolymers and polyalkylstyrenes. The cleaning dispersants other than the dispersion type viscosity index improvers are exemplified by alkenylsuccinic acid imides, sulfonates, salicylates and fenates. One compound or two or more compounds optionally selected from these viscosity index improvers and cleaning dispersants can be contained in optional amounts, but the content is usually desirably 0.01 to 10% by mass, based on the total amount of a composition.

The pour point depressants are specifically exemplified by copolymers of one monomer or two or more monomers of various acrylates and various methacrylates, or their hydrogenated substances. One compound or two or more compounds optionally selected from these pour point depressants can be contained in optional amounts, but the content is usually desirably 0.01 to 5% by mass, based on the total amount of a composition.

The defoaming agents are specifically exemplified by silicones such as dimethylsilicone and fluorosilicone. In the embodiment, one compound or two or more compounds optionally selected from these defoaming agents can be contained in optional amounts, but the content is usually desirably 0.0001 to 0.05% by mass, based on the total amount of a composition.

According to the embodiment having the above-mentioned structure can achieve all of abrasion resistance, friction characteristics, thermal and oxidative stability and viscosity-temperature properties in high levels and well-balancedly. The hydraulic oil composition is very useful in view of enhancing the performance and saving the energy of hydraulic operating systems.

Hydraulic machines to which the hydraulic oil composition according to the embodiment is applied are not especially limited, but include, for example, injection molding machines, machine tools, construction machines, iron making equipment, industrial robots and hydraulic elevators.

Fourth Embodiment

Metalworking Oil Composition

The metalworking oil composition according to a fourth embodiment of the present invention comprise the lubricating oil base oil according to the present invention and at least one lubricity improver selected from esters, alcohols, carboxylic acids and compounds containing phosphorus and/or sulfur as a constituent element(s).

In addition, in the metalworking oil composition according to the present embodiment, since the aspect of the lubricating oil base oil according to the present invention is the similar to the case of the first embodiment, the overlapping explanation is here omitted.

Further, in the metalworking oil composition according to the present embodiment, the lubricating oil base oil according to the present invention may be used alone or in combination with one or two or more other base oils. In addition, since the content of the lubricating oil base oil according to the present invention in the example of other base oils and a mixed base oil is the similar to the case of the first embodiment, the overlapping explanation is here omitted.

Further, the metalworking oil composition according to the present embodiment contains at least one lubricity improver selected from an ester, an alcohol, carboxylic acid and a compound containing phosphorus and/or sulfur as a constituent element(s).

The alcohol constituting an ester as a lubricity improver may be a monohydric alcohol or a polyhydric alcohol. In addition, the carboxylic acid constituting the ester may be a monobasic acid or a polybasic acid.

As the monohydric alcohol, there is usually used one having 1 to 24 carbon atoms. Such an alcohol may be straight-chain or branched-chain. The alcohol having 1 to 24 carbon atoms specifically includes, for example, methanol, ethanol, straight-chain or branched-chain propanol, straight-chain or branched-chain butanol, straight-chain or branched-chain octanol, straight-chain or branched-chain nonanol, straight-chain or branched-chain decanol, straight-chain or branched-chain undecanol, straight-chain or branched-chain dodecanol, straight-chain or branched-chain tridecanol, straight-chain, or branched-chain tetradecanol, straight-chain or branched-chain pentadecanol, straight-chain or branched-chain hexadecanol, straight-chain or branched-chain heptadecanol, straight-chain or branched-chain octadecanol, straight-chain or branched-chain nonadecanol, straight-chain or branched-chain eicosanol, straight-chain or branched-chain heneicosanol, straight-chain or branched-chain tricosanol, straight-chain or branched-chain tetracosanol and a mixture thereof.

In addition, as the polyhydric alcohol, there is generally used a dihydric to decahydric alcohol and preferably used is a dihydric to hexahydric alcohol. The dihydric to decahydric alcohol specifically includes, for example, a dihydric alcohol such as ethylene glycol, diethylene glycol, polyethyleneglycol (trimer to pentadecamer of ethylene glycol), propylene glycol, dipropylene glycol, polypropylene glycol (trimer to pentadecamer of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, neopentyl glycol and the like; a polyhydric alcohol such as glycerin, polyglycerin (dimer to octamer of glycerin, for example, diglycerin, triglycerin and, tetraglycerin), trimethylol alkane (trimethylol ethane, trimethylol propane, trimethylol butane and the like) and a dimer to octamer thereof, pentaerythritol and dimer to tetramer thereof, 1,2,4-butanetriol, 1,3,5-pentanetriol, 1,2,6-hexanetriol, 1,2,3,4-butanetetrol, sorbitol, sorbitan, sorbitol glycerin condensation product, adonitol, arabitol, xylitol, mannitol and the like; saccharides such as, xylose, arabinose, ribose, rhamnose, glucose, fructose, galactose, mannose, sorbose, cellobiose, maltose, isomaltose, trehalose, sucrose and the like and a mixture thereof.

Among these, preferred are a dihydric to hexahydric alcohol such as ethylene glycol, diethylene glycol, polyethylene glycol (trimer to decamer of ethylene glycol), propylene glycol, dipropylene glycol, polypropylene glycol (trimer to decamer of propylene glycol), 1,3-propanediol, 2-methyl-1,2-propanediol, 2-methyl-1,3-propanediol, neopentyl glycol, glycerin, diglycerin, triglycerin, trimethylol alkane (trimethylol ethane, trimethylol propane, trimethylol butane and the like) and a dimer to tetramer thereof, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol glycerin condensation product, adonitol, arabitol, xylitol, mannitol, a mixture thereof and the like. More preferred are ethylene glycol, propylene glycol, neopentyl glycol, glycerin, trimethylol ethane, trimethylol propane, pentaerythritol, sorbitan, a mixture thereof, and the like.

Further, the monobasic acid constituting an ester is generally a fatty acid having 6 to 24 carbon atoms and may be straight-chain or branched-chain and in addition may be saturated or unsaturated. The monobasic acid specifically includes, for example, a saturated fatty acid, such as straight-chain or branched-chain hexanoic acid, straight-chain or branched-chain octanoic acid, straight-chain or branched-chain nonanoic acid, straight-chain or branched-chain decanoic acid, straight-chain or branched-chain undecanoic acid, straight-chain or branched-chain dodecanoic acid, straight-chain or branched-chain tridecanoic acid, straight-chain or branched-chain tetradecanoic acid, straight-chain or branched-chain pentadecanoic acid, straight-chain or branched-chain hexadecanoic acid, straight-chain or branched-chain octadecanoic acid, straight-chain or branched-chain hydroxyoctadecanoic acid, straight-chain or branched-chain nonadecanoic acid, straight-chain or branched-chain eicosanoic acid, straight-chain or branched-chain heneicosanoic acid, straight-chain or branched-chain docosanoic acid, straight-chain or branched-chain tricosanoic acid, straight-chain or branched-chain tetracosanoic acid and the like; an unsaturated fatty acid such as straight-chain or branched-chain hexenoic acid, straight-chain or branched-chain heptene acid, straight-chain or branched-chain octenoic acid, straight-chain or branched-chain nonenoic acid, straight-chain or branched-chain decenoic acid, straight-chain or branched-chain undecene acid, straight-chain or branched-chain dodecenoic acid, straight-chain or branched-chain tridecenoic acid, straight-chain or branched-chain tetradecenoic acid, straight-chain or branched-chain pentadecenoic acid, straight-chain or branched-chain hexadecenoic acid, straight-chain or branched-chain octadecenoic acid, straight-chain or branched-chain hydroxyoctadecenoic acid, straight-chain or branched-chain nonadecenoic acid, straight-chain or branched-chain eicosenoic acid, straight-chain or branched-chain heneicosenoic acid, straight-chain or branched-chain docosenoic acid, straight-chain or branched-chain tricosenoic acid and straight-chain or branched-chain tetracosenoic acid; and a mixture thereof. Among these, preferred are a saturated fatty acid having 8 to 20 carbon atoms, an unsaturated fatty acid having 8 to 20 carbon atoms, and a mixture thereof.

The polybasic acid constituting an ester oiliness agent includes a dibasic acid having 2 to 16 carbon atoms, trimellitic acid and the like. The dibasic acid having 2 to 16 carbon atoms may be straight-chain or branched-chain and may be saturated or unsaturated. The dibasic acid having 2 to 16 carbon atoms specifically includes, for example, ethanedioic acid, propanedioic acid, straight-chain or branched-chain butanedioic acid, straight-chain or branched-chain pentanedioic acid, straight-chain or branched-chain hexanedioic acid, straight-chain or branched-chain octanedioic acid, straight-chain or branched-chain nonanedioic acid, straight-chain or branched-chain decanedioic acid, straight-chain or branched-chain undecanedioic acid, straight-chain or branched-chain dodecanedioic acid, straight-chain or branched-chain tridecanedioic acid, straight-chain or branched-chain tetradecanedioic acid, straight-chain or branched-chain heptadecanedioic acid, straight-chain or branched-chain hexadecanedioic acid; straight-chain or branched-chain hexenedioic acid, straight-chain or branched-chain octenedioic acid, straight-chain or branched-chain nonenedioic acid, straight-chain or branched-chain decenedioic acid, straight-chain or branched-chain undecenedioic acid, straight-chain or branched-chain dodecene dioic acid, straight-chain or branched-chain tridecenedioic acid, straight-chain or branched-chain tetradecenedioic acid, straight-chain or branched-chain heptadecenedioic acid, straight-chain or branched-chain hexadecenedioic acid; and a mixture thereof.

In the present invention, there may be used an ester by combination with an optional alcohol and a carboxylic acid, which is not particularly limited. Specifically, there may be preferably used an ester shown in the following (i) to (vii).

(i) An ester of a monohydric alcohol and a monobasic acid
(ii) An ester of a polyhydric alcohol and a monobasic acid
(iii) An ester of a monohydric alcohol and a polybasic acid
(iv) An ester of a polyhydric alcohol and a polybasic acid
(v) An ester of a mixed alcohol of a monohydric alcohol and a polyhydric alcohol with a polybasic acid
(vi) An ester of a polyhydric alcohol with a mixed carboxylic acid of a monobasic acid and a polybasic acid
(vii) An ester of a mixed alcohol of a monohydric alcohol and a polyhydric alcohol with a mixed carboxylic acid of a monobasic acid and a polybasic acid In addition, if a polyhydric alcohol is used as an alcohol component, the ester may be either a complete ester in which all the hydroxyl groups in the polyhydric alcohol are esterified or a partial ester in which a part of the hydroxyl groups is not esterified and remains as a hydroxyl group. Further, if a polybasic acid is used as a carboxylic acid component, the ester may be either a complete ester in which all the carboxyl groups in the polybasic acid are esterified or a partial ester in which a part of the carboxyl groups is not esterified and remains as a carboxyl group.

As the ester used in the present embodiment, any of the above-mentioned esters may be used. Among these, from the viewpoint of being excellent in workability, preferably used are (i) an ester of a monohydric alcohol and a monobasic acid and (iii) an ester of a monohydric alcohol and a polybasic acid, more preferably used is (i) an ester of a monohydric alcohol and a monobasic acid, and most preferably used is (i) an ester of a monohydric acid and a monobasic acid and (iii) an ester of a monohydric alcohol and a polybasic acid in combination.

The total carbon number of (i) an ester of a monohydric alcohol and a monobasic acid preferably used in the present embodiment is not particularly limited, but the ester has a lower limit of the total carbon number of preferably 7 or more, more preferably 9 or more and most preferably 11 or more. In addition, the ester has an upper limit of the total carbon number of preferably 26 or less, more preferably 24 or less and most preferably 22 or less. The carbon number of the monohydric alcohol is not particularly limited, but the carbon number is preferably 1 to 10, more preferably 1 to 8, further more preferably 1 to 6 and most preferably 1 to 4. The carbon number of the monobasic acid is not particularly limited, but the carbon number is preferably 8 to 22, more preferably 10 to 20 and most preferably 12 to 18. Further, if the total carbon number, the carbon number of the alcohol and the carbon number of the monobasic acid exceed, respectively, the upper limit, the probability of increasing the occurrence of stain or corrosion may become high. Since the fluidity is lost in winter season, it is more likely to become difficult to handle, or since the solubility to a lubricating oil base oil is decreased, it is more likely to precipitate. In addition, if the total carbon number, the carbon number of the alcohol and the carbon number of the monobasic acid are respectively less than the lower limit, the lubricity tends to become insufficient, and the working environment may be deteriorated due to the odor.

The form of (iii) an ester of a monohydric alcohol and a polybasic acid preferably used in the present embodiment is not particularly limited but is preferably a diester represented by the following general formula (49) or an ester of trimellitic acid, $$R^{121}—O—CO—(CH_2)_n—CO—O—R^{122} \quad (49)$$

wherein, $R^{121}$ and $R^{122}$ may be the same or different from each other and each represents a hydrocarbon group, and n represents an integer of 4 to 8.

$R^{121}$ and $R^{122}$ in general formula (49) respectively represent a hydrocarbon group and the carbon number of such a hydrocarbon group is preferably 3 to 10. Further, if the carbon number of the hydrocarbon group is less than 3, the improvement effect of the lubricity may not be expected and the working environment may be deteriorated due to the odor. In addition, if the carbon number of the hydrocarbon group exceeds 10, the probability of increasing the occurrence of stain or corrosion may become high, the fluidity is lost in winter season and thus it is more likely to become difficult to handle, or the solubility to a lubricating oil base oil is decreased and thus it is more likely to precipitate.

The hydrocarbon groups represented by $R^{121}$ and $R^{122}$ in the general formula (49) include an alkyl group, an alkenyl group, an alkylcycloalkyl group, an alkylphenyl group, and a phenylalkyl group, and an alkyl group is especially preferable.

If $R^{121}$ and $R^{122}$ are an alkyl group, the alkyl group may be either a straight-chain alkyl group or a branched-chain alkyl group, and a straight-chain alkyl group and a branched-chain alkyl group may be present together in the same molecule but a branched-chain alkyl group is preferable.

Specific examples of the alkyl group represented by $R^{121}$ and $R^{122}$ include straight-chain or branched-chain propyl group, straight-chain or branched-chain butyl group, straight-chain or branched-chain pentyl group, straight-chain or branched-chain hexyl group, straight-chain or branched-chain heptyl group, straight-chain or branched-chain octyl group, straight-chain or branched-chain nonyl group, and straight-chain or branched-chain decyl group.

In addition, n in the general formula (49) represents an integer of 4 to 8. Further, if n exceeds 8, the probability of increasing the occurrence of stain or corrosion may become high, the fluidity is lost in winter season and thus it is more likely to become difficult to handle, or the solubility to a lubricating oil base oil is decreased and thus it is more likely to precipitate. Further if n is less than 4, the improvement effect of the lubricity may not be expected and the working environment may be deterioeated due to the odor. In addition, from the viewpoint of easy availability of a raw material and the price, preferred a diester in which n is 4 or 6.

The diester represented by the above general formula (49) may be obtained by an arbitrary method, and for example, there may be exemplified by a method of esterifying a straight-chain saturated dicarboxylic acid having 6 to 10 carbon atoms (in the order from the carbon number of 6, adipic acid, pimelic acid, cork acid, azelaic acid, sebacic acid) and a derivative thereof with an alcohol having 3 to 10 carbon atoms, and the like.

In addition, if the ester is an ester of trimellitic acid with a monohydric alcohol, the carbon number of the monohydric alcohol is not particularly limited, however, the carbon number is preferably 1 to 10, more preferably 1 to 8, further more preferably 1 to 6 and especially preferably 1 to 4. Further, if the carbon number of the monohydric alcohol exceeds 10, the probability of increasing the occurrence of stain or corrosion may become high, the fluidity is lost in winter season and thus it is more likely to become difficult to handle, or the solubility to a lubricating oil base oil is decreased and thus it is more likely to precipitate. The ester of trimellitic acid may be either a partial ester (monoester or diester) or a complete ester (triester).

Especially preferred specific examples of an ester used as a lubricity improver include a diester of methyl laurate, butyl laurate, methyl stearate, butyl stearate, methyl oleate, butyl oleate and adipic acid with an alcohol having 4 to 10 carbon atoms.

In addition, the alcohols used as a lubricity improver include the monohydric alcohol and polyhydric alcohol exemplified in the explanation of the ester. Among these, preferred are the monohydric alcohol and the dihydric alcohol, and it is preferable to use the monohydric alcohol alone or it is more preferable to use the monohydric alcohol and the dihydric alcohol in combination. Further, as the dihydric alcohol, preferred is one having an ether bond in the molecule.

The carbon number of the monohydric alcohol and the dihydric alcohol is preferably 6 or more, more preferable 7 or more, further more preferably 8 or more and especially preferably 9 or more. In addition, if the carbon number of the monohydric alcohol and the dihydric alcohol is less than 6, the lubricity tends to become insufficient, and the working environment may be deteriorated due to the odor. Further, the carbon number of the monohydric alcohol and the dihydric alcohol is preferably 20 or less and more preferably 18 or less. In addition, if the carbon number of the monohydric alcohol and the dihydric alcohol exceeds 20, the probability of increasing the occurrence of stain or corrosion may become high, the fluidity is lost in winter season and thus it is more likely to become difficult to handle, or the solubility to a lubricating oil base oil is decreased and thus it is more likely to precipitate.

Especially preferred examples of an alcohol used as a lubricity improver include lauryl alcohol, myristyl alcohol, palmityl alcohol, oleyl alcohol, a pentamer to nonamer of ethylene glycol, a dimer to hexamer of propylene glycol and a mixture of two or more thereof.

In addition, the carboxylic acid used as a lubricity improver may be a monobasic acid or a polybasic acid. Specific example of the carboxylic acid include the monobasic acid or the polybasic acid exemplified in the explanation of the ester. Among these, from the viewpoint of being more excellent in workability, preferred is the monobasic acid.

The carbon number of the carboxylic acid used as a lubricity improver is preferably 6 or more, more preferably 8 or more and further more preferably 10 or more from the viewpoint of being more excellent in the improvement effect of the lubricity. In addition, from the viewpoint of preventing the occurrence of stain or corrosion, the carbon number of the carboxylic acid is preferably 20 or less, more preferably 18 or less and further more preferably 16 or less.

Especially preferred specific examples of the carboxylic acid used as a lubricity improver include lauric acid, myristic acid, palmitic acid and oleic acid.

The above-mentioned ester, alcohol and carboxylic acid used as a lubricity improver are especially excellent in oiliness effect. In the present embodiment, one of the ester, alcohol and carboxylic acid may be used alone as a lubricity improver or may be used as a mixture of two or more of them, however, from the viewpoint of improving the lubricity, the ester or monohydric alcohol are preferable and the ester is more preferable.

The content of the above-mentioned ester, alcohol and carboxylic acid used as a lubricity improver is preferably 0.1 to 70% by mass, based on the total amount of the composition. That is, the content is preferably 0.1% by mass or more, more preferably 0.2% by mass or more and further more preferably 0.5% by mass or more from viewpoint of the improvement effect of the lubricity. In addition, if the content is too large, the content is preferably 70% by mass or less, more preferably 60% by mass or less, further more preferably 50% by mass or less, still further preferably 15% by mass or less, especially preferably 12% by mass or less and most preferably 10% by mass or less, from the viewpoint of possible increase in the occurrence of stain or corrosion and the like.

In addition, the compounds containing phosphorus and/or sulfur as a constituent element(s) include a phosphorus compound and/or a sulfur compound. Since the specific example and the preferred aspect of the phosphorus compound is partially the similar to the case of the first embodiment, the overlapping explanation is here omitted. In addition, since the specific example and the preferred aspect of the sulfur compound is the similar to the case of the third embodiment, the overlapping explanation is here omitted.

Among the sulfur compounds used in the present invention, if there is preferably used at least one selected from the group consisting of a dihydrocarbyl polysulfide and an ester sulfide because the improvement effect of lubricity is obtained at a much higher level.

Specific examples of the phosphorus compound used as a lubricity improver include the phosphorus compounds shown in the explanation of the first embodiment, as well as a metal salt of the phosphorus compounds.

The metal salt of the phosphorus compound includes a salt prepared by neutralizing a part or whole of the acidic hydrogen of the phosphorus compound with a metal base. Such a metal salt includes a metal oxide, a metal hydroxide, a metal carbonate, a metal chloride and the like, and the metal specifically includes an alkali metal such as lithium, sodium, potassium, cesium and the like; an alkali-earth metal such as calcium, magnesium, barium and the like; a heavy metal such as zinc, copper, iron, lead, nickel, silver, manganese and the like; and the like. Among these, preferred are an alkali-earth metal such as calcium, magnesium and the like and zinc.

The metal salt of the phosphorus compound is different its structure depending on the valence of a metal or the number of the OH group or SH group of the phosphorus compound, and thus the structure is not limited in any way. However, for example, if one mole of zinc oxide and 2 moles of a diester phosphate (one OH group) are reacted, it is considered that a compound having a structure represented by the following formula (50) is obtained as the main component, but it is considered that polymerized molecules are also present.

[Chem. 50]

(50)

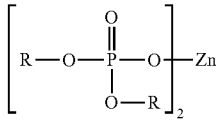

In addition, for example, if 1 mole of zinc oxide and 1 mole of a monoester phosphate (two OH groups) are reacted, it is considered that a compound having a structure represented by the following formula (51) is obtained as the main component, but it is considered that polymerized molecules are also present.

[Chem. 51]

(51)

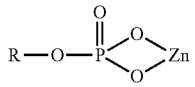

Further, a mixture of two or more of these compounds may be used.

In the present embodiment, among the phosphorus compounds, preferred are a phosphate ester, an acid phosphate ester and an amine salt of an acid phosphate ester because higher improvement effect of lubricity is obtained.

In the present embodiment, especially preferable specific examples of the compound containing phosphorus and/or sulfur used as a lubricity improver include tricresylphosphate, trilaurylphosphate, trilaurylphosphite, trioleylphosphite, dilaurylphosphite, dilauryl hydrogenphosphite, lauryl phosphate, fat and oil sulfide, ester sulfide, diphenyldisulfide, dibenzyldisulfide, didodecylsulfide, di-tert-nonylpolysulfide, trilaurylthiophosphate, trilauryltrithiophosphite, molybdenum disulfide, molybdenum dithiophosphate, zinc dithiophosphate, molybdenum dithiocarbamate and zinc dithiocarbamate.

The metalworking oil composition according to the present embodiment may contain one of a sulfur compound and a phosphorus compound, or may contain both of a sulfur compound and a phosphorus compound as a lubricity improver. From the viewpoint that the improvement effect of lubricity is further enhanced, it is preferable that the metalworking oil composition contains a phosphorus compound or both of a sulfur compound and a phosphorus compound, and it is more preferable that the metalworking oil composition contains both a sulfur compound and a phosphorus compound.

When the metalworking oil composition according to the present embodiment contains a compound containing phosphorus and/or sulfur as a constituent element(s), the content of the compound containing phosphorus and/or sulfur as a constituent element(s) is arbitrary, but from the viewpoint of improving the lubricity, it is preferably 0.005% by mass or more, more preferably 0.01% by mass or more and further more preferably 0.05% by mass or more, based on the total amount of the composition. In addition, from the viewpoint of preventing abnormal abrasion, the content is preferably 15% by mass or less, more preferably 10% by mass or less and further more preferably 7% by mass or less, based on the total amount of the composition. Further, when a compound containing phosphorus and/or sulfur as a constituent element(s) is used singly, the term "content" here means the content of the compound, and when it is used in combination with two or more, the term "content" means the total content of the compounds.

In the metalworking oil composition according to the present embodiment, as the lubricity improver, there are an ester, an alcohol, a carboxylic acid and a compound containing phosphorus and/or sulfur as a constituent element(s), which may be used alone or in combination with two or more.

The metalworking oil composition according to the present embodiment may be composed of only the lubricating oil base oil and the lubricity improver, however, in order to further improve the excellent effect, there may be further added an oxidant, a rust preventive, an anticorrosive, a defoaming agent and the like, which may be used alone or in combination with two or more when needed. Since the specific examples of these additives are the similar to the case of the first to third embodiments, the overlapping explanation is here omitted. In addition, in the present embodiment, the total content of these additives is usually 15% by mass or less and preferably 10% by mass or less (both of which are based on the total amount of the composition).

Further, the metalworking oil composition according to the present embodiment may further contain water. In this case, the metalworking oil composition according to the present embodiment may be used in any of the following states: an emulsified state in which water is used as a continuous phase and an oil component is finely dispersed in the continuous phase to form an emulsion; a solubilized state in which water is dissolved in an oil component; or a suspended state in which water and an oil component are mixed with strong stirring.

When water is incorporated in the metalworking oil composition according to the present embodiment, as the water, there may be used running waters, industrial waters, ion exchange waters, distilled waters, regardless whether they are hard water or soft water.

The kinematic viscosity of the metalworking oil composition according to the present embodiment is not particularly limited, the kinematic viscosity at 40° C. is in the range of preferably from 1 to 150 $mm^2/s$ and more preferably from 2 to 100 $mm^2/s$. In addition, if the kinematic viscosity at 40° C. of the metalworking oil composition is less than 1 $mm^2/s$, the workability tends to be insufficient. Further, the kinematic viscosity exceeds 150 $mm^2/s$, the oil content is difficult to be removed from the product to be processed in the oil removing process installed at the later stage of the processing process.

Since the metalworking oil composition according to the present embodiment having the above constitution is capable of providing excellent workability without increasing the viscosity or increasing the amount of additives and may maintain the workability at a high level over a long period of time, it may be suitably used for various metalworking applications. Examples of the metal working in which the metalworking oil composition according to the present embodiment is used include drawing process, ironing process, pulling out process, press working process, forging process (including hot forging), cutting/grounding process, and rolling process (including hot rolling and cold rolling). In addition, examples of the material of the product to be processed used for these metal working operations, but not particularly limited include iron, stainless steel, aluminum and its alloy, nickel and its alloy, chromium and its alloy, copper and its alloy, zinc and its alloy, and titanium and its alloy.

Further, the metalworking oil composition according to the present embodiment may be used for any of the above-mentioned metal working operations. However, it is preferable to select the kinematic viscosity of the lubricating oil base oil in the metalworking oil composition according to the present embodiment, the type of the lubricity improver and a combination thereof accordingly, depending on the type of metal working operation.

For example, if the metalworking oil composition according to the present embodiment is used in a drawing process or a pressing process, the lubricating oil base oil according to the present invention preferably has a kinematic viscosity at 40° C. of 20 to 150 $mm^2/s$. Further, in this case, as the lubricity improver, there is preferably used at least one compound selected from butyl stearate, an alcohol having 10 to 18 carbon atoms (may be either straight-chain or branched-chain, and may be either saturated or unsaturated), oleic acid, an ester sulfide, a sulfurized fat and oil, zinc thiophosphate and tricresyl phosphate, and especially preferred are any of the following (A-1) to (A-8):

(A-1) a combination of butyl stearate, an ester sulfide and tricresylphosphate (A-2) a combination of oleic acid, an ester sulfide and tricresylphosphate (A-3) a combination of butyl stearate, lauryl alcohol, oleic acid, an ester sulfide and tricresylphosphate (A-4) a combination of an ester sulfide and tricresylphosphate (A-5) a combination of an ester sulfide and zinc dithiophosphate (A-6) a combination of a sulfurized fat and oil and zinc dithiophosphate (A-7) zinc dithiophosphate (A-8) an ester sulfide.

In addition, if the metalworking oil composition according to the present embodiment is used in a rolling process, the lubricating oil base oil according to the present invention preferably has a kinematic viscosity at 40° C. of 4 to 20 $mm^2/s$. Further, in this case, as the lubricity improver, there is preferably used at least one compound selected from butyl stearate, butyl palmitate, dibutyl adipate, dioctyl adipate, dinonyl adipate, didecyl adipate, oleic acid, an alcohol having 10 to 18 carbon atoms (may be either straight-chain or branched-chain, and may be either saturated or unsaturated) and tricresylphosphate, and especially preferred are any of the following (B-1) to (B-7):

(B-1) a combination of butyl stearate, lauryl alcohol, an ester sulfide and tricresylphosphate (B-2) a combination of butyl stearate and lauryl alcohol (B-3) a combination of an ester sulfide and tricresyl phosphate (B-4) a combination of butyl stearate, lauryl alcohol and oleic acid (B-5) a combination of butyl stearate, diester adipate and lauryl alcohol (B-6) a combination of diester adipate and lauryl alcohol (B-7) a combination of diester adipate, lauryl alcohol and oleic acid Fifth Embodiment Heat Treating Oil Composition A heat treating oil composition according to a fifth embodiment of the present invention comprises the lubricating oil base oil according to the present invention and a cooling property improver.

In addition, in the heat treating oil composition according to the present embodiment, since the aspect of the lubricating oil base oil according to the present invention is similar to the case of the first embodiment, the overlapping explanation is here omitted.

Further, in the heat treating oil composition according to the present embodiment, the lubricating oil base oil according to the present invention may be used alone or in combination with one or two or more of other base oils. In addition, specific examples of the other base oils and the content of the lubricating oil base oil according to the present invention in the mixed base oil are similar to the case of the first embodiment, the overlapping explanation is here omitted.

Further, the heat treating oil composition according to the present embodiment contains a cooling property improver, in addition to the lubricating oil base oil. The cooling property improver includes (A-1) a polyolefin and/or its hydrogenated product, (A-2) an asphalt and/or a product having insoluble matters removed from the asphalt, (A-3) an alkali earth metal salt of salicylic acid, and the like.

The polyolefin of the component (A-1) includes a copolymer of ethylene and an α-olefin, a polybutene, a 1-octene oligomer or a 1-decene oligomer and its hydrogenated product, and the like. Among the polyolefins of the component (A), a copolymer of ethylene and an α-olefin is preferably used because it has a higher effect of improving quenching properties and is excellent in thermal and oxidative stability.

The polymerization mode in a copolymer of ethylene and an α-olefin is not particularly limited, and it may be any of random copolymerization, block copolymerization or alternative copolymerization. In addition, the ethylene and α-olefin constituting the copolymer chain may be one or two or more.

The α-olefin may be liner or branched-chain and the carbon number is preferably 3 to 50 and more preferably 3 to 20. The preferred α-olefin includes propylene, 1-butene, 1-pentene, 1-hexene, 4-methyl-1-pentene, 3-methyl-1-pentene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-icocene and the like.

The method for producing a copolymer of ethylene and an α-olefin is not particularly limited. For example, it may not only be produced by the thermal reaction of ethylene with an α-olefin using no catalyst but also may be obtained by copolymerizing ethylene with an α-olefin by using a predetermined catalyst. The catalyst includes an organic peroxide catalyst such as benzoyl peroxide and the like; a Friedel-Crafts type catalyst such as aluminum chloride, aluminum-chloride-polyhydric alcohol, aluminum chloride-titanium tetrachloride, aluminum chloride-alkyl tin halide, boron fluoride and the like; a Ziegler type catalyst such as organic aluminum chloride-titanium tetrachloride, organic aluminum-titanium tetrachloride and the like; a vanadium catalyst such as organic aluminum-vanadium oxytrichloride; a metallocene catalyst such as aluminoxane-zirconocene, ionic compound-zirconocene and the like; a Lewis acid complex catalyst such as aluminum chloride-base, boron fluoride-base and the like; and the like.

When the heat treating oil composition according to the present embodiment contains a copolymer of ethylene and an α-olefin, the ethylene content in the copolymer is not particularly limited, but from the viewpoint of the oxidative stability, quenching properties and photoluminescence of the finally resulting heat treating oil composition, the content of the ethylene component unit in the copolymer is preferably from 40 to 80% by mass, more preferably from 45 to 70% by mass and further more preferably from 50 to 60% by mass, based on the total amount of the copolymer.

Further, the hydrogenated product of the component (A-1) is a component in which the double bond of the polyolefin is hydrogenated. The hydrogenated product tends to be excellent in thermal and oxidative stability compared to the unhydrogenated one.

The hydrogenated product of a polyolefin may be obtained by an arbitrary method. For example, it may be obtained by hydrogenating polyolefins with hydrogen in the presence of a well-known hydrogenation catalyst to saturate the double bond present in the polyolefins. In addition, the production of polyolefins and the hydrogenation of the double bond present in the polyolefins may be performed at one step by an arbitrary selection of a polymerization catalyst. Further, commercially available products under the name of an ethylene-propylene copolymer for a lubricating oil base oil or lubricating oil additive are generally ones in which the double bond is already hydrogenated and which are preferably used as a cooling property improver.

The molecular weight of the polyolefin (A-1) and/or its hydrogenated product is not particularly limited, but from the viewpoint of the excellent degradation stability, the number average molecular weight is preferably from 1200 to 4000 and more preferable 1500 to 3000. In addition, if the number average molecular weight is less than 1200, the quenching properties of the heat treating oil composition tends to be insufficient, and if the number average molecular weight exceeds 4000, the thermal and oxidative stability of the heat treating oil composition tends to be insufficient.

The asphalt of the component (A-2) includes a petroleum asphalt or a natural asphalt or the like.

In addition, the product having insoluble matters removed from the asphalt of the component (A-2) is one obtained by removing components having a low solubility in a mineral oil by applying a solvent extraction method and the like to the asphalt.

As the asphalt (A-2) and the product having insoluble matters removed from the asphalt, preferred is one having a needle penetration (25° C.) of from 0 to 300 as measured according to 6.3 "Penetration Test Method" of JISK 2207 "Petroleum Asphalt", a softening point of from 30 to 150° C. as measured according to 6.4 "Softening Point Test Method" and a density of 1.0 g/cm$^3$ (15° C.) or more.

In addition, since the addition of the component (A-2) does not impair the performance of heat treating oil composition but is accompanied by coloration, when a transparent heating oil is desired, it is preferable not to use the component (A-2).

As the alkali earth metal salt of salicylic acid which is the component (A-3), various compounds may be used, and preferred is a salicylate compound represented by the following general formula (52).

[Chem. 52]

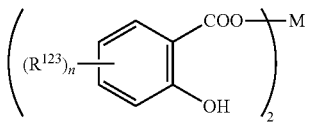

(52)

(In the formula, $R^{123}$ represents an alkyl group having 8 to 20 carbon atoms, n represents an integer of 1 to 4, and M represents a calcium atom, barium atom or magnesium atom.)

In the above general formula (52), specific examples of the alkyl group having 8 to 20 carbon atoms represented by $R^{123}$ include straight-chain or branched-chain octyl group, straight-chain or branched-chain nonyl group, straight-chain or branched-chain decyl group, straight-chain or branched-chain undecyl group, straight-chain or branched-chain dodecyl group, straight-chain or branched-chain tridecyl group, straight-chain or branched-chain tetradecyl group, straight-chain or branched-chain pentadecyl group, straight-chain or branched-chain hexadecyl group, straight-chain or branched-chain heptadecyl group, straight-chain or branched-chain octadecyl group, straight-chain or branched-chain nonadecyl group, straight-chain or branched-chain icosyl group and the like.

In addition, M in the above general formula (52) represents a calcium atom, a barium atom or a magnesium atom, and in the present embodiment, preferably used is a calcium salt or a magnesium salt of salicylic acid.

The base value (TBN) of the alkali earth metal salt of salicylic acid (A-3) is not particularly limited, but if there is used one having a base value of 500 mg KOH/g or less, preferably 100 to 400 mg KOH/g, it is effective for improvement in photoluminescence of a product to be processed.

The alkali earth metal salt of salicylic acid (A-3) may used alone or may be used by optionally combining two or more thereof.

In the present embodiment, even among the components (A-1) to (A-3), there may be preferably used, as the cooling property improver, at least one selected from a copolymer of ethylene and an α-olefin having 3 to 20 carbon atoms, an asphalt and a product having insoluble matters removed from the asphalt and an alkali earth metal salt of alkylsalicylic acid.

The content of the cooling property improver in the heat treating oil composition according to the present embodiment may be arbitrarily selected, but from the viewpoint of the effect of improving quenching properties, it is preferably 0.01% by mass or more, more preferably 0.05% by mass or more and further more preferably 0.1% by mass or more, based on the total amount of the composition. In addition, from the viewpoint of capable of effectively obtaining the effect of improving quenching properties corresponding to the content, the content of the cooling property improver is preferably 20% by mass or less, more preferably 10% by mass or less and further more preferably 7.0% by mass or less, based on the total amount of the composition.

The heat treating oil composition according to the present embodiment may be one composed only of the lubricating oil base oil and the cooling property improver, but in order to improve the performance, various additives described below may be incorporated as needed.

As the additives other than the cooling property improver used in the present invention, there may be exemplified, for example, a photoluminescence improver such as a sulfur compound including sulfides, disulfides, polysulfides, mercaptans, thiophenes and the like, a fatty acid including oleic acid, a cottonseed oil fatty acid and the like, a fatty acid ester, a terpene resin and the like; an antioxidant such as a phenol compound including 2,4-di-t-butyl-p-cresol and the like, an amine compound including diphenylamine, phenyl-α-naphthylamine and the like; a surfactant such as an alkali earth metal sulfonate, an alkali earth metal phenate, an alkali earth metal salicylate, a sorbitan ester, a polyoxyalkylene compound, an alkenylsuccinic acid amide and the like; and the like. The content of these additives may be arbitrarily selected, but the total of the content of the additives other than the cooling property improver is preferably 0.01 to 20% by mass, based on the total amount of the composition.

The heat treating oil composition according to the present embodiment having the above constitution is useful as a heat treating oil which has sufficient hardness and is capable of securely providing a metal product to be processed having less strain, and is suitably used as a heat treating oil during subjecting various alloy steels such as carbon steel, nickel-manganese steel, chromium-molybdenum steel, manganese steel and the like to heat treatment such as quenching, annealing, tempering, preferably quenching. Especially, the heat treating oil composition according to the present embodiment may exhibit excellent performance in the heat treatment such as gas-carburizing quenching, non-oxidation quenching and the like of precision instrument parts or complicatedly shaped parts in an all-case furnace, a continuous furnace and the like.

Sixth Embodiment

Lubricating Oil Composition for Machine Tools

A lubricating oil composition for machine tools according to a sixth embodiment of the present invention comprises the lubricating oil base oil according to the present invention and a compound containing cold phosphorus and/or sulfur as a constituent element(s).

In addition, in the lubricating oil composition for machine tools according to the present embodiment, since the aspect of the lubricating oil base oil according to the present invention is similar to the case of the first embodiment, the overlapping explanation is here omitted.

Further, in the lubricating oil composition for machine tools according to the present embodiment, the lubricating oil base oil according to the present invention may be used alone or in combination with one or two or more of other base oils. In addition, since specific examples of the other base oils and the content of the lubricating oil base oil according to the present invention in the mixed base oil are similar to the case of the first embodiment, the overlapping explanation is here omitted.

Further, since the compound, which contains phosphorus and/or sulfur contained in the lubricating oil composition for machine tools according to the present embodiment as a constituent element(s), is similar to the case of the third embodiment, the overlapping explanation is here omitted.

The lubricating oil composition for machine tools according to the present embodiment may be one composed of the lubricating oil base oil according to the present invention and a compound containing phosphorus and/or sulfur as a constituent element(s), but may further contain the additives described below in order to further improve the performance.

From the viewpoint of the sludge suppressability, the lubricating oil composition for machine tools according to the present embodiment may further contain a dispersion type viscosity index improver. Since the dispersion type viscosity index improver in the present embodiment is similar to the dispersion type viscosity index improver in the third embodiment, the overlapping explanation is here omitted.

In addition, from the viewpoint that the lubricating oil composition for machine tools according to the present embodiment may further improve friction characteristics, it preferably contains at least one selected from the compounds represented by the general formulas (30) to (32) which are explained in the third embodiment, or further preferably contains the compound represented by the general formula (33).

Further, from the viewpoint of the sludge suppressability, the lubricating oil composition for machine tools according to the present embodiment may contain an epoxy compound. Since specific examples and preferred examples of the epoxy compound in the present embodiment are similar to the case of the epoxy compound in the first embodiment, the overlapping explanation is here omitted.

If the lubricating oil composition for machine tools according to the present embodiment contains the epoxy compound, the content is not particularly limited, but is preferably from 0.1 to 5.0% by mass and more preferably from 0.2 to 2.0% by mass, based on the total amount of the composition.

In addition, from the viewpoint that the lubricating oil composition for machine tools according to the present embodiment may further improve oxidative stability, it may contain a phenol-based antioxidant or an amine-based antioxidant or both of them. Since the phenol-based antioxidant and the amine-based antioxidant in present embodiment are similar to the phenol-based antioxidant and the amine-based antioxidant in second embodiment, the overlapping explanation is here omitted.

Further, from the viewpoint of the improvement in friction characteristics, the lubricating oil composition for machine tools according to the present embodiment may contain an oiliness agent. Since the oiliness agent in the present embodiment is similar to the oiliness agent in the third embodiment, the overlapping explanation is here omitted.

In addition, from the viewpoint of the improvement in thermal and oxidative stability, the lubricating oil composition for machine tools according to the present embodiment may contain a triazole represented by the formula (45) and/or a derivative thereof which is described in the explanation of the third embodiment.

Further, in order to further improve the performance, there are incorporated in the lubricating oil composition for machine tools according to the present embodiment various additives represented by rust preventives, metal deactivators, viscosity index improvers other than the dispersion type viscosity index improver, cleaning dispersants, pour point depressants, defoaming agents, which may be used alone or in combination with plural thereof when needed. Since these additives are similar to the case of the third embodiment, the overlapping explanation is here omitted.

The lubricating oil composition for machine tools according to the present embodiment having the above constitution is capable of achieving all of the friction characteristics, stick-slip-reducing properties and thermal and oxidative stability in a balanced manner at a high level, and is very useful in improving the performance of machine tools.

The lubricating oil composition for machine tools according to the present embodiment is especially suitably used for the lubrication of a sliding guide surface of machine tools and is suitably used for the lubrication of various bearings, gears, hydraulic pressure systems and the like of machine tools.

Seventh Embodiment

Lubricating Oil Composition

The lubricating oil composition according to a seventh embodiment of the present invention comprises the lubricating oil base oil according to the present invention and a compound containing cold phosphorus and/or sulfur as a constituent element(s).

In addition, in the lubricating oil composition according to the present embodiment, since the aspect of the lubricating oil base oil according to the present invention is similar to the case of the first embodiment, the overlapping explanation is here omitted.

Further, in the lubricating oil composition according to the present embodiment, the lubricating oil base oil according to the present invention may be used alone or in combination with one or two or more of other base oils. In addition, since specific examples of the other base oils and the content of the lubricating oil base oil in the mixed base oil are similar to the case of the first embodiment, the overlapping explanation is here omitted.

Further, the lubricating oil composition according to the present embodiment contains an ashless antioxidant (A) containing no sulfur as a constituent element. As the component (A), preferred is a phenol-based or amine-based ashless antioxidant containing no sulfur as a constituent element.

Specific examples of the phenol-based ashless antioxidant containing no sulfur as a constituent element include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresole, 2,6-di-tert-butyl-4(N,N'-dimethylaminomethylphenol), octyl-3-(3,5-di-tert-butyl-4-hydroxyphenyl)propionate, tridecyl-3-(3,5-di-tert-butyl-4-hydroxyphenyl)propionate, pentaerythrityl-tetrakis[3-(3,5-di-tert-butyl-4-hydroxyphenyl)propionate], octadecyl-3-(3,5-di-tert-butyl-4-hydroxyphenyl)propionate, octyl-3(3,5-di-tert-butyl-4-hydroxyphenyl)propionate, octyl-3-(3-methyl-5-tert-butyl-4-hydroxyphenyl)propionate, and a mixture thereof, and the like. Among these, preferred are a hydroxyphenyl-substituted ester-based antioxidant (octyl-3-(3,5-di-tert-butyl-4-hydroxyphenyl)propionate, octyl-3-(3-methyl-5-tert-butyl-4-hydroxyphenyl)propionate and the like) which is an ester of a hydroxyphenyl-substituted fatty acid and an alcohol having 4 to 12 carbon atoms and a bisphenol-based antioxidant, and more preferred is a hydroxyphenyl-substituted ester-based antioxidant. In addition, preferable is a phenol compound having a molecular weight of 240 or more because it has a high decomposition temperature and provides the effect even under a higher temperature condition.

Further, as the amine-based ashless antioxidant containing no sulfur as a constituent element, preferred are an amine-based antioxidant and a phenol-based antioxidant, and more preferred is an amine-based antioxidant. In addition, since the amine-based antioxidant and the phenol-based antioxidant in the present embodiment are similar to the case of the amine-based antioxidant and the phenol-based antioxidant in the second embodiment, the overlapping explanation is here omitted.

The content of the ashless antioxidant containing no sulfur as a constituent element is 0.3 to 5% by mass, preferably 0.3 to 3% by mass and more preferably 0.4 to 2% by mass, based on the total amount of the composition. If the content of the ashless antioxidant is less than 0.3% by mass, the thermal and oxidative stability and sludge suppressability tend to be insufficient. On the other hand, if the content of the ashless antioxidant exceeds 5% by mass, it is not preferable because the effect of the thermal and oxidative stability and sludge suppressability corresponding to the content may not be obtained and is also economically disadvantageous.

The lubricating oil composition according to the present embodiment may be one composed only of the lubricating oil base oil and an ashless antioxidant, however, from the viewpoint of being capable of further improving the thermal and oxidative stability and sludge suppressability, it preferably further contains an alkyl group-substituted aromatic hydrocarbon compound.

In the present embodiment, as the alkyl group-substituted aromatic hydrocarbon compound, there is preferably used at least one selected from an alkylbenzene, an alkylnaphthalene, an alkylbiphenyl and an alkyldiphenylalkane.

Specific examples of the alkyl group in the alkylbenzene include an alkyl group having 1 to 40 carbon atoms, such as methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, icosyl group, henicosyl group, docosyl group, tricosyl group, tetracosyl group, pentacosyl group, hexacosyl group, heptacosyl group, octacosyl group, nonacosyl group, triacontyl group, hentriaconstyl group, dotriacontyl group, tritriacontyl group, tetratriacontyl group, pentatriacontyl group, hexatriacontyl group, heptatriacontyl group, octatriacontyl group, nonatriacontyl group, tetracontyl group and the like. In addition, these groups individually contain all isomers. Among these, preferably used is an alkylbenzene, which has one to four (more preferably one or two) alkyl groups having 8 to 30 carbon atoms and in which the total carbon number of the alkyl group is 10 to 50 (more preferably 20 to 40).

The alkyl group which the alkylbenzene has may be straight-chain or branched-chain, but from the viewpoint of the stability, viscosity properties and the like, a branched-chain alkyl group is preferable, and from the viewpoint of especially the availability, more preferred is an branched-chain alkyl group derived from an oligomer of an olefin such as propylene, butene, isobutylene and the like.

The number of the alkyl groups in the alkylbenzene is preferably 1 to 4, but from the viewpoint of the stability and availability, most preferably used is an alkylbenzene having one or two alkyl groups, that is, a monoalkylbenzene or a dialkylbenzene, or a mixture thereof.

The alkylbenzene may be used alone or used as a mixture of two or more thereof. If the mixture of two or more of alkylbenzenes is used, the average molecular weight of the mixture is preferably 200 to 500.

The method for producing an alkylbenzene is arbitrary and is not in any way limited, but the alkylbenzene may be produced by the following synthetic methods. As the aromatic hydrocarbon group which becomes a raw material, specifically used are, for example, benzene, toluene, xylene, ethylbenzene, methylethylbenzene, diethylbenzene, a mixture thereof and the like. In addition, as the alkylating agent, there may be specifically used, for example, a lower monoolefin such as ethylene, propylene, butene, isobutylene and the like, preferably a straight-chain or branched-chain olefin having 6 to 40 carbon atoms obtained by the polymerization of propylene; a straight-chain or branched-chain olefin having 6 to 40 carbon atoms obtained from the thermal cracking of wax, heavy oil, petroleum fraction, polyethylene, polypropylene and the like; a straight-chain olefin having 6 to 40 carbon atoms obtained by separating n-paraffin from petroleum fraction such as kerosene, light oil and the like and followed by olefination of the resulting n-paraffin by catalyst; a mixture thereof; and the like.

In addition, as the alkylation catalyst in alkylating, there is used a well-known catalyst such as a Friedel-Crafts type catalyst including aluminum chloride, zinc chloride and the like; an acidic catalyst including sulfuric acid, phosphoric acid, phosphotungsten acid, hydrofluoric acid, activated clay and the like; and the like.

As the alkylnaphthalene, there is preferably used a compound represented by the following general formula (53):

[Chem. 53]

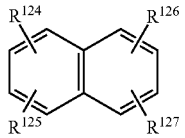

(53)

[In the formula (53), $R^{124}$, $R^{125}$, $R^{126}$ and $R^{127}$ may be the same or different from one another and individually represent a hydrogen atom or a hydrocarbon group having 1 to 40 carbon atoms, and at least one of $R^{124}$, $R^{125}$, $R^{126}$ or $R^{127}$ is an alkyl group.]

$R^{124}$, $R^{125}$, $R^{126}$ and $R^{127}$ in the general formula (53) individually represent a hydrogen atom or a hydrocarbon group, and the hydrocarbon group contains, in addition to the alkyl group, an alkenyl group, an aryl group, an alkylaryl group, an arylalkyl group and the like, but all of $R^{124}$, $R^{125}$, $R^{126}$ and $R^{127}$ are preferably alkyl groups.

The alkyl group includes one exemplified as the alkyl group which the alkylbenzene has in the explanation of the alkylbenzene. Among these, preferred is an alkyl group having 8 to 30 carbon atoms and more preferred is an alkyl group having 10 to 20 carbon atoms.

In addition, in the alkylnaphthalene represented by the general formula (53), $R^{124}$, $R^{125}$, $R^{126}$ and $R^{127}$ may be the same or different from one another. That is, it may be one in which all of $R^{124}$, $R^{125}$, $R^{126}$ and $R^{127}$ are hydrocarbon groups containing an alkyl group, or may be one in which at least one of $R^{124}$, $R^{125}$, $R^{126}$ or $R^{127}$ is an alkyl group and the others are hydrogen atoms. The total carbon number of $R^{124}$, $R^{125}$, $R^{126}$ and $R^{127}$ is preferably 8 to 50 and more preferably 10 to 40.

When two or more of $R^{124}$, $R^{125}$, $R^{126}$ and $R^{127}$ are hydrocarbon groups, if at least one of them is an alkyl group, the combination is arbitrary, but they are preferably all alkyl groups. In addition, it may be one in which two hydrocarbon groups are bonded to the same benzene ring such that $R^{124}$ and $R^{125}$ are hydrocarbon groups, or may be one in which one each of a hydrocarbon group is bonded to a different benzene ring such that $R^{124}$ and $R^{125}$ are hydrocarbon groups.

Specific examples of the alkylnaphthalene represented by the general formula (53) include decylnaphthalene, undecylnaphthalene, dodecylnaphthalene, tridecylnaphthalene, tetradecylnaphthalene, pentadecylnaphthalene, hexadecylnaphthalene, heptadecylnaphthalene, octadecylnaphthalene, nonadecylnaphthalene, icosylnaphthalene, di(decyl)naphthalene, di(undecyl)naphthalene, di(dodecyl)naphthalene, di(tridecyl)naphthalene, di(tetradecyl)naphthalene, di(pentadecyl)naphthalene, di(hexadecyl)naphthalene, di(heptadecyl)naphthalene, di(octadecyl)naphthalene, di(nonadecyl)naphthalene, and di(icosyl)naphthalene. In addition, these compounds individually contain all isomers.

Among these, preferred is an alkylnaphthalene which has one to four (more preferably one or two) alkyl groups having 8 to 30 carbon atoms (preferably 10 to 20) and in which the total carbon number of the alkyl group that the alkylnaphthalene has is 8 to 50 (more preferably 10 to 40).

The alkylnaphthalene may be used alone or used as a mixture of two or more thereof. If the mixture of two or more of alkylnaphthalene is used, the average molecular weight of the mixture is preferably 200 to 500.

The method for producing the alkylnaphthalene is arbitrary and the alkylnaphthalene may be produced by various well-known methods. Examples of the production method include, for example, a method of adding hydrocarbon halogenation products, olefins, styrenes and the like to naphthalene in the presence of an acid catalyst such as a mineral acid including sulfuric acid, phosphoric acid, phosphotungsten acid, hydrofluoric acid and the like, a solid acid substance including acid clay, activated clay and the like, a Friedel-Crafts type catalyst which is a metal halide including aluminum chloride, zinc chloride and the like.

As the alkylbiphenyl, there is preferably used represented by the following general formula (54):

[Chem. 54]

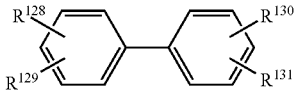

(54)

wherein $R^{128}$, $R^{129}$, $R^{130}$ and $R^{131}$ may be the same or different from one another and individually represent a hydrogen atom or a hydrocarbon group having 1 to 40 carbon atoms, and at least one of $R^{128}$, $R^{129}$, $R^{130}$ or $R^{131}$ is an alkyl group.

The hydrocarbon groups represented by $R^{128}$, $R^{129}$, $R^{130}$ and $R^{131}$ in the general formula (54) include the alkyl group, as well as an alkenyl group, an aryl group, an alkaryl group, and an aralkyl group. All of $R^{128}$, $R^{129}$, $R^{130}$ and $R^{131}$ are preferably alkyl groups.

The alkyl group includes one exemplified as the alkyl group which the alkylbenzene has in the explanation of the alkylbenzene. Among these, preferred is an alkyl group having 8 to 30 carbon atoms and more preferred is an alkyl group having 10 to 20 carbon atoms.

In addition, in the alkylbiphenyl represented by the general formula (54), $R^{128}$, $R^{129}$, $R^{130}$ and $R^{131}$ may be the same or different from one another. That is, it may be one in which all of $R^{128}$, $R^{129}$, $R^{130}$ and $R^{131}$ are alkyl groups, or may be one in which at least one of $R^{128}$, $R^{129}$, $R^{130}$ or $R^{131}$ is an alkyl group and the others are hydrogen atoms or hydrocarbon groups other than an alkyl group. The total carbon number of $R^{128}$, $R^{129}$, $R^{130}$ and $R^{131}$ is preferably 8 to 50 and more preferably 10 to 40.

When two or more of $R^{128}$, $R^{129}$, $R^{130}$ and $R^{131}$ are hydrocarbon groups, if at least one of them is an alkyl group, the combination is arbitrary, and it may be one in which two hydrocarbon groups are bonded to the same benzene ring such that $R^{128}$ and $R^{129}$ are hydrocarbon groups, or may be one in which one each of a hydrocarbon group is bonded to a different benzene ring such that $R^{128}$ and $R^{130}$ are hydrocarbon groups.

The alkylbiphenyl may be used alone or used as a mixture of two or more thereof. If the mixture of two or more of alkylbiphenyls is used, the average molecular weight of the mixture is preferably 200 to 500.

The method for producing the alkylbiphenyl is arbitrary and the alkylbiphenyl may be produced by various well-known methods. Examples of the production method include, for example, a method of adding hydrocarbon halogenation products, olefins, styrenes and the like to biphenyl in the presence of an acidic catalyst such as a mineral acid including sulfuric acid, phosphoric acid, phosphotungsten acid, hydrofluoric acid and the like, a solid acid substance including acid clay, activated clay and the like, a Friedel-Crafts type catalyst which is a metal halide including aluminum chloride, zinc chloride and the like.

As the alkyldiphenylalkane, there is preferably used a compound represented by the following general formula (55):

[Chem. 55]

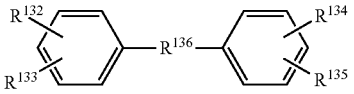

(55)

wherein $R^{132}$, $R^{133}$, $R^{134}$ and $R^{135}$ may be the same or different from one another and individually represent a hydrogen atom or a hydrocarbon group having 1 to 40 carbon atoms, at least one of $R^{130}$, $R^{131}$, $R^{132}$ and $R^{133}$ is an alkyl group, and $R^{135}$ represents an alkylene group or an alkenyl group having 1 to 8 carbon atoms.

The hydrocarbon groups represented by $R^{132}$, $R^{133}$, $R^{134}$ and $R^{135}$ in the general formula (55) include the alkyl group, an alkenyl group, an aryl group, an alkaryl group, and an aralkyl group. All of $R^{132}$, $R^{133}$, $R^{134}$ and $R^{135}$ are preferably alkyl groups.

The alkyl group includes one exemplified as the alkyl group which the alkylbenzene has in the explanation of the alkylbenzene. Among these, preferred is an alkyl group having 8 to 30 carbon atoms and more preferred is an alkyl group having 10 to 20 carbon atoms.

In addition, in the diphenyl alkane represented by the general formula (55), $R^{132}$, $R^{133}$, $R^{134}$ and $R^{135}$ may be the same or different from one another. That is, it may be one in which all of $R^{132}$, $R^{133}$, $R^{134}$ and $R^{135}$ are alkyl groups, or may be one in which at least one of $R^{132}$, $R^{133}$, $R^{134}$ or $R^{135}$ is an alkyl group and the others are hydrogen atoms or hydrocarbon groups other than an alkyl group. The total carbon number of $R^{132}$, $R^{133}$, $R^{134}$ and $R^{135}$ is preferably 8 to 50 and more preferably 10 to 40.

When two or more of $R^{132}$, $R^{133}$, $R^{134}$ and $R^{135}$ are hydrocarbon groups, if at least one of them is an alkyl group, the combination is arbitrary, and it may be one in which two hydrocarbon groups are bonded to the same benzene ring such that $R^{132}$ and $R^{133}$ are hydrocarbon groups, or may be one in which one each of a hydrocarbon group is bonded to a different benzene ring such that $R^{132}$ and $R^{134}$ are hydrocarbon groups.

In addition, $R^{136}$ in the general formula (55) represents an alkylene group or an alkenylene group.

As the $R^{136}$, preferable is an alkylene group or an alkenylene group having 1 to 8 carbon atoms and more preferable is an alkylene group or an alkenylene group having 1 to 6 carbon atoms. The most preferred ones include; an alkenylene group having 1 to 3 carbon atoms such as methylene group, methylmethylene group (ethylidene group), ethylene group, ethylmethylene group (propylidene group), dimethylmethylene group (isopropylidene group), methylethylene group (propylene group), trimethylene group and the like; an alkenylene group having 2 to 3 carbon atoms such as vinylidene group, ethenylene group (vinylene group), propenylene group, methyleneethylene group, methylethenylene group, 1-propenylidene group, 2-propenylidene group and the like; among alkylene groups having 4 to 6 carbon atoms, 1-methyltrimethylene group, 1-ethyltrimethylene group, 1,1-dimethyltrimethylene group, 1,2-dimethyltrimethylene group, 1,3-dimethyltrimethylene group, 1-ethyl-3-methyltrmethylene group, 1-ethyl-2-methyltrimethylene group, 1,1,2-trimethyltrimethylene group, 1,1,3-trimethyltrimethylene group; among alkenylene groups having 4 to 6 carbon atoms, 3-methylpropenylene group, 1-methyl-3-methylenetrimethylene group, 3-ethylpropenylene group, 1,3-dimethylpropenylene group, 2,3-dimethylpropenylene group, 3,3-dimethylpropenylene group, 1,1-dimethyl-3-methylenetrimethylene group, 1-ethyl-3-methylenetrimethylene group, 3-ethyl-1-methylpropenylene group, 3-ethyl-2-methylpropenylene group, 1,3,3-trimethylpropenylene group, 2,3,3-trimethylpropenylene group; and the like.

The diphenyl alkane may be used alone or used as a mixture of two or more thereof. If the mixture of two or more of diphenyl alkanes is used, the average molecular weight of the mixture is preferably 200 to 500.

The method for producing the diphenyl alkane is arbitrary and the diphenyl alkane may be produced by various well-known methods. Several examples of the production method are shown below.

For example, the diphenyl alkane may be obtained by adding styrenes such as styrene, α- or β-methylstyrene, ethylstyrene and the like to an alkylbenzene in the presence of an acid catalyst. As the acid catalyst, there may be used a mineral acid such as sulfuric acid, phosphoric acid and the like, a solid acid substance such as acid clay, activated clay and the like, a Friedel-Crafts type catalyst which is a metal halide, and the like.

In addition, the alkyldiphenylalkane is also produced by the polymerization reaction of the styrenes in the presence of a suitable acid catalyst. In this case, the copolymerization may be conducted by using a single styrene compound or two or more of styrene compounds. As the acid catalyst, there may be used a mineral acid such as sulfuric acid, phosphoric acid and the like, a solid acid substance such as acid clay, activated clay and the like, a Friedel-Crafts catalyst which is a metal halide, and the like. In general, the hydrocarbon compound obtained by this method is a compound in which two benzene rings are linked by an alkenylene group. In the present embodiment, there may be used the compound as is, or there may be used a compound obtained by subjecting the alkenylene group to hydrogenation treatment in the presence of a suitable catalyst to convert the alkenylene group into an alkylene group.

With respect to the alkylation of an aromatic hydrocarbon compound, the Friedel-Crafts reaction of chlorides is well known, and the diphenyl alkane may be also produced by this method. For example, the hydrocarbon compound according to the present embodiment is obtained by reacting an alkylbenzene in which a side chain alkyl group is chlorinated with benzene or an alkylbenzene in the presence of a suitable Friedel-Crafts catalyst such as a metal halide and the like. In addition, there may be also mentioned a method of subjecting an alkane dihalide to coupling reaction with benzene or an alkylbenzene in the presence of a suitable Friedel-Crafts catalyst such as a metal halide to obtain the hydrocarbon compound according to the present embodiment.

The alkyldiphenylalkane may be produced by using an alkylbenzene having an alkyl group represented by $R^{132}$ to $R^{135}$ by the above method, or may be produced by adding an alkyl group represented by $R^{132}$ to $R^{135}$ to the diphenyl alkane produced by the above method and the like in various manners.

In the present embodiment, the aromatic hydrocarbon compounds having an alkyl group include an alkylbenzene, an alkylnaphthalene, an alkylbiphenyl and an alkyldiphenylalkane, and they may be used alone or in combination with two or more thereof. Among these, especially preferred is an alkylbenzene or an alkylnaphthalene and most preferred is an alkylnaphthalene from the viewpoint of excellent effect of improving the sludge suppressability.

The viscosity of the alkyl group-substituted aromatic hydrocarbon compound used in the present invention is not particularly limited, but the kinematic viscosity at 40° C. is preferably 10 to 100 $mm^2/s$, more preferably 20 to 80 $mm^2/s$ and further more preferably 25 to 60 $mm^2/s$.

When the lubricating oil composition according to the present embodiment contains an alkyl group-substituted aromatic hydrocarbon compound, from the viewpoint of the thermal and oxidative stability and sludge suppressability, the content of the alkyl group-substituted aromatic hydrocarbon compound is preferably 2% by mass or more, more preferably 5% by mass or more and further more preferably 10% by mass or more, based on the total amount of the composition. In addition, from the viewpoint of the viscosity-temperature properties, the content of the alkyl group-substituted aromatic hydrocarbon compound is preferably 50% by mass or less, more preferably 30% by mass or less, further more preferably 20% by mass or less and particularly preferably 15% by mass or less, based on the total amount of the composition.

Further, in order to further improve the various performances, the lubricating oil composition according to the present embodiment may further contain other well-known lubricating oil additives including, for example, a rust preventive, an anticorrosive, a pour point depressant, a defoaming agent and the like. These additives may be used alone or in combination with two or more. Since these additives in the present invention are similar to the case of the second embodiment, the overlapping explanation is here omitted.

The lubricating oil composition according to the present embodiment constituting the above constitution is capable of achieving the thermal and oxidative stability and sludge suppressability in a balanced manner at a high level, and is very useful as a lubricating oil composition for a high temperature application. Here, in the high temperature application, the use temperature is not particularly limited, but when the temperature of the oil to be recyclically used in a tank is continuously 60° C. or higher, it is preferable because the above effect according to the present invention can be achieved at a high level. Furthermore, when the temperature is 80° C. or higher, it is more preferable because a more excellent effect can be achieved, and when the temperature is 100° C. or higher, it is further more preferable because a further more excellent effect can be achieved. The high-temperature applications include a large capacity steam turbine, a gas turbine using a combustion of LNG or a by-product gas from ironworks as a working medium, various rotary gas compressors, a construction machine which is operated at a high temperature and the like, however, the applications of the lubricating oil composition of the present invention are not limited to these areas.

EXAMPLES

Hereinafter, the present invention will be specifically explained based on Examples and Comparative Examples, but the present invention is in no way limited to these Examples.

[Production of Lubricating Oil Base Oil]

(Base Oils 1 to 3)

In the process of purifying a solvent purifying base oil, a fraction separated by reduced pressure distillation was solvent extracted with furfural and followed by hydrogenation treatment. Thereafter, the resulting product was solvent dewaxed with a methylethylketone-toluene mixed solvent. A wax component (hereinafter, referred to as "WAX1") removed during the solvent dewaxing was used as a raw material for a lubricating oil base oil. The properties of WAX1 are shown in Table 1.

TABLE 1

| | |
|---|---|
| Name of Raw Material Wax | WAX1 |
| Kinematic Viscosity at 100° C. ($mm^2/s$) | 6.6 |
| Melting Point (° C.) | 60 |
| Oil Content (% by mass) | 6.1 |
| Sulfur Content (ppm by mass) | 880 |

Subsequently, the WAX 1 was hydrocracked in the presence of a hydrocracking catalyst under the conditions of a hydrogen partial pressure of 5 MPa, an average reaction temperature of 340° C. and an LHSV of 0.8 $hr^{-1}$. As the hydrocracking catalyst, there was used a catalyst in which nickel and molybdenum are supported on an amorphous silica-alumina carrier in a sulfurized state.

Thereafter, the cracked product obtained by the above-mentioned hydrogenolysis was distilled under reduced pressure to obtain 20% by volume of a lubricating oil fraction relative to the raw material oil. The lubricating oil fraction was solvent dewaxed with a methylethylketone-toluene mixed solvent under the conditions of a two-fold ratio of solvents to oils and a filtration temperature of −30° C., thereby obtaining three of lubricating oil base oils having different viscosity grades (hereinafter, referred to as "Base Oil 1", "Base Oil 2" and "Base Oil 3").

(Base Oils 4 to 6)

A mixture of 700 g of zeolite and 300 g of alumina binder was mixed and kneaded to form a cylindrical shape having a diameter of 1/16 inches (approximately 1.6 mm) and a height of 8 mm. The resulting cylindrical product was sintered at 480° C. for two hours to obtain a carrier. The carrier was impregnated with an aqueous solution of dichlorotetraamine platinum (II) in an amount of 1.0% by mass of the carrier in terms of platinum and then dried at 125° C. for two hours, followed by sintering at 380° C. for one hour to obtain the target catalyst.

Next, the resulting catalyst was filled in a fixed bed flow reactor, and by using this reactor, a raw material oil containing a paraffinic hydrocarbon was subjected to hydrogenolysis and hydroisomerization. In this process, as the raw material oil, there was used an FT wax (hereinafter referred to as "WAX2") having a paraffin content of 95% by mass and a carbon number distribution of 20 to 80. The properties of WAX2 are shown in Table 2. The conditions for the hydrogenolysis were set at a hydrogen pressure of 3.5 MPa, a reaction temperature of 340° C. and an LHSV of 1.5 $h^{-1}$, thereby obtaining a cracking/isomerization product oil in an amount of 25% by mass (cracking percentage: 25%) of a fraction (cracking product) having a boiling point of 370° C. or less relative to the raw material.

TABLE 2

| | |
|---|---|
| Name of Raw Material Wax | WAX2 |
| Kinematic Viscosity at 100° C. ($mm^2/s$) | 5.9 |
| Melting Point (° C.) | 69 |
| Oil Content (% by mass) | <1 |
| Sulfur Content (ppm by mass) | <0.2 |

Next, the cracking/isomerization product oil obtained in the above hydrogenolysis and hydroisomerization process was distilled under reduced pressure to obtain a lubrication oil fraction. The lubricating oil fraction was solvent dewaxed with a methylethylketone-toluene mixed solvent under the conditions of a three-fold ratio of solvents to oils and a filtration temperature of −30° C., thereby obtaining three of lubricating oil base oils having different viscosity grades (hereinafter, referred to as "Base Oil 4", "Base Oil 5" and "Base Oil 6").

(Base Oils 7 to 9)

In the process of purifying a solvent purifying base oil, a fraction separated by reduced pressure distillation was solvent extracted with furfural and followed by hydrogenation treatment. Thereafter, the resulting product was solvent dewaxed with a methylethylketone-toluene mixed solvent. A wax component (hereinafter, referred to as "WAX3") obtained by further deoiling a slack wax removed during the solvent dewaxing was used as a raw material for a lubricating oil base oil. The properties of Wax3 are shown in Table 3.

TABLE 3

| | |
|---|---|
| Name of Raw Material Wax | WAX3 |
| Kinematic Viscosity at 100° C. ($mm^2/s$) | 6.5 |
| Melting Point (° C.) | 51 |
| Oil Content (% by mass) | 19.5 |
| Sulfur Content (ppm by mass) | 2000 |

Subsequently, the WAX 3 was hydrocracked in the presence of a hydrocracking catalyst under the conditions of a hydrogen partial pressure of 5.5 MPa, an average reaction temperature of 340° C. and an LHSV of 0.8 $hr^{-1}$. As the hydrocracking catalyst, there was used a catalyst in which nickel and molybdenum are supported on an amorphous silica-alumina carrier in a sulfurized state.

Thereafter, the cracked product obtained by the above-mentioned hydrogenolysis was distilled under reduced pressure to obtain 20% by volume of a lubricating oil fraction relative to the raw material oil. The lubricating oil fraction was solvent dewaxed with a methylethylketone-toluene mixed solvent under the conditions of a two-fold ratio of solvents to oils and a filtration temperature of −30° C., thereby obtaining three of lubricating oil base oil having different viscosity grades (hereinafter, referred to as "Base Oil 7", "Base Oil 8" and "Base Oil 9").

The various properties and performance evaluation test results of Base Oils 1 to 9 are shown in Tables 4 to 6.

In addition, as the base oils used in Comparative Examples described later, there were prepared Base Oils 10 to 17 shown in Tables 7 to 9 (any of them is mineral base oil) and Base Oils 18 to 20 described below. The various properties and performance evaluation test results of Base Oils 10 to 17 are shown in Tables 7 to 9.

(Base Oil)

Base Oil 18: Poly-α-olefin (Kinematic viscosity at 40° C.: 9.5 $mm^2/s$)

Base Oil 19: Poly-α-olefin (Kinematic viscosity at 40° C.: 21.5 $mm^2/s$)

Base Oil 20: Poly-α-olefin (Kinematic viscosity at 40° C.: 45.5 $mm^2/s$)

TABLE 4

| | | | Base Oil Name | | |
|---|---|---|---|---|---|
| | | | Base Oil 1 | Base Oil 2 | Base Oil 3 |
| Name of Raw Material Wax | | | WAX1 | WAX1 | WAX1 |
| Base Oil Composition (Based on the Total Amount of Base Oil) | Saturated Content | % by mass | 98.2 | 98.1 | 98.2 |
| | Aromatic Content | % by mass | 1.2 | 1.0 | 1.0 |
| | Polar Compound Content | % by mass | 0.6 | 0.9 | 0.8 |
| Details of Saturated Content (Based on the Total Amount of Saturated Content) | Cyclic Saturated Content | % by mass | 3.2 | 4.5 | 6.2 |
| | Non-cyclic Saturated Content | % by mass | 96.8 | 95.5 | 93.8 |
| Content of Non-cyclic Saturated Content (Based on the Total Amount of Base Oil) | Liner Paraffin Content | % by mass | 0.1 | 0.1 | 0.1 |
| | Branched-chain Paraffin Content | % by mass | 95.0 | 93.6 | 92.0 |
| n-d-M Ring Analysis | % $C_P$ | | 91.8 | 93.4 | 94.4 |
| | % $C_N$ | | 7.9 | 6.5 | 6.4 |
| | % $C_A$ | | 0.3 | 0.1 | 0.2 |
| | % $C_P$/% $C_N$ | | 11.62 | 14.37 | 14.75 |
| Sulfur Content | | ppm by mass | <1 | <1 | <1 |
| Nitrogen Content | | ppm by mass | <3 | <3 | <3 |
| Refractive Index (20° C.) $n_{20}$ | | | 1.4497 | 1.4554 | 1.4580 |
| Kinematic Viscosity (40° C.) | | $mm^2/s$ | 10.1 | 17.1 | 34.6 |
| Kinematic Viscosity (100° C.) | | $mm^2/s$ | 2.8 | 4.1 | 6.6 |
| Viscosity Index | | | 123 | 141 | 150 |
| Density (15° C.) | | $g/cm^3$ | 0.809 | 0.819 | 0.825 |
| Iodine Value | | | 0.92 | 0.68 | 0.61 |
| Pour Point | | ° C. | −27.5 | −22.5 | −17.5 |
| Aniline Point | | ° C. | 112 | 119 | 125 |
| Distillation Properties | IBP[° C.] | ° C. | 325 | 362 | 418 |
| | T10[° C.] | ° C. | 353 | 389 | 449 |
| | T50[° C.] | ° C. | 380 | 433 | 480 |
| | T90[° C.] | ° C. | 424 | 473 | 499 |
| | FBP[° C.] | ° C. | 468 | 500 | 532 |
| CCS Viscosity (−35° C.) | | mPa · s | <1000 | 1950 | 14500 |
| NOACK Evaporation Amount (250° C., one hour) | | % by mass | 34.5 | 13.4 | 2.6 |
| RBOT Life (150° C.) | | min | 345 | 390 | 432 |
| Residual Metal Content | Al | ppm by mass | <1 | <1 | <1 |
| | Mo | ppm by mass | <1 | <1 | <1 |
| | Ni | ppm by mass | <1 | <1 | <1 |

TABLE 5

| | | | Base Oil Name | | |
|---|---|---|---|---|---|
| | | | Base Oil 4 | Base Oil 5 | Base Oil 6 |
| Name of Raw Material Wax | | | WAX2 | WAX2 | WAX2 |
| Base Oil Composition (Based on the Total Amount of Base Oil) | Saturated Content | % by mass | 99.4 | 99.3 | 99.2 |
| | Aromatic Content | % by mass | 0.4 | 0.4 | 0.5 |
| | Polar Compound Content | % by mass | 0.2 | 0.3 | 0.3 |
| Details of Saturated Content (Based on the Total Amount of Saturated Content) | Cyclic Saturated Content | % by mass | 0.8 | 0.9 | 2.5 |
| | Non-cyclic Saturated Content | % by mass | 99.2 | 99.1 | 97.5 |
| Content of Non-cyclic Saturated Content (Based on the Total Amount of Base Oil) | Liner Paraffin Content | % by mass | 0.1 | 0.1 | 0.2 |
| | Branched-chain Paraffin Content | % by mass | 98.5 | 98.3 | 96.5 |
| n-d-M Ring Analysis | % $C_P$ | | 95.1 | 96.9 | 95.2 |
| | % $C_N$ | | 2.9 | 3.1 | 5.2 |
| | % $C_A$ | | 0.0 | 0.0 | 0.0 |
| | % $C_P$/% $C_N$ | | 32.79 | 31.26 | 18.31 |
| Sulfur Content | | ppm by mass | <1 | <1 | <1 |
| Nitrogen Content | | ppm by mass | <3 | <3 | <3 |
| Refractive Index (20° C.) $n_{20}$ | | | 1.4510 | 1.4540 | 1.4590 |
| Kinematic Viscosity (40° C.) | | $mm^2/s$ | 10.5 | 17.3 | 35.2 |
| Kinematic Viscosity (100° C.) | | $mm^2/s$ | 2.9 | 4.1 | 6.8 |
| Viscosity Index | | | 125 | 140 | 152 |
| Density (15° C.) | | $g/cm^3$ | 0.811 | 0.816 | 0.825 |
| Iodine Value | | | 0.53 | 0.22 | 0.20 |
| Pour Point | | ° C. | −22.5 | −17.5 | −12.5 |
| Aniline Point | | ° C. | 115 | 119 | 128 |

TABLE 5-continued

| | | | Base Oil Name | | |
|---|---|---|---|---|---|
| | | | Base Oil 4 | Base Oil 5 | Base Oil 6 |
| Distillation Properties | IBP[° C.] | ° C. | 335 | 355 | 415 |
| | T10[° C.] | ° C. | 360 | 385 | 448 |
| | T50[° C.] | ° C. | 383 | 435 | 480 |
| | T90[° C.] | ° C. | 419 | 476 | 503 |
| | FBP[° C.] | ° C. | 459 | 505 | 531 |
| CCS Viscosity (−35° C.) | | mPa · s | <1700 | 2450 | 13900 |
| NOACK Evaporation Amount (250° C., one hour) | | % by mass | 35.2 | 13.5 | 2.5 |
| RBOT Life (150° C.) | | min | 358 | 405 | 449 |
| Residual Metal Content | Al | ppm by mass | <1 | <1 | <1 |
| | Mo | ppm by mass | <1 | <1 | <1 |
| | Ni | ppm by mass | <1 | <1 | <1 |

TABLE 6

| | | | Base Oil Name | | |
|---|---|---|---|---|---|
| | | | Base Oil 7 | Base Oil 8 | Base Oil 9 |
| Name of Raw Material Wax | | | WAX3 | WAX3 | WAX3 |
| Base Oil Composition (Based on the Total Amount of Base Oil) | Saturated Content | % by mass | 95.2 | 96.7 | 98.2 |
| | Aromatic Content | % by mass | 4.3 | 2.8 | 1.4 |
| | Polar Compound Content | % by mass | 0.5 | 0.5 | 0.4 |
| Details of Saturated Content (Based on the Total Amount of Saturated Content) | Cyclic Saturated Content | % by mass | 6.5 | 9.9 | 13.0 |
| | Non-cyclic Saturated Content | % by mass | 93.5 | 90.1 | 87 |
| Content of Non-cyclic Saturated Content (Based on the Total Amount of Base Oil) | Liner Paraffin Content | % by mass | 0.1 | 0.1 | 0.1 |
| | Branched-chain Paraffin Content | % by mass | 88.9 | 87.0 | 85.3 |
| n-d-M Ring Analysis | % $C_P$ | | 90.8 | 91.8 | 90.7 |
| | % $C_N$ | | 8.1 | 8.0 | 9.3 |
| | % $C_A$ | | 1.1 | 0.2 | 0.0 |
| | % $C_P$/% $C_N$ | | 11.21 | 11.48 | 9.75 |
| Sulfur Content | | ppm by mass | <1 | <1 | <1 |
| Nitrogen Content | | ppm by mass | <3 | <3 | <3 |
| Refractive Index (20° C.) $n_{20}$ | | | 1.4537 | 1.4561 | 1.4610 |
| Kinematic Viscosity (40° C.) | | $mm^2/s$ | 11.2 | 16.5 | 31.5 |
| Kinematic Viscosity (100° C.) | | $mm^2/s$ | 2.9 | 3.9 | 6.1 |
| Viscosity Index | | | 124 | 140 | 151 |
| Density (15° C.) | | $g/cm^3$ | 0.812 | 0.821 | 0.832 |
| Iodine Value | | | 2.19 | 1.44 | 0.85 |
| Pour Point | | ° C. | −27.5 | −25 | −17.5 |
| Aniline Point | | ° C. | 113 | 120 | 125 |
| Distillation Properties | IBP[° C.] | 109 | 336 | 367 | 402 |
| | T10[° C.] | ° C. | 360 | 392 | 450 |
| | T50[° C.] | ° C. | 394 | 425 | 486 |
| | T90[° C.] | ° C. | 425 | 460 | 525 |
| | FBP[° C.] | ° C. | 467 | 501 | 570 |
| CCS Viscosity (−35° C.) | | mPa · s | <1000 | 1850 | 15500 |
| NOACK Evaporation Amount (250° C., one hour) | | % by mass | 36.5 | 13.8 | 2.7 |
| RBOT Life (150° C.) | | min | 334 | 387 | 443 |
| Residual Metal Content | Al | ppm by mass | <1 | <1 | <1 |
| | Mo | ppm by mass | <1 | <1 | <1 |
| | Ni | ppm by mass | <1 | <1 | <1 |

TABLE 7

| | | | Base Oil Name | | | |
|---|---|---|---|---|---|---|
| | | | Base Oil 10 | Base Oil 11 | Base Oil 12 | Base Oil 13 |
| Name of Raw Material Wax | | | — | — | | — |
| Base Oil Composition (Based on the Total Amount of Base Oil) | Saturated Content | % by mass | 93.8 | 94.8 | 93.3 | 99.5 |
| | Aromatic Content | % by mass | 6.0 | 5.2 | 6.6 | 0.4 |

TABLE 7-continued

| | | | Base Oil Name | | | |
|---|---|---|---|---|---|---|
| | | | Base Oil 10 | Base Oil 11 | Base Oil 12 | Base Oil 13 |
| | Polar Compound Content | % by mass | 0.2 | 0.0 | 0.1 | 0.1 |
| Details of Saturated Content (Based on the Total Amount of Saturated Content) | Cyclic Saturated Content | % by mass | 46.5 | 46.8 | 47.2 | 46.4 |
| | Non-cyclic Saturated Content | % by mass | 53.5 | 53.2 | 52.8 | 53.6 |
| Content of Non-cyclic Saturated Content (Based on the Total Amount of Base Oil) | Liner Paraffin Content | % by mass | 0.4 | 0.1 | 0.1 | 0.1 |
| | Branched-chain Paraffin Content | % by mass | 49.8 | 50.3 | 49.2 | 50.9 |
| n-d-M Ring Analysis | % $C_P$ | | 75.4 | 78.0 | 78.4 | 80.6 |
| | % $C_N$ | | 23.2 | 20.7 | 21.1 | 19.4 |
| | % $C_A$ | | 1.4 | 1.3 | 0.5 | 0.0 |
| | % $C_P$/% $C_N$ | | 3.3 | 3.8 | 3.7 | 4.2 |
| Sulfur Content | | ppm by mass | <1 | 2 | <1 | <1 |
| Nitrogen Content | | ppm by mass | <3 | 4 | <3 | <3 |
| Refractive Index (20° C.) $n_{20}$ | | | 1.4597 | 1.4640 | 1.4685 | 1.4664 |
| Kinematic Viscosity (40° C.) | | $mm^2/s$ | 9.4 | 18.7 | 37.9 | 33.9 |
| Kinematic Viscosity (100° C.) | | $mm^2/s$ | 2.6 | 4.1 | 6.6 | 6.2 |
| Viscosity Index | | | 109 | 121 | 129 | 133 |
| Density (15° C.) | | $g/cm^3$ | 0.829 | 0.839 | 0.847 | 0.841 |
| Iodine Value | | | 5.10 | 2.78 | 5.30 | 3.95 |
| Pour Point | | ° C. | −27.5 | −22.5 | −17.5 | −17.5 |
| Aniline Point | | ° C. | 104 | 112 | 126 | 123 |
| Distillation Properties | IBP [° C.] | ° C. | 243 | 325 | 317 | 308 |
| | T10 [° C.] | ° C. | 312 | 383 | 412 | 420 |
| | T50 [° C.] | ° C. | 377 | 420 | 477 | 469 |
| | T90 [° C.] | ° C. | 418 | 458 | 525 | 522 |
| | FBP [° C.] | ° C. | 492 | 495 | 576 | 566 |
| CCS Viscosity (−35° C.) | | mPa · s | <1000 | 3500 | >10000 | >10000 |
| NOACK Evaporation Amount (250° C., one hour) | | % by mass | 51.9 | 16.1 | 6.0 | 9.7 |
| RBOT Life (150° C.) | | min | 280 | 300 | 380 | 370 |
| Residual Metal Content | Al | ppm by mass | <1 | <1 | <1 | <1 |
| | Mo | ppm by mass | <1 | <1 | <1 | <1 |
| | Ni | ppm by mass | <1 | <1 | <1 | <1 |

TABLE 8

| | | | Base Oil Name | |
|---|---|---|---|---|
| | | | Base Oil 14 | Base Oil 15 |
| Name of Raw Material Wax | | | — | — |
| Base Oil Composition (Based on the Total Amount of Base Oil) | Saturated Content | % by mass | 99.5 | 99.5 |
| | Aromatic Content | % by mass | 0.4 | 0.4 |
| | Polar Compound Content | % by mass | 0.1 | 0.1 |
| Details of Saturated Content (Based on the Total Amount of Saturated Content) | Cyclic Saturated Content | % by mass | 42.7 | 46.4 |
| | Non-cyclic Saturated Content | % by mass | 57.3 | 53.6 |
| Content of Non-cyclic Saturated Content (Based on the Total Amount of Base Oil) | Liner Paraffin Content | % by mass | 0.1 | 0.1 |
| | Branched-chain Paraffin Content | % by mass | 50.9 | 53.2 |
| n-d-M Ring Analysis | % $C_P$ | | 83.4 | 80.6 |
| | % $C_N$ | | 16.1 | 19.4 |
| | % $C_A$ | | 0.5 | 0.0 |
| | % $C_P$/% $C_N$ | | 5.2 | 4.2 |
| Sulfur Content | | ppm by mass | <1 | <1 |
| Nitrogen Content | | ppm by mass | <3 | <3 |
| Refractive Index (20° C.) $n_{20}$ | | | 1.4659 | 1.4657 |
| Kinematic Viscosity (40° C.) | | $mm^2/s$ | 32.7 | 33.9 |
| Kinematic Viscosity (100° C.) kv100 | | $mm^2/s$ | 6.0 | 6.2 |
| Viscosity Index | | | 131 | 133 |

TABLE 8-continued

| | | | Base Oil Name | |
|---|---|---|---|---|
| | | | Base Oil 14 | Base Oil 15 |
| Density (15° C.) | | g/cm$^3$ | 0.838 | 0.841 |
| Iodine Value | | | 4.52 | 3.95 |
| Pour Point | | ° C. | −17.5 | −17.5 |
| Aniline Point | | ° C. | 123 | 123 |
| Distillation Properties | IBP[° C.] | 109 | 308 | 310 |
| | T10[° C.] | ° C. | 420 | 422 |
| | T50[° C.] | ° C. | 469 | 472 |
| | T90[° C.] | ° C. | 522 | 526 |
| | FBP[° C.] | ° C. | 566 | 583 |
| CCS Viscosity (−35° C.) | | mPa · s | <10000 | <10000 |
| NOACK Evaporation Amount (250° C., one hour) | | % by mass | 9.7 | 8.2 |
| RBOT Life (150° C.) | | min | 390 | 370 |
| Residual Metal Content | Al | ppm by mass | <1 | <1 |
| | Mo | ppm by mass | <1 | <1 |
| | Ni | ppm by mass | <1 | <1 |

TABLE 9

| | | | Base Oil Name | |
|---|---|---|---|---|
| | | | Base Oil 16 | Base Oil 17 |
| Name of Raw Material Wax | | | — | — |
| Base Oil Composition (Based on the Total Amount of Base Oil) | Saturated Content | % by mass | 99.3 | 94.8 |
| | Aromatic Content | % by mass | 0.5 | 5.0 |
| | Polar Compound Content | % by mass | 0.2 | 0.2 |
| Details of Saturated Content (Based on the Total Amount of Saturated Content) | Cyclic Saturated Content | % by mass | 42.1 | 42.3 |
| | Non-cyclic Saturated Content | % by mass | 57.9 | 57.7 |
| Content of Non-cyclic Saturated Content (Based on the Total Amount of Base Oil) | Liner Paraffin Content | % by mass | 0.1 | 0.1 |
| | Branched-chain Paraffin Content | % by mass | 57.4 | 54.6 |
| n-d-M Ring Analysis | % $C_P$ | | 72.9 | 78.1 |
| | % $C_N$ | | 26.0 | 20.6 |
| | % $C_A$ | | 1.1 | 0.7 |
| | % $C_P$/% $C_N$ | | 2.8 | 3.8 |
| Sulfur Content | | ppm by mass | <1 | 1 |
| Nitrogen Content | | ppm by mass | <3 | 3 |
| Refractive Index (20° C.) $n_{20}$ | | | 1.4606 | 1.4633 |
| Kinematic Viscosity (40° C.) | | mm$^2$/s | 9.7 | 18.1 |
| Kinematic Viscosity (100° C.) | | mm$^2$/s | 2.6 | 4.0 |
| Viscosity Index | | | 98 | 119 |
| Density (15° C.) | | g/cm$^3$ | 0.831 | 0.836 |
| Iodine Value | | | 5.40 | 2.65 |
| Pour Point | | ° C. | −17.5 | −27.5 |
| Aniline Point | | ° C. | 104 | 112 |
| Distillation Properties | IBP[° C.] | 115 | 249 | 309 |
| | T10[° C.] | ° C. | 317 | 385 |
| | T50[° C.] | ° C. | 386 | 425 |
| | T90[° C.] | ° C. | 425 | 449 |
| | FBP[° C.] | ° C. | 499 | 489 |
| CCS Viscosity (−35° C.) | | mPa · s | <1000 | 2900 |
| NOACK Evaporation Amount (250° C., one hour) | | % by mass | 62.7 | 16.5 |
| RBOT Life (150° C.) | | min | 265 | 330 |
| Residual Metal Content | Al | ppm by mass | <1 | <1 |
| | Mo | ppm by mass | <1 | <1 |
| | Ni | ppm by mass | <1 | <1 |

Examples 1-1 to 1-9 and Comparative Examples 1-1 to 1-3

Refrigerating Machine Oil for Isobutene Refrigerant

In Examples 1-1 to 1-9, there were prepared refrigerating machine oils having the compositions shown in Tables 10 and 11 by using Base, Oil 1 shown in Table 4, Base Oil 4 shown in Table 5 or Base Oil 7 shown in Table 6 and the additives shown below. In addition, in Comparative Examples 1-1 to 1-3, there were prepared refrigerating machine oils having the compositions shown in Tables 11 by using Base Oil 10 shown in Table 7 or Base Oil 18 and the additives shown below.

(Additives)

Additive 1-1: Tricresylphosphate

Additive 1-2: Phenylglycidyl ether

Next, for the refrigerating machine oils of Examples 1-1 to 1-9 and Comparative Examples 1-1 to 1-3, performance evaluation tests were conducted as follows.

(Lubricity Test A)

The FALEX test was carried out while blowing a refrigerant (isobutene) from the bottom of a test sample container using a FALEX tester (ASTM D2670) under the following conditions. In the test, the average friction coefficient and the abrasion amount between a pin which is a test piece and a V block were determined to evaluate the friction characteristics and abrasion resistance of the refrigerating machine oils. The average friction coefficient was calculated by measuring the friction force every one second during the test period and then dividing the resulting friction force by a load. In addition, the abrasion amount was determined by measuring the weight of the pin and block before and after the FALEX test as a decreased amount of weight. The results obtained are shown in Tables 10 and 11.

Test start temperature: 25° C.

Test time: 30 min.

Load: 200 lbf (1078 N)

Blowing rate of refrigerant: 10 L/h (Stability Test A)

Into a 200 ml autoclave were placed 80 g of refrigerating machine oil and iron, copper and aluminum wires (each having a diameter of 1.6 mm and a length of 100 mm) as a catalyst and then the autoclave was tightly sealed. The autoclave was sufficiently cooled with a dry ice-ethanol solution and then the air in the autoclave was expelled by a decompression pump, followed by filling 10 g of isobutene refrigerant. The autoclave was maintained at 225° C. for two weeks and then the change of the catalyst and the presence of sludge were evaluated. The results obtained are shown in Tables 10 and 11.

TABLE 10

| | | Example 1-1 | Example 1-2 | Example 1-3 | Example 1-4 | Example 1-5 | Example 1-6 |
|---|---|---|---|---|---|---|---|
| Composition [% by mass] | Base Oil 1 | 100 | 99.50 | 99.00 | — | — | — |
| | Base Oil 4 | — | — | — | 100 | 99.50 | 99.50 |
| | Additive 1-1 | — | 0.50 | 0.50 | — | 0.50 | 0.50 |
| | Additive 1-2 | — | — | 0.50 | — | — | 0.50 |
| Lubricity A | Average Friction Coefficient | 0.108 | 0.112 | 0.111 | 0.104 | 0.110 | 0.109 |
| | Abrasion Amount [mg] | 4.5 | 2.8 | 2.7 | 3.9 | 2.6 | 2.4 |
| Stability A | Change of Catalyst | No | Slightly yes | No | No | No | No |
| | Presence of Sludge | No | No | No | No | No | No |

TABLE 11

| | | Example 1-7 | Example 1-8 | Example 1-9 | Comparative Example 1-1 | Comparative Example 1-2 | Comparative Example 1-3 |
|---|---|---|---|---|---|---|---|
| Composition [% by mass] | Base Oil 7 | 100 | 99.50 | 99.00 | — | — | — |
| | Base Oil 10 | — | — | — | — | 100 | 99.50 |
| | Base Oil 18 | — | — | — | 100 | — | — |
| | Additive 1-1 | — | 0.50 | 0.50 | — | — | 0.50 |
| | Additive 1-2 | — | — | 0.50 | — | — | — |
| Lubricity A | Average Friction Coefficient | 0.110 | 0.111 | 0.109 | 0.115 | 0.112 | 0.116 |
| | Abrasion Amount [mg] | 4.9 | 3.4 | 3.1 | 8.3 | 7.9 | 5.2 |
| Stability A | Change of Catalyst | No | Slightly yes | No | No | Slightly yes | Yes |
| | Presence of Sludge | No | No | No | No | Slightly yes | Yes |

Examples 1-10 to 1-18 and Comparative Examples 1-4 to 1-6

Refrigerating Machine Oils for Propane Refrigerant

In the Examples 1-10 to 1-18, there were prepared refrigerating machine oils having the compositions shown in Tables 12 and 13 by using Base Oils 2, 3, 5, 6, 8, shown in Tables 4 to 6 and 9 and the above-mentioned additives 1-1 and 1-2. In addition, in Comparative Examples 1-4 to 1-6, there were prepared refrigerating machine oils having the compositions shown in Tables 13 by using Base Oils 11 and 12 shown in Table 7 or the above-mentioned Base Oils 19 and 20 and the above-mentioned Additives 1-1 and 1-2.

Next, for the refrigerating machine oils of Examples 1-10 to 1-18 and Comparative Examples 1-4 to 1-6, performance evaluation tests were conducted as follows.

(Lubricity Test B)

The FALEX test was carried out in the same manner as in lubricity test A except for using a propane refrigerant instead of an isobutene refrigerant, and the average friction coefficient and abrasion amount were determined. The results obtained are shown in Tables 12 and 13.

(Stability Test B)

The stability test was carried out in the same manner as in stability test A except for using a propane refrigerant instead of an isobutene refrigerant, and the change of the catalyst and the presence or absence of sludge were evaluated. The results obtained are shown in Tables 12 and 13.

TABLE 12

| | | Example 1-10 | Example 1-11 | Example 1-12 | Example 1-13 | Example 1-14 | Example 1-15 |
|---|---|---|---|---|---|---|---|
| Composition [% by mass] | Base Oil 2 | 50.00 | 49.75 | 49.50 | — | — | — |
| | Base Oil 3 | 50.00 | 49.75 | 49.50 | — | — | — |
| | Base Oil 5 | — | — | — | 50.00 | 49.75 | 49.50 |
| | Base Oil 6 | — | — | — | 50.00 | 49.75 | 49.50 |
| | Additive 1-1 | — | 0.5 | 0.5 | — | 0.5 | 0.5 |
| | Additive 1-2 | — | — | 0.5 | — | — | 0.5 |
| Lubricity B | Average Friction Coefficient | 0.110 | 0.115 | 0.115 | 0.111 | 0.113 | 0.112 |
| | Abrasion Amount [mg] | 3.8 | 3.3 | 3.4 | 3.7 | 3.1 | 2.9 |
| Stability B | Change of Catalyst | No | Slightly yes | No | No | No | No |
| | Presence of Sludge | No | No | No | No | No | No |

TABLE 13

| | | Example 1-16 | Example 1-17 | Example 1-18 | Comparative Example 1-4 | Comparative Example 1-5 | Comparative Example 1-6 |
|---|---|---|---|---|---|---|---|
| Composition [% by mass] | Base Oil 8 | 50.00 | 49.75 | 49.50 | — | — | — |
| | Base Oil 9 | 50.00 | 49.75 | 49.50 | — | — | — |
| | Base Oil 11 | — | — | — | — | 50.00 | 49.75 |
| | Base Oil 12 | — | — | — | — | 50.00 | 49.75 |
| | Base Oil 19 | — | — | — | 50.00 | | |
| | Base Oil 20 | — | — | — | 50.00 | — | — |
| | Additive 1-1 | — | 0.5 | 0.5 | — | — | 0.50 |
| | Additive 1-2 | — | — | 0.5 | — | — | — |
| Lubricity B | Average Friction Coefficient | 0.111 | 0.113 | 0.114 | 0.122 | 0.118 | 0.124 |
| | Abrasion Amount [mg] | 3.5 | 2.9 | 3.1 | 8.8 | 8.2 | 6.0 |
| Stability B | Change of Catalyst | No | Slightly yes | No | No | Slightly yes | Yes |
| | Presence of Sludge | No | No | No | No | Slightly yes | Yes |

Examples 1-19 to 1-27 and Comparative Examples 1-7 to 1-9

Refrigerating Machine Oils for Carbon Dioxide Refrigerant

In Examples 1-19 to 1-27, there were prepared refrigerating machine oils having the compositions shown in Tables 14 and 15 by using Base Oils 3, 6 and 9 shown in Tables 4 to 6 and the above-mentioned Additives 1-1 and 1-2. In addition, in Comparative Examples 1-7 to 1-9, there were prepared refrigerating machine oils having the compositions shown in Table 15 by using Base Oil 12 shown in Table 7 or Base Oil 20 and the above-mentioned Additives 1 and 2.

Next, for the refrigerating machine oils of Examples 1-19 to 1-27 and Comparative Examples 1-7 to 1-9, performance evaluation tests were conducted as follows.

(Lubricity Test C)

The lubricating properties of each refrigerating machine oil were evaluated by using a high-pressure friction tester. The tester used has a slide part accommodated in a high-pressure container and is capable of conducting a friction test under the atmosphere of a high-pressure carbon dioxide refrigerant. The test was carried out under the conditions of a pressure of a carbon dioxide refrigerant of 5 MPa, a test temperature of 120° C., a load of 2000 N and a sliding velocity of 1 m/s. In addition, a cylindrical member made of SUJ2 and a disk made of SUJ2 were used for a test piece, and the average friction coefficient and the abrasion amount were determined at the time of sliding the edge face of the cylindrical member and the disk. The average friction coefficient was calculated by measuring the friction force every one second during the test period and then dividing the resulting friction force by a load. In addition, the abrasion amount was determined by measuring the weight of the disk before and after the test as a decreased amount of weight. The results obtained are shown in Tables 14 and 15.

(Stability Test C)

The stability test was carried out in the same manner as in stability test A except for using a carbon dioxide refrigerant instead of an isobutene refrigerant, and the change of the catalyst and the presence or absence of sludge were evaluated. The results obtained are shown in Tables 14 and 15.

TABLE 14

| | | Example 1-19 | Example 1-20 | Example 1-21 | Example 1-22 | Example 1-23 | Example 1-24 |
|---|---|---|---|---|---|---|---|
| Composition [% by mass] | Base Oil 3 | 100 | 99.50 | 99.00 | — | — | — |
| | Base Oil 6 | — | — | — | 100 | 99.50 | 99.00 |
| | Additive 1-1 | — | 0.50 | 0.50 | — | 0.50 | 0.50 |
| | Additive 1-2 | — | — | 0.50 | — | — | 0.50 |
| Lubricity C | Average Friction Coefficient | 0.125 | 0.129 | 0.128 | 0.123 | 0.126 | 0.127 |
| | Abrasion Amount [mg] | 22.3 | 18.5 | 18.3 | 21.4 | 19.5 | 17.9 |
| Stability C | Change of Catalyst | No | Slightly yes | No | No | No | No |
| | Presence of Sludge | No | No | No | No | No | No |

TABLE 15

| | | Example 1-25 | Example 1-26 | Example 1-27 | Comparative Example 1-7 | Comparative Example 1-8 | Comparative Example 1-9 |
|---|---|---|---|---|---|---|---|
| Composition [% by mass] | Base Oil 9 | 100 | 99.50 | 99.00 | — | — | — |
| | Base Oil 12 | — | — | — | — | 100 | 99.50 |
| | Base Oil 20 | — | — | — | 100 | — | — |
| | Additive 1-1 | — | 0.50 | 0.50 | — | — | 0.50 |
| | Additive 1-2 | — | — | 0.50 | — | — | — |
| Lubricity C | Average Friction Coefficient | 0.121 | 0.125 | 0.124 | 0.133 | 0.131 | 0.128 |
| | Abrasion Amount [mg] | 20.5 | 17.6 | 18.0 | 25.5 | 25.2 | 23.5 |
| Stability C | Change of Catalyst | No | Slightly yes | No | No | Slightly yes | Yes |
| | Presence of Sludge | No | No | No | No | Slightly yes | Yes |

Examples 1-28 to 1-36 and Comparative Examples 1-10 to 1-12

Refrigerating Machine Oils for HFC Refrigerant

In Examples 1-28 to 1-36, there were prepared refrigerating machine oils having the compositions shown in Tables 16 and 17 by using Base Oils 1, 4 and 7 shown in Tables 4 to 6 and the above-mentioned Additives 1-1 and 1-2. In addition, in Comparative Examples 1-10 to 1-12, there were prepared refrigerating machine oils having the compositions shown in Table 17 by using Base Oil 10 shown in Table 7 or the above-mentioned Base Oil 18 and the above-mentioned Additives 1 and 2.

Next, for the refrigerating machine oils of Examples 1-28 to 1-36 and Comparative Examples 1-10 to 1-12, performance evaluation tests were conducted as follows.

(Lubricity Test D)

The FALEX test was carried out in the same manner as in lubricity test A except for using an HFC134a refrigerant instead of an isobutene refrigerant, and the average friction coefficient and the abrasion amount were determined. The results obtained are shown in Tables 16 and 17.

(Stability Test D)

The stability test was carried out in the same manner as in stability test A except using an HFC134a refrigerant instead of an isobutene refrigerant, and the change of the catalyst and the presence or absence of sludge were evaluated. The results obtained are shown in Tables 16 and 17.

Examples 2-1 to 2-7 and Comparative Examples 2-1 to 2-4

Compressor Oil Composition (Preparation of Lubricating Oil Base Oil)

There was prepared Base Oil 21 (base oil 2/base oil 3=18/82 (mass ratio), kinematic viscosity at 40° C.: 31.5 $mm^2/s$) by blending Base Oil 2 and Base Oil 3 shown in Table 4. In addition, there was prepared Base Oil 22 (Base Oil 5/Base Oil 6=22/78 (mass ratio), kinematic viscosity at 40° C.: 32.5 $mm^2/s$) by blending Base Oil 5 and Base Oil 6 shown in Table 5.

(Preparation of Compressor Oil Composition)

In Examples 2-1 to 2-4, there were prepared the compressor oil compositions having the compositions shown in Table 18 by using Base Oil 21 or Base Oil 22 and the additives shown below. In addition, in Examples 2-5 to 2-7, there were prepared the compressor oil compositions having the compositions shown in Table 19 by using Base Oil 9 shown in Table 6 and the additives shown below. Further, in Comparative Examples 2-1 to 2-4, there were prepared the compressor oil compositions having the compositions shown in Table 20 by using Base Oil 9 shown in Table 6, the above-described Base Oil 21 or Base Oil 13 shown in Table 7 and the additives shown below.

(Antioxidant)

A2-1: Dodecylphenyl-α-naphthylamine

A2-2: N-octylphenyl-N-butylphenylamine

TABLE 16

| | | Example 1-28 | Example 1-29 | Example 1-30 | Example 1-31 | Example 1-32 | Example 1-33 |
|---|---|---|---|---|---|---|---|
| Composition [% by mass] | Base Oil 1 | 100 | 99.50 | 99.00 | — | — | — |
| | Base Oil 4 | — | — | — | 100 | 99.50 | 99.00 |
| | Additive 1-1 | — | 0.50 | 0.50 | — | 0.50 | 0.50 |
| | Additive 1-2 | — | — | 0.50 | — | — | 0.50 |
| Lubricity D | Average Friction Coefficient | 0.109 | 0.111 | 0.110 | 0.106 | 0.109 | 0.106 |
| | Abrasion Amount [mg] | 4.1 | 2.5 | 2.4 | 3.8 | 2.5 | 2.6 |
| Stability D | Change of Catalyst | No | Slightly yes | No | No | No | No |
| | Presence of Sludge | No | No | No | No | No | No |

TABLE 17

| | | Example 1-34 | Example 1-35 | Example 1-36 | Comparative Example 1-10 | Comparative Example 1-11 | Comparative Example 1-12 |
|---|---|---|---|---|---|---|---|
| Composition [% by mass] | Base Oil 7 | 100 | 99.50 | 99.00 | — | — | — |
| | Base Oil 10 | — | — | — | — | 100 | 99.50 |
| | Base Oil 18 | — | — | — | 100 | — | — |
| | Additive 1-1 | — | 0.50 | 0.50 | — | — | 0.50 |
| | Additive 1-2 | — | — | 0.50 | — | — | — |
| Lubricity D | Average Friction Coefficient | 0.110 | 0.112 | 0.111 | 0.117 | 0.115 | 0.119 |
| | Abrasion Amount [mg] | 3.5 | 2.2 | 2.0 | 8.9 | 8.2 | 6.1 |
| Stability D | Change of Catalyst | No | Slightly yes | No | No | Slightly yes | Yes |
| | Presence of Sludge | No | No | No | No | Slightly yes | Yes |

(Mist Suppressant)

B2-1: Polymethacrylate (weight average molecular weight: 80000)

(Phosphorous Extreme-Pressure Agent)

C2-1: Tricresylphosphate

[Thermal and Oxidative Stability Test]

For the compressor oil compositions of Examples 2-1 to 2-7 and Comparative Examples 2-1 to 2-4, the residual RBOT life was measured according to JIS K2514. The results obtained are shown in Tables 18 to 20. The Tables indicate that the larger the value of the residual RBOT life is, the more excellent the thermal and oxidative stability of the compressor oil composition is and the better the effectiveness of an antioxidant is.

[Mist Test]

For the compressor oil compositions of Examples 2-1 to 2-7 and Comparative Examples 2-1 to 2-4, mist test was conducted according to ASTM D 3705.

FIG. 1 is a schematic configuration diagram illustrating a mist test apparatus used in the present test. The mist test apparatus shown in FIG. 1 has a constitution in which a mist generator 11 and a mist box 12 are connected via a pipe L1.

As shown in FIG. 1, the shape of the pipe L1 at the side of the mist generator 11 is extended upwards from the connecting position with the mist generator 11 and then is bent at a predetermined position and extended downwards. In the vicinity of the connecting position of the pipe L1 and the mist generator 11, there is installed a pressure gauge 13 which monitors the pressure of the mist sent from the mist generator 11 to the pipe L1.

And, pipe L1 is branched-chain off downward directly and obliquely upward at a predetermined position in which the pipe L1 is extended downwards, and the lower end of the pipe extending downwards is connected to a collecting bottle 14. A part of the mist sent from the mist generator 11 is collected in the collecting bottle 14.

On the other hand, the pipe branched-chain off upwards is further branched-chain off into two lines at a predetermined position, and each of the branched-chain pipes penetrates the upper wall of a mist box 12. And, nozzle sprays 15 are disposed at the ends of the branched-chain pipes, and the mist sent from the mist generator 12 is sprayed inside the mist box 12 by the nozzle sprays 15. At this time, part of the sprayed mist is liquefied and remains in the mist box 12, and in the meantime stray mist is generated. The stray mist generated is discharged from a stray mist outlet 16 disposed at the sidewall of the mist box 12 outside of the mist box 12.

By using the mist test apparatus having the above constitution, the mist preventing properties of each compressor oil composition was evaluated. Specifically, a predetermined amount of each compressor oil composition is filled in the mist generator 11 to form mist, and the residual oil amount in the mist generator 11 and the oil amount collected in the collecting bottle 14 and the oil amount remained in the mist box 12 were measured. And, the mist generation amount and the stray mist rate were determined based on the following formulas (A) and (B), respectively. The results obtained are shown in Tables 18 to 20. In addition, it is indicated in the Tables that the smaller the mist generation amount is, the smaller the amount of consumption of the oil for forming mist is. Further, it is indicated that the smaller the stray mist rate is, the smaller the discharge amount of the oil to the discharge gas passing through a filter is when the oil is used as a compressor oil.

(The mist generation amount [g/h])={(The oil filling amount to the mist generator 11 [g])−(The residual oil amount in the mist generator 11 after test) [g])}/(The test time) (A)

(The stray mist rate [%])={(The mist generation amount [g])−(The total amount of the collected oil amount in the collecting bottle 14 after test and the oil amount remained in the mist box 12 [g])}×100/(The mist generation amount [g]) (B)

[Sludge Resistance Evaluation Test]

For the compressor oil compositions of Examples 2-1 to 2-7 and Comparative Examples 2-1 to 2-4, the actual equipment test was carried out on a bench scale under the conditions of a discharge pressure is 0.8±0.1 MPa and a temperature within an oil tank of 90° C., using a rotary screw compressor (motor output power: 11 kw, compressed gas: air). After the elapse of 6000 hours from the start of the test, the compressor was stopped and the open inspection of the water-cooling cooler was conducted, and then the degree of the adherence of sludge to a fin tube was evaluated based on the following evaluation criteria. The results obtained are shown in Tables 18 to 20.

1: Sludge is adhered to the entire fin tube and the space between tubes is clogged with sludge.

2: Sludge is adhered to the entire fin tube and the fin shape cannot be confirmed.

3: Sludge is adhered to the entire fin tube, but the fin shape can be confirmed.

4: Sludge is partially adhered to the fin tube, but the ground metal of the fin tube can be confirmed.

5: Almost no change was observed (the same state as before the test).

TABLE 18

| | | Example 2-1 | Example 2-2 | Example 2-3 | Example 2-4 |
|---|---|---|---|---|---|
| Composition [% by mass] | Base Oil 21 | Residual Portion | Residual Portion | Residual Portion | — |
| | Base Oil 22 | — | — | — | Residual Portion |
| | A2-1 | 1.0 | 1.0 | 0.1 | 1.0 |
| | A2-2 | 1.0 | 1.0 | 0.1 | 1.0 |
| | B2-1 | 0.1 | 0.1 | 0.1 | 0.1 |
| | C2-1 | — | 0.5 | — | 0.5 |
| Kinematic Viscosity [$mm^2/s$] | 40° C. | 32.1 | 32.1 | 32.1 | 32.3 |
| | 100° C. | 6.37 | 6.37 | 6.37 | 6.41 |
| Viscosity Index | | 154 | 154 | 154 | 155 |
| Thermal and Oxidative Stability | Residual RBOT Life [h] | 4000 | 4000 | 650 | 4300 |

TABLE 18-continued

| | | Example 2-1 | Example 2-2 | Example 2-3 | Example 2-4 |
|---|---|---|---|---|---|
| Mist Preventing Properties | Mist Generation Amount [g/h] | 49.8 | 50.1 | 48.6 | 45.6 |
| | Percentage Stray Mist [%] | 6.3 | 6.2 | 6.3 | 6.0 |
| Sludge Resistance | Evaluation Point | 4 | 4 | 2 | 4 |

TABLE 19

| | | Example 2-5 | Example 2-6 | Example 2-7 |
|---|---|---|---|---|
| Composition [% by mass] | Base Oil 9 | Residual Portion | Residual Portion | Residual Portion |
| | A2-1 | 1.0 | 1.0 | 0.1 |
| | A2-2 | 1.0 | 1.0 | 0.1 |
| | B2-1 | 0.1 | 0.1 | 0.1 |
| | C2-1 | — | 0.5 | — |
| Kinematic Viscosity [$mm^2/s$] | 40° C. | 31.9 | 31.9 | 31.9 |
| | 100° C. | 6.37 | 6.37 | 6.37 |
| Viscosity Index | | 156 | 154 | 156 |
| Thermal and Oxidative Stability | Residual RBOT Life [h] | 3800 | 3800 | 1000 |
| Mist Preventing Properties | Mist Generation Amount [g/h] | 49.9 | 50.4 | 49.6 |
| | Percentage Stray Mist [%] | 6.2 | 6.3 | 6.2 |
| Sludge Resistance | Evaluation Point | 4 | 4 | 3 |

TABLE 20

| | | Comparative Example 2-1 | Comparative Example 2-2 | Comparative Example 2-3 | Comparative Example 2-4 |
|---|---|---|---|---|---|
| Composition [% by mass] | Base Oil 21 | — | — | Residual Portion | — |
| | Base Oil 9 | — | — | — | Residual Portion |
| | Base Oil 22 | Residual Portion | Residual Portion | — | — |
| | A2-1 | 1.0 | 0.1 | 0.1 | 0.1 |
| | A2-2 | 1.0 | 0.1 | 0.1 | 0.1 |
| | B2-1 | 0.1 | 0.1 | — | — |
| | C2-1 | — | — | — | — |
| Kinematic Viscosity [$mm^2/s$] | 40° C. | 32.0 | 32.0 | 32.1 | 32.1 |
| | 100° C. | 5.87 | 5.87 | 6.37 | 6.37 |
| Viscosity Index | | 128 | 128 | 154 | 154 |
| Thermal and Oxidative Stability | Residual RBOT Life [h] | 1900 | 480 | 4000 | 850 |
| Mist Preventing Properties | Mist Generation Amount [g/h] | 60.2 | 59.5 | 57.2 | 58.2 |
| | Percentage Stray Mist [%] | 8.4 | 8.5 | 8.9 | 8.8 |
| Sludge Resistance | Evaluation Point | 3 | 1 | 4 | 2 |

Examples 3-1 to 3-15 and Comparative Examples 3-1 to 3-7

Hydraulic Oil Composition

In Examples 3-1 to 3-15, there were prepared hydraulic oil compositions having the compositions shown in Tables 21 to 23 by using Base Oils 3, 6 and 9 shown in Tables 4 to 6 and the additives shown below. In addition, in Comparative Examples 3-1 to 3-7, there were prepared hydraulic oil compositions having the compositions shown in Tables 24 and 25 by using Base Oils 3, 6, 9 and 12 shown in Tables 4 to 8 and the additives shown below.

(A compound containing phosphorus and/or sulfur as a constituent element(s))

A3-1: Tricresylphosphate

A3-2: β-dithiophosphorylated propionic acid ethyl ester

A3-3: Triphenyl phosphorothionate

A3-4: Zinc dioctyl dithiophosphate (Other Additive)

B3-1: 2,6-di-tert-butyl-p-cresole

B3-2: Dioctyldiphenylamine

Next, for the hydraulic oil compositions of Examples 3-1 to 3-15 and Comparative Examples 3-1 to 3-7, the following evaluation tests were carried out.

[Thermal and Oxidative Stability Test]

For the hydraulic oil compositions of Examples 3-1 to 3-15 and Comparative Examples 3-1 to 3-7, a thermal and oxidative stability test was carried out according to "Turbine Oil Oxidation Stability Test" specified in JIS K 2514, and the time from the start of the test to the time when the acid value of a hydraulic oil composition is increased by 2.0 mg KOH/g was measured. The results obtained are shown in Tables 21 to 25.

[SRV (Minor Reciprocating Friction) Test]

Figure 2:
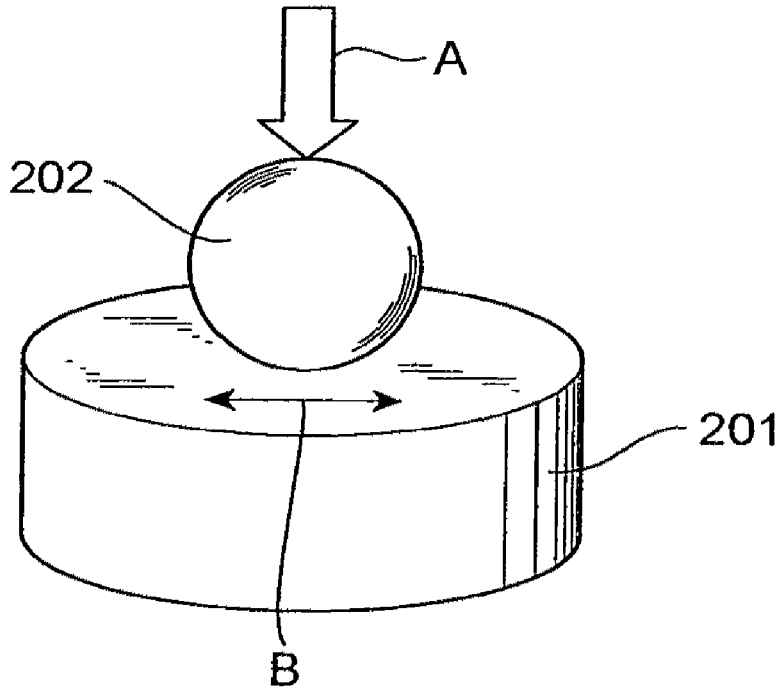
FIG. 2 is a view explaining the disposition and motion of the disc and the ball in SRV (minor reciprocating friction) test.

For the hydraulic oil compositions of Examples 3-1 to 3-15 and Comparative Examples 3-1 to 3-7, an SRV test was carried out to evaluate the friction characteristics. More specifically, as shown in FIG. 2, a test oil was applied to the point contact area of a disk 1 and a ball 202 disposed on the upper surface of the disk 1, and while applying a load to the ball 202 in the vertically downward direction (the arrow A in FIG. 2), the ball 202 was reciprocated relatively to the direction along the upper surface of the disk 201 (the arrow B in FIG. 2). At this time, the friction coefficient was measured by a load cell (not shown) installed on a disk holder 1 (not shown). As the disk 201, there is used one made of SPCC material having a diameter of 25 mm and a thickness of 8 mm, and as the ball 202, there is used one made of SPCC material having a diameter of 10 mm. In addition, the load applied to the ball 202 was 1200 N, the vibration amplitude of the ball 2 was 1 mm, the reciprocal frequency was 50 Hz and the temperature was 80° C. The results obtained are shown in Tables 21 to 25.

[Abrasion Resistance Test]

For each hydraulic oil composition of Examples 3-1 to 3-15 and Comparative Examples 3-1 to 3-7, a vane pump test specified in ASTM D 2882 was carried out to measure the weight of the vane and the ring before and after the test and the abrasion amount. The testing time was 100 hours. The results obtained are shown in Tables 21 to 25.

TABLE 21

| | | Example 3-1 | Example 3-2 | Example 3-3 | Example 3-4 | Example 3-5 |
|---|---|---|---|---|---|---|
| Composition [% by mass] | Base Oil 3 | Residual Portion | Residual Portion | Residual Portion | Residual Portion | Residual Portion |
| | A3-1 | 0.5 | — | — | — | — |
| | A3-2 | — | 0.5 | — | — | 0.2 |
| | A3-3 | — | — | 0.5 | — | — |
| | A3-4 | — | — | — | 0.5 | — |
| | B3-1 | 0.5 | 0.5 | 0.5 | 0.5 | 0.3 |
| | B3-2 | 0.3 | 0.3 | 0.3 | 0.3 | 0.1 |
| Oxidative Stability (Time Required [h]) | | 2350 | 2260 | 2180 | 2020 | 2060 |
| SRV (Friction Coefficient) | | 0.115 | 0.108 | 0.113 | 0.118 | 0.117 |
| Abrasion Resistance (Abrasion Amount [mg]) | | 8.8 | 9.7 | 7.4 | 6.5 | 9.9 |

TABLE 22

| | | Example 3-6 | Example 3-7 | Example 3-8 | Example 3-9 | Example 3-10 |
|---|---|---|---|---|---|---|
| Composition [% by mass] | Base Oil 6 | Residual Portion | Residual Portion | Residual Portion | Residual Portion | Residual Portion |
| | A3-1 | 0.5 | — | — | — | — |
| | A3-2 | — | 0.5 | — | — | 0.2 |
| | A3-3 | — | — | 0.5 | — | — |
| | A3-4 | — | — | — | 0.5 | — |
| | B3-1 | 0.5 | 0.5 | 0.5 | 0.5 | 0.3 |
| | B3-2 | 0.3 | 0.3 | 0.3 | 0.3 | 0.1 |
| Oxidative Stability (Time Required [h]) | | 2560 | 2450 | 2390 | 2230 | 2160 |
| SRV (Friction Coefficient) | | 0.113 | 0.108 | 0.111 | 0.109 | 0.112 |
| Abrasion Resistance (Abrasion Amount [mg]) | | 6.9 | 7.3 | 7.8 | 5.8 | 7.2 |

TABLE 23

| | | Example 3-11 | Example 3-12 | Example 3-13 | Example 3-14 | Example 3-15 |
|---|---|---|---|---|---|---|
| Composition [% by mass] | Base Oil 9 | Residual Portion | Residual Portion | Residual Portion | Residual Portion | Residual Portion |
| | A3-1 | 0.5 | — | — | — | — |
| | A3-2 | — | 0.5 | — | — | 0.2 |
| | A3-3 | — | — | 0.5 | — | — |
| | A3-4 | — | — | — | 0.5 | — |
| | B3-1 | 0.5 | 0.5 | 0.5 | 0.5 | 0.3 |
| | B3-2 | 0.3 | 0.3 | 0.3 | 0.3 | 0.1 |
| Oxidative Stability (Time Required [h]) | | 2200 | 2150 | 2080 | 1980 | 2000 |
| SRV (Friction Coefficient) | | 0.114 | 0.109 | 0.115 | 0.118 | 0.117 |
| Abrasion Resistance (Abrasion Amount [mg]) | | 6.5 | 8.7 | 6.9 | 7.2 | 8.8 |

TABLE 24

| | | Comparative Example 3-1 | Comparative Example 3-2 | Comparative Example 3-3 | Comparative Example 3-4 | Comparative Example 3-5 | Comparative Example 3-6 |
|---|---|---|---|---|---|---|---|
| Composition [% by mass] | Base Oil 3 | Residual Portion | — | — | — | — | — |
| | Base Oil 6 | — | Residual Portion | — | — | — | — |
| | Base Oil 12 | — | — | Residual Portion | — | — | Residual Portion |
| | Base Oil 14 | — | — | — | Residual Portion | — | — |
| | Base Oil 15 | — | — | — | — | Residual Portion | |
| | A3-1 | — | — | 0.5 | — | — | — |
| | A3-2 | — | — | — | 0.5 | — | — |
| | A3-3 | — | — | — | — | 0.5 | — |
| | A3-4 | — | — | — | — | | 0.5 |
| | B3-1 | 0.5 | 0.5 | 0.5 | 0.5 | 0.5 | 0.5 |
| | B3-2 | 0.3 | 0.3 | 0.3 | 0.3 | 0.3 | 0.3 |
| Oxidative Stability (Time Required [h]) | | 2480 | 2590 | 1840 | 1490 | 730 | 1740 |
| SRV (Friction Coefficient) | | 0.121 | 0.123 | 0.125 | 0.127 | 0.131 | 0.128 |
| Abrasion Resistance (Abrasion Amount [mg]) | | 135.4 | 114.2 | 12.5 | 8.9 | 7.4 | 6.9 |

TABLE 25

| | | Comparative Example 3-7 |
|---|---|---|
| Composition [% by mass] | Base Oil 9 | Residual Portion |
| | A3-1 | — |
| | A3-2 | — |
| | A3-3 | — |
| | A3-4 | — |
| | B3-1 | 0.5 |
| | B3-2 | 0.3 |
| Oxidative Stability (Time Required [h]) | | 2420 |
| SRV (Friction Coefficient) | | 0.123 |
| Abrasion Resistance (Abrasion Amount [mg]) | | 131.0 |

Examples 4-1 to 4-7 and Comparative Examples 4-1 to 4-4

Metalworking Oil Composition

In Examples 4-1 to 4-7, there were prepared the metalworking oil compositions having the compositions shown in Table 26 by using Base Oils 1, 6 and 9 shown in Tables 4 to 6, respectively and the additives shown below. In addition, in Comparative Examples 4-1 to 4-4, there were prepared the metalworking oil compositions shown in Table 27 by using Base Oil 12 shown in Table 7 or Base Oil 23 shown below and the additives shown below. The kinematic viscosity at 40° C. of each metalworking oil composition is collectively shown in Tables 26 and 27. Further, the content of the additives shown in Tables 26 and 28 is based on the total amount of the composition.

(Base Oil)

Base oil 23: Paraffinic mineral oil (kinematic viscosity at 40° C.: 49.7 $mm^2/s$, saturated content: 91.5% by mass, and content of the cyclic saturated component in the saturated content: 49.8% by mass)

(Additives)

Additive 4-1: Butyl stearate

Additive 4-2: Lauryl alcohol

Additive 4-3: Oleic acid

Additive 4-4: Tricresylphosphate

Additive 4-5: Ester sulfide (inactive type)

Next, for the metalworking oil compositions of Examples 4-1 to 4-7 and Comparative Examples 4-1 to 4-4, the following evaluation tests were performed.

[Drawing Process Test]

In molding a disk made of aluminum (JIS A 5182, diameter: 100 mm, thickness: 0.4 mm) into a container with a bottom by using each of the metalworking oil compositions of Examples 4-1 to 4-7 and Comparative Examples 4-1 to 4-4, when the wrinkle pressing force was set at 1000 kg, the required maximum drawing force of a punch was measured. The results obtained are shown in Table 26 and 27. It is indicated in Tables 26 and 27 that the lower the maximum drawing force is, the more excellent in workability is.

[Oil Removing Properties Test (1)]

Each of the metalworking oil compositions of Examples 4-1 to 4-7 and Comparative Examples 4-1 to 4-4 was applied on one surface of a disk made of aluminum (JIS A 5182, diameter: 100 mm, thickness: 0.4 mm) using a sprayer so that the application amount was 3 $g/m^2$, followed by allowing to stand at room temperature for 6 hours. Thereafter, the disk was immersed in an absorbent cotton containing a nonionic surfactant for one hour and taken out to further wash with running water for 30 seconds. After washing with water, the disk was immediately held so that the radial direction is vertical, and the water wetting area after 20 seconds was measured. A disk in which the water wetting area was 90% or more of the coated area was evaluated as A and a disk in which the water wetting area was less than 90% of the coated area was evaluated as B. The results obtained are shown in Tables 26 and 27. In addition, the larger the water wetting area is (that is, a disk evaluated as A), the more excellent the oil removing properties are.

TABLE 26

| | | Example 4-1 | Example 4-2 | Example 4-3 | Example 4-4 | Example 4-5 | Example 4-6 | Example 4-7 |
|---|---|---|---|---|---|---|---|---|
| Base Oil | | Base Oil 1 | Base Oil 1 | Base Oil 1 | Base Oil 6 | Base Oil 9 | Base Oil 9 | Base Oil 9 |
| Content of Additive [% by mass] | Additive 4-1 | 5 | — | 10 | — | 5 | — | 10 |
| | Additive 4-2 | — | — | 5 | — | — | — | 5 |
| | Additive 4-3 | — | 2 | 2 | — | — | 2 | 2 |
| | Additive 4-4 | 5 | 3 | 3 | 5 | 5 | 3 | 3 |
| | Additive 4-5 | 20 | 25 | 10 | 20 | 20 | 25 | 10 |
| Kinematic Viscosity at 40° C. [$mm^2/s$] | | 30.1 | 27.8 | 33.8 | 36.4 | 27.1 | 24.4 | 30.2 |
| Drawing Test (Maximum Drawing Force [kgf]) | | 1510 | 1460 | 1600 | 1505 | 1495 | 1460 | 1590 |
| Oil Removing Properties Test (1) | | A | A | A | A | A | A | A |

TABLE 27

| | | Comparative Example 4-1 | Comparative Example 4-2 | Comparative Example 4-3 | Comparative Example 4-4 |
|---|---|---|---|---|---|
| Base Oil | | Base Oil 12 | Base Oil 12 | Base Oil 12 | Base Oil 23 |
| Content of Additive [% by mass] | Additive 4-1 | 5 | — | 10 | 10 |
| | Additive 4-2 | — | — | 5 | 5 |
| | Additive 4-3 | — | 2 | 2 | 2 |
| | Additive 4-4 | 5 | 3 | 3 | 3 |
| | Additive 4-5 | 20 | 25 | 10 | 10 |
| Kinematic Viscosity at 40° C. [$mm^2/s$] | | 29.9 | 27.7 | 33.5 | 42.9 |
| Drawing Test (Maximum Drawing Force [kgf]) | | 1780 | 1880 | 1950 | 1635 |
| Oil Removing Properties Test (1) | | A | A | A | B |

Examples 4-8 to 4-14 and Comparative Examples 4-5 to 4-8

In Examples 4-8 to 4-14, there were prepared the metalworking oil compositions having the compositions shown in Table 28 by using Base Oils 2, 4 and 7 shown in Tables 4 to 6, respectively and the additives shown below. In addition, in Comparative Examples 4-5 to 4-8, there were prepared the metalworking oil compositions shown in Table 29 by using Base Oil 10 shown in Table 7 or Base Oil 24 shown below and the additives shown below. The kinematic viscosity at 40° C. of each metalworking oil composition is collectively shown in Tables 28 and 29. Further, the content of the additives shown in Tables 28 and 29 is based on the total amount of the composition.

(Base Oil)

Base oil 24: Paraffinic mineral oil (kinematic viscosity at 40° C.: 19.3 $mm^2/s$, saturated content: 99.1% by mass, and content of the cyclic saturated component in the saturated content: 45.9% by mass)

(Additives)

Additive 4-1: Butyl stearate

Additive 4-2: Lauryl alcohol

Additive 4-4: Tricresylphosphate

Additive 4-5: Ester sulfide (inactive type)

Next, for the metalworking oil compositions of Examples 4-8 to 4-14 and Comparative Examples 4-5 to 4-8, the following evaluation tests were performed.

[Rolling Process Test]

In rolling a rolled material made of stainless steel (SUS 304, length: 100 mm, width: 50 mm, thickness: 0.25 mm) by using each of the metalworking oil compositions of Examples 4-8 to 4-14 and Comparative Examples 4-5 to 4-8, the required rolling load was measured when the rolling speed was set at 250 m/min and the rolling reduction was set at 35%. The results obtained are shown in Tables 28 and 29. It is indicated in Tables 28 and 29 that the lower the rolling load is, the more excellent the workability is.

[Oil Removing Properties Test (2)]

Each of the metalworking oil compositions of Examples 8 to 14 and Comparative Examples 5-8 was applied on one surface of a rolled material made of stainless steel (SUS 304, length: 100 mm, width: 50 mm, thickness: 0.25 mm) using a sprayer so that the application amount was 3 $g/m^2$, followed by allowing to stand at room temperature for 6 hours. Subsequently, the rolled material was immersed in n-hexane for 5 seconds and was taken to dry. Thereafter, the rolled material was heated from room temperature to 450° C. over three hours, and was held at 450° C. for one hour, followed by cooling to room temperature over two hours (thermal defatting). By measuring the area of the discolored portion of the surface of the rolled material after the thermal defatting was measured, a rolled material in which the discolored area was 95% or more of the coated area was evaluated as A and a rolled material in which the discolored area was less than 95% of the coated area was evaluated as B. The results obtained are shown in Tables 28 and 29. In addition, the larger the discolored area is (that is, a material evaluated as A), the more excellent the oil removing properties are.

TABLE 28

| | | Example 4-8 | Example 4-9 | Example 4-10 | Example 4-11 | Example 4-12 | Example 4-13 | Example 4-14 |
|---|---|---|---|---|---|---|---|---|
| Base Oil | | Base Oil 2 | Base Oil 2 | Base Oil 2 | Base Oil 4 | Base Oil 7 | Base Oil 7 | Base Oil 7 |
| Content of Additive [% by mass] | Additive 4-1 | 15 | 15 | — | 15 | 15 | 15 | — |
| | Additive 4-2 | 3 | 5 | — | 3 | 3 | 5 | — |
| | Additive 4-4 | 1 | — | 5 | 1 | 1 | — | 5 |
| | Additive 4-5 | 1 | — | 15 | 1 | 1 | — | 15 |
| Kinematic Viscosity at 40° C. [$mm^2/s$] | | 11.4 | 10.9 | 12.1 | 11.5 | 10.5 | 10.1 | 11.5 |
| Rolling Test (Rolling Load [tonf]) | | 7.6 | 7.2 | 7.4 | 7.4 | 7.2 | 7.0 | 7.1 |
| Oil Removing Properties Test (2) | | A | A | A | A | A | A | A |

TABLE 29

| | | Comparative Example 4-5 | Comparative Example 4-6 | Comparative Example 4-7 | Comparative Example 4-8 |
|---|---|---|---|---|---|
| Base Oil | | Base Oil 10 | Base Oil 10 | Base Oil 10 | Base Oil 24 |
| Content of Additive [% by mass] | Additive 4-1 | 15 | 15 | — | — |
| | Additive 4-2 | 3 | 5 | — | — |
| | Additive 4-4 | 1 | — | 5 | 5 |
| | Additive 4-5 | 1 | — | 15 | 15 |
| Kinematic Viscosity at 40° C. [$mm^2/s$] | | 10.6 | 10.1 | 11.4 | 20.2 |
| Rolling Test (Rolling Load [tonf]) | | 8.4 | 8.3 | 8.9 | 7.2 |
| Oil Removing Properties Test (2) | | A | A | A | B |

Examples 4-15 to 4-24 and Comparative Examples 4-9 to 4-11

In Examples 4-15 to 4-24, there were prepared the metalworking oil compositions (cutting oil compositions) having the compositions shown in Tables 30 to 31 by using Base Oils 3, 4 and 7 shown in Tables 4 to 6, respectively and the additives shown below. In addition, in Comparative Examples 4-9 to 4-11, there were prepared the metalworking oil compositions shown in Table 31 by using Base Oil 10 shown in Table 7 and the additives shown below. The kinematic viscosity at 40° C. of each metalworking oil composition is collectively shown in Tables 30 and 31. Further, in columns of Tables 30 and 31, each content of Base Oils 3, 4, 7 and 9 and Additives 4-6 to 4-13 was based on the total amount of the composition.

(Additives)

Additive 4-6: Active ester sulfide (Sulfur content: 17.5% by mass)

Additive 4-7: di-t-dodecylpolysulfide (Sulfur content: 32% by mass)

Additive 4-8: Zinc dithiophosphate compound (Sulfur content: 20% by mass, Zinc content: 10% by mass, phosphorous content: 9% by mass)

Additive 4-9: Overbased calcium sulfonate (Base value: 400 mgKOH/g)

Additive 4-10: Ethylene-propylene copolymer (Kinematic viscosity at 100° C.: 1200 $mm^2/s$)

Additive 4-11: Tricresylphosphate

Additive 4-12: High oleic vegetable oil (Iodine value: 95, Content of oleic acid in the constituent carboxylic acid: 65% by mass)

Additive 4-13: n-dodecanol

Next, for the metalworking oil compositions of Examples 4-15 to 4-24 and Comparative Examples 4-9 to 4-11, the following evaluation tests were performed.

[Tapping Test]

A tapping test was carried out by a normal feeding system using each metalworking oil composition of Examples 4-15 to 4-24 and Comparative Examples 4-9 to 4-11. Specifically, the tapping test was carried out by alternately using each metalworking oil composition and a comparative standard oil (DIDA: diisodecyl adipate) under the following conditions, and the tapping energy was measured.

Tapping Conditions:

Tool: Nat tap M8 (P=1.25 mm)

Lower hole diameter: 7.2 mm

Workpiece: AC8A (t=10 mm)

Cutting speed: 9.0 m/min

Oil Supply System:

The metalworking oil compositions and DIDA were directly supplied to the working site under the condition of approximately 6 mL/min.

Next, the tapping energy efficiency (%) was calculated according to the following formula using the resulting measurement values of the tapping energy. The results obtained are shown in Tables 28 and 29. It is indicated in Tables that the higher the value of the tapping energy efficiency is, the higher the lubricity is.

Tapping energy efficiency (%)=(The tapping energy in case of using DIDA)/(The tapping energy in case of using the oil composition)

[Oil Taking-Out Amount Test]

An SPCC steel plate (60 mm×80 mm) was immersed in each metalworking oil composition of Examples 4-9 to 4-15 and Comparative Examples 4-9 to 4-11, followed by maintaining for one minutes. Subsequently, the SPCC steel plate was taken out and then was hung up vertically for 5 minutes to drop off oil. Thereafter, the adhered amount of the metalworking oil composition (taking-out amount) was measured. The results obtained are shown in Tables 30 and 31.

TABLE 30

| | | Example 4-15 | Example 4-16 | Example 4-17 | Example 4-18 | Example 4-19 | Example 4-20 | Example 4-21 |
|---|---|---|---|---|---|---|---|---|
| Composition [% by mass] | Base Oil 3 | 76 | 59 | 68 | — | — | — | 38 |
| | Base Oil 4 | — | — | — | 76 | 59 | 68 | 38 |
| | Additive 4-6 | 15 | 10 | — | 15 | 10 | — | 15 |
| | Additive 4-7 | — | 10 | 10 | — | 10 | 10 | — |
| | Additive 4-8 | 1 | — | 1 | 1 | — | 1 | 1 |
| | Additive 4-9 | 5 | 5 | 5 | 5 | 5 | 5 | 5 |
| | Additive 4-10 | 1 | 1 | 1 | 1 | 1 | 1 | 1 |
| | Additive 4-11 | 1 | 5 | 5 | 1 | 5 | 5 | 1 |
| | Additive 4-12 | — | 10 | 10 | — | 10 | 10 | — |
| | Additive 4-13 | 1 | — | — | 1 | — | — | 1 |
| Kinematic Viscosity at 40° C. [$mm^2/s$] | | 13 | 16 | 14 | 13 | 16 | 14 | 13 |
| Cutting Test (Tapping Energy Efficiency [%]) | | 120 | 126 | 123 | 120 | 128 | 122 | 121 |
| Oil Taking-Out Test (Oil Taking Out Amount [g]) | | 0.38 | 0.45 | 0.42 | 0.37 | 0.45 | 0.41 | 0.38 |

TABLE 31

| | | Example 4-22 | Example 4-23 | Example 4-24 | Comparative Example 4-9 | Comparative Example 4-10 | Comparative Example 4-11 |
|---|---|---|---|---|---|---|---|
| Composition [% by mass] | Base Oil 7 | 76 | 59 | 68 | — | — | — |
| | Base Oil 10 | — | — | — | 76 | 59 | 68 |
| | Additive 4-6 | 15 | 10 | — | 15 | 10 | — |
| | Additive 4-7 | — | 10 | 10 | — | 10 | 10 |
| | Additive 4-8 | 1 | — | 1 | 1 | — | 1 |
| | Additive 4-9 | 5 | 5 | 5 | 5 | 5 | 5 |
| | Additive 4-10 | 1 | 1 | 1 | 1 | 1 | 1 |
| | Additive 4-11 | 1 | 5 | 5 | 1 | 5 | 5 |
| | Additive 4-12 | — | 10 | 10 | — | 10 | 10 |
| | Additive 4-13 | 1 | — | — | 1 | — | — |
| Kinematic Viscosity at 40° C. [$mm^2/s$] | | 13 | 16 | 14 | 12 | 15 | 13 |
| Cutting Test (Tapping Energy Efficiency [%]) | | 122 | 128 | 122 | 110 | 116 | 110 |
| Oil Taking-Out Test (Oil Taking Out Amount [g]) | | 0.38 | 0.44 | 0.40 | 0.43 | 0.50 | 0.48 |

Examples 5-1 to 5-11 and Comparative Examples 5-1 to 5-10

Heat Treating Oil Composition

In Examples 5-1 to 5-6, there were prepared the heat treating oil compositions having the compositions shown in Table 32 by using Base Oils 1, 2, 3 and 5 shown in Tables 4 and 5 and the below-shown cooling property improvers A5-1, A5-2 and A5-3. In addition, in Examples 5-7 to 5-11, there were prepared the heat treating oil compositions having the compositions shown in Table 33 by using Base Oils 7 to 9 shown in Table 6 and the below-shown cooling property improvers A5-1, A5-2 and A5-3. Further, in Comparative Examples 5-1 to 5-10, there were prepared the heat treating oil compositions having the compositions shown in Tables 34 and 35 by using Base Oils 1 to 3, 5, 7 to 9, 12, 16 and 17 shown in Tables 4 to 7 and 9 and the below-shown cooling property improvers A5-1, A5-2 and A5-3. The kinematic viscosity at 40° C. of each metalworking oil composition is collectively shown in Tables 32 and 35.

(Cooling Property Improvers)

A5-1: Ethylene-propylene copolymer (Trade name: LUCANT HC600, produced by Mitsui Chemicals Inc., Number average molecular weight: 2600)

A5-2: A product having insoluble matters removed from an asphalt (Trade name: NC505, produced by Pennzoil Corporation)

A5-3: Calcium Salicylate (Trade name: SAP002, produced by Shell Corp.)

Next, for the heat treating oil compositions of Examples 5-1 to 5-11 and Comparative Examples 5-1 to 5-10, the following evaluation tests were performed.

[Quenching Test 1]

A cylindrical steel product (S45C) having a bottom surface diameter of 24 mm and a height of 10 mm was heated in a mixed gas of hydrogen and nitrogen (the hydrogen/nitrogen ratio of 3/97) at 850° C. for 45 minutes. Thereafter, the steel product was added in a heat treating oil composition heated at 80° C. and then was subjected to quenching. After quenching, the hardness was measured at seven measuring points with an interval of 3 mm on the diameter of the bottom surface of the steel product using a Rockwell hardness meter, and the average value of the measurement values was determined. The results obtained are shown in Tables 32 to 35.

[Quenching Test 2]

There were prepared 24 pieces of cylindrical steel products (SUJ2) having a bottom surface diameter of 8 mm and a height of 90 mm. The steel products were simultaneously subjected to quenching using a batch furnace. Further, the steel product was heated at 830° C. for 60 minutes and the oil temperature at the time of quenching was set at 80° C. After quenching, the "bending" of each steel product was measured using a dial gauge and then the average value of 24 pieces of cylindrical steel products was determined. The results obtained are shown in Tables 32 to 35. In addition, the "bending" was measured by reading the maximum displacement when the tip of the dial gauge was put to the center portion in the longitudinal direction of the steel product disposed on a V block and the steel product was slowly rotated on the V block.

TABLE 32

| | | Example 5-1 | Example 5-2 | Example 5-3 | Example 5-4 | Example 5-5 | Example 5-6 |
|---|---|---|---|---|---|---|---|
| Composition of Lubricating Oil Base Oil (% by mass) | Base Oil 1 | 55 | — | — | 55 | — | — |
| | Base Oil 2 | — | 100 | 100 | — | 100 | — |
| | Base Oil 3 | 45 | — | — | 45 | — | — |
| | Base Oil 5 | — | — | — | — | — | 100 |
| Content of Cooling Property Improver (% by mass) | A5-1 | 3 | 3 | — | — | — | 3 |
| | A5-2 | — | — | 6 | — | — | — |
| | A5-3 | — | — | — | 3 | 4 | — |
| Kinematic Viscosity at 40° C. [$mm^2/s$] | | 22.4 | 21.1 | 23.2 | 19.2 | 19.8 | 20.3 |
| Quenching Test 1 | Hardness (HRC) | 53 | 54 | 52 | 52 | 53 | 55 |
| Quenching Test 2 | Strain (μm) | 20 | 28 | 28 | 24 | 23 | 28 |

TABLE 33

| | | Example 5-7 | Example 5-8 | Example 5-9 | Example 5-10 | Example 5-11 |
|---|---|---|---|---|---|---|
| Content of Cooling Property Improver (% by mass) | Base Oil 7 | 55 | — | — | 55 | — |
| | Base Oil 8 | — | 100 | 100 | — | 100 |
| | Base Oil 9 | 45 | — | — | 45 | — |
| Content of Cooling Property Improver (% by mass) | A5-1 | 3 | 3 | — | — | — |
| | A5-2 | — | — | 6 | — | — |
| | A5-3 | — | — | — | 3 | 4 |
| Kinematic Viscosity at 40° C. [$mm^2/s$] | | 20.7 | 20.4 | 23.5 | 17.4 | 20.0 |
| Quenching Test 1 | Hardness (HRC) | 54 | 55 | 52 | 53 | 53 |

TABLE 33-continued

| | | Example 5-7 | Example 5-8 | Example 5-9 | Example 5-10 | Example 5-11 |
|---|---|---|---|---|---|---|
| Quenching Test 2 | Strain (μm) | 21 | 29 | 28 | 25 | 23 |

TABLE 34

| | | Comparative Example 5-1 | Comparative Example 5-2 | Comparative Example 5-3 | Comparative Example 5-4 | Comparative Example 5-5 |
|---|---|---|---|---|---|---|
| Content of Cooling Property Improver (% by mass) | Base Oil 1 | 55 | — | — | — | — |
| | Base Oil 2 | — | 100 | — | — | — |
| | Base Oil 3 | 45 | — | — | — | — |
| | Base Oil 5 | — | — | — | — | — |
| | Base Oil 16 | — | — | 50 | — | — |
| | Base Oil 17 | — | — | — | 100 | 100 |
| | Base Oil 12 | — | — | 50 | — | — |
| Content of Cooling Property Improver (% by mass) | A5-1 | — | — | 3 | 3 | — |
| | A5-2 | — | — | — | — | 6 |
| | A5-3 | — | — | — | — | — |
| Kinematic Viscosity at 40° C. [$mm^2/s$] | | 17.6 | 17.3 | 21.5 | 21.8 | 24.2 |
| Quenching Test 1 | Hardness (HRC) | 18 | 19 | 53 | 54 | 51 |
| Quenching Test 2 | Strain (μm) | 17 | 28 | 45 | 38 | 38 |

TABLE 35

| | | Comparative Example 5-6 | Comparative Example 5-7 | Comparative Example 5-8 | Comparative Example 5-9 | Comparative Example 5-10 |
|---|---|---|---|---|---|---|
| Content of Cooling Property Improver (% by mass) | Base Oil 7 | 55 | — | — | — | — |
| | Base Oil 8 | — | 100 | — | — | — |
| | Base Oil 9 | 45 | — | — | — | — |
| | Base Oil 16 | — | — | 50 | 40 | 40 |
| | Base Oil 17 | — | — | — | — | — |
| | Base Oil 12 | — | — | 50 | 60 | 100 |
| Content of Cooling Property Improver (% by mass) | A1 | — | — | — | 3 | — |
| | A2 | — | — | — | — | 6 |
| | A3 | — | — | 4 | — | — |
| Kinematic Viscosity at 40° C. [$mm^2/s$] | | 18.5 | 18.1 | 21.5 | 22.1 | 24.3 |
| Quenching Test 1 | Hardness (HRC) | 44 | 41 | 52 | 48 | 47 |
| Quenching Test 2 | Strain (μm) | 27 | 38 | 56 | 20 | 22 |

Examples 6-1 to 6-21 and Comparative Examples 6-1 to 6-8

In Examples 6-1 to 6-21, there were prepared lubricating oil compositions for machine tools having the compositions shown in Tables 36 to 38 using Base Oils 3, 6 and 9 shown in Tables 4 to 6 and the below-shown additives. In addition, in Comparative Examples 6-1 to 6-8, there were prepared lubricating oil compositions for machine tools having the compositions shown in Tables 39 and 40 using Base Oils 3, 6, 9, 12, 14 and 15 shown in Tables 4 to 8 and the below-shown additives.

(A compound containing phosphorus and/or sulfur as a constituent element(s))

A6-1: Oleyl Acid Phosphate

A6-2: Oleyl amine salt of an oleyl acid phosphate

A6-3: Tricresylphosphate

A6-4: Ester sulfide (Sulfur content percentage: 11.4% by mass)

A6-5: Lard sulfide (Sulfur content percentage: 11.0% by mass)

(Other Additives)

B6-1: Oleic acid

B6-2: 2,6-di-tert-buty-p-cresole

Next, for the lubricating oil compositions for machine tools of Examples 6-1 to 6-21 and Comparative Examples 6-1 to 6-8, the following evaluation tests were performed.

[Thermal and Oxidative Stability Test]

The sludge generation suppressability of each lubricating oil composition was evaluated according to JIS K 2540-1989 "A Testing Method for Thermal Stability of Lubricating Oil". That is, into a 50 ml beaker was placed 45 g of a lubricating oil composition and a copper catalyst and an iron catalyst were added to the beaker, followed by allowing to stand in air constant-temperature chamber at 140° C. for 72 hours to measure the sludge amount of the lubricating oil composition. The amount of sludge generated was determined by measuring the weight of the product collected by diluting the lubricating oil composition after testing with n-hexane and then filtering through a membrane filter of 0.8 μm. As the copper catalyst and the iron catalyst, there were used ones obtained by cutting the catalysts used in "Turbine Oil Oxidation Stability Test" (JIS K 2514) to 8 rolls (length: approximately 3.5 cm). The results obtained are shown in Tables 36 to 40.

[Friction Characteristics Evaluation Test]

Figure 3:
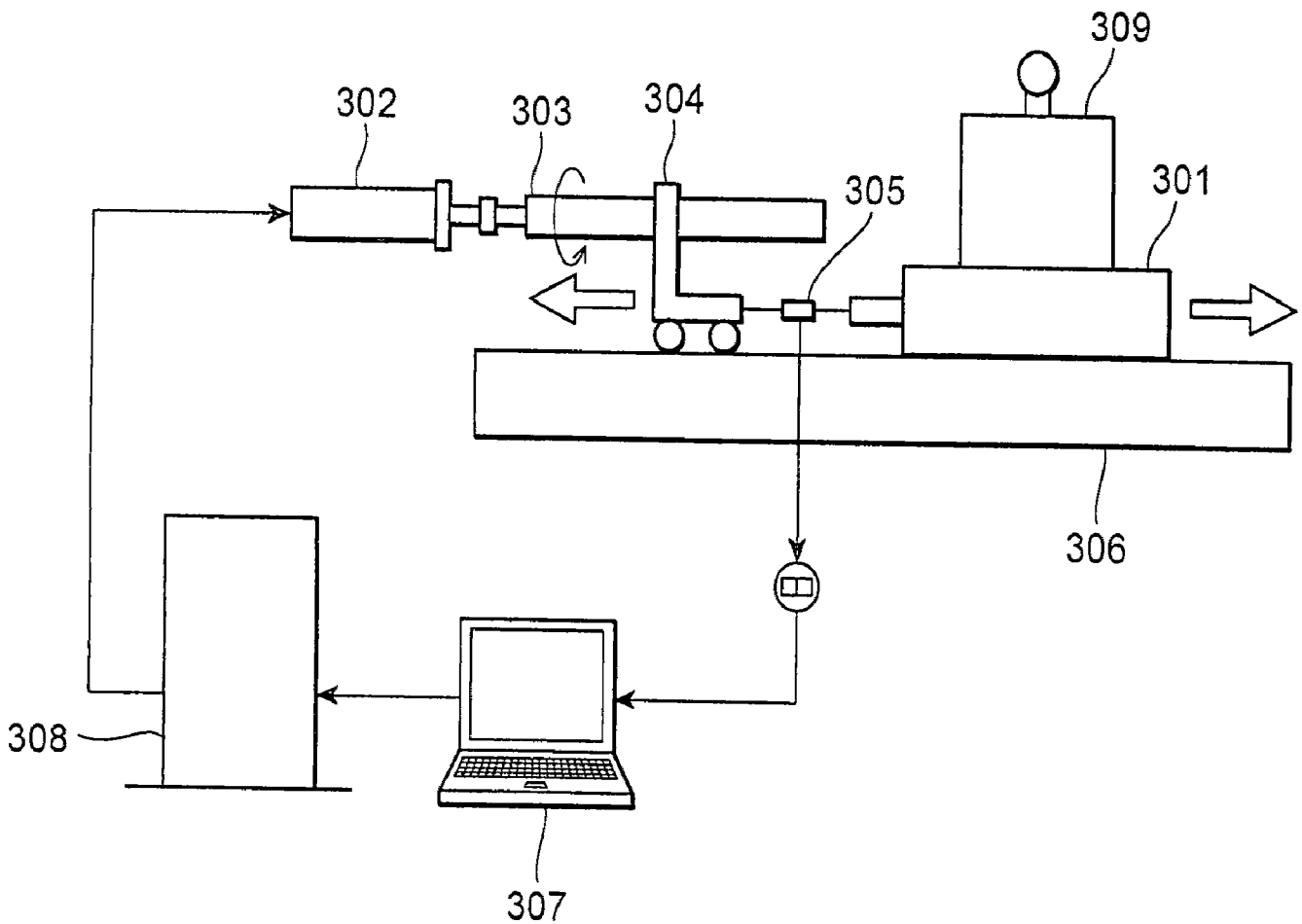
FIG. 3 is a schematic configuration diagram illustrating a friction coefficient measurement system used in Examples.

FIG. 3 is a schematic configuration diagram illustrating a friction coefficient measurement system used in the friction characteristics evaluation test. In FIG. 3, a table 301 and a movable jig 304 are installed through a load cell 305 on a bed 306, and further, a weight 309 is disposed on the table 301 as a substitute of a working tool. Both of the table 301 and the bed 306 are made of cast iron. In addition, the movable jig 304 has bearings and is connected through a feed screw 303 to an A/C servo motor 302. The movable jig 304 can be reciprocated in the axial direction of the feed screw 303 (the arrow direction in FIG. 3) by operating the feed screw 303 by the A/C servo meter 2. Further, the load cell 305 is electrically connected to a computer 307, and the computer 307 and the A/C servo meter 302 are electrically connected to a control panel 308, thereby enabling to control the reciprocating motion of the movable jig 304 and to measure the load between the table 301 and the movable jig 304.

In the friction coefficient measurement system, a lubricating oil composition was dropwise added on the upper surface of a bed 706 and the surface pressure between the table 301 and the bed 306 was adjusted to 200 kpa by selecting the table weight 309. Thereafter, the movable jig 304 was reciprocated at a feed rate of 1.2 mm/min and a feed length of 15 mm. At this time, the load between the table 301 and the movable jig 304 was measured by the load cell 305 (load meter) and the friction coefficient of the guide surface (the table 301/the bed 306=cast iron/cast iron) was determined based on the resulting measurement value. In addition, the above test was performed after preconditioning operation was carried out three times. The friction coefficient of each lubricating oil composition is shown in Table 36 to 40.

[Stick-Slip-Reducing Characteristics Evaluation Test]

Figure 4:
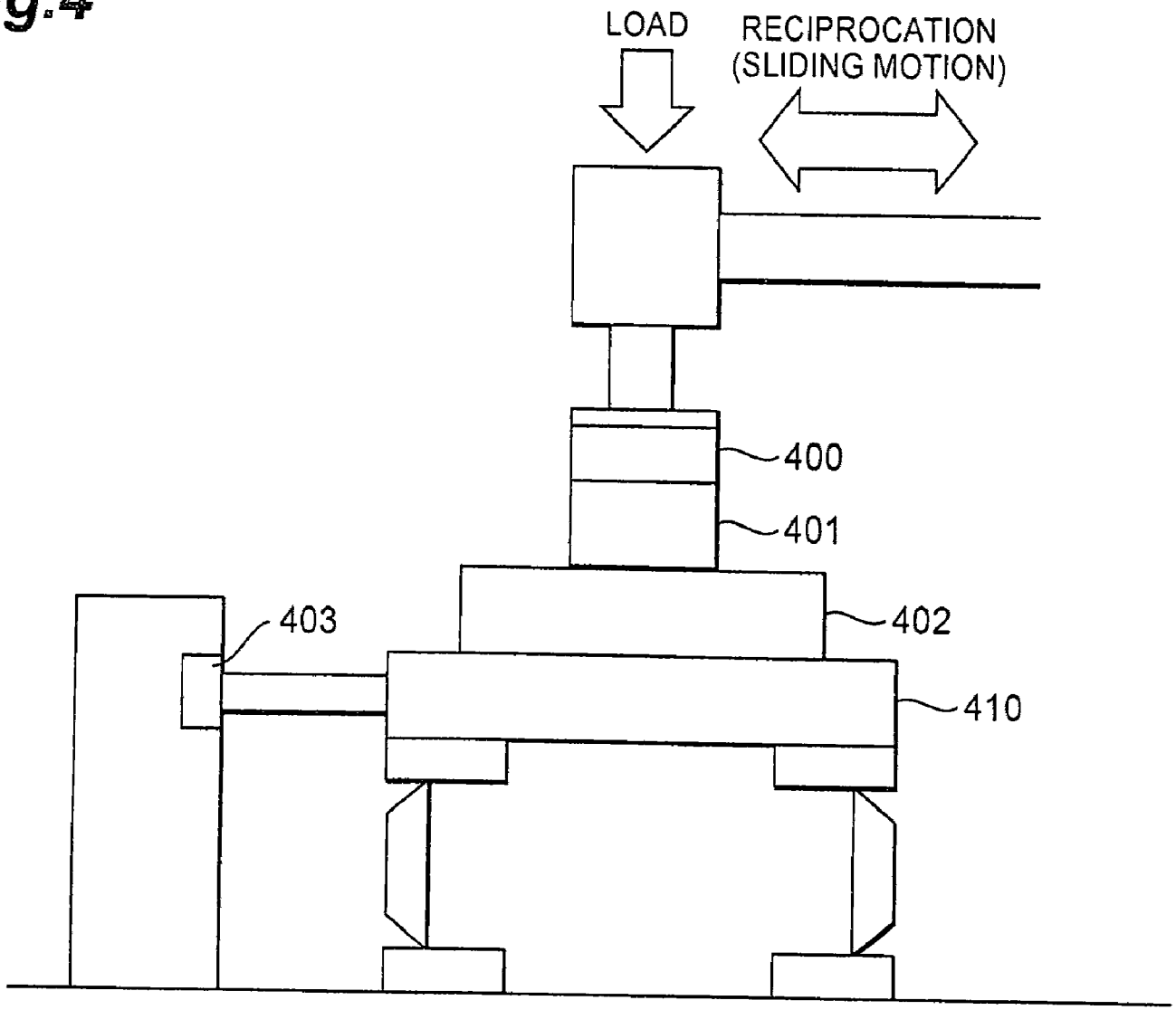
FIG. 4 is an outline configuration diagram schematically illustrating a stick-slip-reducing characteristics evaluation apparatus used in Examples.
Figure 5:
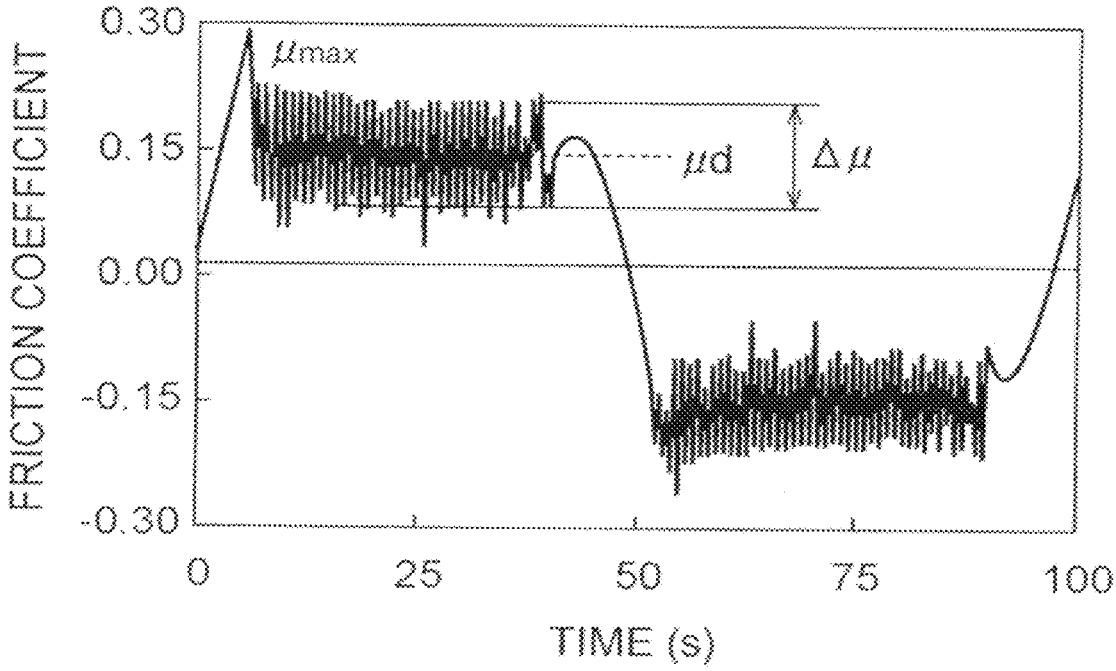
FIG. 5 is a graph showing an example of the correlation between the friction coefficient obtained by using the apparatus of FIG. 4 and time.

FIG. 4 is a schematic configuration diagram illustrating a stick-slip-reducing characteristics evaluation apparatus (TE-77 Tester, manufactured by Hint & Partners Ltd.). The apparatus shown in FIG. 4 is an apparatus in which a lower test piece 402, an upper test piece 401 and an elastic body 400 are laminated on a supporting stand 410 in this order, and the test pieces 401 and 402 are slid by reciprocating (sliding motion) the elastic body 400 along the surface of the supporting stand 410 while pressing the test pieces 401 and 412 each other under a predetermined load. Then, the friction coefficient between the test pieces 401 and 402 are determined by measuring the load applied to the test pieces 401 and 402 at the time of the sliding by a load detector 403. FIG. 5 is a graph showing an example of the correlation between the friction coefficient obtained by the above operations and time. The mark Δμ in FIG. 5 indicates the amplitude of the friction coefficient.

The Δμ was measured when each lubricating oil composition was allowed to exist between the test pieces 401 and 402, according to a method described in literature (Japanese Society of Tribologist, Tribology Conference, Plenary Lecture Tokyo 1999-5D17) except in that test pieces and conditions were improved for lubrication oil evaluations for a slide guide surface using such an apparatus. Specifically, the test was performed at an average sliding speed of 0.3 mm/s under a load of 250 N by using JIS G 4051 S45C as both of the test pieces 401 and 402 and a chloroprene rubber as the elastic body 400. The stick-slip-reducing characteristics was evaluated as follows. When the amplitude Δμ was less than 0.02, the presence of stick slip was evaluated as no, and when the amplitude Δμ was 0.02 or more, the presence of stick slip was evaluated as yes. The results obtained are shown in Tables 36 to 40.

TABLE 36

| | | Example 6-1 | Example 6-2 | Example 6-3 | Example 6-4 | Example 6-5 | Example 6-6 | Example 6-7 |
|---|---|---|---|---|---|---|---|---|
| Composition [% by mass] | Base Oil 3 | Residual Portion | Residual Portion | Residual Portion | Residual Portion | Residual Portion | Residual Portion | Residual Portion |
| | A6-1 | 0.5 | — | — | — | — | 0.5 | — |
| | A6-2 | — | 0.5 | — | — | — | — | 0.5 |
| | A6-3 | — | — | 0.5 | — | — | — | — |
| | A6-4 | — | — | — | 0.5 | — | — | 0.5 |
| | A6-5 | — | — | — | — | 0.5 | — | — |
| | B6-1 | — | — | — | — | — | 0.5 | 0.5 |
| | B6-2 | 0.5 | 0.5 | 0.5 | 0.5 | 0.5 | 0.5 | 0.5 |
| Thermal and Oxidative Stability (Sludge Amount [mg]) | | 3.2 | 4.1 | 2.5 | 8.4 | 7.5 | 4.5 | 6.9 |
| Friction Properties (Friction Coefficient) | | 0.109 | 0.107 | 0.112 | 0.111 | 0.113 | 0.092 | 0.088 |
| Presence of Stick Slip | | No | No | No | No | No | No | No |

TABLE 37

| | | Example 6-8 | Example 6-9 | Example 6-10 | Example 6-11 | Example 6-12 | Example 6-13 | Example 6-14 |
|---|---|---|---|---|---|---|---|---|
| Composition [% by mass] | Base Oil 6 | Residual Portion | Residual Portion | Residual Portion | Residual Portion | Residual Portion | Residual Portion | Residual Portion |
| | A6-1 | 0.5 | — | — | — | — | 0.5 | — |
| | A6-2 | — | 0.5 | — | — | — | — | 0.5 |
| | A6-3 | — | — | 0.5 | — | — | — | — |
| | A6-4 | — | — | — | 0.5 | — | — | 0.5 |
| | A6-5 | — | — | — | — | 0.5 | — | — |
| | B6-1 | — | — | — | — | — | 0.5 | 0.5 |
| | B6-2 | 0.5 | 0.5 | 0.5 | 0.5 | 0.5 | 0.5 | 0.5 |
| Thermal and Oxidative Stability (Sludge Amount [mg]) | | 4.5 | 3.2 | 2.9 | 6.8 | 7.2 | 5.4 | 7.4 |
| Friction Properties (Friction Coefficient) | | 0.108 | 0.106 | 0.113 | 0.112 | 0.111 | 0.095 | 0.089 |
| Presence of Stick Slip | | No | No | No | No | No | No | No |

TABLE 38

| | | Example 6-15 | Example 6-16 | Example 6-17 | Example 6-18 | Example 6-19 | Example 6-20 | Example 6-21 |
|---|---|---|---|---|---|---|---|---|
| Composition [% by mass] | Base Oil 9 | Residual Portion | Residual Portion | Residual Portion | Residual Portion | Residual Portion | Residual Portion | Residual Portion |
| | A6-1 | 0.5 | — | — | — | — | 0.5 | — |
| | A6-2 | — | 0.5 | — | — | — | — | 0.5 |
| | A6-3 | — | — | 0.5 | — | — | — | — |
| | A6-4 | — | — | — | 0.5 | — | — | 0.5 |
| | A6-5 | — | — | — | — | 0.5 | — | — |
| | B6-1 | — | — | — | — | — | 0.5 | 0.5 |
| | B6-2 | 0.5 | 0.5 | 0.5 | 0.5 | 0.5 | 0.5 | 0.5 |
| Thermal and Oxidative Stability (Sludge Amount [mg]) | | 3.9 | 4.6 | 3.2 | 9.1 | 7.9 | 5.4 | .5 |
| Friction Properties (Friction Coefficient) | | 0.111 | 0.109 | 0.114 | 0.112 | 0.113 | 0.095 | 0.090 |
| Presence of Stick Slip | | No | No | No | No | No | No | No |

TABLE 39

| | | Comparative Example 6-1 | Comparative Example 6-2 | Comparative Example 6-3 | Comparative Example 6-4 | Comparative Example 6-5 | Comparative Example 6-6 | Comparative Example 6-7 |
|---|---|---|---|---|---|---|---|---|
| Composition [% by mass | Base Oil 3 | Residual Portion | — | — | — | — | — | — |
| | Base Oil 6 | — | Residual Portion | — | — | — | — | — |
| | Base Oil 12 | — | — | Residual Portion | — | — | — | Residual Portion |
| | Base Oil 14 | — | — | — | Residual Portion | — | — | — |
| | Base Oil 15 | — | — | — | — | Residual Portion | Residual Portion | — |
| | A6-1 | — | — | 0.5 | — | — | — | — |
| | A6-2 | — | — | — | 0.5 | — | — | — |
| | A6-3 | — | — | — | — | 0.5 | — | — |
| | A6-4 | — | — | — | — | — | 0.5 | — |
| | A6-5 | — | — | — | — | — | — | 0.5 |
| | B6-1 | — | — | — | — | — | — | — |
| | B6-2 | 0.5 | 0.5 | 0.5 | 0.5 | 0.5 | 0.5 | 0.5 |
| Thermal and Oxidative Stability (Sludge Amount [mg]) | | 2.1 | 1.9 | 4.5 | 5.6 | 3.9 | 9.7 | 11.2 |

TABLE 39-continued

| | Comparative Example 6-1 | Comparative Example 6-2 | Comparative Example 6-3 | Comparative Example 6-4 | Comparative Example 6-5 | Comparative Example 6-6 | Comparative Example 6-7 |
|---|---|---|---|---|---|---|---|
| Friction Properties (Friction Coefficient) | 0.138 | 0.129 | 0.119 | 0.118 | 0.123 | 0.121 | 0.119 |
| Presence of Stick Slip | Yes | Yes | No | No | Yes | Yes | Yes |

TABLE 40

| | | Comparative Example 6-8 |
|---|---|---|
| Composition [% by mass] | Base Oil 9 | Residual Portion |
| | A6-1 | — |
| | A6-2 | — |
| | A6-3 | — |
| | A6-4 | — |
| | A6-5 | — |
| | B6-1 | — |
| | B6-2 | 0.5 |
| Thermal and Oxidative Stability (Sludge Amount [mg]) | | 2.7 |
| Friction Properties (Friction Coefficient) | | 0.141 |
| Presence of Stick Slip | | Yes |

Example 7-1 to 7-18 and Comparative Examples 7-1 to 7-4

Lubrication Oil Composition (Preparation of Lubricating Oil Base Oil)

There was prepared Base Oil 25 (the base oil 2/the base oil 3=10/90 (by mass ratio), kinematic viscosity at 40° C.: 32 $mm^2/s$) by blending Base Oil 2 and Base Oil 3 shown in Table 4.

In addition, there was prepared Base Oil 26 (the base oil 5/the base oil 6=12/88 (by mass ratio), kinematic viscosity at 40° C.: 32.1 $mm^2/s$) by blending Base Oil 5 and Base Oil 6 shown in Table 5.

Further, there was prepared a base oil 27 (the base oil 11/the base oil 12=20/80 (by mass ratio), kinematic viscosity at 40° C.: 32 $mm^2/s$) by blending Base Oil 11 and Base Oil 12 shown in Table 7.

Furthermore, there was prepared Base Oil 28 (poly-α-olefin, kinematic viscosity at 40° C.: 32.0 $mm^2/s$) as a lubricating oil base oil for comparison.

(Preparation of Lubricating Oil Composition)

In Example 7-1 to 7-10, there were prepared lubricating oil compositions having the compositions shown in Tables 41 and 42 by using the above-mentioned Base Oil 25 or Base Oil 26 and the below-shown additives. In addition, in Examples 7-11 to 7-18, there were prepared lubricating oil compositions having the compositions shown in Tables 43 and 44 by using Base Oil 9 shown in Table 6 and the below-shown additives. Further, in Comparative Examples 7-1 to 7-4, there were prepared lubricating oil compositions having the compositions shown in Table 45 by using the above-mentioned Base Oil 27 or Base Oil 28 and the below-shown additives.

(Antioxidants)

A7-1: (3,5-di-tert-butyl-4-hydroxyphenyl)propionic acid ester

A7-2: Dodecylphenyl-α-naphthylamine

A7-3: N-octylphenyl-N-butylphenylamine (Alkyl Group-Substituted Aromatic Hydrocarbon Compound)

B7-1: Alkylnaphthalene having one or two alkyl groups having 16 or 18 carbon atoms

[Characteristics Evaluation Test (1)]

For the lubricating oil compositions of Examples 7-1 to 7-18 and Comparative Examples 7-1 to 7-4, characteristics evaluation tests was carried out simultaneously using the turbine oil oxidation stability test (TOST) and the rotary bomb oxidation stability test (RBOT) specified in JIS K 2514. Specifically, in the TOST test, the sludge generation amount and the RBOT value were measured when each lubricating oil composition was oxidized and deteriorated at 120° C. for a predetermined time. And then, the thermal and oxidative stability and the sludge suppressability of the lubricating oil composition were evaluated based on the time when the RBOT value of a deteriorated oil was reached to 25% of the RBOT value before test (25% arrival time of the remnant life) and the sludge generation amount at that time. In Tables 41 to 45, there are shown the RBOT value of each lubricating oil composition before test, 25% arrival time of the remnant life and the sludge generation amount at the time of 25% arrival time of the remnant life (generation amount per 100 ml of a sample oil).

[Characteristics Evaluation Test (2)]

Figure 6:
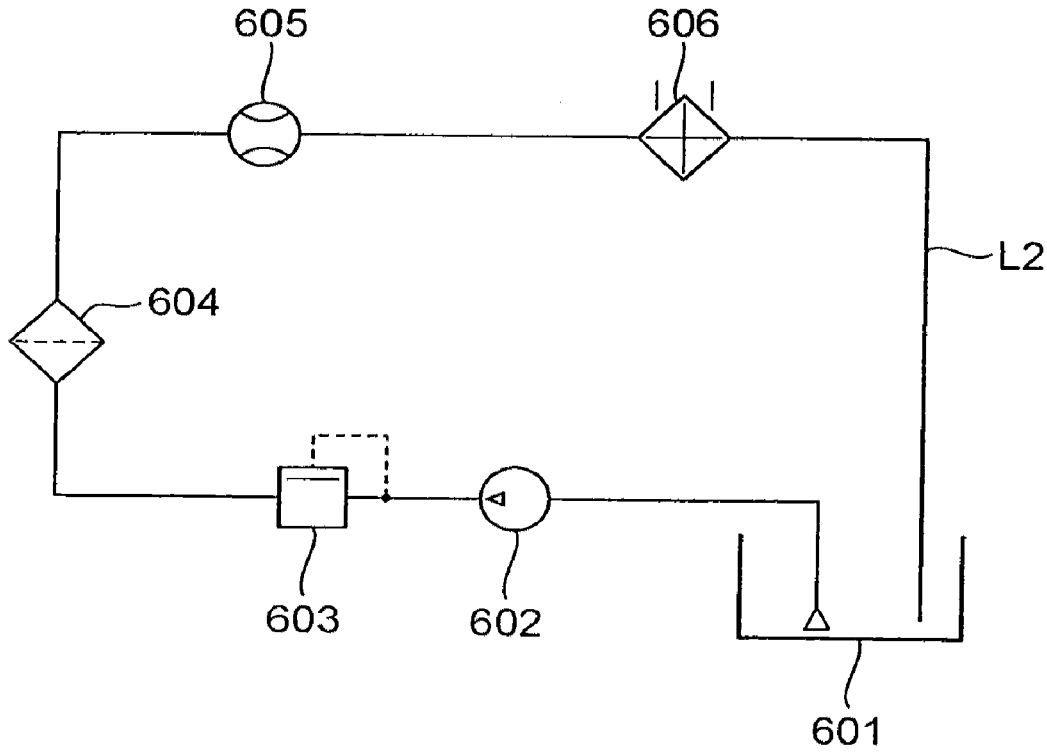
FIG. 6 is an explanation diagram showing a high-temperature pump circulation test apparatus used in Examples.

For the lubricating oil compositions of Examples 7-1 to 7-18 and Comparative Examples 7-1 to 7-4, the sludge suppressability was evaluated in the following manner. FIG. 6 is a diagram showing a schematic configuration of a high-temperature pump circulation apparatus used in the present test. In FIG. 6, the pump circulation apparatus is designed such that a circulation flow channel L2 is provided with an oil tank 601, a piston pump 602, a pressure reducing valve 603, a line filter 604, a flow meter 605 and a cooler 606, in this order, and the lubricating oil composition is drawn out into the circulation flow channel L2 by the piston pump 602 and is again returned through the circulation flow channel L2 to the oil tank 601.

In the present test, by using the high-temperature pump circulation apparatus shown in FIG. 6, increase in differential pressure before and after the line filter 604 (3 μm) was monitored by circulating each lubricating oil composition using the piston pump 602 at 7 MPa and at 120° C. The differential pressure when sludge is absent is approximately 35 kPa, but if sludge is collected, the differential pressure gradually increases. In this manner, the operating time until the differential pressure is 100 kPa was measured to use as a measure of sludge generation suppressability. The results obtained are shown in Tables 41 to 45. In addition, it is indicated that the larger the value of the operating time is, the more excellent the sludge generation suppressability is. Further, in Tables 41 to 45, the expression ">1000" means that even if the operating time exceeds 1000 hours, the differential pressure does not reach 100 kPa.

TABLES 41

| | | Example 7-1 | Example 7-2 | Example 7-3 | Example 7-4 | Example 7-5 |
|---|---|---|---|---|---|---|
| Composition [% by mass] | Base Oil 25 | Residual Portion | Residual Portion | Residual Portion | Residual Portion | Residual Portion |
| | A7-1 | 0.50 | 1.00 | — | — | — |
| | A7-2 | — | — | 0.50 | 1.00 | 0.50 |
| | A7-3 | — | — | 0.15 | 0.30 | 0.80 |
| | B7-1 | — | — | — | — | — |
| Test (1) | RBOT Value before Test [min] | 250 | 400 | 1800 | 2100 | 1900 |
| | 25% Arrival Time of Remnant Life [h] | 380 | 600 | 1500 | 2000 | 1500 |
| | Sludge Generation Amount at 25% Arrival Time of Remnant Life [mg/100 ml] | 2 | 2 | 3 | 4 | 7 |
| Test (2) | Operating Time [h] | 400 | 600 | 900 | >1000 | 900 |

TABLES 42

| | | Example 7-6 | Example 7-7 | Example 7-8 | Example 7-9 | Example 7-10 |
|---|---|---|---|---|---|---|
| Composition [% by mass] | Base Oil 25 | Residual Portion | Residual Portion | Residual Portion | — | — |
| | Base Oil 26 | — | — | — | Residual Portion | Residual Portion |
| | A7-1 | — | — | — | — | — |
| | A7-2 | 1.30 | — | 1.00 | 0.50 | 1.00 |
| | A7-3 | — | 1.30 | 0.30 | 0.80 | 0.30 |
| | B7-1 | — | — | 10.00 | — | 10.00 |
| Test (1) | RBOT Value before Test [min] | 2000 | 1500 | 2100 | 2000 | 2400 |
| | 25% Arrival Time of Remnant Life [h] | 1800 | 1700 | 2000 | 1400 | 2200 |
| | Sludge Generation Amount at 25% Arrival Time of Remnant Life [mg/100 ml] | 3 | 5 | 2 | 6 | 1 |
| Test (2) | Operating Time [h] | 900 | 800 | >1000 | >1000 | >1000 |

TABLES 43

| | | Example 7-11 | Example 7-12 | Example 7-13 | Example 7-14 | Example 7-15 |
|---|---|---|---|---|---|---|
| Composition [% by mass] | Base Oil 9 | Residual Portion | Residual Portion | Residual Portion | Residual Portion | Residual Portion |
| | A7-1 | 0.50 | 1.00 | — | — | — |
| | A7-2 | — | — | 0.50 | 1.00 | 0.50 |
| | A7-3 | — | — | 0.15 | 0.30 | 0.80 |
| | B7-1 | — | — | — | — | — |
| Test (1) | RBOT Value before Test [min] | 235 | 390 | 1750 | 2010 | 1880 |
| | 25% Arrival Time of Remnant Life [h] | 370 | 585 | 1460 | 1970 | 1470 |
| | Sludge Generation | 2 | 2 | 3 | 4 | 7 |

TABLES 43-continued

| | | Example 7-11 | Example 7-12 | Example 7-13 | Example 7-14 | Example 7-15 |
|---|---|---|---|---|---|---|
| | Amount at 25% Arrival Time of Remnant Life [mg/100 ml] | | | | | |
| Test (2) | Operating Time [h] | 400 | 600 | 900 | >1000 | 900 |

TABLES 44

| | | Example 7-16 | Example 7-17 | Example 7-18 |
|---|---|---|---|---|
| Composition [% by mass] | Base Oil 9 | Residual Portion | Residual Portion | Residual Portion |
| | A7-1 | — | — | — |
| | A7-2 | 1.30 | — | 1.00 |
| | A7-3 | — | 1.30 | 0.30 |
| | B7-1 | — | — | 10.00 |
| Test (1) | RBOT Value before Test [min] | 1950 | 1430 | 1990 |
| | 25% Arrival Time of Remnant Life [h] | 1760 | 1620 | 1920 |
| | Sludge Generation Amount at 25% Arrival Time of Remnant Life [mg/100 ml] | 3 | 5 | 2 |
| Test (2) | Operating Time [h] | 900 | 800 | >1000 |

TABLES 45

| | | Comparative Example 7-1 | Comparative Example 7-2 | Comparative Example 7-3 | Comparative Example 7-4 |
|---|---|---|---|---|---|
| Composition [% by mass] | Base Oil 27 | Residual Portion | Residual Portion | Residual Portion | — |
| | Base Oil 28 | — | — | — | Residual Portion |
| | A7-1 | 0.50 | 1.00 | — | — |
| | A7-2 | — | — | 1.00 | 1.00 |
| | A7-3 | — | — | 0.30 | 0.30 |
| | B7-1 | — | — | — | — |
| Test (1) | RBOT Value before Test [min] | 180 | 250 | 1700 | 2000 |
| | 25% Arrival Time of Remnant Life [h] | 200 | 300 | 1500 | 1800 |
| | Sludge Generation Amount at 25% Arrival Time of Remnant Life [mg/100 ml] | 2 | 2 | 6 | 7 |
| Test (2) | Operating Time [h] | 300 | 430 | 800 | 850 |

The invention claimed is:

1. A hydraulic oil composition comprising:

a lubricating base oil having % $C_A$ of not more than 2, % $C_P$/% $C_N$ of not less than 6, % $C_N$ of 7 to 13, a sulfur content of not more than 100 ppm by mass, and an iodine value of not more than 2.5, wherein the content of the saturated components in the lubricating base oil is not less than 95% by mass based on the total amount of the lubricating base oil and wherein the ratio $M_A/M_B$ of the mass of monocyclic saturated components $M_A$ to the mass of bi- or more cyclic saturated components $M_B$ in the saturated cyclic components is not more than 3; and at least one compound containing phosphorus and/or sulfur as a constituent element(s) selected from phosphoric acid esters, acidic phosphoric acid esters, amine salts of acidic phosphoric acid esters, chlorinated phosphoric acid esters and phosphorus-containing carboxylic acid compounds, sulfurized oils and fats, sulfurized fatty acids, sulfurized esters, dihydrocarbyl (poly)sulfides, thiadiazole compounds, thioterpene compounds, dialkyl-thiodipropionate compounds and sulfurized mineral oils.

* * * * *